US011448384B2

(12) United States Patent
Nikooyan et al.

(10) Patent No.: US 11,448,384 B2
(45) Date of Patent: Sep. 20, 2022

(54) METHODS AND APPARATUS FOR ADJUSTING A LUMINAIRE

(71) Applicant: DMF, Inc., Carson, CA (US)

(72) Inventors: Ali A. Nikooyan, Santa Ana, CA (US); Amir Lotfi, Redondo Beach, CA (US); Michael D. Danesh, Carson, CA (US); William Wai-Loong Young, La Habra Heights, CA (US)

(73) Assignee: DMF, Inc., Carson, CA (US)

( * ) Notice: Subject to any disclaimer, the term of this patent is extended or adjusted under 35 U.S.C. 154(b) by 0 days.

(21) Appl. No.: 16/883,144

(22) Filed: May 26, 2020

(65) Prior Publication Data

US 2021/0010663 A1 Jan. 14, 2021

Related U.S. Application Data

(63) Continuation of application No. 16/690,970, filed on Nov. 21, 2019, now Pat. No. 10,663,153, which is a (Continued)

(51) Int. Cl.
*F21V 21/30* (2006.01)
*F21V 29/76* (2015.01)

(Continued)

(52) U.S. Cl.
CPC ..... *F21V 21/30* (2013.01); *F21S 8/026* (2013.01); *F21V 1/10* (2013.01); *F21V 14/02* (2013.01);

(Continued)

(58) Field of Classification Search
CPC .... F21S 8/02–026; F21V 21/02; F21V 21/04; F21V 21/14; F21V 21/15–20;

(Continued)

(56) References Cited

U.S. PATENT DOCUMENTS 1,133,535 A 3/1915 Cain et al.
1,471,340 A 10/1923 Knight (Continued)

FOREIGN PATENT DOCUMENTS

CA 2243934 C 6/2002
CA 2502637 A1 9/2005

(Continued)

OTHER PUBLICATIONS

Notice of Allowance dated Apr. 9, 2020 from U.S. Appl. No. 16/653,497, 7 pages.

(Continued)

*Primary Examiner* — Rajarshi Chakraborty
*Assistant Examiner* — Steven Y Horikoshi
(74) *Attorney, Agent, or Firm* — Smith Baluch LLP

(57) ABSTRACT

An adjustable lighting apparatus includes a lighting module that is rotatably adjustable about a first rotation axis relative to an adjustable mount. The lighting module may include a heat sink, a driver, and a light source. The adjustable mount may include a base structure, a retainer, a shield, and a secondary shield. A trim may also be coupled to the adjustable mount. In some implementations, the lighting module translates along a first translation axis defined by the adjustable mount while rotating about the first rotation axis in order to reorient the light source while reducing shading losses caused by the adjustable mount. Openings in the base structure and the shield may be substantially covered at all rotational positions of the lighting module using a combination of the shield, the trim, the heat sink, and the secondary shield, thus eliminating the need for an additional enclosure.

21 Claims, 138 Drawing Sheets

Related U.S. Application Data continuation of application No. PCT/US2018/067614, filed on Dec. 27, 2018.

(60) Provisional application No. 62/728,451, filed on Sep. 7, 2018, provisional application No. 62/610,864, filed on Dec. 27, 2017.

(51) Int. Cl.

| | |
|---|---|
| ***F21V 29/89*** | (2015.01) |
| ***F21S 8/02*** | (2006.01) |
| ***F21V 1/10*** | (2006.01) |
| ***F21V 14/02*** | (2006.01) |
| ***F21V 21/04*** | (2006.01) |

(52) U.S. Cl.
CPC ..... *F21V 21/04* (2013.01); *F21V 29/76* (2015.01); *F21V 29/89* (2015.01)

(58) Field of Classification Search
CPC ..... F21V 21/26–29; F21V 21/30; F21V 17/02–08; F21V 17/14; F21V 1/10; F21V 1/12; F21V 14/02; F21V 14/04
See application file for complete search history.

(56) References Cited

U.S. PATENT DOCUMENTS 1,856,356 A 5/1932 Owen
2,038,784 A 4/1936 Ghadiali
2,197,737 A 4/1940 Appleton
2,352,913 A 7/1944 Morrill
2,528,989 A 11/1950 Ammells
2,597,595 A 5/1952 Ordas
2,642,246 A 6/1953 Larry
2,670,919 A 3/1954 Vincent
2,758,810 A 8/1956 Good
D180,844 S 8/1957 Poliakoff
3,023,920 A 3/1962 Cook et al.
3,057,993 A 10/1962 Gellert
3,104,087 A 9/1963 Joseph et al.
3,214,126 A 10/1965 Roos
3,422,261 A 1/1969 McGinty
3,460,299 A 8/1969 Wilson
3,650,046 A 3/1972 Skinner
3,675,807 A 7/1972 Lund et al.
3,700,885 A 10/1972 Bobrick
3,711,053 A 1/1973 Drake
D227,989 S 7/1973 Geisel
3,773,968 A 11/1973 Copp
3,812,342 A 5/1974 Mcnamara
3,836,766 A 9/1974 Auerbach
3,913,773 A 10/1975 Copp et al.
D245,905 S 9/1977 Taylor
4,088,827 A 5/1978 Kohaut
4,154,218 A 5/1979 Hulet
4,154,219 A 5/1979 Gupta et al.
4,176,758 A 12/1979 Glick
4,280,169 A 7/1981 Allen
4,399,497 A 8/1983 Druffel
4,450,512 A 5/1984 Kristofek
4,460,948 A 7/1984 Malola
4,520,435 A 5/1985 Baldwin
4,539,629 A 9/1985 Poppenheimer
4,601,145 A 7/1986 Wilcox
4,667,840 A 5/1987 Lindsey
4,723,747 A 2/1988 Karp et al.
4,729,080 A 3/1988 Fremont et al.
4,733,339 A 3/1988 Kelsall
4,754,377 A 6/1988 Wenman
4,880,128 A 11/1989 Jorgensen
4,910,651 A 3/1990 Montanez
4,919,292 A 4/1990 Hsu
4,929,187 A 5/1990 Hudson et al.
4,930,054 A 5/1990 Krebs
5,044,582 A 9/1991 Walters
D326,537 S 5/1992 Gattari
5,216,203 A 6/1993 Gower
5,239,132 A 8/1993 Bartow
5,250,269 A 10/1993 Langer et al.
5,266,050 A 11/1993 O'Neil et al.
5,291,381 A * 3/1994 Price ..... F21V 21/34 362/427
5,303,894 A 4/1994 Deschamps et al.
5,382,752 A 1/1995 Reyhan et al.
5,420,376 A 5/1995 Rajecki et al.
5,444,606 A 8/1995 Barnes et al.
5,465,199 A 11/1995 Bray et al.
D365,165 S 12/1995 Stultz
5,505,419 A 4/1996 Gabrius
5,544,870 A 8/1996 Kelly et al.
5,562,343 A 10/1996 Chan et al.
5,571,993 A 11/1996 Jones et al.
5,580,158 A 12/1996 Aubrey et al.
5,588,737 A 12/1996 Kusmer
5,603,424 A 2/1997 Bordwell et al.
5,609,408 A 3/1997 Targetti
5,613,338 A 3/1997 Esposito
D381,111 S 7/1997 Lecluze
5,662,413 A 9/1997 Akiyama et al.
D386,277 S 11/1997 Lecluze
5,690,423 A 11/1997 Hentz et al.
D387,466 S 12/1997 Lecluze
5,738,436 A 4/1998 Cummings et al.
5,778,625 A 7/1998 Druffel et al.
5,836,678 A 11/1998 Wright et al.
5,942,726 A 8/1999 Reiker
5,944,412 A 8/1999 Janos et al.
5,957,573 A 9/1999 Wedekind et al.
5,975,323 A 11/1999 Turan
6,030,102 A 2/2000 Gromotka
6,082,878 A 7/2000 Doubek et al.
6,095,669 A 8/2000 Cho
6,098,945 A 8/2000 Korcz
6,105,334 A 8/2000 Monson et al.
6,161,910 A 12/2000 Reisenauer et al.
6,170,685 B1 1/2001 Currier
6,174,076 B1 1/2001 Petrakis et al.
6,176,599 B1 1/2001 Farzen
6,267,491 B1 7/2001 Parrigin
6,332,597 B1 12/2001 Korcz et al.
6,350,043 B1 2/2002 Gloisten
6,350,046 B1 2/2002 Lau
6,364,511 B1 4/2002 Cohen
6,375,338 B1 4/2002 Cummings et al.
6,402,112 B1 6/2002 Thomas et al.
D461,455 S 8/2002 Forbes
6,461,016 B1 10/2002 Jamison et al.
6,474,846 B1 11/2002 Kelmelis et al.
6,491,413 B1 12/2002 Benesohn
D468,697 S 1/2003 Straub, Jr.
D470,970 S 2/2003 Huang
6,515,313 B1 2/2003 Ibbetson et al.
6,521,833 B1 2/2003 DeFreitas
D471,657 S 3/2003 Huang
6,583,573 B2 6/2003 Bierman
6,585,389 B2 7/2003 Bonazzi
6,600,175 B1 7/2003 Baretz et al.
D478,872 S 8/2003 Heggem
6,632,006 B1 10/2003 Rippel et al.
6,657,236 B1 12/2003 Thibeault et al.
6,666,419 B1 12/2003 Vrame
D488,583 S 4/2004 Benghozi
6,719,438 B2 4/2004 Sevack et al.
6,758,578 B1 7/2004 Chou
6,777,615 B1 8/2004 Gretz
6,779,908 B1 8/2004 Ng
6,827,229 B2 12/2004 Dinh et al.
6,827,471 B1 12/2004 Benghozi
6,838,618 B2 1/2005 Newbold et al.
6,906,352 B2 6/2005 Edmond et al.
D509,314 S 9/2005 Rashidi
6,948,829 B2 9/2005 Verdes et al.
6,958,497 B2 10/2005 Emerson et al.

(56) References Cited

U.S. PATENT DOCUMENTS

| | | | |
|---|---|---|---|
| 6,964,501 | B2 | 11/2005 | Ryan |
| 6,967,284 | B1 | 11/2005 | Gretz |
| D516,235 | S | 2/2006 | Rashidi |
| 7,025,476 | B2 | 4/2006 | Leadford |
| 7,025,477 | B2 | 4/2006 | Blessing |
| 7,064,269 | B2 | 6/2006 | Smith |
| D528,673 | S | 9/2006 | Maxik et al. |
| 7,102,172 | B2 | 9/2006 | Lynch |
| D531,740 | S | 11/2006 | Maxik |
| D532,532 | S | 11/2006 | Maxik |
| 7,148,420 | B1 | 12/2006 | Johnson et al. |
| 7,148,632 | B2 | 12/2006 | Berman et al. |
| 7,152,985 | B2 | 12/2006 | Benitez et al. |
| 7,154,040 | B1 | 12/2006 | Tompkins |
| 7,170,015 | B1 | 1/2007 | Roesch et al. |
| D536,349 | S | 2/2007 | Humber et al. |
| D537,039 | S | 2/2007 | Pincek |
| 7,181,378 | B2 | 2/2007 | Benitez et al. |
| D539,229 | S | 3/2007 | Murphey |
| 7,186,008 | B2 | 3/2007 | Patti |
| 7,190,126 | B1 | 3/2007 | Paton |
| 7,211,833 | B2 | 5/2007 | Slater, Jr. et al. |
| 7,213,940 | B1 | 5/2007 | Van De Ven et al. |
| 7,234,674 | B2 | 6/2007 | Rippel et al. |
| D547,889 | S | 7/2007 | Huang |
| D552,969 | S | 10/2007 | Bobrowski et al. |
| D553,267 | S | 10/2007 | Yuen |
| D555,106 | S | 11/2007 | Pape et al. |
| D556,144 | S | 11/2007 | Dinh |
| 7,297,870 | B1 | 11/2007 | Sartini |
| 7,312,474 | B2 | 12/2007 | Emerson et al. |
| 7,320,536 | B2 | 1/2008 | Petrakis et al. |
| D561,372 | S | 2/2008 | Yan |
| D561,373 | S | 2/2008 | Yan |
| 7,335,920 | B2 | 2/2008 | Denbaars et al. |
| D563,896 | S | 3/2008 | Greenslate |
| 7,347,580 | B2 | 3/2008 | Blackman et al. |
| D570,012 | S | 5/2008 | Huang |
| 7,374,308 | B2 | 5/2008 | Sevack et al. |
| D570,504 | S | 6/2008 | Maxik et al. |
| D570,505 | S | 6/2008 | Maxik et al. |
| 7,399,104 | B2 | 7/2008 | Rappaport |
| 7,413,156 | B1 | 8/2008 | Cho |
| 7,429,025 | B1 | 9/2008 | Gretz |
| D578,677 | S | 10/2008 | Huang |
| 7,431,482 | B1 | 10/2008 | Morgan et al. |
| 7,432,440 | B2 | 10/2008 | Hull et al. |
| 7,442,883 | B2 | 10/2008 | Jolly et al. |
| 7,446,345 | B2 | 11/2008 | Emerson et al. |
| 7,470,048 | B2 | 12/2008 | Wu |
| 7,473,005 | B2 | 1/2009 | O'Brien |
| 7,488,097 | B2 | 2/2009 | Reisenauer et al. |
| 7,494,258 | B2 | 2/2009 | McNaught |
| 7,503,145 | B2 | 3/2009 | Newbold et al. |
| 7,524,089 | B2 | 4/2009 | Park |
| D591,894 | S | 5/2009 | Flank |
| 7,534,989 | B2 | 5/2009 | Suehara et al. |
| D596,154 | S | 7/2009 | Rivkin |
| 7,566,154 | B2 | 7/2009 | Gloisten et al. |
| D599,040 | S | 8/2009 | Alexander et al. |
| D600,836 | S | 9/2009 | Hanley et al. |
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |
| 7,670,021 | B2 | 3/2010 | Chou |
| 7,673,841 | B2 | 3/2010 | Wronski |
| 7,677,766 | B2 | 3/2010 | Boyer |
| D613,444 | S | 4/2010 | Rashidi |
| 7,692,182 | B2 | 4/2010 | Bergmann et al. |
| 7,704,763 | B2 | 4/2010 | Fujii et al. |
| D616,118 | S | 5/2010 | Thomas et al. |
| 7,712,922 | B2 | 5/2010 | Hacker et al. |
| 7,722,208 | B1 | 5/2010 | Dupre et al. |
| 7,722,227 | B2 | 5/2010 | Zhang et al. |
| 7,735,795 | B2 | 6/2010 | Wronski |
| 7,735,798 | B2 | 6/2010 | Kojima |
| 7,748,887 | B2 | 7/2010 | Zampini, II et al. |
| 7,766,518 | B2 | 8/2010 | Piepgras et al. |
| 7,769,192 | B2 | 8/2010 | Takagi et al. |
| 7,771,082 | B2 | 8/2010 | Peng |
| 7,771,094 | B2 | 8/2010 | Goode |
| 7,784,754 | B2 | 8/2010 | Nevers et al. |
| D624,691 | S | 9/2010 | Zhang et al. |
| D624,692 | S | 9/2010 | Mackin et al. |
| D625,847 | S | 10/2010 | Maglica |
| D625,876 | S | 10/2010 | Chen et al. |
| D627,507 | S | 11/2010 | Lai et al. |
| D627,727 | S | 11/2010 | Alexander et al. |
| 7,828,465 | B2 | 11/2010 | Roberge et al. |
| D629,366 | S | 12/2010 | Ericson et al. |
| 7,845,393 | B2 | 12/2010 | Kao et al. |
| 7,857,275 | B2 | 12/2010 | de la Borbolla |
| 7,871,184 | B2 | 1/2011 | Peng |
| 7,874,539 | B2 | 1/2011 | Wright et al. |
| 7,874,703 | B2 | 1/2011 | Shastry et al. |
| 7,874,709 | B1 | 1/2011 | Beadle |
| D633,224 | S | 2/2011 | Lee |
| 7,909,487 | B1 | 3/2011 | Venetucci et al. |
| D636,117 | S | 4/2011 | Kim et al. |
| D636,118 | S | 4/2011 | Kim et al. |
| D636,903 | S | 4/2011 | Torenbeek |
| D637,339 | S | 5/2011 | Hasan et al. |
| D637,340 | S | 5/2011 | Hasan et al. |
| 7,950,832 | B2 | 5/2011 | Tanaka et al. |
| D639,499 | S | 6/2011 | Choi et al. |
| D640,819 | S | 6/2011 | Pan |
| 7,959,332 | B2 | 6/2011 | Tickner et al. |
| 7,967,480 | B2 | 6/2011 | Pickard et al. |
| D642,317 | S | 7/2011 | Rashidi |
| 7,972,035 | B2 | 7/2011 | Boyer |
| 7,972,043 | B2 | 7/2011 | Schutte |
| D642,536 | S | 8/2011 | Robinson |
| D643,970 | S | 8/2011 | Kim et al. |
| 7,993,037 | B1 | 8/2011 | Buse |
| 8,002,425 | B2 | 8/2011 | Russo et al. |
| D646,011 | S | 9/2011 | Rashidi |
| 8,013,243 | B2 | 9/2011 | Korcz et al. |
| 8,038,113 | B2 | 10/2011 | Fryzek et al. |
| D648,476 | S | 11/2011 | Choi et al. |
| D648,477 | S | 11/2011 | Kim et al. |
| D650,115 | S | 12/2011 | Kim et al. |
| 8,070,328 | B1 | 12/2011 | Knoble et al. |
| 8,096,670 | B2 | 1/2012 | Trott |
| D654,205 | S | 2/2012 | Rashidi |
| D655,436 | S | 3/2012 | Johnson |
| D656,262 | S | 3/2012 | Yoshinobu et al. |
| D656,263 | S | 3/2012 | Ogawa et al. |
| 8,142,057 | B2 | 3/2012 | Roos et al. |
| 8,152,334 | B2 | 4/2012 | Krogman |
| D658,788 | S | 5/2012 | Dudik et al. |
| D658,802 | S | 5/2012 | Chen |
| D659,862 | S | 5/2012 | Tsai |
| D659,879 | S | 5/2012 | Rashidi |
| D660,814 | S | 5/2012 | Wilson |
| 8,182,116 | B2 | 5/2012 | Zhang et al. |
| 8,201,968 | B2 | 6/2012 | Maxik et al. |
| D663,058 | S | 7/2012 | Pan |
| D663,466 | S | 7/2012 | Rashidi |
| D664,274 | S | 7/2012 | de Visser et al. |
| D664,705 | S | 7/2012 | Kong et al. |
| 8,215,805 | B2 | 7/2012 | Cogliano et al. |
| 8,220,970 | B1 | 7/2012 | Khazi et al. |
| 8,226,270 | B2 | 7/2012 | Yamamoto et al. |
| 8,235,549 | B2 | 8/2012 | Gingrich, III et al. |
| 8,238,050 | B2 | 8/2012 | Minano et al. |
| 8,240,630 | B2 | 8/2012 | Wronski |
| D667,155 | S | 9/2012 | Rashidi |
| 8,262,255 | B1 | 9/2012 | Rashidi |
| D668,372 | S | 10/2012 | Renshaw et al. |

(56) References Cited

U.S. PATENT DOCUMENTS

D668,809 S 10/2012 Rashidi
D669,198 S 10/2012 Qiu
D669,199 S 10/2012 Chuang
D669,620 S 10/2012 Rashidi
8,277,090 B2 10/2012 Fryzek et al.
D671,668 S 11/2012 Rowlette, Jr. et al.
8,308,322 B2 11/2012 Santiago et al.
D672,899 S 12/2012 Ven et al.
D673,869 S 1/2013 Yu
D676,263 S 2/2013 Birke
D676,814 S 2/2013 Paul
8,376,593 B2 2/2013 Bazydola et al.
D677,417 S 3/2013 Rashidi
D677,634 S 3/2013 Korcz et al.
D679,044 S 3/2013 Jeswani et al.
D679,047 S 3/2013 Tickner et al.
8,403,533 B1 3/2013 Paulsel
8,403,541 B1 3/2013 Rashidi
8,405,947 B1 3/2013 Green et al.
D681,259 S 4/2013 Kong
8,408,759 B1 4/2013 Rashidi
D682,456 S 5/2013 Kaplan et al.
D682,459 S 5/2013 Gordin et al.
D683,063 S 5/2013 Lopez et al.
D683,890 S 6/2013 Lopez et al.
D684,269 S 6/2013 Wang et al.
D684,287 S 6/2013 Rashidi
D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
8,506,127 B2 8/2013 Russello et al.
8,506,134 B2 8/2013 Wilson et al.
D690,049 S 9/2013 Rashidi
D690,864 S 10/2013 Rashidi
D691,763 S 10/2013 Hand et al.
8,550,669 B2 10/2013 Macwan et al.
D693,043 S 11/2013 Schmalfuss et al.
D693,517 S 11/2013 Davis
D694,456 S 11/2013 Rowlette, Jr. et al.
8,573,816 B2 11/2013 Negley et al.
D695,441 S 12/2013 Lui et al.
D695,941 S 12/2013 Rashidi
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
8,632,040 B2 1/2014 Mass et al.
D698,985 S 2/2014 Lopez et al.
D699,384 S 2/2014 Rashidi
D699,687 S 2/2014 Baldwin et al.
D700,387 S 2/2014 Snell
8,641,243 B1 * 2/2014 Rashidi ..... F21V 29/713
362/373
8,659,034 B2 2/2014 Baretz et al.
D700,991 S 3/2014 Johnson et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
8,696,158 B2 4/2014 Santiago et al.
D705,472 S 5/2014 Huh
D705,481 S 5/2014 Zhang et al.
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Gehle et al.
8,820,985 B1 9/2014 Tam et al.
8,833,013 B2 9/2014 Harman
8,845,144 B1 9/2014 Davies et al.
D714,989 S 10/2014 Rowlette, Jr. et al.
8,870,426 B2 10/2014 Biebl et al.
8,888,332 B2 11/2014 Martis et al.
8,890,414 B2 11/2014 Rowlette, Jr. et al.
D721,845 S 1/2015 Lui et al.
8,926,133 B2 1/2015 Booth
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D723,781 S 3/2015 Miner
D723,783 S 3/2015 Miner
D725,359 S 3/2015 Miner
8,967,575 B1 3/2015 Gretz
D726,363 S 4/2015 Danesh
D726,949 S 4/2015 Redfern
D728,129 S 4/2015 Kreuzbichler
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
D734,525 S 7/2015 Gordin et al.
D735,012 S 7/2015 Cowie
D735,142 S 7/2015 Hagarty
9,078,299 B2 7/2015 Ashdown
9,109,760 B2 8/2015 Shum et al.
9,109,783 B1 8/2015 Davis et al.
D739,590 S 9/2015 Redfern
9,140,441 B2 9/2015 Goelz et al.
D741,538 S 10/2015 Ghasabi
9,151,457 B2 10/2015 Pickard et al.
9,151,477 B2 10/2015 Pickard et al.
D742,325 S 11/2015 Leung
D743,079 S 11/2015 Adair
D744,723 S 12/2015 Yoo
9,217,560 B2 12/2015 Harbers et al.
9,222,661 B2 12/2015 Kim et al.
9,239,131 B1 1/2016 Wronski et al.
D750,317 S 2/2016 Lui et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,310,052 B1 4/2016 Shum
9,322,543 B2 4/2016 Hussell et al.
9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,417,506 B1 8/2016 Tirosh
9,423,110 B1 8/2016 Newton et al.
D766,185 S 9/2016 Hagarty
D767,199 S 9/2016 Wronski et al.
9,447,917 B1 9/2016 Wronski et al.
9,447,953 B2 9/2016 Lawlor
D768,325 S 10/2016 Xu
D768,326 S 10/2016 Guzzini
D769,501 S 10/2016 Jeswani et al.
D770,065 S 10/2016 Tittle
D770,076 S 10/2016 Li et al.
9,476,552 B2 10/2016 Myers et al.
9,488,324 B2 11/2016 Shum et al.

(56) References Cited

U.S. PATENT DOCUMENTS

D774,676 S 12/2016 Ng
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,842 B1 3/2017 Davis
9,605,910 B2 3/2017 Swedberg et al.
D785,228 S 4/2017 Guzzini
D786,472 S 5/2017 Redfern
D786,473 S 5/2017 Dean
D786,474 S 5/2017 Fujisawa
D788,330 S 5/2017 Johnson et al.
D790,102 S 6/2017 Guzzini
9,673,597 B2 6/2017 Lee
9,689,541 B2 6/2017 Wronski
D791,709 S 7/2017 Holton
D791,711 S 7/2017 Holton
D791,712 S 7/2017 Holton
9,696,021 B2 7/2017 Wronski
9,702,516 B1 7/2017 Vasquez et al.
D795,820 S 8/2017 Wengreen
9,732,904 B1 8/2017 Wronski
9,732,947 B1 8/2017 Christ et al.
9,739,464 B2 8/2017 Wronski
D799,105 S 10/2017 Eder et al.
D800,957 S 10/2017 Eder et al.
9,791,111 B1 10/2017 Huang et al.
9,797,562 B2 10/2017 Dabiet et al.
9,803,839 B2 10/2017 Visser et al.
D805,660 S 12/2017 Creasman et al.
9,854,642 B2 12/2017 Kashani
D809,176 S 1/2018 Partington
9,860,961 B2 1/2018 Chemel et al.
9,863,619 B2 1/2018 Mak
D809,465 S 2/2018 Keirstead
9,903,569 B2 2/2018 O'Brien et al.
9,945,548 B2 4/2018 Williams et al.
9,964,266 B2 5/2018 Danesh
D820,494 S 6/2018 Cohen
D821,615 S 6/2018 Trice
D821,627 S 6/2018 Ko
9,995,441 B2 6/2018 Power et al.
D822,505 S 7/2018 Gibson et al.
D824,494 S 7/2018 Martins et al.
D825,829 S 8/2018 Guo
10,041,638 B2 8/2018 Vasquez et al.
10,054,274 B2 8/2018 Athalye et al.
D827,903 S 9/2018 Wu
10,072,805 B2 9/2018 Bailey
D832,218 S 10/2018 Wronski et al.
D833,977 S 11/2018 Danesh et al.
10,125,959 B2 11/2018 Cohen
10,139,059 B2 11/2018 Danesh
D836,976 S 1/2019 Reese et al.
10,244,607 B1 3/2019 Kashani
D847,414 S 4/2019 Danesh et al.
D847,415 S 4/2019 Danesh et al.
10,247,390 B1 4/2019 Kopitzke et al.
D848,375 S 5/2019 Danesh et al.
10,281,131 B2 5/2019 Cohen
10,295,163 B1 5/2019 Cohen
D850,695 S 6/2019 Dabiet et al.
D851,046 S 6/2019 Peng et al.
10,408,396 B2 9/2019 Wronski et al.
10,408,436 B2 9/2019 Wronski et al.
D863,661 S 10/2019 Tian et al.
D864,877 S 10/2019 Danesh et al.
D867,653 S 11/2019 Gorman
10,563,850 B2 2/2020 Danesh
D877,957 S 3/2020 Kopitzke, IV
10,591,120 B2 3/2020 Bailey et al.
10,609,785 B1 3/2020 Fardadi et al.
D880,733 S 4/2020 Lo et al.
D883,562 S 5/2020 Hu
D885,648 S 5/2020 Zeng
D885,649 S 5/2020 McLaughlin, III et al.
10,663,127 B2 5/2020 Danesh et al.
10,663,153 B2 * 5/2020 Nikooyan ..... F21V 17/14
D888,313 S 6/2020 Xie et al.
10,683,994 B2 6/2020 Wronski et al.
10,684,003 B2 6/2020 Wronski et al.
D890,410 S 7/2020 Stanford et al.
10,704,745 B2 7/2020 Sherry et al.
10,753,558 B2 8/2020 Danesh
10,808,917 B2 10/2020 Harris et al.
10,816,148 B2 10/2020 Danesh
D901,398 S 11/2020 Danesh et al.
D901,745 S 11/2020 Yang
D902,871 S 11/2020 Danesh et al.
D903,605 S 12/2020 Danesh et al.
D905,327 S 12/2020 Williams et al.
D907,284 S 1/2021 Danesh et al.
D910,223 S 2/2021 Cohen
10,975,570 B2 4/2021 Shen
10,982,829 B2 4/2021 Danesh
11,022,259 B2 6/2021 Bailey et al.
11,028,982 B2 6/2021 Danesh
11,047,538 B2 6/2021 Danesh et al.
D924,467 S 7/2021 Danesh et al.
D925,109 S 7/2021 Danesh et al.
11,060,705 B1 7/2021 Danesh et al.
11,067,231 B2 7/2021 Lotfi et al.
D927,430 S 8/2021 Cohen et al.
11,085,597 B2 8/2021 Danesh
11,118,768 B2 9/2021 Danesh
D939,134 S 12/2021 Danesh et al.
11,231,154 B2 1/2022 Kopitzke et al.
D944,212 S 2/2022 Peng et al.
11,242,983 B2 2/2022 Danesh
11,255,497 B2 2/2022 Danesh
2002/0172047 A1 11/2002 Ashley
2003/0006353 A1 1/2003 Dinh et al.
2003/0016532 A1 1/2003 Reed
2003/0021104 A1 1/2003 Tsao
2003/0161153 A1 8/2003 Patti
2004/0001337 A1 1/2004 Defouw et al.
2004/0156199 A1 8/2004 Rivas et al.
2005/0078474 A1 4/2005 Whitfield
2005/0121215 A1 6/2005 Halbert
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0221620 A1 10/2006 Thomas
2006/0237601 A1 10/2006 Rinderer
2006/0243877 A1 11/2006 Rippel
2006/0250788 A1 * 11/2006 Hodge ..... F21S 8/02
362/147
2006/0262536 A1 11/2006 Nevers
2006/0262545 A1 11/2006 Piepgras et al.
2007/0012847 A1 1/2007 Tai
2007/0035951 A1 2/2007 Tseng
2007/0121328 A1 5/2007 Mondloch et al.
2007/0131827 A1 6/2007 Nevers et al.
2007/0185675 A1 8/2007 Papamichael et al.
2007/0200039 A1 8/2007 Petak
2007/0206374 A1 9/2007 Petrakis et al.
2008/0002414 A1 1/2008 Miletich et al.
2008/0019138 A1 1/2008 Otte et al.
2008/0068847 A1 3/2008 Bedard
2008/0112168 A1 5/2008 Pickard et al.
2008/0112170 A1 5/2008 Trott
2008/0112171 A1 5/2008 Patti et al.
2008/0130308 A1 6/2008 Behr et al.
2008/0137347 A1 6/2008 Trott et al.
2008/0165545 A1 7/2008 O'Brien

(56) References Cited

U.S. PATENT DOCUMENTS

2008/0170404 A1 7/2008 Steer et al.
2008/0186718 A1 8/2008 Magisano et al.
2008/0224008 A1 9/2008 Dal Ponte et al.
2008/0232116 A1 9/2008 Kim
2008/0247181 A1 10/2008 Dixon
2008/0285271 A1 11/2008 Roberge et al.
2009/0003009 A1 1/2009 Tessnow et al.
2009/0034261 A1 2/2009 Grove
2009/0080189 A1 3/2009 Wegner
2009/0086484 A1 4/2009 Johnson
2009/0097262 A1 4/2009 Zhang et al.
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1 11/2009 Brown et al.
2010/0002320 A1 1/2010 Minano et al.
2010/0014282 A1 1/2010 Danesh
2010/0033095 A1 2/2010 Sadwick
2010/0061108 A1 3/2010 Zhang et al.
2010/0110690 A1 5/2010 Hsu et al.
2010/0110698 A1 5/2010 Harwood et al.
2010/0110699 A1 5/2010 Chou
2010/0148673 A1 6/2010 Stewart et al.
2010/0149822 A1 6/2010 Cogliano et al.
2010/0155497 A1 6/2010 Hagaman
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0277905 A1 11/2010 Janik et al.
2010/0284185 A1 11/2010 Ngai
2010/0302778 A1 12/2010 Dabiet et al.
2010/0328956 A1 12/2010 Zhang
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0121756 A1 5/2011 Thomas et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0140465 A1 6/2012 Rowlette, Jr. et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0250321 A1 10/2012 Blincoe et al.
2012/0266449 A1 10/2012 Krupa
2012/0287625 A1 11/2012 Macwan et al.
2012/0305868 A1 12/2012 Callahan et al.
2012/0314429 A1 12/2012 Plunk
2013/0009552 A1 1/2013 Page
2013/0010476 A1 1/2013 Pickard et al.
2013/0016864 A1 1/2013 Ivey et al.
2013/0033872 A1 2/2013 Randolph et al.
2013/0050994 A1 2/2013 Pieper
2013/0051012 A1 2/2013 Oehle et al.
2013/0077307 A1 3/2013 Yamamoto
2013/0083529 A1 4/2013 Gifford
2013/0141913 A1 6/2013 Sachsenweger
2013/0155681 A1 6/2013 Nall et al.
2013/0163254 A1* 6/2013 Chang ..... F21V 7/041 362/294
2013/0170232 A1 7/2013 Park et al.
2013/0170233 A1 7/2013 Nezu et al.
2013/0258677 A1 10/2013 Fryzek et al.
2013/0265750 A1 10/2013 Pickard et al.
2013/0271989 A1 10/2013 Hussell et al.
2013/0294084 A1 11/2013 Kathawate et al.
2013/0301252 A1 11/2013 Hussell et al.
2013/0322062 A1 12/2013 Danesh
2013/0322084 A1 12/2013 Ebisawa
2013/0335980 A1 12/2013 Nakasuji et al.
2014/0029262 A1 1/2014 Maxik et al.
2014/0036497 A1 2/2014 Hussell et al.
2014/0049957 A1 2/2014 Goelz et al.
2014/0063776 A1 3/2014 Clark et al.
2014/0071679 A1 3/2014 Booth
2014/0071687 A1 3/2014 Tickner et al.
2014/0140490 A1 5/2014 Roberts et al.
2014/0063818 A1 6/2014 Randolph et al.
2014/0233246 A1 8/2014 Lafreniere et al.
2014/0254177 A1 9/2014 Danesh
2014/0268836 A1 9/2014 Thompson
2014/0268869 A1 9/2014 Blessitt et al.
2014/0299730 A1 10/2014 Green et al.
2014/0313775 A1 10/2014 Myers et al.
2014/0321122 A1 10/2014 Domagala et al.
2014/0347848 A1 11/2014 Pisavadia et al.
2015/0009676 A1 1/2015 Danesh
2015/0029732 A1 1/2015 Hatch
2015/0078008 A1 3/2015 He
2015/0085500 A1 3/2015 Cooper et al.
2015/0092449 A1* 4/2015 Demuynck ..... F21V 29/508 362/649
2015/0131301 A1 5/2015 Ho
2015/0138779 A1 5/2015 Livesay et al.
2015/0153635 A1 6/2015 Chen et al.
2015/0184837 A1 7/2015 Zhang et al.
2015/0198324 A1 7/2015 O'Brien et al.
2015/0219317 A1 8/2015 Gatof et al.
2015/0233556 A1 8/2015 Danesh
2015/0241039 A1 8/2015 Fryzek
2015/0263497 A1 9/2015 Korcz et al.
2015/0276185 A1 10/2015 Bailey et al.
2015/0308662 A1 10/2015 Vice et al.
2015/0345761 A1 12/2015 Lawlor
2015/0362159 A1 12/2015 Ludyjan
2016/0084488 A1 3/2016 Wu et al.
2016/0209007 A1 7/2016 Belmonte et al.
2016/0230969 A1 8/2016 Pelletier et al.
2016/0238225 A1 8/2016 Doust
2016/0308342 A1 10/2016 Witherbee et al.
2016/0312987 A1 10/2016 Danesh
2016/0348860 A1 12/2016 Danesh
2016/0348861 A1 12/2016 Bailey et al.
2016/0366738 A1 12/2016 Boulanger et al.
2017/0045213 A1 2/2017 Williams et al.
2017/0059135 A1 3/2017 Jones
2017/0138576 A1 5/2017 Peng et al.
2017/0138581 A1 5/2017 Doust
2017/0167672 A1 6/2017 Stauner et al.
2017/0167699 A1 6/2017 Schubert et al.
2017/0198896 A1 7/2017 May
2017/0284616 A1 10/2017 Coakley et al.
2017/0307188 A1 10/2017 Oudina et al.
2017/0307198 A1 10/2017 Shah et al.
2018/0112857 A1 4/2018 Wronski et al.
2018/0119907 A1 5/2018 O'Brien et al.
2018/0142871 A1 5/2018 Morales
2018/0216809 A1 8/2018 Cohen
2018/0224095 A1 8/2018 Cohen
2018/0231197 A1 8/2018 Danesh

(56) References Cited

U.S. PATENT DOCUMENTS

| | | | |
|---|---|---|---|
| 2018/0283677 | A1 | 10/2018 | Cohen |
| 2018/0372284 | A1 | 12/2018 | Danesh et al. |
| 2019/0032874 | A1 | 1/2019 | Bonnetto et al. |
| 2019/0041050 | A1 | 2/2019 | Cairns et al. |
| 2019/0049080 | A1 | 2/2019 | Danesh |
| 2019/0063701 | A1 | 2/2019 | Lotfi et al. |
| 2019/0063724 | A1* | 2/2019 | Vice, Jr. ..... F21V 17/12 |
| 2019/0093836 | A1 | 3/2019 | Danesh |
| 2019/0249852 | A1 | 8/2019 | Kim |
| 2020/0182420 | A1 | 6/2020 | Cohen et al. |
| 2020/0291652 | A1 | 9/2020 | Shen |
| 2020/0355334 | A1 | 11/2020 | Shen et al. |
| 2020/0393118 | A1 | 12/2020 | Danesh et al. |
| 2021/0010647 | A1 | 1/2021 | Danesh et al. |
| 2021/0033268 | A1 | 2/2021 | Danesh |
| 2021/0080081 | A1 | 3/2021 | Cohen |
| 2021/0080084 | A1 | 3/2021 | Danesh et al. |
| 2021/0222845 | A1 | 7/2021 | Kopitzke et al. |
| 2021/0254812 | A1 | 8/2021 | Danesh et al. |
| 2021/0364139 | A1 | 11/2021 | Danesh |
| 2022/0018522 | A1 | 1/2022 | Kopitzke et al. |
| 2022/0018523 | A1 | 1/2022 | Vinh et al. |
| 2022/0018525 | A1 | 1/2022 | Danesh |
| 2022/0042664 | A1 | 2/2022 | Lotfi et al. |
| 2022/0049841 | A1 | 2/2022 | Young et al. |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CA | 2998173 | | 7/2018 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 8/2012 |
| CN | 202733693 | U | 2/2013 |
| CN | 103307518 | A | 9/2013 |
| CN | 103322476 | A | 9/2013 |
| CN | 203202661 | U | 9/2013 |
| CN | 203215483 | U | 9/2013 |
| CN | 101498411 | B | 11/2013 |
| CN | 203273663 | U | 11/2013 |
| CN | 203297980 | U | 11/2013 |
| CN | 203628464 | U | 12/2013 |
| CN | 203641919 | U | 6/2014 |
| CN | 204300818 | U | 4/2015 |
| CN | 104654142 | A | 5/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 103712135 | B | 4/2016 |
| CN | 205606362 | U | 9/2016 |
| CN | 206130742 | U | 4/2017 |
| CN | 103154606 | B | 5/2017 |
| CN | 206222112 | U | 6/2017 |
| CN | 304220113 | | 7/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 589 289 | | 10/2005 |
| EP | 1 672 155 | A1 | 6/2006 |
| EP | 1688663 | | 8/2006 |
| EP | 2 095 938 | A1 | 2/2008 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2325728 | | 12/1998 |
| GB | 2427020 | A | 12/2006 |
| GB | 2466875 | | 7/2010 |
| GB | 2471929 | | 1/2014 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 1/2015 |
| JP | 2015002028 | A2 | 1/2015 |
| JP | 2016219335 | A | 12/2016 |
| JP | 2017107699 | A2 | 6/2017 |
| JP | D1658938 | | 4/2020 |
| KR | 1020110008796 | A | 1/2011 |
| KR | 1020120061625 | A | 6/2012 |
| MX | 2011002947 | A | 9/2011 |
| PH | 3-2018-658-0001 | | 7/2018 |
| TW | 474382 | U | 1/2002 |
| WO | WO D038920-001 | | 1/1997 |
| WO | WO 2013/128896 | A1 | 9/2013 |
| WO | WO 2014/015656 | | 1/2014 |
| WO | WO 2015/000212 | A1 | 1/2015 |
| WO | WO 2016152166 | A2 | 9/2016 |

OTHER PUBLICATIONS

Notice of Allowance dated Oct. 27, 2020 from U.S. Appl. No. 29/648,046, 5 pages.

Notice of Allowance dated Oct. 27, 2020 from U.S. Appl. No. 29/694,475, 5 pages.

Notice of Allowance dated Nov. 10, 2020 from U.S. Appl. No. 29/688,143, 6 pages.

Notice of Allowance dated Nov. 10, 2020 from U.S. Appl. No. 29/688,172, 6 pages.

Non-Final Office Action dated Nov. 30, 2020 from U.S. Appl. No. 17/000,702, 7 pages.

Notice of Allowance dated Dec. 2, 2020 from U.S. Appl. No. 29/746,262, 6 pages.

International Search Report and Written Opinion in PCT/US2020/050767 dated Dec. 9, 2020, 25 pages.

Non-Final Office Action dated Dec. 16, 2020 from U.S. Appl. No. 17/080,080, 28 pages.

Canadian Office Action in Application No. 2941051 dated Dec. 8, 2020, 5 pages.

Final Office Action dated Jan. 11, 2021 from U.S. Appl. No. 15/688,266, 7 pages.

Non-Final Office Action dated Jan. 11, 2021 from U.S. Appl. No. 16/725,606, 7 pages.

Non-Final Office Action dated Jan. 13, 2021 from U.S. Appl. No. 17/085,636, 14 pages.

Notice of Allowance dated Jan. 15, 2021 from U.S. Appl. No. 17/000,702, 7 pages.

Notice of Allowance dated Jan. 22, 2021 from U.S. Appl. No. 17/080,080, 14 pages.

Notice of Allowance dated Jan. 22, 2021 from U.S. Appl. No. 16/886,365, 7 pages.

Final Office Action dated Feb. 5, 2021 from U.S. Appl. No. 16/200,393, 7 pages.

"Electrical Boxes" accessed at http://electrical-inspector.blogspot.com/2013/06/electrical-boxes.html Jun. 22, 2013 retrieved from Wayback Machine Archinve.org on Jan. 25, 2021. 12 pages.

"Electrical Boxes Volume and Fill Calculations" accessed at http://electrical-inspector.blogspot.com/2013/06/electrical-boxes-Volume-and-Fill-Calculations.html Jun. 22, 2013 retrieved from Wayback Machine Archinve.org on Jan. 25, 2021. 8 pages.

U.S. Appl. No. 61/881,162, filed Sep. 23, 2013. Priority application to US Publication No. 2015/0085500 to Cooper et al. 31 pages.

Non-Final Office Action dated Jan. 19, 2021 from U.S. Appl. No. 17/099,650, 15 pages.

(56) References Cited

OTHER PUBLICATIONS

Supplemental Notice of Allowance dated Mar. 10, 2021 from U.S. Appl. No. 16/886,365, 2 pages.
Notice of Allowance dated Apr. 6, 2021 from U.S. Appl. No. 16/200,393, 11 pages.
Non-Final Office Action dated Apr. 12, 2021 from U.S. Appl. No. 29/694,475, 11 pages.
Notice of Allowance dated Apr. 13, 2021 from U.S. Appl. No. 16/725,606, 7 pages.
Notice of Allowance dated Apr. 26, 2021 from U.S. Appl. No. 17/080,080, 11 pages.
Corrected Notice of Allowance dated Apr. 28, 2021 from U.S. Appl. No. 16/725,606, 2 pages.
Notice of Allowance dated May 5, 2021 from U.S. Appl. No. 17/085,636, 8 pages.
Notice of Allowance dated May 14, 2021 from U.S. Appl. No. 16/881,686, 8 pages.
Notice of Allowance dated May 17, 2021 from U.S. Appl. No. 15/688,266, 9 pages.
Notice of Allowance dated May 24, 2021 from U.S. Appl. No. 29/688,143, 6 pages.
Notice of Allowance dated May 24, 2021 from U.S. Appl. No. 29/688,172, 6 pages.
Notice of Allowance dated May 27, 2021 from U.S. Appl. No. 16/779,865, 9 pages.
Notice of Allowance dated May 28, 2021 from U.S. Appl. No. 16/779,824, 11 pages.
Notice of Allowance dated Jun. 1, 2021 from U.S. Appl. No. 16/719,361, 7 pages.
Corrected Notice of Allowance dated Jun. 21, 2021 from U.S. Appl. No. 16/779,865, 3 pages.
Non-Final Office Action dated Jul. 14, 2021 from U.S. Appl. No. 17/118,742, 11 pages.
Element by Tech Lighting. 3" LED Adjustable Downlight—Product Information. Element Dec. 13, 2017. Accessed at https://web.archive.org/web/20171213064314/http://www.element-lighting.com/Products/Details/3-LED-Adjustable-Downlight on Jun. 10, 2021.
VersaLux—Versatile LED downlight. Accessed at https://www.eaton.com/gb/en-gb/catalog/lighting-and-controls/versalux-downlight.html on Jul. 15, 2021. 8 pages.
LRX Series LR4X™ LED Downlight—4". Cree Lighting Nov. 1, 2019. Accessed at https://rexel-cdn.com/Products/CreeLighting/LR4X-7L-40K.pdf?i=534A0E89-4184-44DE-840A-3D75598E5C62. 4 pages.
LED Retrofit Downlights CR Series. Cree Lighting. Accessed at https://www.creelighting.com/products/indoor/retrofit-downlights/cr-series on Jul. 15, 2021. 1 page.
Notice of Allowance dated Jul. 21, 2021 from U.S. Appl. No. 17/318,193, 13 pages.
Supplemental Notice of Allowance dated Aug. 13, 2021 1 from U.S. Appl. No. 16/779,824, 3 pages.
Supplemental Notice of Allowance dated Aug. 19, 2021 1 from U.S. Appl. No. 17/318,193, 4 pages.
Notice of Allowance dated Aug. 20, 2021 1 from U.S. Appl. No. 29/764,875, 5 pages.
Cree LMH2 LED Modules Product Family Data Sheet. Cree 2011-2014, 18 pages.
Cree LMH2 LED Modules Design Guide. Cree 2011-2015, 23 pages.
Brochure of Elco EL49A, EL49ICA, EL49RA modules. ELCO Lighting Nov. 25, 2009. 1 page.
Image of Elco E347/247 module identified by Elco in response to DMF's Request for Production in Civil Action No. 2:18-cv-07090-CAS-GJS on Aug. 28, 2019. 1 page.
Screenshots from the Deposition of Brandon Cohen in Civil Action No. 2:18-cv-07090-CAS-GJS. Conducted Sep. 2, 2020. 8 pages.
Defendant AMP Plus, Inc.'s Initial Disclosure and Designation of Expert Witnesses in Civil Action No. 2:19-CV-4519-CAS. 37 pages.
Defendant AMP Plus, Inc. D/B/A Elco Lighting's Supplemental Responses to Plaintiff DMF, Inc.'s First Set of Interrogatories (Nos. 1-16) in Civil Action No. 2:19-CV-4519-CAS, Redacted. 13 pages.
Final Written Decision in IPR2019-01094 dated Nov. 19, 2020, 58 pages.
2006 International Building Code, Section 712 Penetrations, Jan. 2006, 4 pages.
Acrich COB Zhaga Module, Product Description, Seoul Semiconductor, Nov. 11, 2016, 39 pages.
<https://www.zhagastandard.org/books/book18/>, Mar. 2017, 5 pages. Accessed on May 14, 2018.
Bortz, J. C. et al., "Optimal design of a nonimaging TIR doublet lens for an illumination system using an LED source", Proc. SPIE 5529, Nonimaging Optics and Efficient Illumination Systems, (Sep. 29, 2004); doi: 10.1117/12.562598; https://doi.org/10.1117/12.562598, 10 pages.
BXUV.GuideInfo, Fire Resistance Ratings—ANSI/UL 263, UL Online Certifications Directory, last updated Nov. 3, 2016, 27 pages.
CEYY.GuideInfo, Outlet Boxes and Fittings Certified for Fire Resistance, UL Online Certifications Directory, last updated May 16, 2013, 2 pages.
Canadian Office Action dated Dec. 23, 2013 from Canadian Application No. 2,778,581, 3 pages.
Canadian Office Action dated Mar. 22, 2016 from Canadian Application No. 2,879,629, 4 pages.
Canadian Office Action dated Dec. 6, 2016 from Canadian Application No. 2,879,629, 3 pages.
Canadian Office Action dated Mar. 9, 2017 from Canadian Application No. 2,931,588, 5 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Aug. 11, 2017 from Canadian Application No. 2,941,051, 4 pages.
Carlon® Zip Box® Blue™ Switch and Outlet Boxes, Product Brochure, http://www.carlonsales.com/brochures.php, Jun. 20, 2006, 22 pages.
Cree LED Lamp Family Sales Sheet—Better light is beautiful light, Apr. 24, 2017, 2 pages.
DME Series Installation Instructions, Oct. 18, 2011, 2 pages.
DMF, Inc., "dmfLIGHTING: LED Recessed Lighting Solutions," Info sheets, Mar. 15, 2012, 4 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
Dross, O. et al., "Review of SMS design methods and real-world applications", Proc. SPIE 5529, Nonimaging Optics and Efficient Illumination Systems, (Sep. 29, 2004); doi: 10.1117/12.561336; https://doi.org/10.1117/12.561336, 14 pages.
Final Office Action dated Apr. 27, 2016 from U.S. Appl. No. 14/184,601, 19 pages.
Final Office Action dated Jul. 26, 2017 from U.S. Appl. No. 14/184,601, 18 pages.
Final Office Action dated Jan. 29, 2016 from U.S. Appl. No. 14/183,424, 21 pages.
Final Office Action dated Jun. 23, 2016 from U.S. Appl. No. 13/484,901, 18 pages.
Final Office Action dated Apr. 2, 2015 from U.S. Appl. No. 13/484,901, 13 pages.
Halo, Halo LED H4 H7 Collection, SustainabLEDesign, Cooper Lighting, (emphasis on p. 18 "H7 Collection LED Modules—Halo LED H7 Module Features,") Mar. 28, 2012, 52 pages.
Halo, H7 LED Downlight Trims 49x Series, 6-inch LED Trims for Use with MI7x LED Modules, Cooper Lighting, ADV110422, rev. Aug. 12, 2011, 15 pages.
Halo, LED Module ML706x, Cooper Lighting, General Installation for All Modules/p. 1; Tether Installation/pp. 2-3; Installation into HALO H750x Series LED—only (Non-Screw Based), Recessed Fixture, p. 4, Oct. 20, 2009, 4 pages.

(56) References Cited

OTHER PUBLICATIONS

Medvedev, V. et al., "Uniform LED illuminator for miniature displays," Proc. SPIE 3428, Illumination and Source Engineering, (Oct. 20, 1998); doi: 10.1117/12.327957;https://doi.org/10.1117/12.327957, 13 pages.
"Membrane Penetrations in Fire-Resistance Rated Walls," https://www.ul.com/wp-content/uploads/2014/04/ul_MembranePenetrations.pdf, Issue 1, 2009, published Feb. 26, 2010, 2 pages.
"Metallic Outlet Boxes," UL 514A, Underwriters Laboratories, Inc., Feb. 16, 2004 (Title Page Reprinted Aug. 10, 2007), 106 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
Notice of Allowance dated Mar. 26, 2018 for U.S. Appl. No. 14/184,601, 10 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Jul. 20, 2015 from U.S. Appl. No. 14/184,601, 16 pages.
Non-Final Office Action dated Dec. 15, 2016 from U.S. Appl. No. 14/184,601, 18 pages.
Non-Final Office Action dated Feb. 6, 2018 from U.S. Appl. No. 15/167,682, 9 pages.
Non-Final Office Action dated Sep. 15, 2015 from U.S. Appl. No. 13/484,901, 16 pages.
Non-Final Office Action dated Oct. 16, 2014 from U.S. Appl. No. 13/484,901, 11 pages.
Non-Final Office Action dated Sep. 6, 2017 from U.S. Appl. No. 14/726,064, 8 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Non-Final Office Action dated Apr. 12, 2018 for U.S. Appl. No. 29/638,259, 5 pages.
Non-Final Office Action dated May 16, 2018 for U.S. Appl. No. 15/132,875, 18 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Oct. 21, 2016 from U.S. Appl. No. 13/484,901, 7 pages.
Notice of Allowance dated Mar. 24, 2016 from U.S. Appl. No. 14/247,149, 8 pages.
Notice of Allowance dated May 22, 2018 from U.S. Appl. No. 14/183,424, 9 pages.
Notice of Allowance dated May 10, 2018 from U.S. Appl. No. 14/726,064, 7 pages.
Notice of Allowance dated Aug. 23, 2017 from Canadian Application No. 2,879,629, 1 page.
"Outlet Boxes for Use in Fire Rated Assemblies," https://www.ul.com/wp-content/uploads/2014/04/UI_outletboxes.pdf, Apr. 2007, 2 pages.
Parkyn, W. A. et al., "New TIR lens applications for light-emitting diodes", Proc. SPIE 3139, Nonimaging Optics: Maximum Efficiency Light Transfer IV, (Oct. 3, 1997); doi: 10.1117/12.290217, 7 pages.
Schreiber, P. et al., "Microoptics for homogeneous LED-illumination", Proc. SPIE 6196, Photonics in Multimedia, 61960P (Apr. 21, 2006); doi: 10.1117/12.663084; https://doi.org/10.1117/12.663084, 11 pages.
Van Giel, B. V. et al., "Design of axisymmetrical tailored concentrators for LED light source applications", Proc. SPIE 6196, Photonics in Multimedia, 619603 (Apr. 21, 2006); doi: 10.1117/12.660115; https://doi.org/10.1117/12.660115, 11 pages.
Zhen, Y. et al., "The optimal design of TIR lens for improving LED illumination uniformity and efficiency", Proc. SPIE 6834, Optical Design and Testing III, 68342K (Nov. 28, 2007); doi: 10.1117/12.756101, 9 pages.
Zou, H. et al., "58.1: Single-Panel LCOS Color Projector with LED Light Sources", SID Symposium, vol. 36, Issue 1, 4 pages (May 2005).
Notice of Allowance dated Sep. 21, 2018 from U.S. Appl. No. 29/645,941, 5 pages.
"Advanced LED Solutions," Imtra Marine Lighting. Jun. 17, 2011. 39 pages.
"Portland Bi-Color, Warm White/Red," item:ILIM30941.Imtra Marine Products. 2012. 3 pages. Accessed athttp://www.imtra.com:80/Oade25fb-3218-4cae-a926-6abe64ffd93a/lighting-light-fixtures-downlights-3-to-4-inches-detail.htm on Jan. 25, 2013.
"Cree LMH2 LED Modules," Mouser Electronics. Accesssed at www.mouser.com/new/cree/creelmh2 on Sep. 9, 2012. 2 pages.
"Cree LMH2 LED Module with TrueWhite Technology," Cree Product Family Data Sheet. Dec. 21, 2011. 3 pages.
"Cree LMH2 LED Modules Design Guide," Cree Product Design Guide. 2011. 20 pages.
"Undercabinet Pucks, Xyris Mini LED Puck Light," ELCO Lighting. Sep. 2018. 1 page.
"LED Undercabinet Pocket Guide," ELCO Lighting. Nov. 2, 2016. 12 pages.
"VERSI LED Mini Flush," Lithonia Lghting. Sep. 2013. 6 pages.
Notice of Allowance dated Oct. 4, 2018 from U.S. Appl. No. 15/947,065, 9 pages.
Notice of Allowance dated Sep. 19, 2018 from U.S. Appl. No. 15/167,682, 7 pages.
Non-Final Office Action dated Jun. 25, 2018 for U.S. Appl. No. 29/541,565, 10 pages.
Non-Final Office Action dated Oct. 24, 2018 for U.S. Appl. No. 15/688,266, 14 pages.
OneFrame Recessed LED Downlight. Dmflighting.com. Published Jun. 6, 2018. Retrieved at https://www.dmflighting.com/product/oneframe on Jun. 6, 2018. 11 pages.
Notice of Allowance dated Oct. 9, 2018 from U.S. Appl. No. 29/653,142, 7 pages.
International Search Report and Written Opinion in PCT/US2018/048357 dated Nov. 14, 2018, 13 pages.
Notice of Allowance dated Nov. 27, 2018 from U.S. Appl. No. 15/167,682, 11 pages.
Non-Final Office Action dated Dec. 5, 2018 from U.S. Appl. No. 14/942,937, 13 pages.
International Search Report and Written Opinion in International Patent Application No. PCT/US18/39048 dated Dec. 14, 2018. 24 pages.
Notice of Allowance dated Jan. 2, 2019 from U.S. Appl. No. 29/541,565, 6 pages.
RACO 4 i+A882:C958n. Octagon Welded Concrete Ring, 3-1/2 in. Deep with 1/2 and 3/4 in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
Notice of Allowance dated Feb. 8, 2019 from U.S. Appl. No. 29/541,565, 5 pages.
Non-Final Office Action dated Feb. 7, 2019 from U.S. Appl. No. 16/200,393, 32 pages.
Notice of Allowance dated Jan. 28, 2019 from U.S. Appl. No. 29/664,471, 8 pages.
Non-Final Office Action dated Jul. 24, 2018 from U.S. Appl. No. 29/638,259, 5 pages.
Final Office Action dated Mar. 15, 2019 from U.S. Appl. No. 15/132,875,15 pages.

(56) References Cited

OTHER PUBLICATIONS

International Search Report and Written Opinion in International Patent Application No. PCT/US18/62868 dated Mar. 14, 2019, 13 pages.
CS&E PCT Collaborative Search and Examination Pilot Upload Peer Contribution in International Patent Application No. PCT/US18/62868 dated Mar. 14, 2019, 61 pages.
Notice of Allowance dated Apr. 1, 2019 from U.S. Appl. No. 15/167,682, 7 pages.
Non-Final Office Action dated Apr. 4, 2019 from U.S. Appl. No. 29/678,482, 8 pages.
Notice of Allowance dated Apr. 8, 2019 from U.S. Appl. No. 29/653,142, 8 pages.
Notice of Allowance dated Apr. 17, 2019 from U.S. Appl. No. 29/678,478, 7 pages.
International Search Report and Written Opinion in International Patent Application No. PCT/US18/67614 dated Apr. 25, 2019, 20 pages.
CS&E PCT Collaborative Search and Examination Pilot Upload Peer Contribution in International Patent Application No. PCT/US18/67614 dated Apr. 24, 2019, 53 pages.
Specification & Features 4" Octagonal Concrete Box Covers. Orbit Industries, Inc. Accessed at https://www.orbitelectric.com on May 6, 2019. 1 page.
4" Octagon Concrete Boxes and Back Plates. Appleton. Accessed at www.appletonelec.com on May 6, 2019. 1 page.
RACO Commercial, Industrial and Residential Electrical Products. Hubbell. Accessed at www.Hubbell-RTB.com on May 6, 2019. 356 pages.
Imtra Marine Lighting 2008 Catalog. 40 pages.
Imtra Marine Lighting 2009 Catalog. 32 pages.
Imtra Marine Lighting Spring 2007 Catalog. 36 pages.
Final Office Action dated Jun. 6, 2019 from U.S. Appl. No. 15/688,266, 7 pages.
Non-Final Office Action dated Jun. 11, 2019 from U.S. Appl. No. 15/901,738, 6 pages.
Notice of Allowance dated Jun. 12, 2019 from U.S. Appl. No. 16/016,040, 8 pages.
Cooper Lighting HALO ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
KWIKBRACE® New Construction Braces for Lighting Fixtures or Ceiling Fans 1-1/2 in. Depth. Hubbel. Accessed at https://hubbellcdn.com/specsheet/926.pdf on Jun. 27, 2019. 1 page.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Ex-Parte Quayle Action mailed Jun. 27, 2019 from U.S. Appl. No. 29/683,730, 5 pages.
Notice of Allowance dated Jul. 31, 2019 from U.S. Appl. No. 15/167,682, 7 pages.
Supplemental Notice of Allowance dated Aug. 5, 2019 from U.S. Appl. No. 15/947,065, 2 pages.
International Search Report and Written Opinion in International Patent Application No. PCT/US19/32281 dated Aug. 2, 2019, 18 pages.
Notice of Allowance dated Sep. 11, 2019 from U.S. Appl. No. 29/653,142, 6 pages.
Notice of Allowance dated Sep. 19, 2019 from U.S. Appl. No. 16/016,040, 7 pages.
Corrected Notice of Allowance dated Sep. 27, 2019 from U.S. Appl. No. 15/167,682, 2 pages.
Final Office Action dated Sep. 27, 2019 from U.S. Appl. No. 16/200,393, 34 pages.
Notice of Allowance dated Feb. 15, 2019 from U.S. Appl. No. 15/947,065, 9 pages.
Notice of Allowance dated Oct. 1, 2019 from U.S. Appl. No. 14/942,937, 7 pages.
Final Office Action dated Oct. 3, 2019 from U.S. Appl. No. 29/678,482, 6 pages.
Delhi Rehab & Nursing Facility ELM16-70884. Vertex Innovative Solutions Feb. 25, 2016. 89 pages.
SlimSurface surface mount downlighting. Philips Lightolier 2018. 8 pages.
Be seen in the best light. Lightolier by signify. Comprehensive 2019 Lighting Catalog. 114 pages.
Corrected Notice of Allowance dated Oct. 10, 2019 from U.S. Appl. No. 16/016,040, 2 pages.
Cree® LMR2 Led Module. Product Family Data Sheet Cree 2011. 3 pages.
Notice of Allowance dated Oct. 16, 2019 from U.S. Appl. No. 15/132,875, 12 pages.
International Search Report and Written Opinion in International Patent Application No. PCT/US2019/036477 dated Oct. 17, 2019, 15 pages.
ML56 LED Lighting System 600 / 900 / 1200 Series Halo. Cooper Lighting Brochure 2015. Accessed at https://images.homedepot-static.com/catalog/pdfImages/06/06d28f93-4bf6-45be-a35a-a0239606f227.pdf. 41 pages.
Switch and Outlet Boxes and Covers Brochure. Appelton 2010. 77 pages.
Non-Final Office Action dated Dec. 30, 2019 from U.S. Appl. No. 16/653,497, 8 pages.
Notice of Allowance dated Feb. 5, 2020 from U.S. Appl. No. 15/901,738, 8 pages.
Notice of Allowance dated Feb. 5, 2020 from U.S. Appl. No. 29/678,482 , 13 pages.
Maxim Lighting Wafer Trifold Brochure LMXBRO1711 2017. Accessed at https://www.maximlighting.com/Upload/download/brochure/pdf/LMXBR01711.pdf on Feb. 13, 2020. 2 pages.
Maxim Convert Fixture. LMXCAT1805 Maxim Main Catalog 2018 p. 639.
Maxim Wafer. LMXCAT1805 Maxim Main Catalog 2018 pp. 636-638.
Maxim Lighting Trim Trifold LMXBRO1905 2019. Accessed at https://www.maximlighting.com/Upload/download/brochure/pdf/LMXBRO1905.pdf on Feb. 13, 2020. 2 pages.
International Search Report and Written Opinion in International Patent Application No. PCT/US2019/054220 dated Feb. 24, 2020, 23 pages.
Final Office Action dated Mar. 17, 2020 for U.S. Appl. No. 29/653,142, 13 pages.
LED Book Pr ice Guide 2012. DMF Light. Issued Jun. 26, 2013. 3 pages.
DLER411 4" Recessed LED Retrofit Module. DMF Light. Issued Jun. 15, 2011. 1 page.
DLEI411 4" Recessed LED New Construction, IC. DMF Light. Issued Nov. 30, 2011. 1 page.
DLEIR411 4" Recessed LED Remodel, IC. DMF Light. Issued Jun. 15, 2011. 1 page.
3 & 4" DLE Series LED Sample Case Now Available. DMF Light. Issued Jan. 6, 2012. 1 page.
DLEI3 3" Recessed LED New Construction, IC. DMF Light. Issued Nov. 30, 2011. 2 pages.
Ridgway-Barnes, SlimSurface LED Downlight: One of the thinnest LED surface mount downlights in the market. Philips Lighting Blog. Oct. 28, 2014. Accessed at http://applications.nam.lighting.philips.com/blog/index.php/2014/10/28/slimsurface-led-downlight-one-of-the-thinnest-led-surface-mount-downlights-in-the-market/. 3 pages.
SlimSurface LED S5R, S7R & S10R Round 5", 7" and 10" Apertures. Lightolier by Signify. Nov. 2018. 9 pages.
Non-Final Office Action dated Apr. 2, 2020 for U.S. Appl. No. 16/522,275, 21 pages.
Notice of Allowance dated May 18, 2020 from U.S. Appl. No. 15/901,738, 7 pages.
Non-Final Office Action dated May 20, 2020 for U.S. Appl. No. 15/688,266, 6 pages.
Non-Final Office Action dated May 26, 2020 for U.S. Appl. No. 16/719,361, 10 pages.

(56) References Cited

OTHER PUBLICATIONS

Maxim Lighting International, "Wafer LED 7" RD 3000K Wall/Flush Mount", undated.
Maxim Lighting International, "Convert LED Flush Mount", undated.
Maxim Lighting International, "Views of the Wafer Flush Mount", undated.
Maxim Lighting International, "Product/Drawing Specification Sheet", undated.
International Search Report and Written Opinion in PCT/US2020/017331 dated Jun. 22, 2020, 16 pages.
Taiwan Office Action and translation thereof dated Jun. 12, 2020 from Taiwan Application No. 108116564, 8 pages.
Access Lighting Installation Instructions. No. 20870LEDD/20871LEDD/20872LEDD. Dec. 16, 2019. 2 pages.
Model No. 20870LEDD-WH/ACR Infinite Specification Sheet. Access Lighting. Apr. 9, 2020. 1 page.
Notice of Allowance dated Jul. 10, 2020 from U.S. Appl. No. 29/694,475, 6 pages.
Corrected Notice of Allowability dated Oct. 25, 2018 from U.S. Appl. No. 14/183,424, 3 pages.
Dmf DRD2 Recessed LED Downlight General Retrofit Junction Box Dated: Dec. 18, 2015 Downloaded Jul. 28, 2018, from https://www.a lconlighting.com/specsheets/DMF/DRD2-Junction-Box-Retrofit-Spec-Sheet .pdf, 6 pages.
Dmf DRD2 Recessed LED Downlight General New Construction 4", 5", 6" Aperture Dated: Aug. 31, 2016 Downloaded Jul. 28, 2018, from https://www. cansandfans.com/sites/default/files/DRD2-General-New-Construction-Spec-Sheet_7_0 .pdf, 9 pages.
Mar. 5, 2016—The DMF Lighting DRD2 Recessed LED Downlight General Retrofit Junction Box—Wet Location Rated is the ideal solution for Commercial LED recessed lighting retrofit applications. web cache https://www.alconlighting.com/dmf-drd2m.html (downloaded Jul. 28, 2018), 6 pages.
Ex Parte Quayle Office Action mailed Oct. 16, 2018 for U.S. Appl. No. 29/663,037, 7 pages.
Notice of Allowance dated Nov. 19, 2018 from U.S. Appl. No. 29/663,037, 5 pages.
Notice of Allowance dated Nov. 15, 2018 from U.S. Appl. No. 29/663,040, 5 pages.
LED modules advance in performance, standardization questions persist (Magazine). LEDs Magazine. Oct. 29, 2013. Accessed at https://www.ledsmagazine.com/leds-ssl-design/modular-light-engines/article/16695073/led-modules-advance-in-performance-standardization-questions-persist-magazine. 9 pages.
Notice of Allowance dated Jul. 20, 2020 from U.S. Appl. No. 29/648,046, 5 pages.
Octagon Concrete Box Cover with (3) 1/2 in. & (2) 3/4 in. Conduit Knockouts. Garvin. Accessed at https://www.garvinindustries.com/covers-and-device-rings/concrete-slab-box-covers-adaptor-rings/flat-covers-all-styles/cbp?gclid=Cj0KCQjw9b_4BRCMARIsADMUIypJc0K80UHdDTI9C5m4BDzR3U87PRYV1NdQIBFxEWQ2I_3otTCTqEkaAi_DEALw_wcB on Jul. 20, 2020. 1 page.
Notice of Allowance dated Jul. 28, 2020 from U.S. Appl. No. 16/719,361, 8 pages.
Notice of Allowance dated Jul. 29, 2020 from U.S. Appl. No. 16/522,275, 8 pages.
Non-Final Office Action dated Aug. 19, 2020 for U.S. Application Serial No. 16/886,365, 16 pages.
Notice of Allowance dated Sep. 8, 2020 from U.S. Appl. No. 29/678,482, 5 pages.
Corrected Notice of Allowance dated Sep. 11, 2020 from U.S. Appl. No. 16/719,361, 2 pages.
Canadian Office Action in Application No. 2931588 dated Aug. 13, 2020, 5 pages.
Corrected Notice of Allowance dated Sep. 14, 2020 from U.S. Appl. No. 16/522,275, 2 pages.
Notice of Allowance dated Sep. 22, 2020 from U.S. Appl. No. 29/683,730, 6 pages.
Notice of Allowance dated Sep. 22, 2020 from U.S. Appl. No. 29/653,142, 6 pages.
Petition for Inter Partes Review of U.S. Pat. No. 9,964,266 Pursuant to 37 C.F.R. § 42.100 et seq. *AMP Plus Inc. dbd ELCO Lighting* v. *DMF, Inc*, IPR2019-01094 filed May 17, 2019. 108 pages.
IPR2019-01094 Exhibit 1001. U.S. Pat. No. 9,964,266 ("the '266 Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. Imtra 2007 Marine Lighting Catalog ("Imtra 2007"). 36 pages.
IPR2019-01094 Exhibit 1007. U.S. Pat. No. 9,366,418 ("Gifford"). 9 pages.
IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, ANSI RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL- 8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.
IPR2019-01094 Exhibit 1013. Illuminating Engineering Society of North America, IES Lighting Handbook (John E. Kaufman and Howard Haynes eds., Application vol. 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("Pier LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.

(56) References Cited

OTHER PUBLICATIONS

IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY'12 (prepared by Navigant Consulting, Inc., Mar. 2006) ("DOE 2006"). 129 pages.
IPR2019-01094 Exhibit 1028. U.S. Department of Energy, Solid-State Lighting Research and Development: Multi-Year Program Plan (Apr. 2013) ("DOE 2013"). 89 pages.
Declaration of Colby Chevalier from Central District of California Civil Docket for Case #: 2:18-cv-07090-CAS-GJS filed Jun. 3, 2019, signed Jun. 3, 2019. 2 pages.
Docket Listing in Inter Partes Review of U.S. Pat. No. 9,964,266. Docket Navegator *AMP Plus, Inc. d/b/a Elco Lighting et al.* v. *DMF, Inc*. PTAB-IPR2019-01094. Downloaded Mar. 25, 2020. 4 pages.
Petition for Inter Partes Review of U.S. Pat. No. 9,964,266 Pursuant to 37 C.F.R. § 42.100 et seq. *AMP Plus Inc. dbd ELCO Lighting* v. *DMF, Inc*, PTAB-IPR2019-01500 filed Aug. 14, 2019. 99 pages.
Docket Listing in Inter Partes Review of U.S. Pat. No. 9,964,266 . *AMP Plus, Inc. d/b/a ELCO Lighting et al.* v. *DMF, Inc*. PTAB-IPR2019-01500. Downloaded Mar. 25, 2020. 3 pages.
Civil Action No. 2:18-cv-07090. Complaint For Infringement and Unfair Competition. *DMF, Inc*. v. *AMP Plus, Inc. d/b/a ELCO Lighting*. 52 pages. Dated Aug. 15, 2018.
Docket Listing in Civil Action No. 2:18-cv-07090. *DMF, Inc*. v. *AMP Plus, Inc. d/b/a ELCO Lighting et al*. CDCA-2-18-CV-07090. Downloaded on Mar. 25, 2020. 39 pages.
Civil Action No. 2:19-cv-4519.Complaint For Patent Infringement. *DMF, Inc*. v. *AMP Plus, Inc. d/b/a ELCO Lighting*. 52 pages dated May 22, 2019. 23 pages.
Docket Listing in Civil Action No. 2:19-cv-4519. *DMF Inc* v. *AMP Plus, Inc. d/b/a ELCO Lighting et al*. CDCA-2-19-cv-04519. Downloaded on Mar. 25, 2020. 3 pages.
Decision Denying Institution of Inter Partes Review of U.S. Pat. No. 9,964,266 in IPR2019-01500 dated Mar. 17, 2020. 21 pages.
Defendants' Notice of Prior Art Pursuant To 35 U.S.C. § 282 in Civil Action No. 2:18-cv-07090-CAS-GJS dated Feb. 28, 2020. 7 pages.
Defendant AMP Plus, Inc.'s Opposition to DMF's Motion for Summary Judgement in Civil Action No. 2:18-cv-07090-CAS-GJS filed Feb. 10, 2020. 32 pages.
Declaration of Eric Bretschneider, Ph.D In Support of Amp Plus, Inc.'s Opposition to Dmf, Inc.'s Motion for Partial Summary Judgment in Civil Action No. 2:18-cv-07090-CAS-GJS filed Feb. 10, 2020. 210 pages.
Plaintiff DMF's Reply in Support of Motion For Partial Summary Judgment in Civil Action No. 2:18-cv-07090-CAS-GJS filed Feb. 18, 2020. 33 pages.
Declaration of James R. Benya in Support of Plaintiff DMF's Motion for Summary Judgment in Civil Action No. 2:18-cv-07090-CAS-GJS filed Feb. 3, 2020. 193 pages.
Underwriters Laboratories Inc. Standard for Safely. UL 1598. Luminaires Jan. 11, 2020. 12 pages.
Exceptional LED Lighting Technology Product Portfolio. LightingScience 2012. 11 pages.
"Cree LMH2 LED Modules," Mouser Electronics. Sep. 9, 2012. 4 pages.
Slim Line Disc. EYE LEDs Specification Sheet 2012. 2 pages.
HiBay LED Heat Sink. Wakefield-vette. Dec. 11, 2017. 1 pages.
Thermal Management of Cree® XLamp® LEDs. Cree Application Note. 2004. 19 pages.
Imtra Marine Lighting Fall 2007 Catalog. 32 pages.
Notice of Allowance dated Sep. 16, 2021 from U.S. Appl. No. 16/779,865, 9 pages.
Non-Final Office Action dated Oct. 18, 2021 from U.S. Appl. No. 29/696,830, 8 pages.
Notice of Allowance dated Nov. 3, 2021 from U.S. Appl. No. 17/220,779, 7 pages.
Notice of Allowance dated Nov5, , 2021 1 from U.S. Appl. No. 17/318,193, 11 pages.
Non-Final Office Action datefd Nov. 5, 2021 from U.S. Appl. No. 17/379,748, 8 pages.
Notice of Allowance dated Nov. 8, 2021 1 from U.S. Appl. No. 29/764,875, 5 pages.
Non-Final Office Action dated Nov. 15, 2021 from U.S. Appl. No. 17/374,674, 7 pages.
Final Office Action dated Nov. 16, 2021 from U.S. Appl. No. 17/099,650,14 pages.
Notice of Allowance dated Nov. 22, 2021 from U.S. Appl. No. 29/694,475, 7 pages.
Notice of Allowance dated Nov. 24, 2021 from U.S. Appl. No. 17/234,421, 9 pages.
Non-Final Office Action dated Nov. 30, 2021 from U.S. Appl. No. 17/395,522, 28 pages.
Corrected Notice of Allowance dated Dec. 10, 2021 from U.S. Appl. No. 17/234,421, 2 pages.
Non-Final Office Action dated Dec. 13, 2021 from U.S. Appl. No. 29/711,198, 8 pages.
Corrected Notice of Allowance dated Jan. 11, 2022 from U.S. Appl. No. 29/694,475, 2 pages.
Corrected Notice of Allowance dated Jan. 12, 2022 from U.S. Appl. No. 16/779,865, 9 pages.
Non-Final Office Action mdated Jan. 21, 2022 from U.S. Appl. No. 17/229,668, 5 pages.
Notice of Allowance from U.S. Appl. No. 17/379,748 dated Feb. 16, 2022, 5 pages.
"12 Pack" reference by Hykolity on Amazon.com, date first available Nov. 7, 2019 [online], available from internet URL: https://www.amazon.com/dp/B081655CDL/ref=cm_sw_em_r_mt_dp_8NAZD4R3MTTP59290SG3?_encoding=UTF8&th=1 (Year: 2019) (6 pages).
"HALO" reference by Amazon.com, date first available Aug. 4, 2017 [online], site visited Jan. 31, 2022, available from internet URL: https://www.amazon.com/dp/B074K234DL/ref=cm_sw_em_r_mt_dp_P7H78BZ413RNSQ55NVTR (Year: 2013) (6 pages).
"Juno Lighting" reference by Express Electric on Amazon.com, date first available Feb. 14, 2008 [online], site visited Jan. 31, 2022, available from internet URL: https://www.amazon.com/Juno-Lighting-TC44R-Retrofit-Downlight/dp/BOOOOD I2HT/ref=psdc_6355949011_t2_B078X1D488?th=1 (Year: 2008) (6 pages).
"Sunco Lighting" reference by Sunco Lighting on Amazon.com, date first available Sep. 21, 2018 [online], site visited Jan. 31, 2022, available from internet URL: https://www.amazon.com/Sunco-Lighting-Construction-Downlight-Electrician/dp/B07D92B5DL?th=1 (Year: 2018) (6 pages).
Non-Final Office Action dated Feb. 16, 2022 from U.S. Appl. No. 29/743,066, 6 pages.
Notice of Allowance dated Feb. 14, 2022 from U.S. Appl. No. 17/473,934, 9 pages.
Non-Final Office Action dated Feb. 25, 2022 from U.S. Appl. No. 17/384,564 28 pages.
Notice of Allowance dated Mar. 11, 2022 from U.S. Appl. No. 17/118,742 13 pages.

* cited by examiner

| ITEM NO. | DESCRIPTION | Surface Slide/QTY. |
|---|---|---|
| 1 | | 2 |
| 2 | | 1 |
| 3 | | 6 |
| 4 | 4mm Ball Plunger (MACRON PN BP-005) | 3 |
| 5 | | 2 |
| 6 | | 1 |
| 7 | | 2 |
| 8 | | 2 |
| 9 | | 2 |
| 10 | | 1 |
| 11 | BJB LED Holder | 1 |
| 12 | CREE CXB1520 | 1 |
| 14 | Diffuser Lens | 1 |
| 15 | | 1 |
| 16 | DCD4 Lens Holder KESSLER | 1 |
| 17 | Kessler Lens Assembly | 1 |
| 18 | HEX LOUVRE ENVELOPE | 1 |
| 19 | Hex Louver Retaining Ring, Adjustable | 1 |
| 20 | Base Structure, 4 Inch Adjustable | 1 |
| 21 | Shield, 4 Inch Adjustable | 1 |
| 22 | Retainer, Adjustable | 1 |
| 23 | Rotation Ring, 4 Inch Adjustable | 1 |
| 24 | Head Sink Module, Adjustable Commercial | 1 |
| 25 | Heat Sink Arm | 1 |
| 26 | Rotation Lock, Adjustable | 1 |
| 27 | Secondary Shield Subassembly | 1 |
| 28 | | 1 |
| 29 | Heat Sink Arm, Right | 1 |
| 30 | Retainer, Adjustable | 1 |
| 31 | Push Bracket | 1 |
| 32 | Locking Nut, Adjustable | 1 |
| 33 | 2-pin DC Connector Assy, Male | 1 |

FIG. 11B

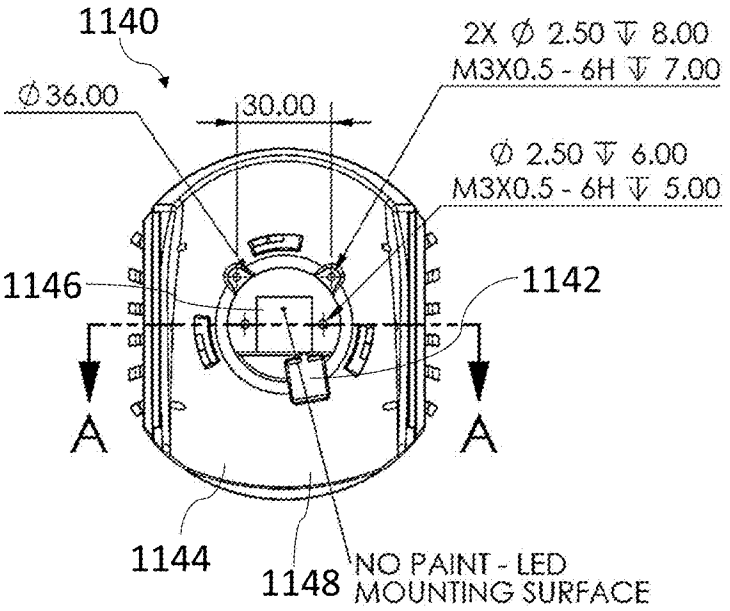
FIG. 12A
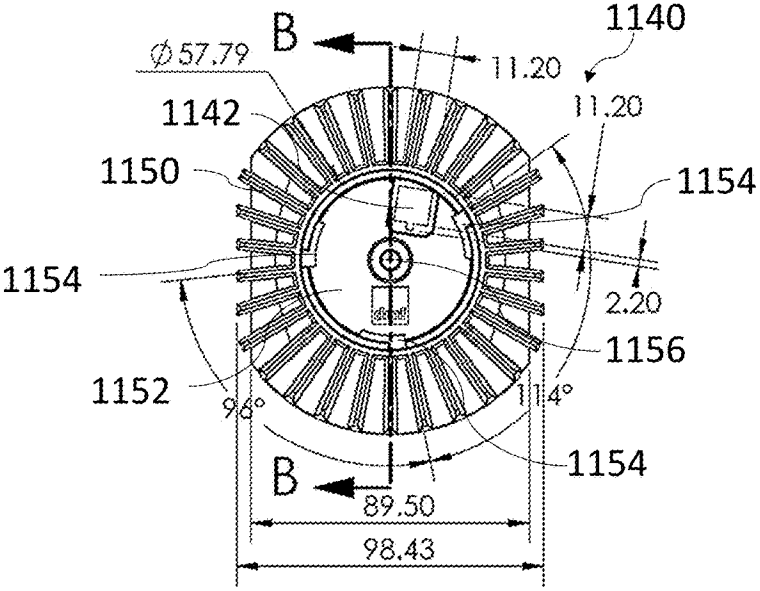
FIG. 12B
FIG. 12C
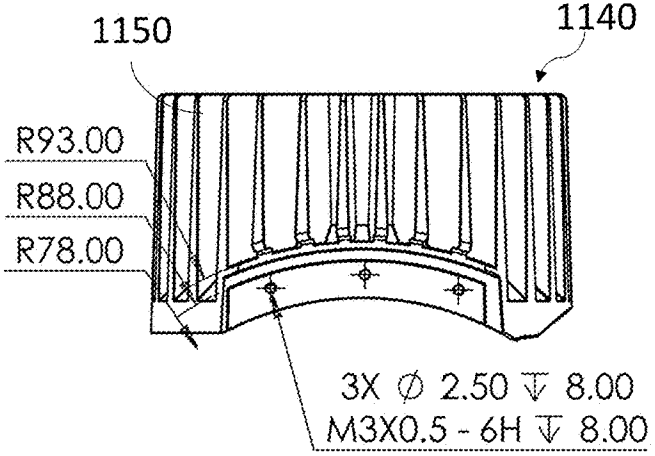
FIG. 12D

SECTION B-B

SECTION A-A

SECTION B-B

SECTION C-C

SECTION A-A

SECTION A-A

SECTION A-A

SECTION B-B

SECTION B-B

SECTION A-A

SECTION B-B

SECTION C-C

SECTION A-A

SECTION B-B

DETAIL C
SCALE 1 : 1

DETAIL A
SCALE 1 : 1

| ITEM NO. | DESCRIPTION | QTY. |
|---|---|---|
| 1 | | 2 |
| 2 | | 2 |
| 3 | | 2 |
| 4 | | 2 |
| 5 | | 2 |
| 6 | | 4 |
| 7 | | 2 |
| 8 | | 1 |
| 9 | | 1 |
| 10 | | 10 |
| 11 | | 1 |
| 12 | | 1 |
| 13 | 4mm Ball Plunger (MACRON PN BP-005) | 4 |
| 14 | | 2 |
| 15 | Base Structure, 4 Inch Adjustable | 1 |
| 16 | Shield, 4 Inch Adjustable | 1 |
| 17 | | 1 |
| 18 | | 1 |
| 19 | Rotation Ring, 4 Inch Adjustable | 1 |
| 20 | | 1 |
| 21 | | 1 |
| 22 | | 1 |
| 23 | Slider Plate, 4 Inch Adjustable | 1 |
| 24 | Quarter Turn Lock, 4 Inch Adjustable | 1 |
| 25 | | 1 |
| 26 | | 1 |

FIG. 31B

SECTION B-B

SECTION A-A

SECTION A-A

SECTION B-B

SECTION C-C

| ITEM NO. | DESCRIPTION | QTY. |
|---|---|---|
| 1 | | 2 |
| 2 | | 2 |
| 3 | | 4 |
| 4 | | 10 |
| 5 | Push Spring, Adjustable | 1 |
| 6 | 4mm Ball Plunger (MACRON PN BP-005) | 4 |
| 7 | | 2 |
| 8 | Threaded Pin, M3x0.5, 10mm | 2 |
| 9 | BJB 47.319.6105 LED COB holde | 1 |
| 10 | Red and Black, # Gauge, Solid or Strand, | 1 |
| 11 | CREE CXB1520 | 1 |
| 12 | | 1 |
| 13 | Khatod Optic Holder, 4 Inch Adjustable | 1 |
| 14 | | 1 |
| 15 | Base Structure, 4 Inch Adjustable | 1 |
| 16 | Shield, 4 Inch Adjustable | 1 |
| 17 | Retainer, Adjustable | 1 |
| 18 | Rotation Ring, 4 Inch Adjustable | 1 |
| 19 | Head Sink Module, Adjustable Commercial | 1 |
| 20 | Heat Sink Arm | 1 |
| 21 | Slider Plate, 4 Inch Adjustable | 1 |
| 22 | Rotation Lock, Adjustable | 1 |
| 23 | Secondary Shield, Adjustable | 1 |
| 24 | Quick Release Pin, Adjustable | 1 |
| 25 | Quick Release Lever, Adjustable | 1 |
| 26 | | 1 |
| 27 | Heat Sink Arm, Right | 1 |
| 28 | Retainer, Right | 1 |

FIG. 47B

SECTION A-A

SECTION B-B

SECTION B-B

SECTION C-C

SECTION A-A

SECTION C-C

DETAIL B
SCALE 1 : 1

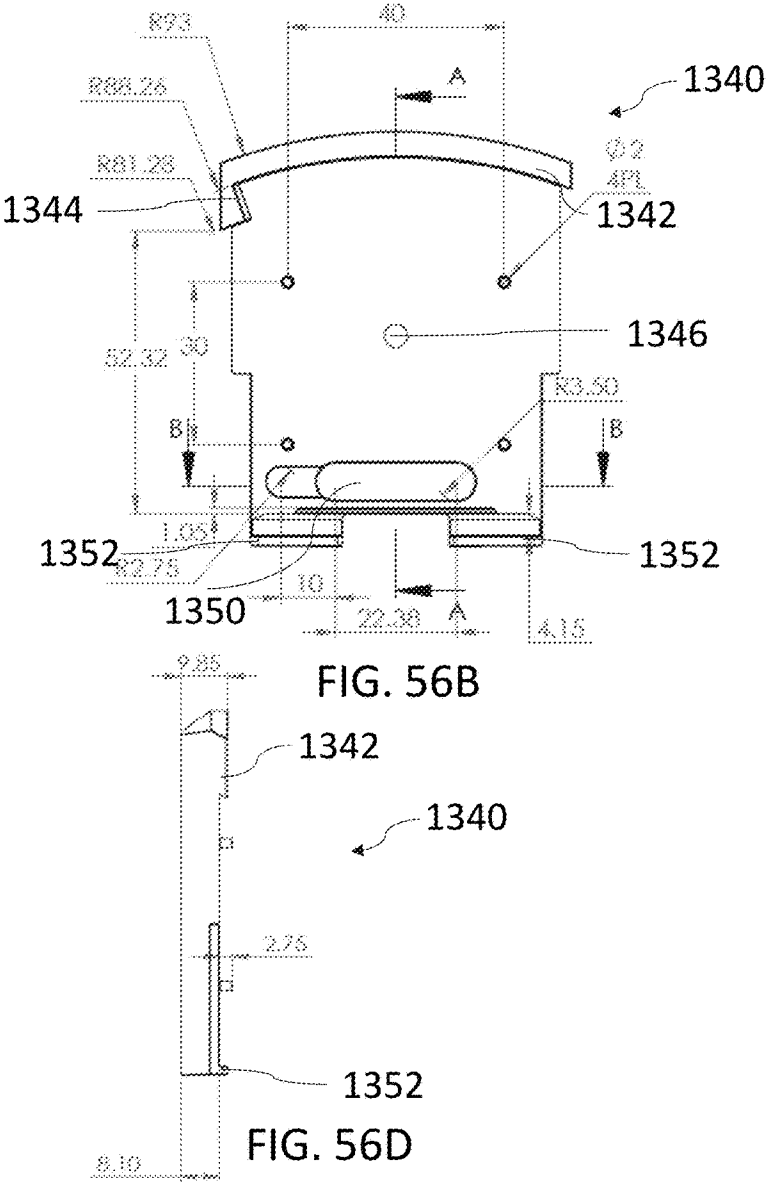
FIG. 56B
FIG. 56D
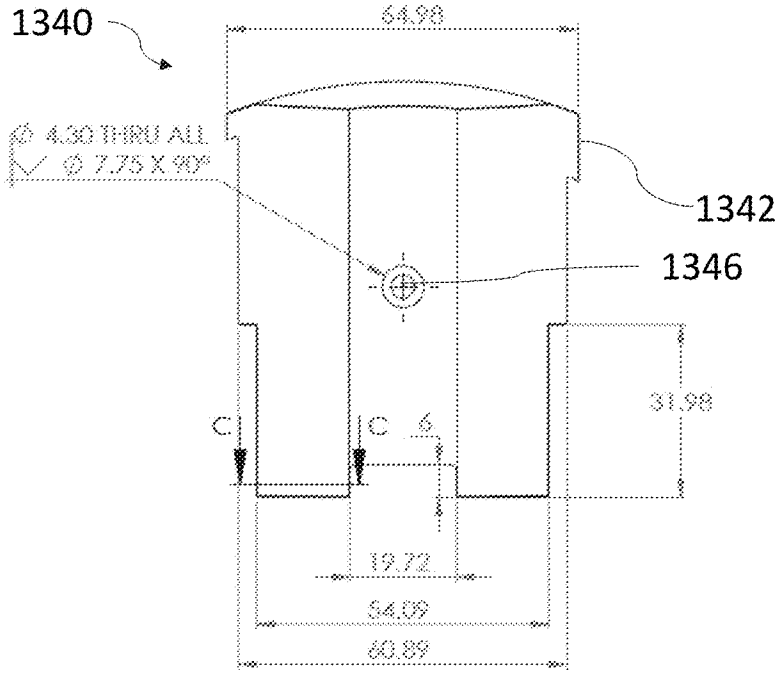
FIG. 56A
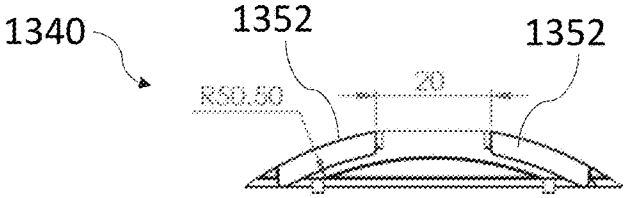
FIG. 56C

SECTION B-B

SECTION C-C

SECTION A-A

SECTION B-B

DETAIL C
SCALE 1 : 1

DETAIL A
SCALE 1 : 1

METHODS AND APPARATUS FOR ADJUSTING A LUMINAIRE

CROSS-REFERENCE TO RELATED APPLICATIONS

This application is a continuation application (CON) of U.S. application Ser. No. 16/690,970, filed Nov. 21, 2019, entitled "METHODS AND APPARATUS FOR ADJUSTING A LUMINAIRE," which claims priority to International PCT Application PCT/US2018/067614, filed Dec. 27, 2018, entitled "METHODS AND APPARATUS FOR ADJUSTING A LUMINAIRE," which claims priority to U.S. provisional application Ser. No. 62/610,864, filed Dec. 27, 2017, entitled "ADJUSTABLE LIGHT APPARATUS," and U.S. provisional application Ser. No. 62/728,451, filed Sep. 7, 2018, entitled "ADJUSTABLE LIGHT APPARATUS." Each of the aforementioned applications is incorporated by reference herein in its entirety.

BACKGROUND

Adjustable lighting fixtures provide users the ability to configure lighting conditions in an interior or exterior space by allowing the user to redirect light from the lighting fixture along a desired orientation. Typically, a light source is mechanically coupled to a housing such that the light source may rotate about one or more rotational axes relative to the housing. The housing in a conventional adjustable lighting fixture typically includes one or more openings shaped and dimensioned to accommodate the range of motion of the light source. Depending on the position of the light source, a portion of these openings may be exposed allowing users to see into a ceiling or a wall space. One common approach to prevent visibility through a portion of such a fixture to see into a ceiling or a wall space is to install a substantial enclosure around the light source and the lighting fixture to visually cover (or block) the openings in the housing. The inclusion of such an enclosure increases the overall size of the lighting fixture, which in turn can hinder or, in some instances, prevent the installation of an adjustable lighting fixture in a confined ceiling or wall space, such as in a multifamily housing environment.

Additionally, in some conventional adjustable lighting fixtures particularly intended for recessed lighting applications (e.g., in which the lighting fixture is recessed behind a wall or a ceiling in a built environment), the light source may be initially recessed with respect to a ceiling or a wall space when the lighting fixture is in a nominal centered position (e.g., substantially downlighting an area below a recessed lighting fixture installation in a ceiling). However, once the light source is rotated, a portion of the light source may protrude from the plane of the ceiling or the wall, which undermines the nature and intent of the recessed lighting fixture.

SUMMARY

The Inventors have recognized and appreciated that adjustable lighting fixtures offer users flexibility in reconfiguring lighting conditions in order to meet personal preferences. However, the Inventors have also recognized and appreciated that conventional recessed adjustable lighting fixtures typically provide adjustment at the expense of aesthetic quality and/or installation into confined ceiling or wall spaces. In particular, for conventional adjustable lighting fixtures, especially recessed adjustable lighting fixtures, the Inventors have recognized and appreciated that the manner in which mechanical adjustment of the light source is provided detrimentally affects the aesthetic quality of the lighting fixture and the form factor of the lighting fixture.

The present disclosure is thus directed to various inventive apparatus and methods for adjusting an orientation of a light source. In some implementations, an adjustable lighting apparatus includes a lighting module and an adjustable mount. The lighting module includes a light source to emit light and at least one motion track. The lighting module rotates about a first rotation axis relative to the adjustable mount. The adjustable mount includes a first cavity that substantially surrounds the light source, a first opening that is aligned proximate to and, in some instances, abuts the lighting module, and a second opening through which light from the light source passes through. The adjustable mount also includes one or more slots defining one or more translation axes. The adjustable mount also includes at least one motion rail that is slidable relative to the at least one motion track. The first rotation axis intersects a first translation axis from the one or more translation axes. The at least one motion track and the at least one motion rail cause the lighting module to translate along the first translation axis when rotating about the first rotation axis. The adjustable mount also includes a shield, disposed, at least in part, inside the first cavity of the adjustable mount, with a second cavity that substantially surrounds the light source. The shield has a rotation slot through which the light source is coupled to the heat sink in the lighting module. The shield is coupled to the lighting module and the adjustable mount such that the shield translates with the lighting module along only the first translation axis when the lighting module rotates about the first rotation axis.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIG. 11B is a table showing the various parts of the lighting assembly shown in FIG. 11A.

FIG. 12A is a bottom view of a heat sink of an adjustable lighting apparatus, according to an implementation.

FIG. 12B is a top view of the heat sink shown in FIG. 12A.

FIG. 12C is a rear view of the heat sink shown in FIG. 12A.

FIG. 12D is a right view of the heat sink shown in FIG. 12A.

FIG. 27D is a top, front, right perspective view of the rotation ring shown in FIG. 27A.

FIG. 27E is a cross-sectional view of the rotation ring shown in FIG. 27A along the plane A-A.

FIG. 27F is a magnified view of the rotation ring shown in FIG. 27B in inset B.

FIG. 28A is a right view of a rotation lock of an adjustable lighting apparatus, according to an implementation.

FIG. 28B is a top view of the rotation lock shown in FIG. 28A.

FIG. 28C is a top, right perspective view of the rotation lock shown in FIG. 28A.

FIG. 29A is a right side view of an adjustable lighting apparatus, according to an implementation.

FIG. 29B is a right side view of the adjustable lighting apparatus shown in FIG. 29A in a rotated state.

FIG. 29C is a right side, cross-sectional view of the adjustable lighting apparatus shown in FIG. 29A.

FIG. 29D is a right side, cross-sectional view of the adjustable lighting apparatus shown in FIG. 29B.

FIG. 29E is a first left side, cross-sectional view of an adjustable lighting apparatus, according to an implementation.

FIG. 29F is a first left side, cross-sectional view of the adjustable lighting apparatus shown in FIG. 29E in a rotated state.

Figure 29A:
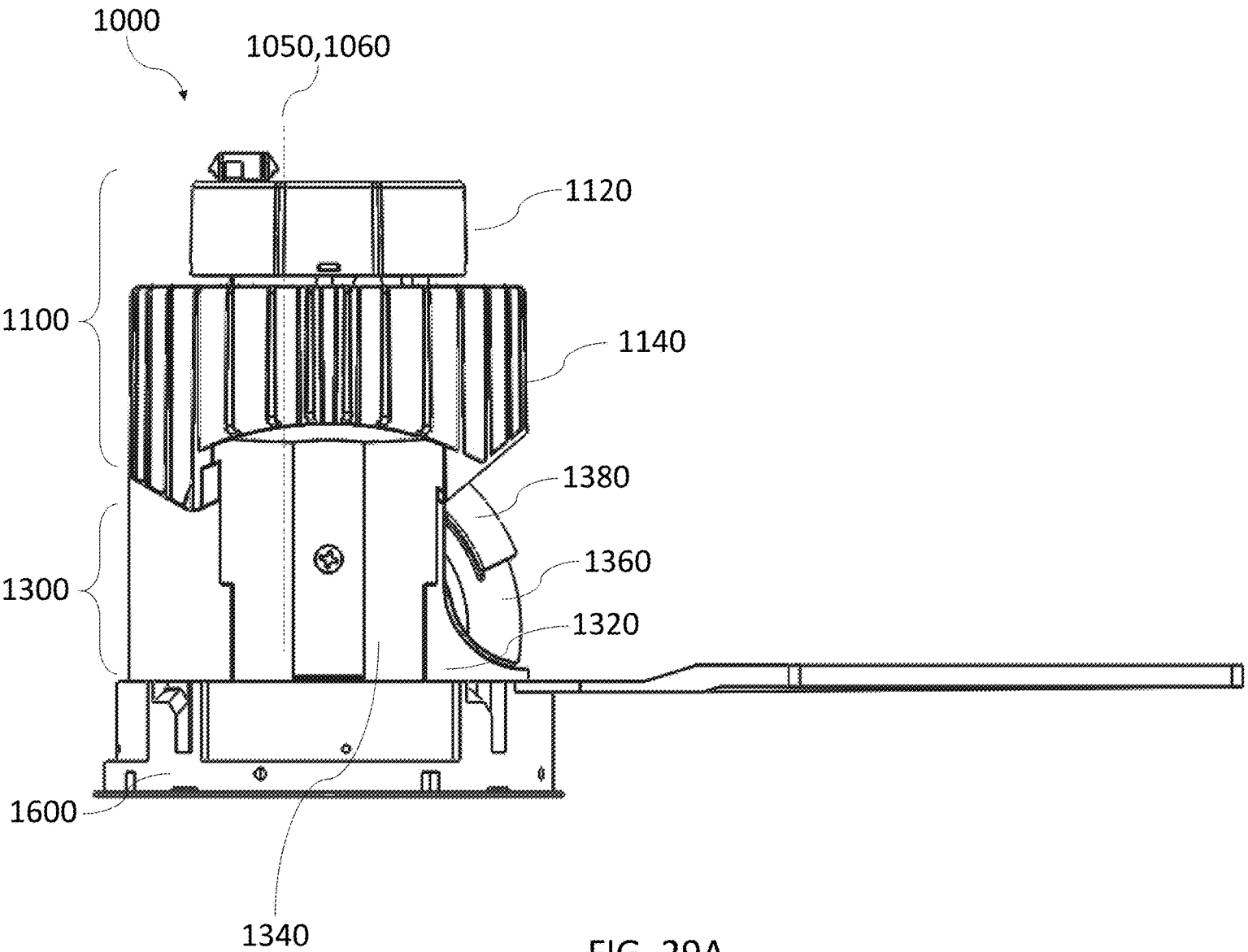
Figure 29B:
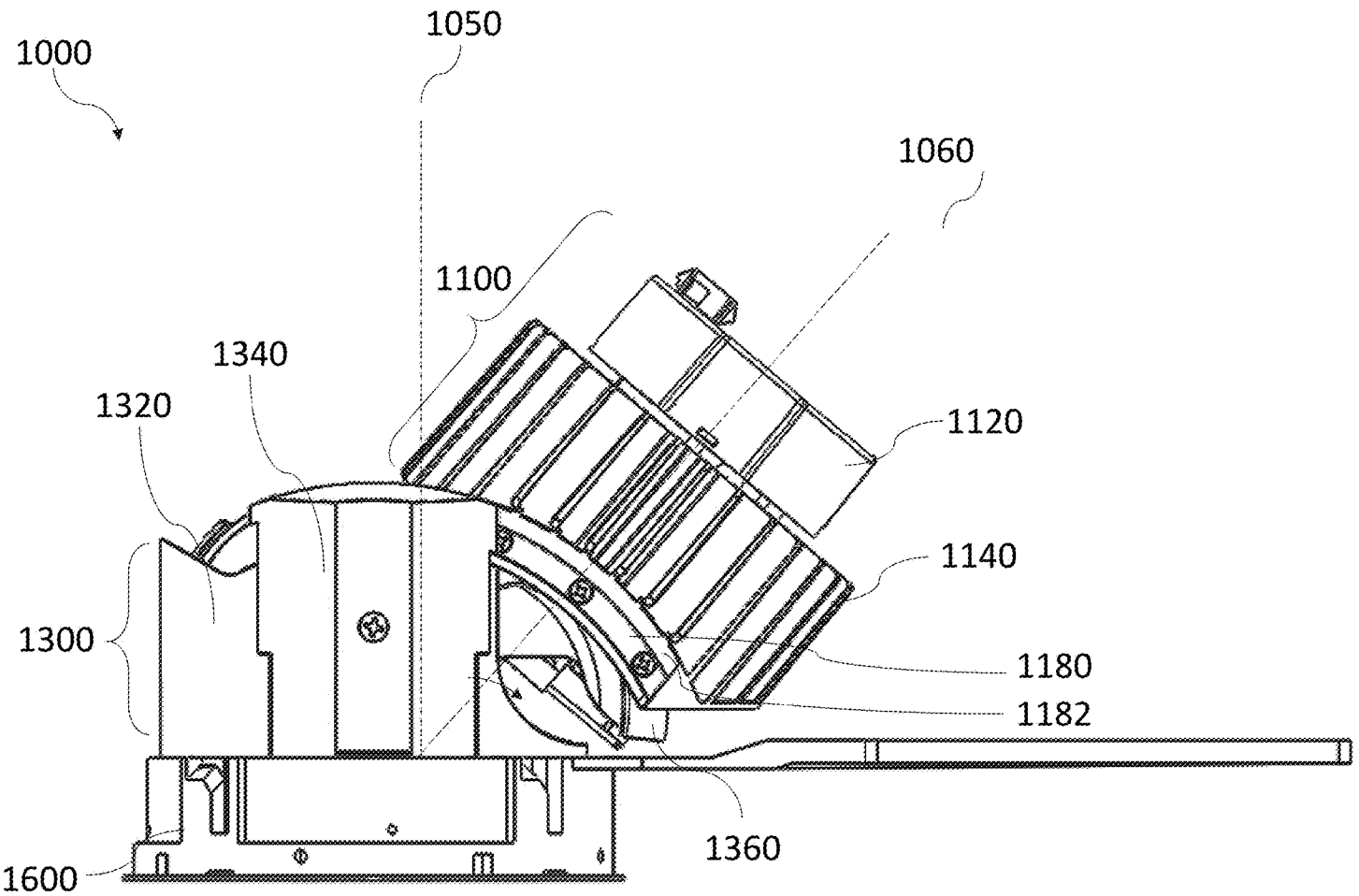
Figure 29C:
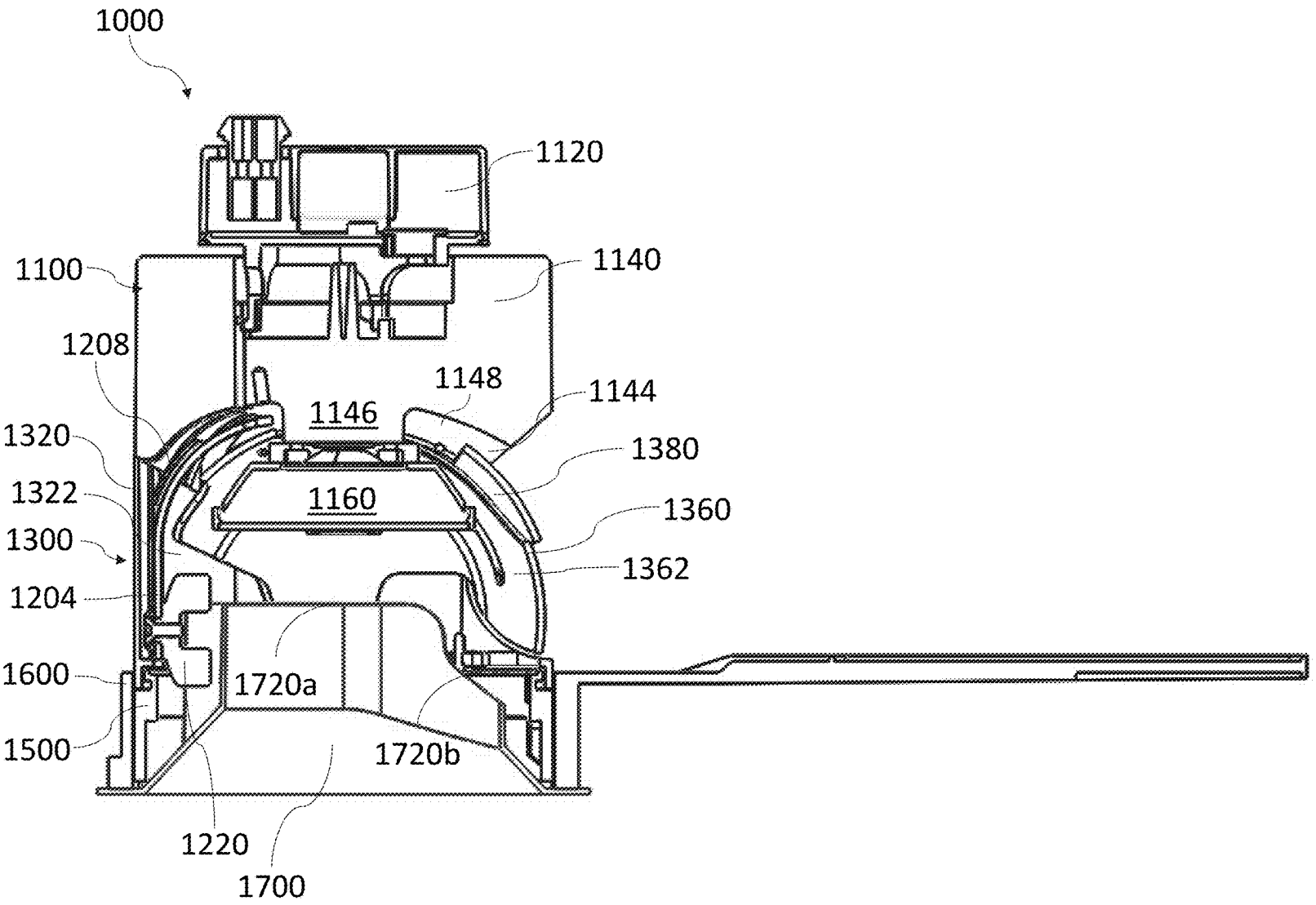
Figure 29D:
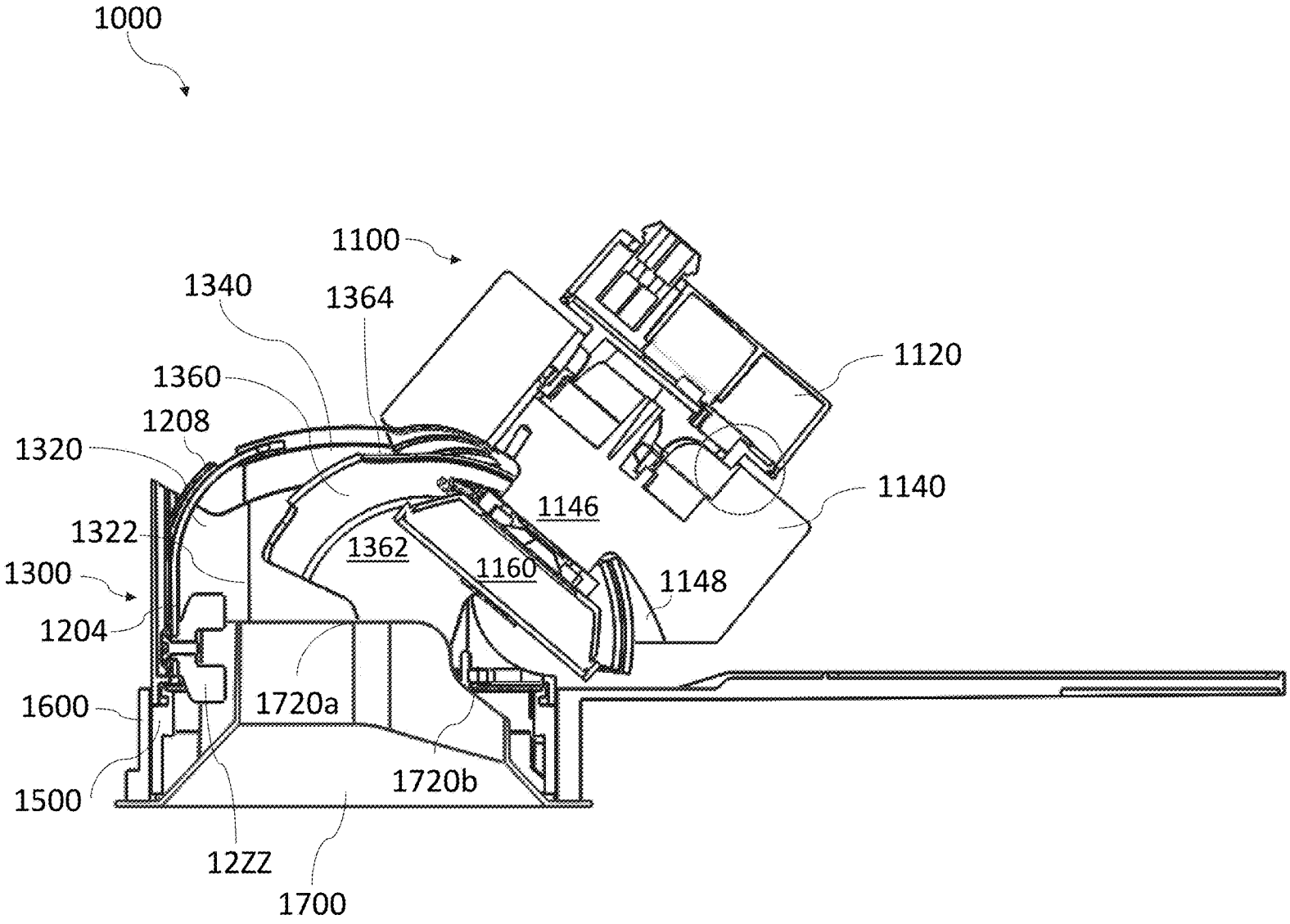
Figure 29E:
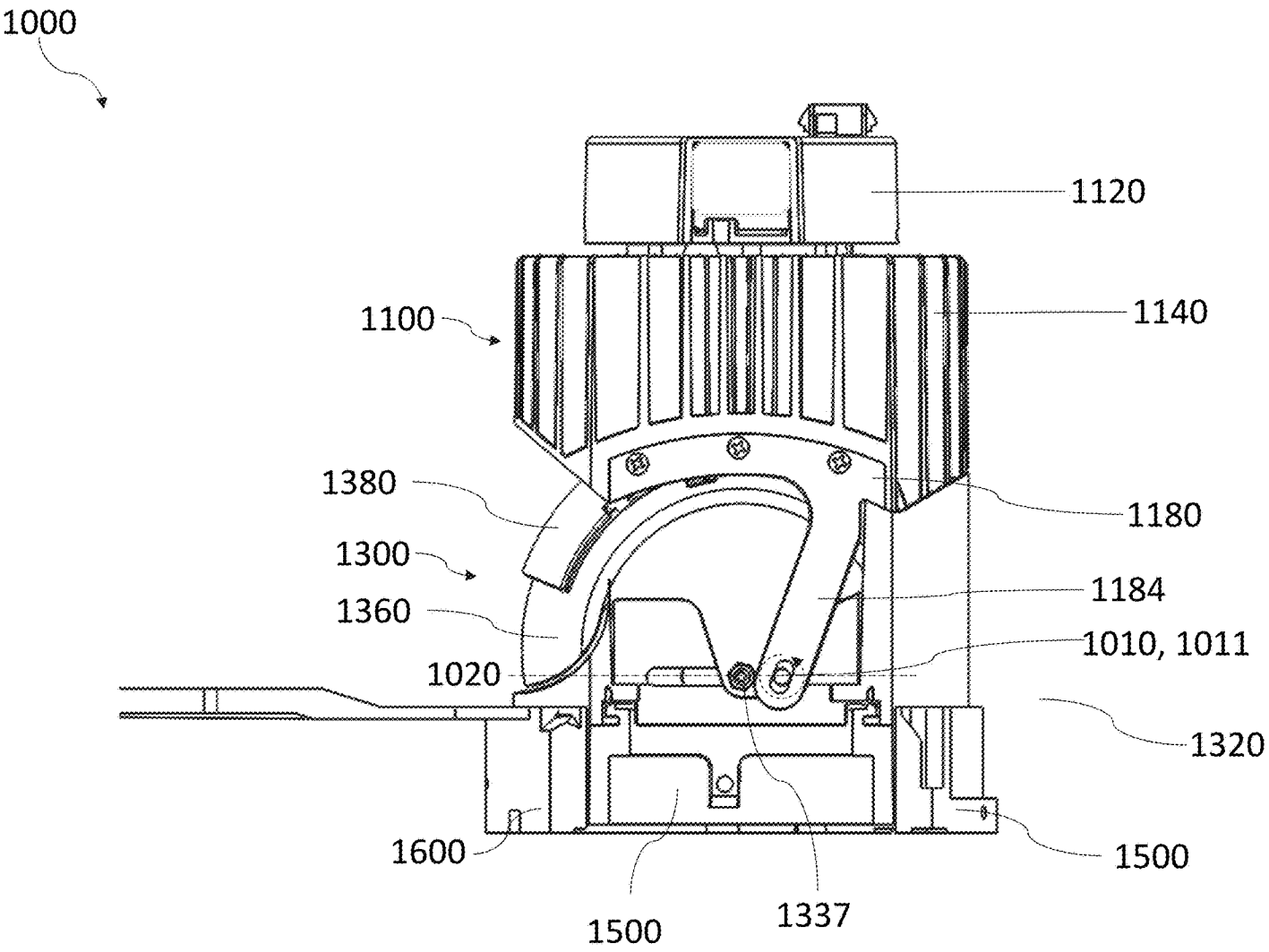
Figure 29F:
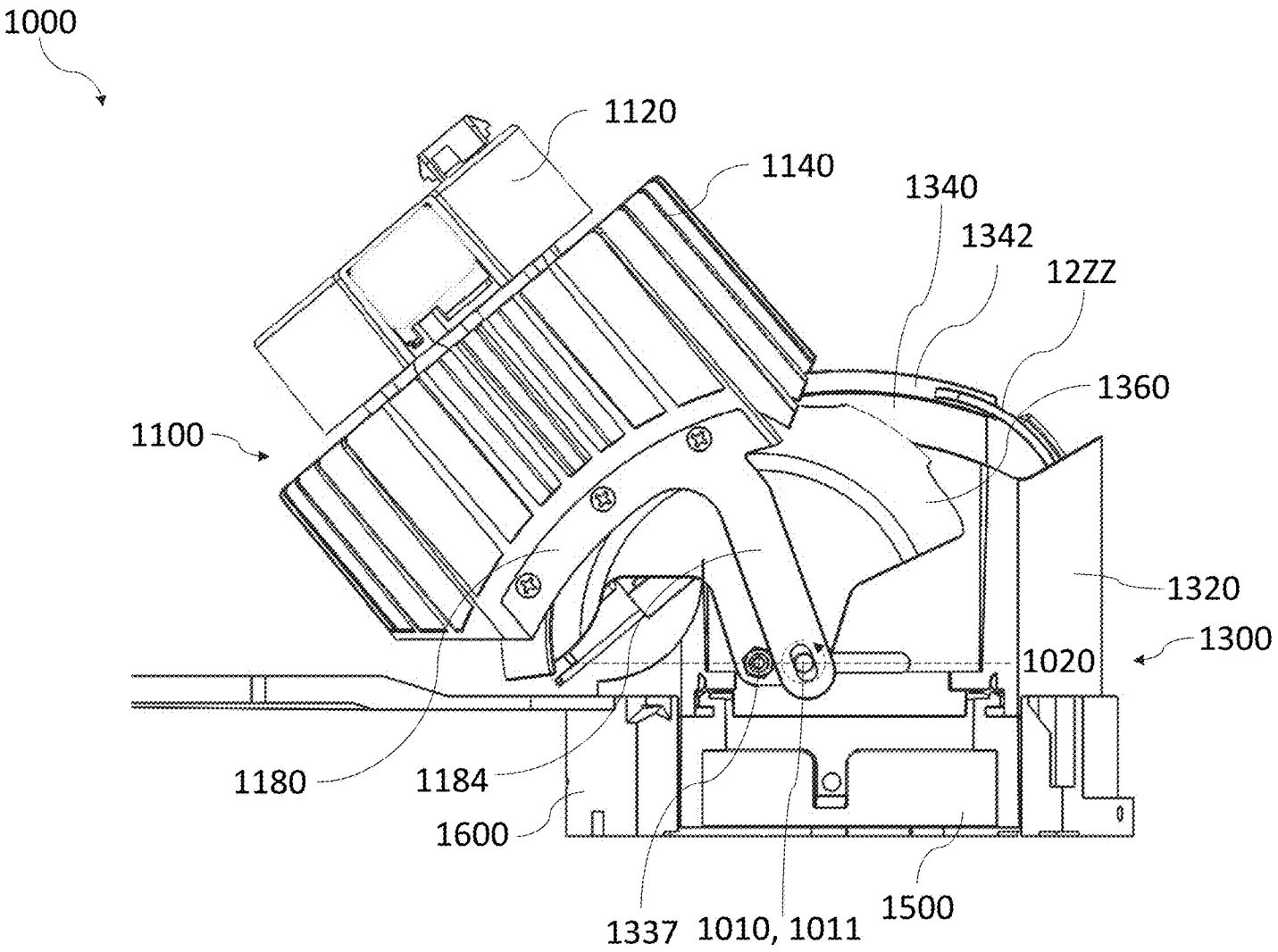
Figure 29G:
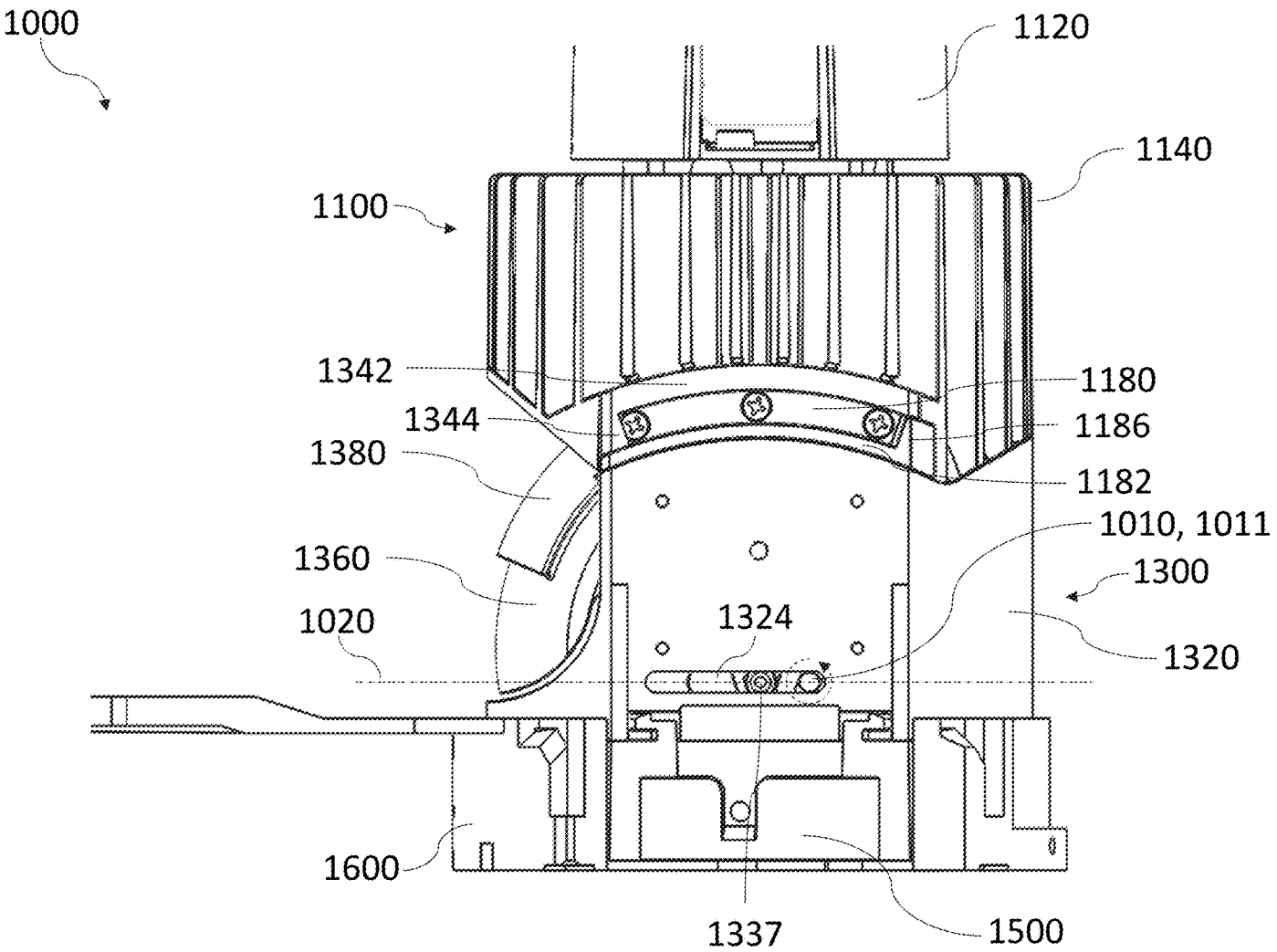

FIG. 29G is a second left side, cross-sectional view of the adjustable lighting apparatus shown in FIG. 29E.

Figure 29H:
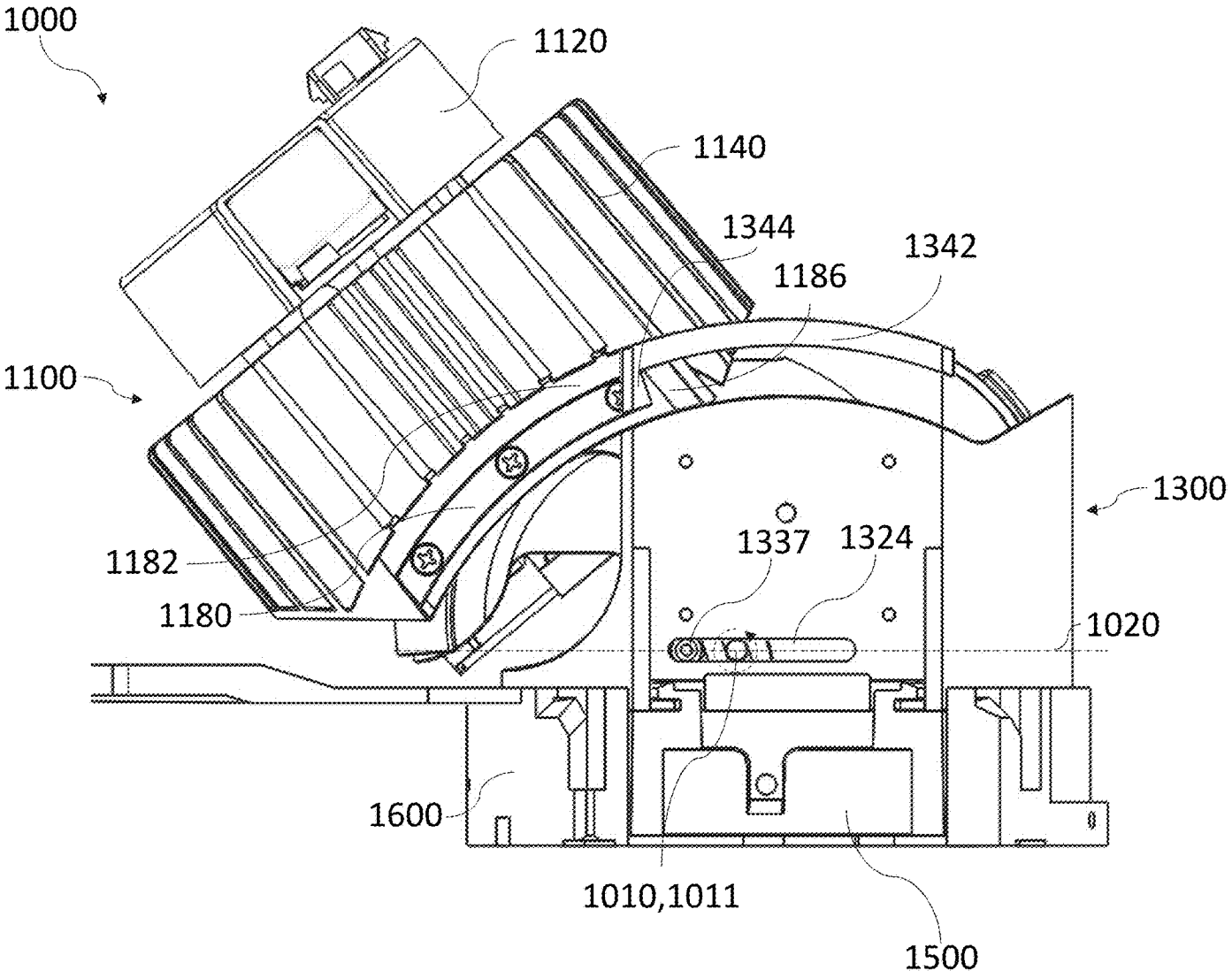

FIG. 29H is a second left side, cross-sectional view of the adjustable lighting apparatus shown in FIG. 29F.

Figure 29J:
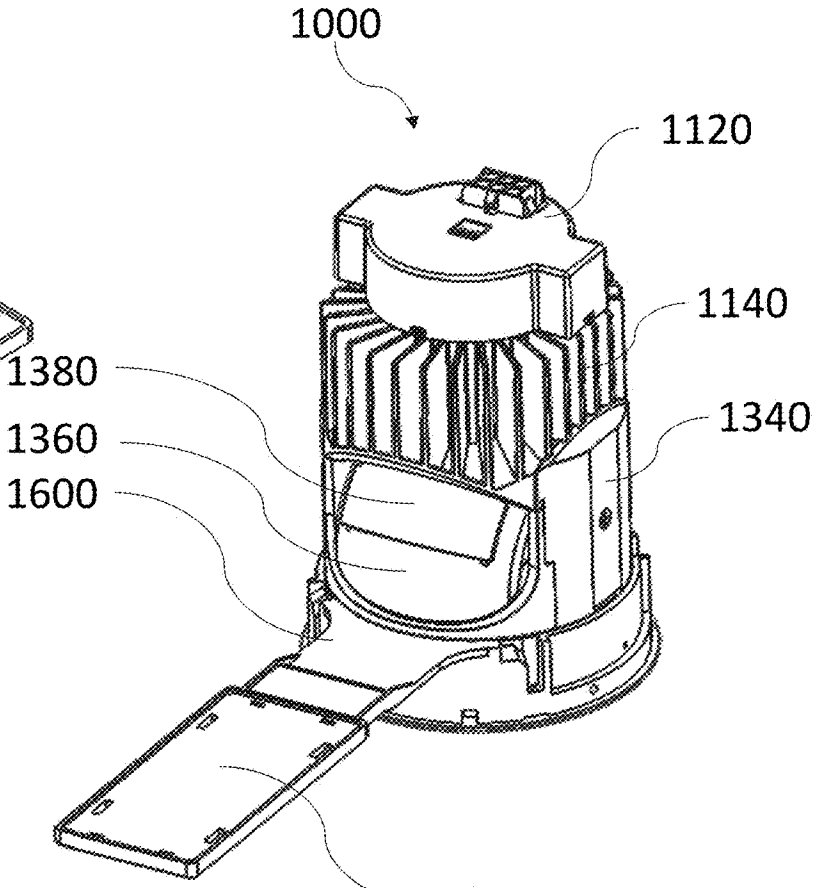
Figure 29I:
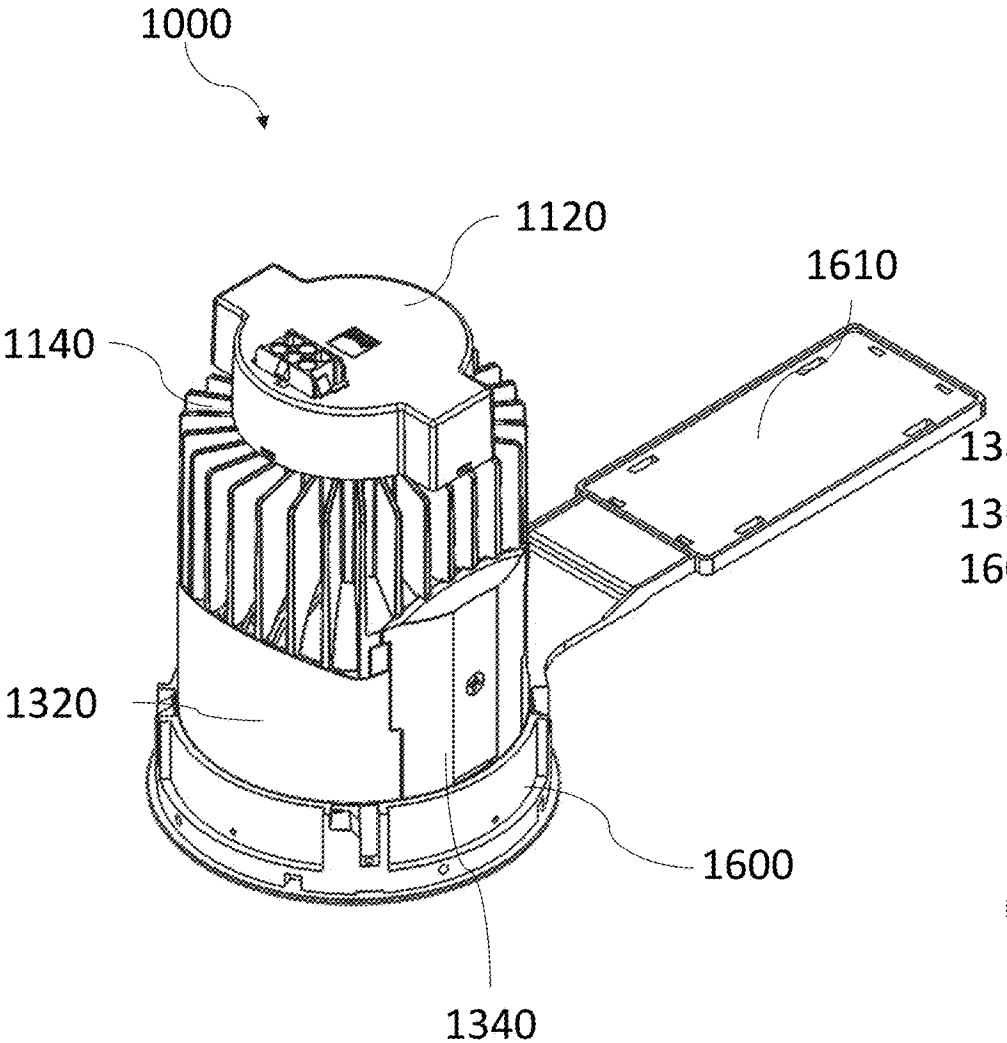

FIG. 29I is a top, rear perspective view of an adjustable lighting apparatus, according to an implementation.

FIG. 29J is a top, front perspective view of the adjustable lighting apparatus shown in FIG. 29I.

Figure 29L:
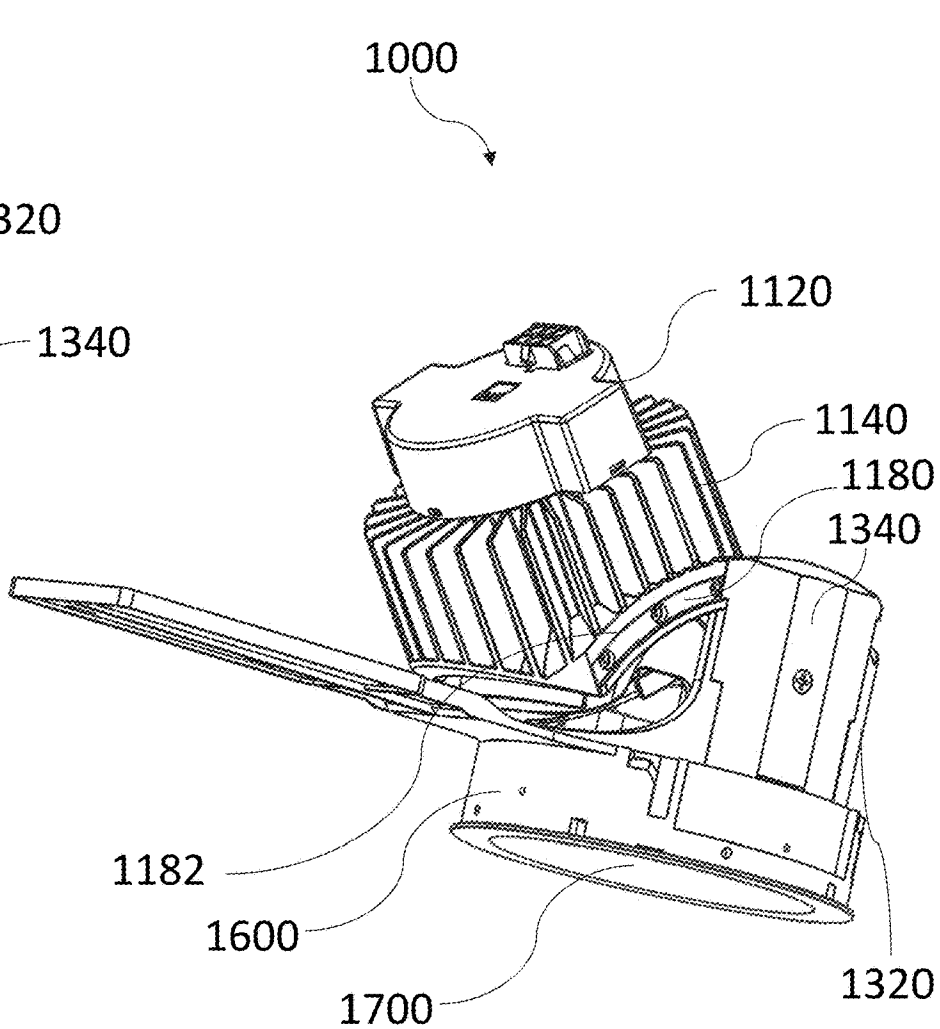
Figure 29K:
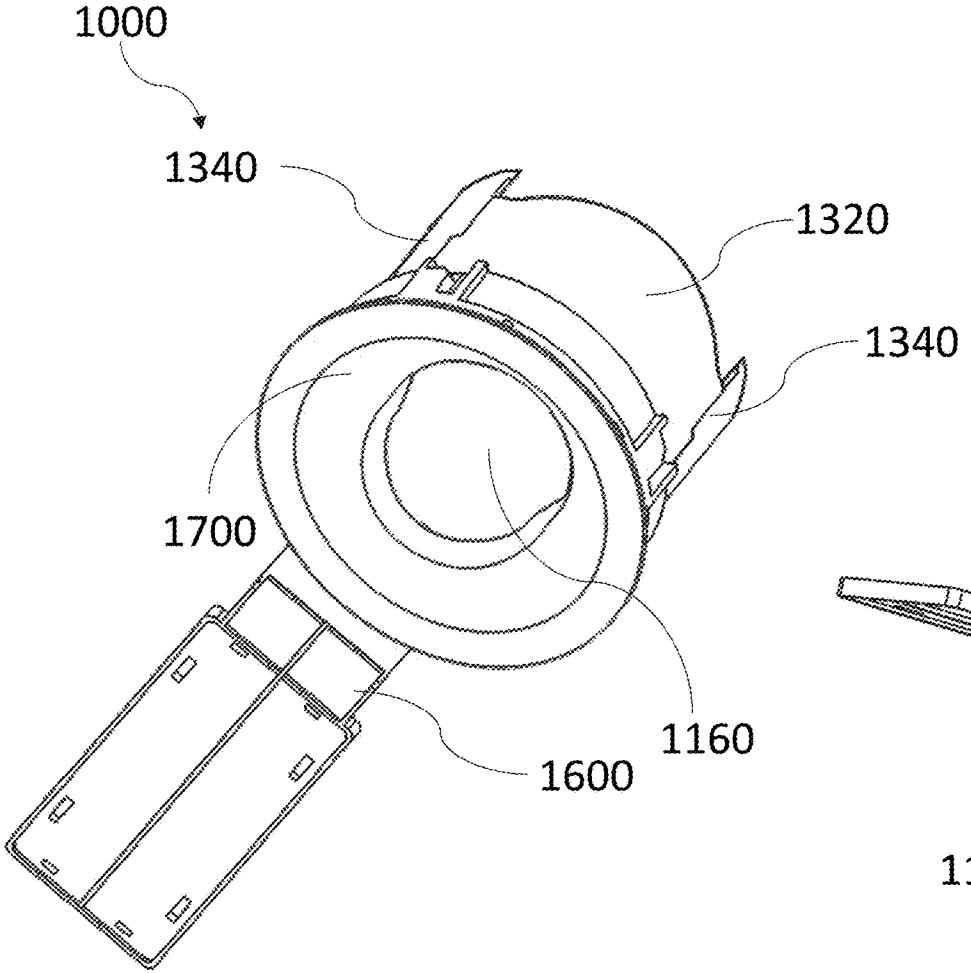

FIG. 29K is a bottom view of the adjustable lighting apparatus shown in FIG. 29I in a rotated state.

FIG. 29L is a bottom, front, left perspective view of the adjustable lighting apparatus shown in FIG. 29K.

Figure 30A:
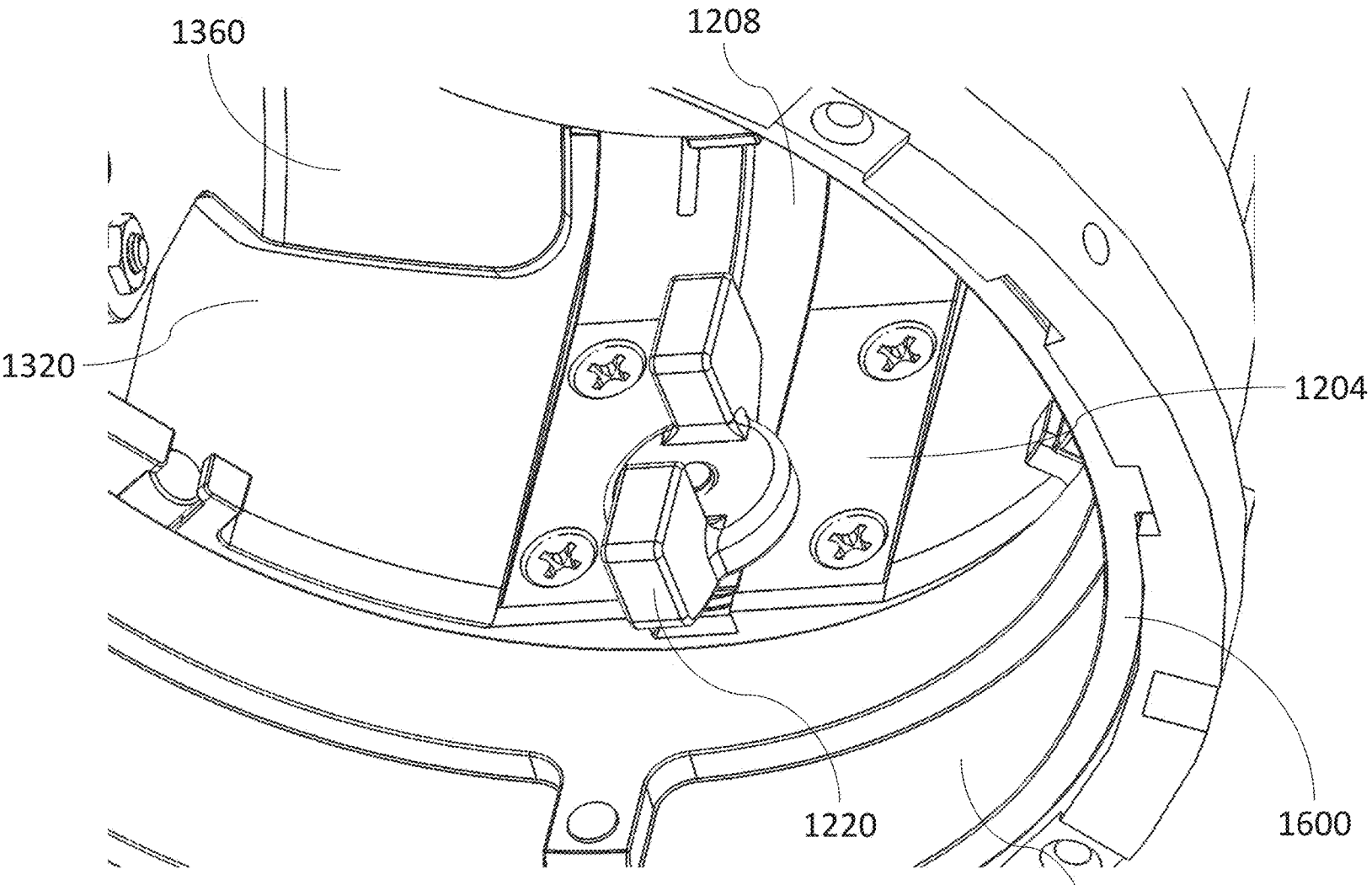

FIG. 30A is a bottom perspective interior view of an adjustment device and an adjustment slot of an adjustable lighting apparatus, according to an implementation.

Figure 30B:
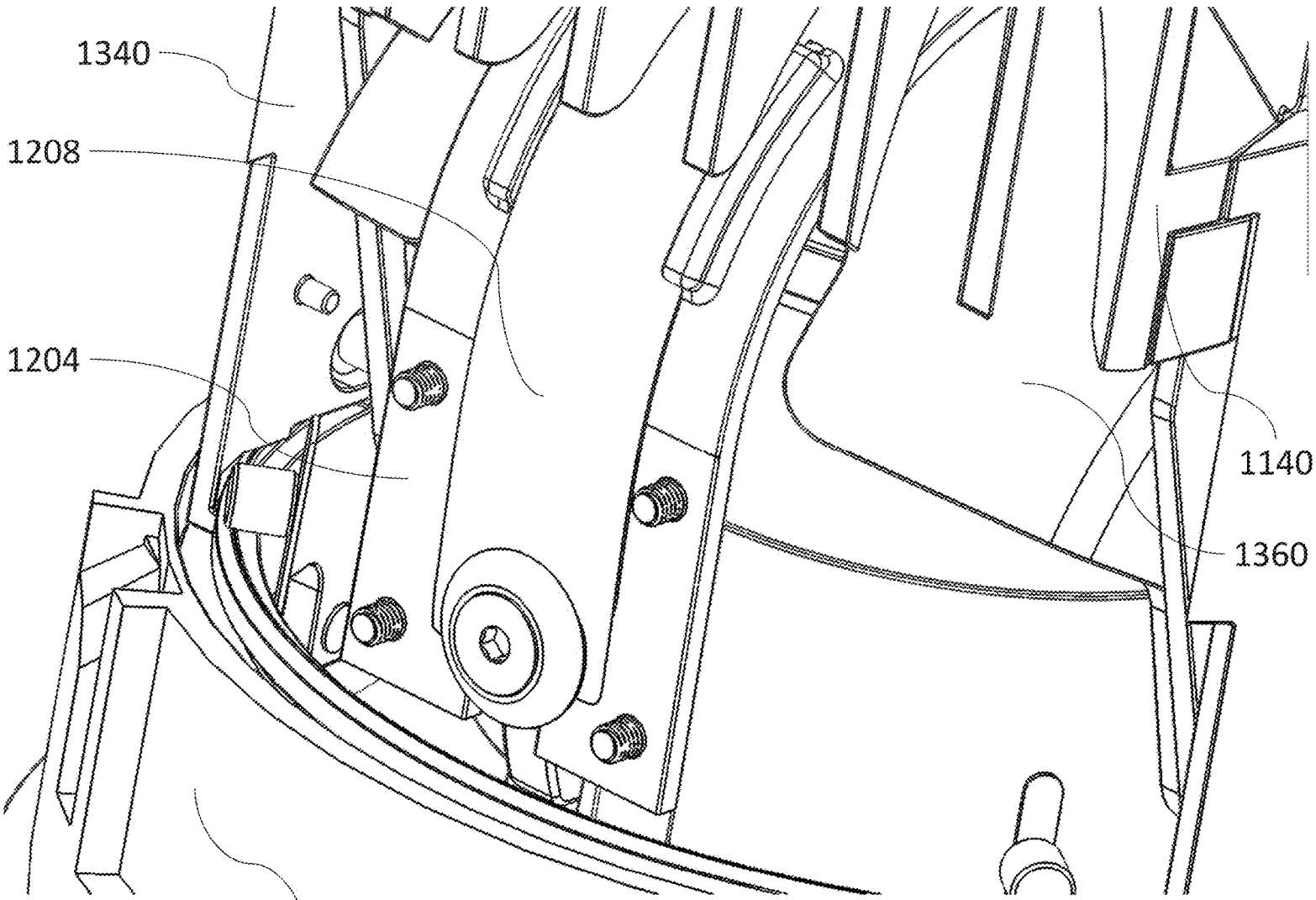

FIG. 30B is a top perspective exterior view of the adjustment device and the adjust slot shown in FIG. 30A.

Figure 31A:
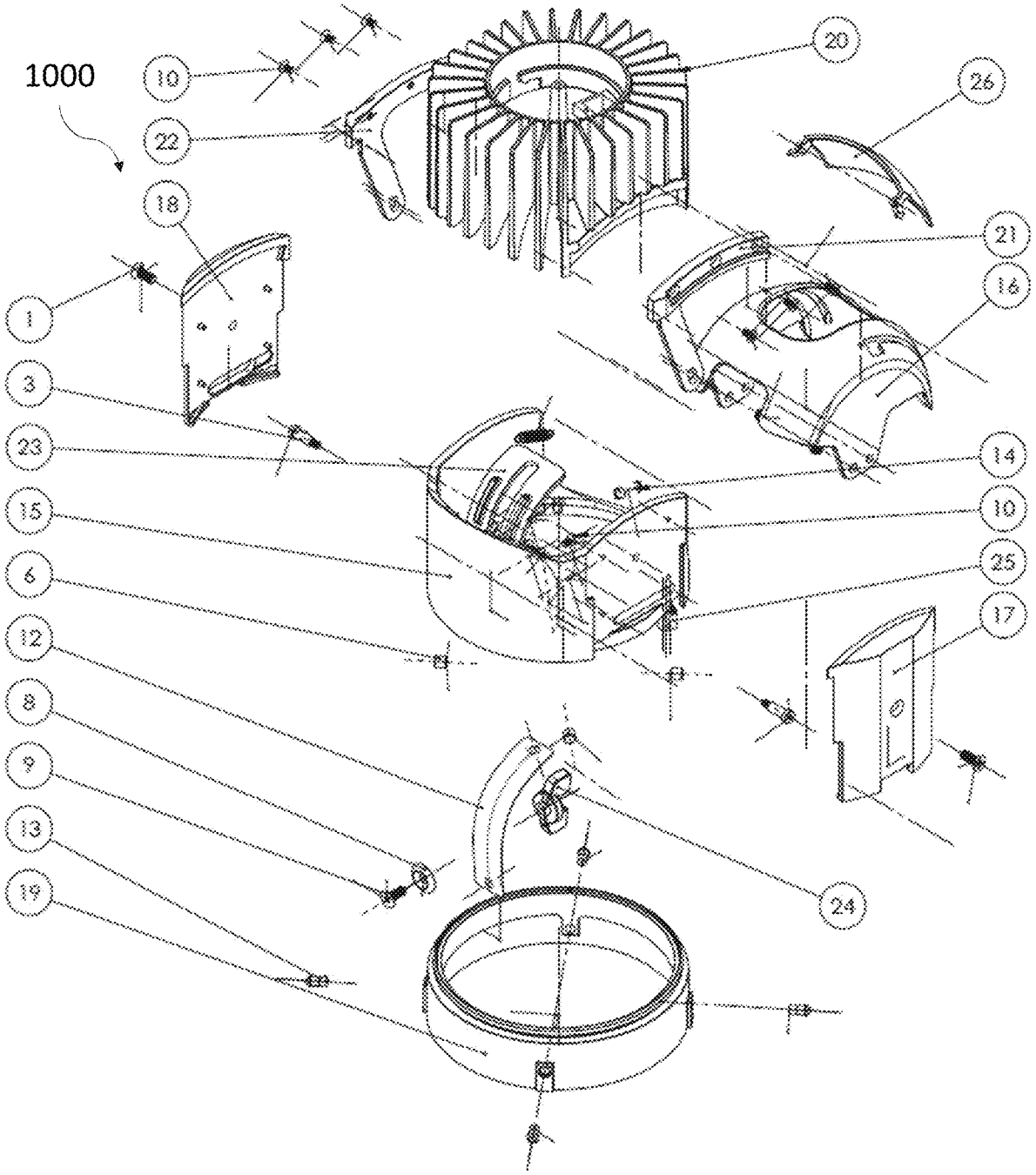

FIG. 31A is an exploded view of an adjustable lighting apparatus, according to an implementation.

FIG. 31B is a table showing the various parts of the adjustable lighting apparatus shown in FIG. 31A.

Figure 32B:
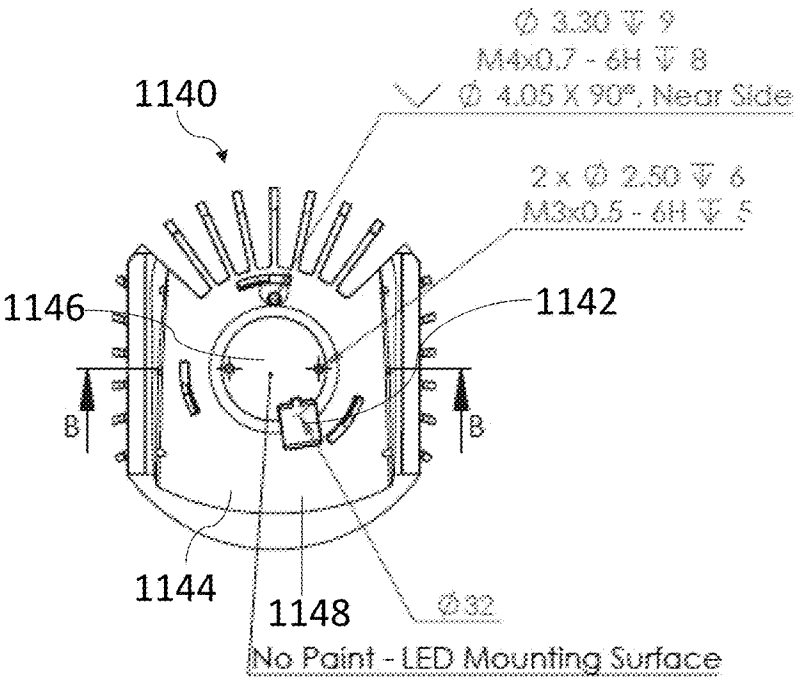
Figure 32D:
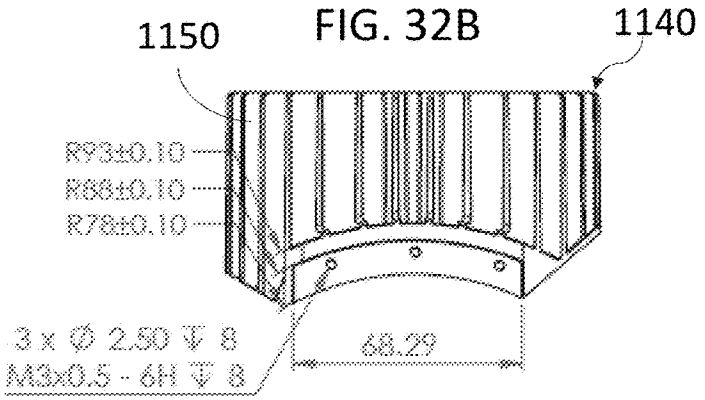
Figure 32A:
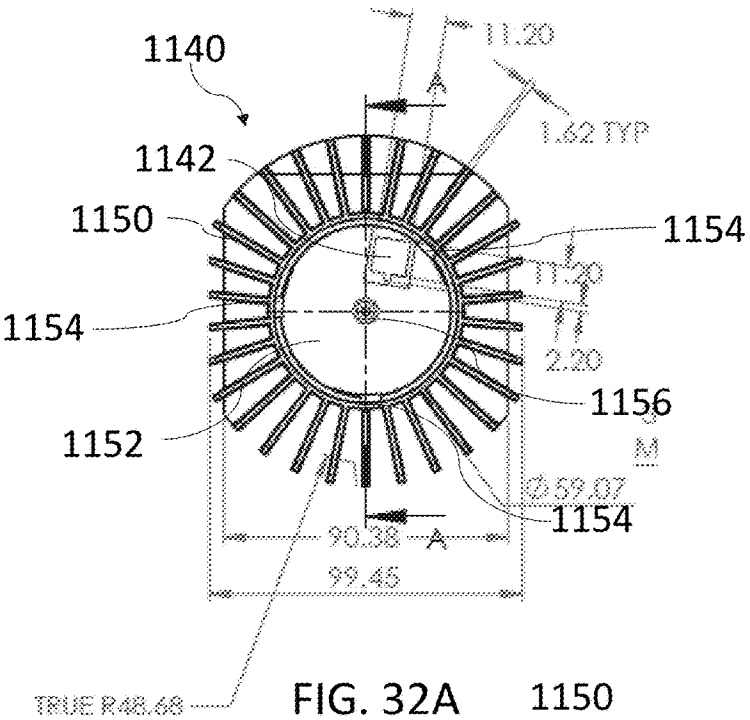

FIG. 32A is a top view of a heat sink of an adjustable lighting apparatus, according to an implementation.

FIG. 32B is a bottom view of the heat sink shown in FIG. 32A.

Figure 32C:
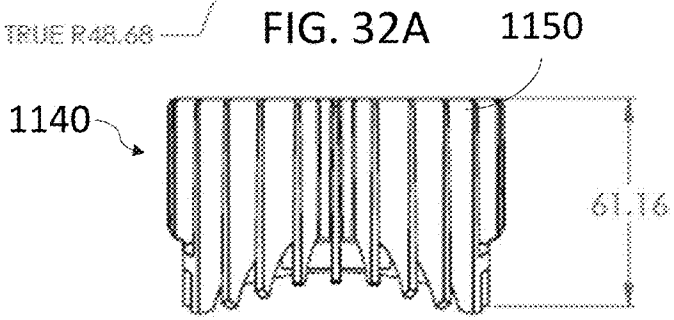

FIG. 32C is a front view of the heat sink shown in FIG. 32A.

FIG. 32D is a right side view of the heat sink shown in FIG. 32A.

Figure 32F:
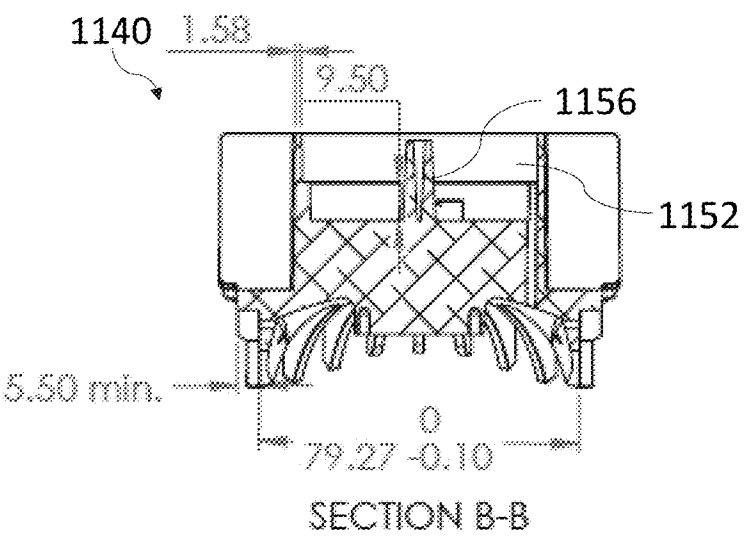
Figure 32E:
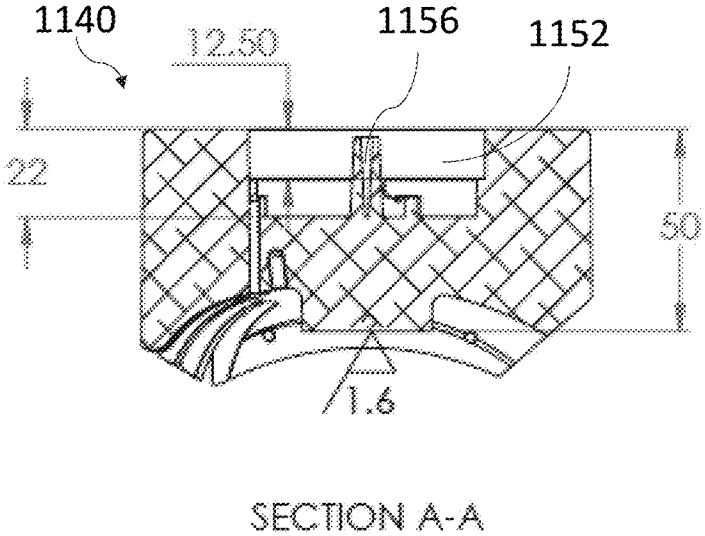

FIG. 32E is a cross-sectional view of the heat sink shown in FIG. 32A along the plane A-A.

FIG. 32F is a cross-sectional view of the heat sink shown in FIG. 32B, along the plane B-B.

Figure 32G:
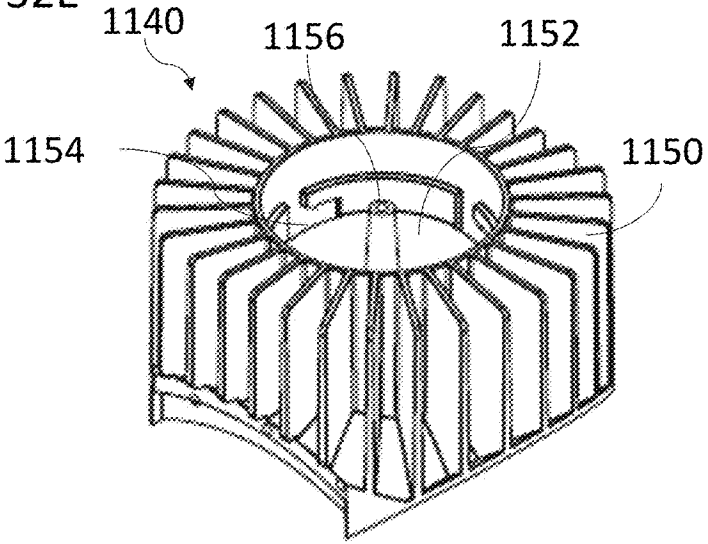

FIG. 32G is a top, front, right perspective view of the heat sink shown in FIG. 32A.

Figure 33B:
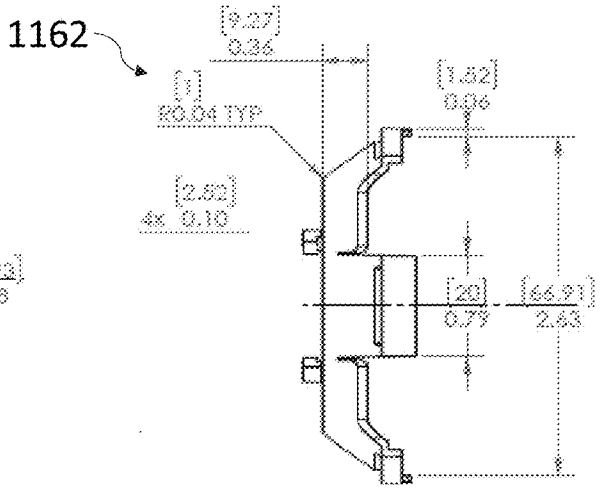
Figure 33D:
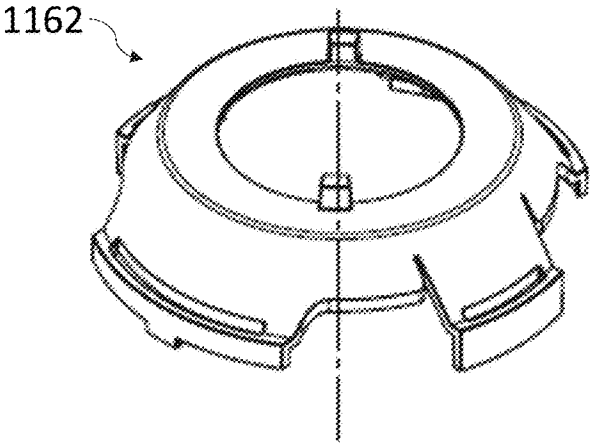
Figure 33A:
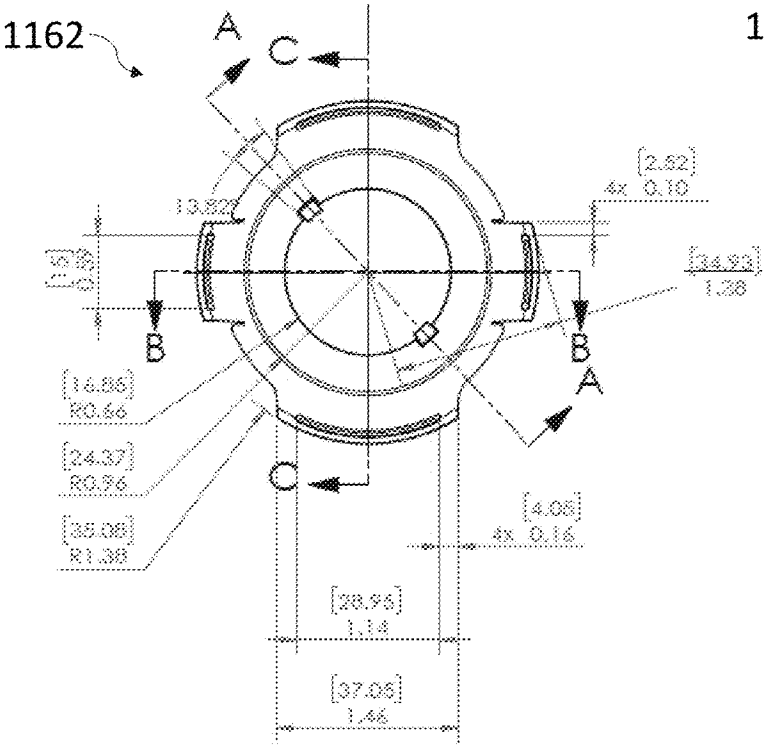

FIG. 33A is a top view of an optic holder of an adjustable lighting apparatus, according to an implementation.

FIG. 33B is a right side view of the optic holder shown in FIG. 33A.

Figure 33C:
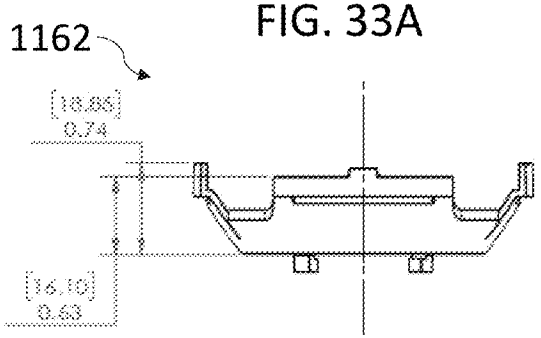

FIG. 33C is a front view of the optic holder shown in FIG. 33A.

FIG. 33D is a top, front, right perspective view of the optic holder shown in FIG. 33A.

Figure 33F:
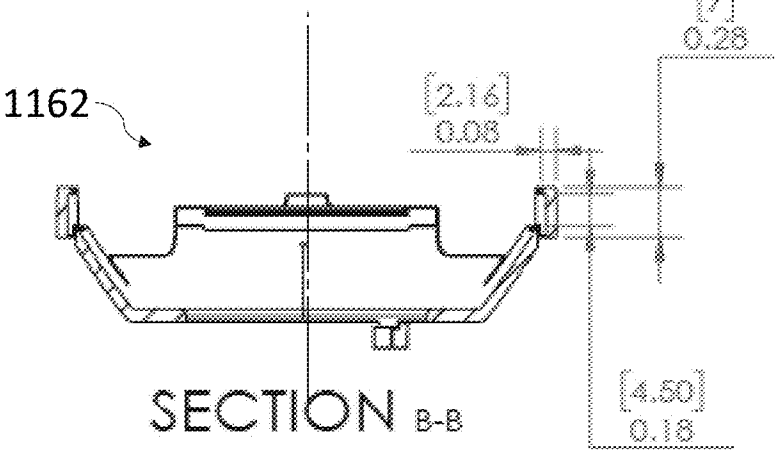
Figure 33E:
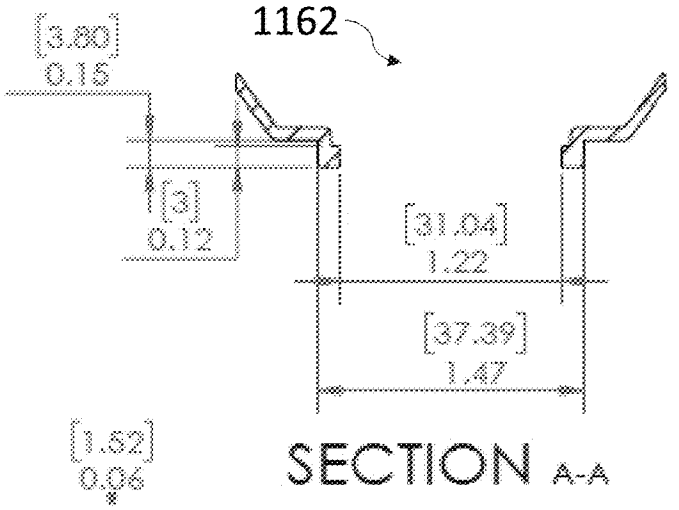

FIG. 33E is a cross-sectional view of the optic holder shown in FIG. 33A along the plane A-A.

FIG. 33F is a cross-sectional view of the optic holder shown in FIG. 33A along the plane B-B.

Figure 33G:
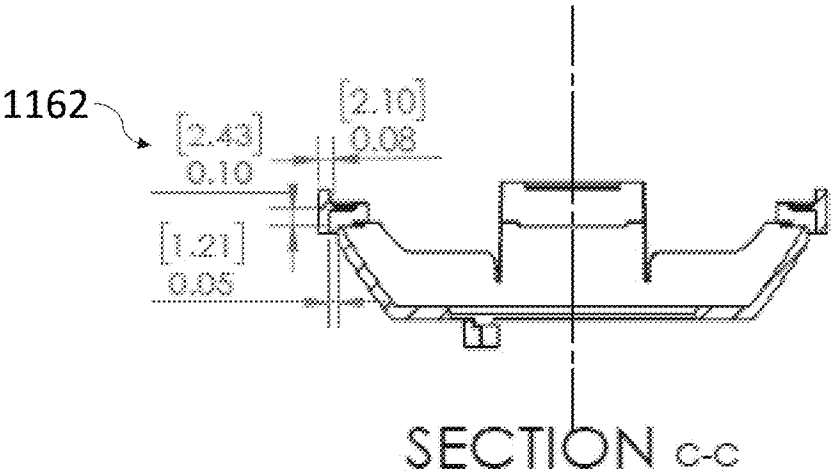

FIG. 33G is a cross-sectional view of the optic holder shown in FIG. 33A along the plane C-C.

Figure 34B:
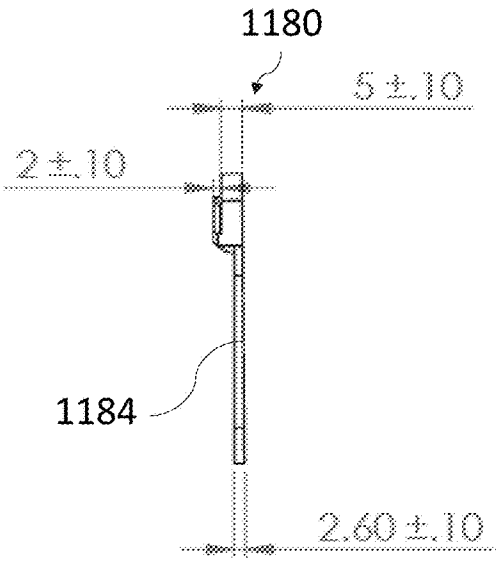
Figure 34D:
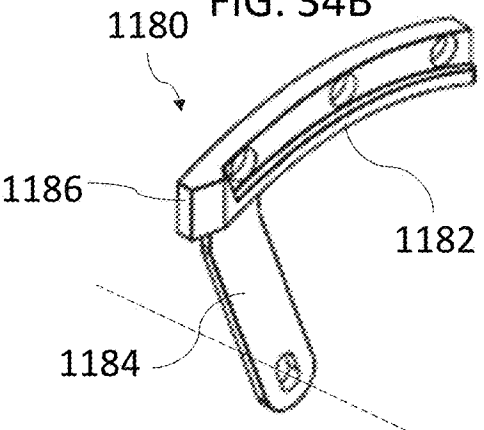
Figure 34A:
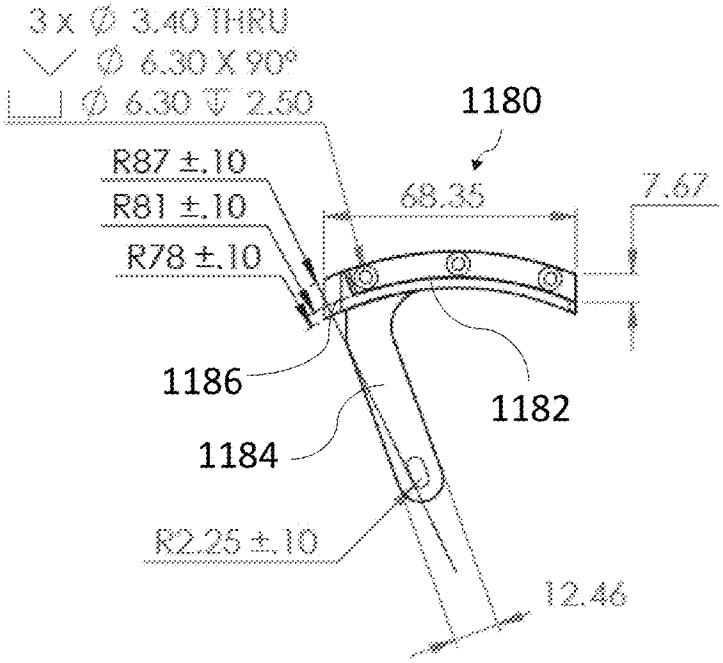

FIG. 34A is a right side view of a heat sink arm of an adjustable lighting apparatus, according to an implementation.

FIG. 34B is a front view of the heat sink arm shown in FIG. 34A.

Figure 34C:
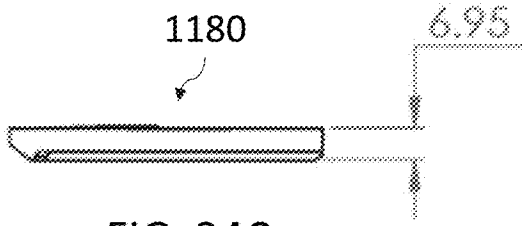

FIG. 34C is a top view of the heat sink arm shown in FIG. 34A.

FIG. 34D is a top, front perspective view of the heat sink arm shown in FIG. 34A.

Figure 35B:
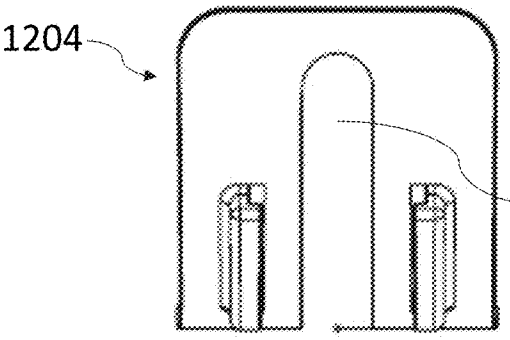
Figure 35C:
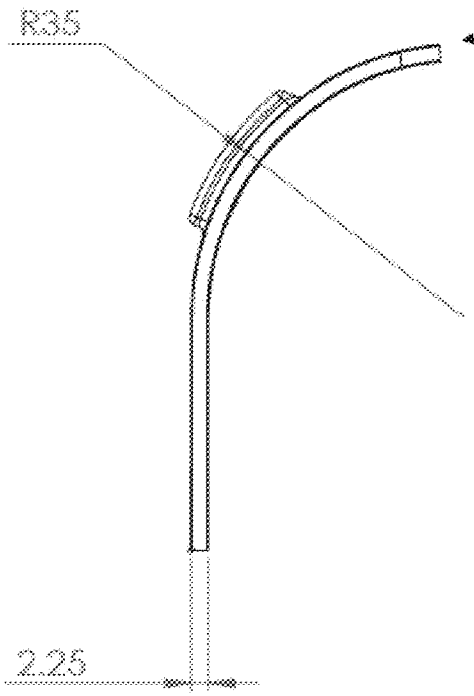
Figure 35A:
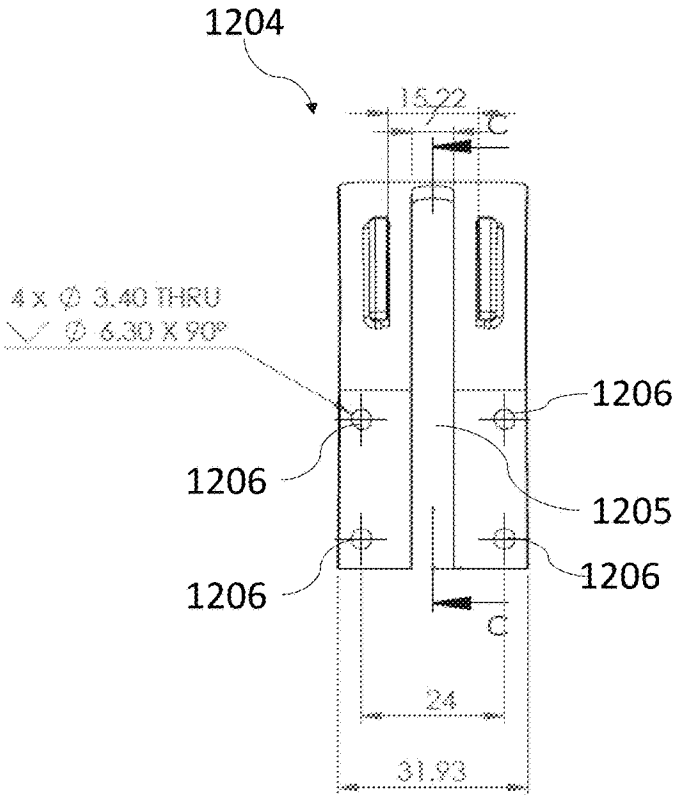

FIG. 35A is a front view of a slider plate of an adjustable lighting apparatus, according to an implementation.

FIG. 35B is a top view of the slider plate shown in FIG. 35A.

FIG. 35C is a right side view of the slider plate shown in FIG. 35A.

Figure 35E:
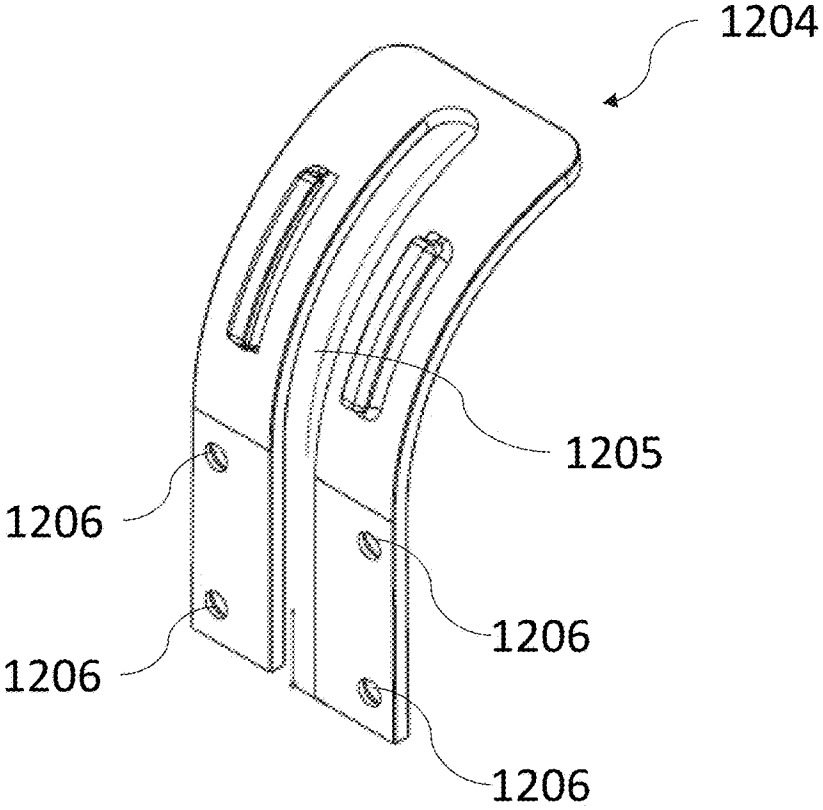
Figure 35D:
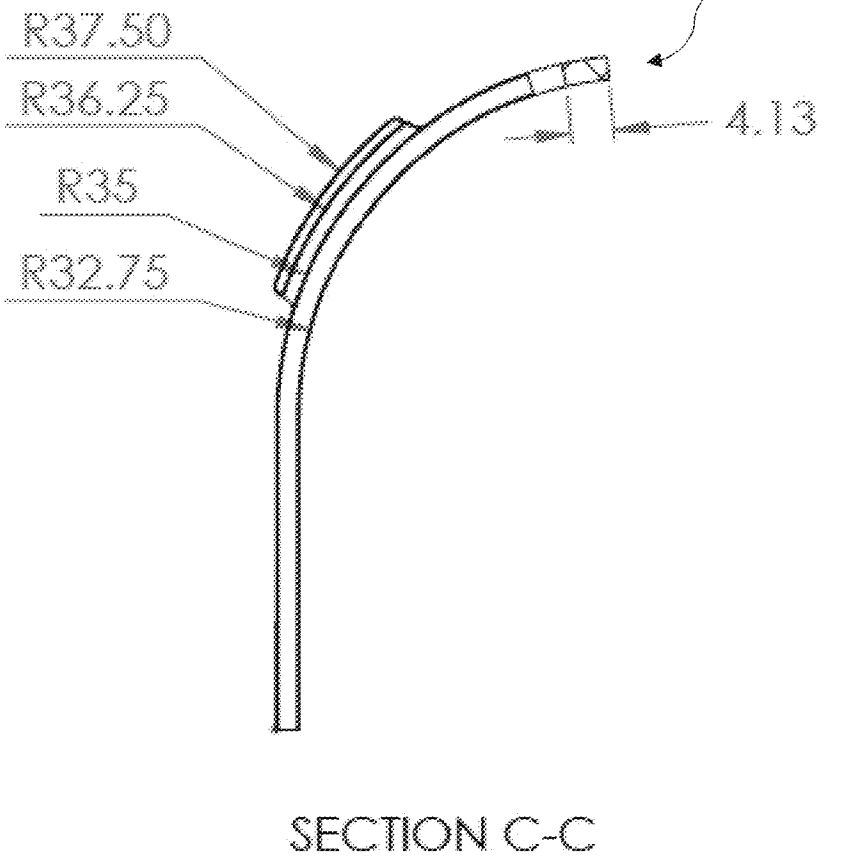

FIG. 35D is a cross-sectional view of the slider plate shown in FIG. 35A along the plane C-C.

FIG. 35E is a top, front, right perspective view of the slider plate shown in FIG. 35A.

Figure 36C:
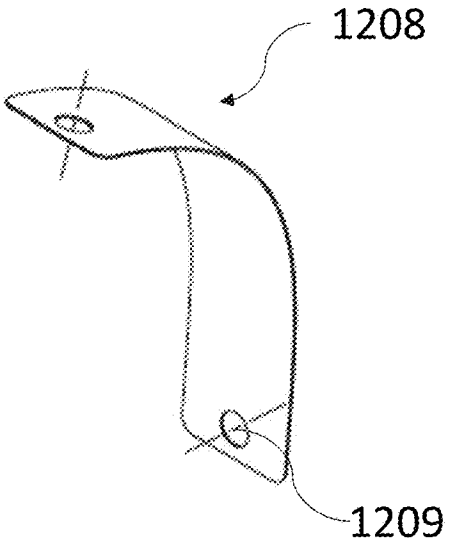
Figure 36B:
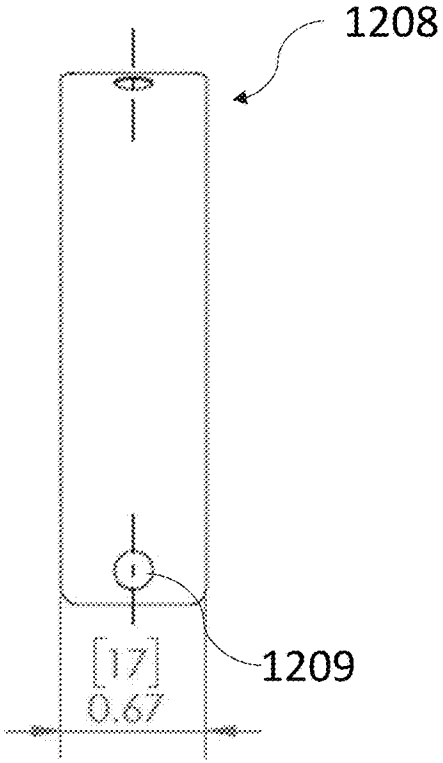
Figure 36A:
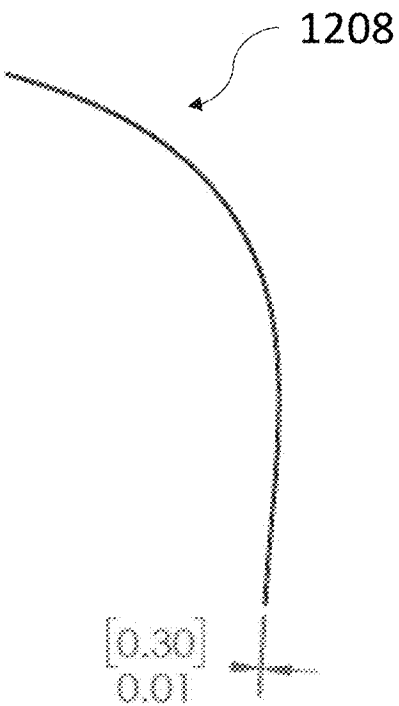

FIG. 36A is a right side view of a push spring of an adjustable lighting apparatus, according to an implementation.

FIG. 36B is a front view of the push spring shown in FIG. 36A.

FIG. 36C is a top, front perspective view of the push spring shown in FIG. 36A.

Figure 37B:
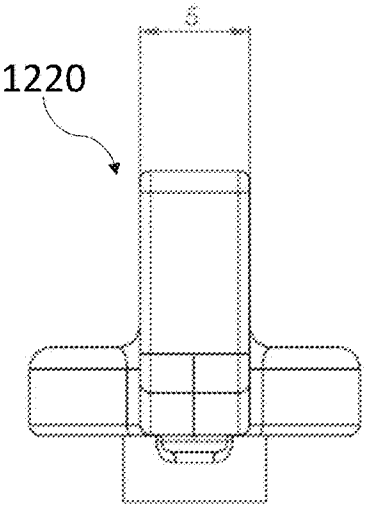
Figure 37D:
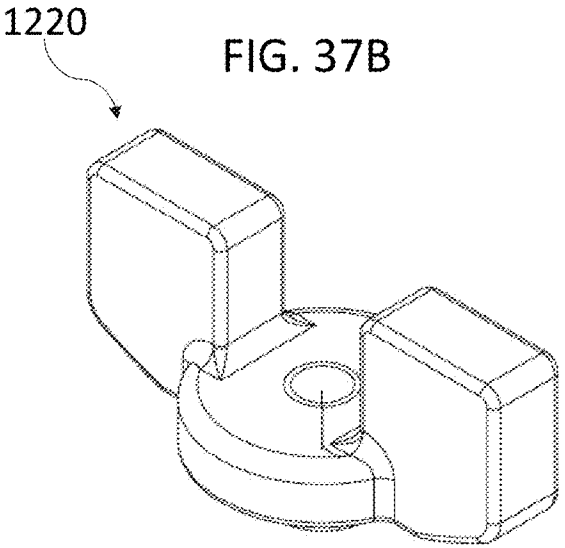
Figure 37A:
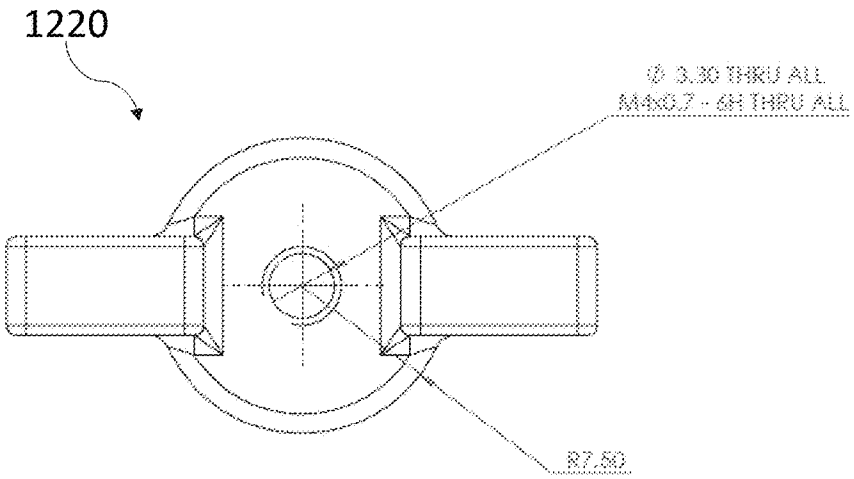

FIG. 37A is a top view of a quarter turn lock of an adjustable lighting apparatus, according to an implementation.

FIG. 37B is a right side view of the quarter turn lock shown in FIG. 37A.

Figure 37C:
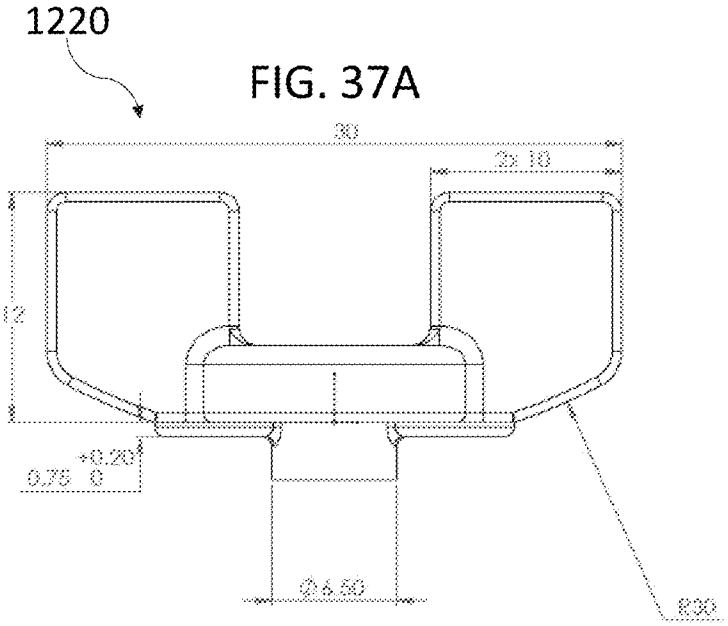

FIG. 37C is a front view of the quarter turn lock shown in FIG. 37A.

FIG. 37D is a top, front, right perspective view of the quarter turn lock shown in FIG. 37A.

Figure 38B:
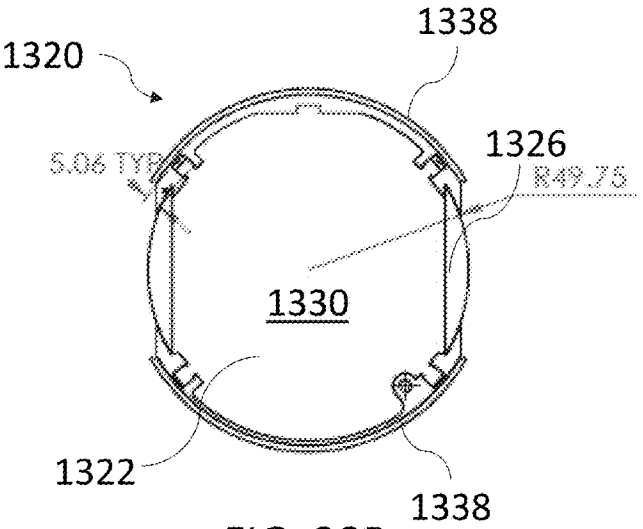
Figure 38A:
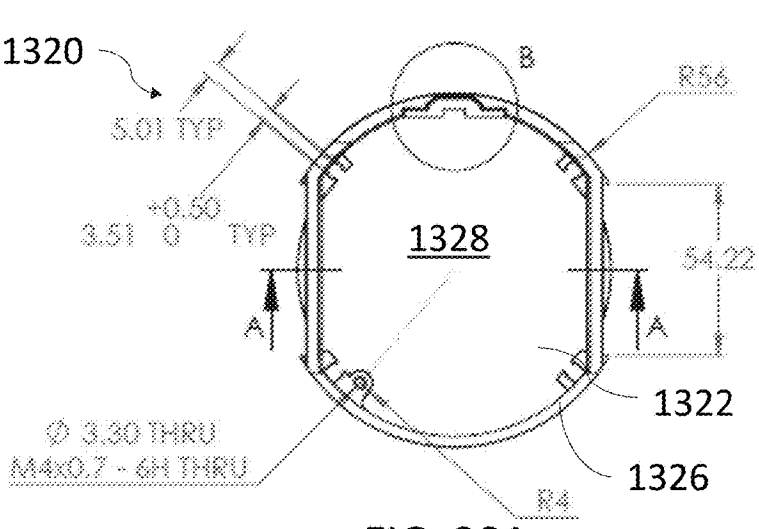

FIG. 38A is a top view of a base structure of an adjustable lighting apparatus, according to an implementation.

FIG. 38B is a bottom view of the base structure shown in FIG. 38A.

Figure 38D:
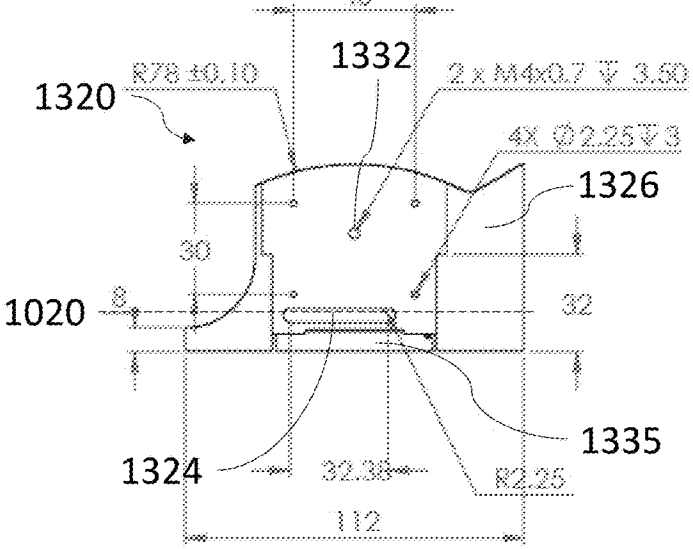
Figure 38C:
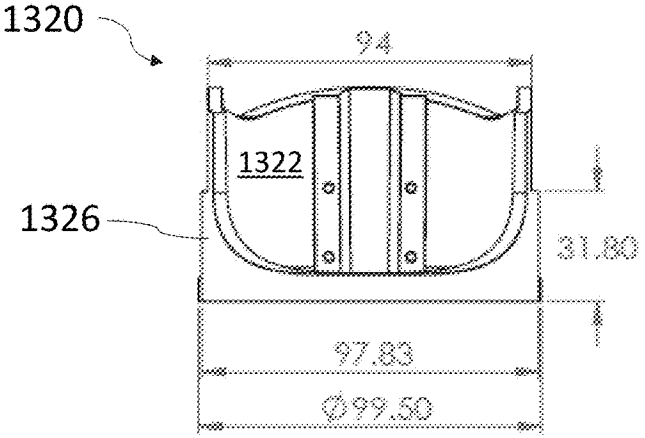

FIG. 38C is a front view of the base structure shown in FIG. 38A.

FIG. 38D is a right side view of the base structure shown in FIG. 38A.

Figure 38F:
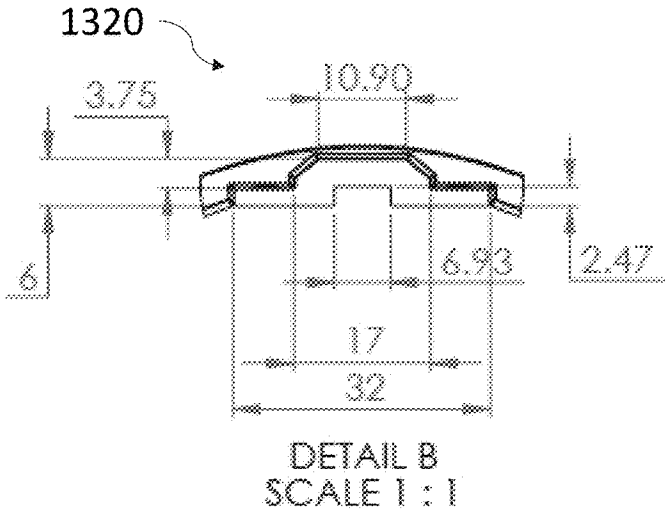
Figure 38E:
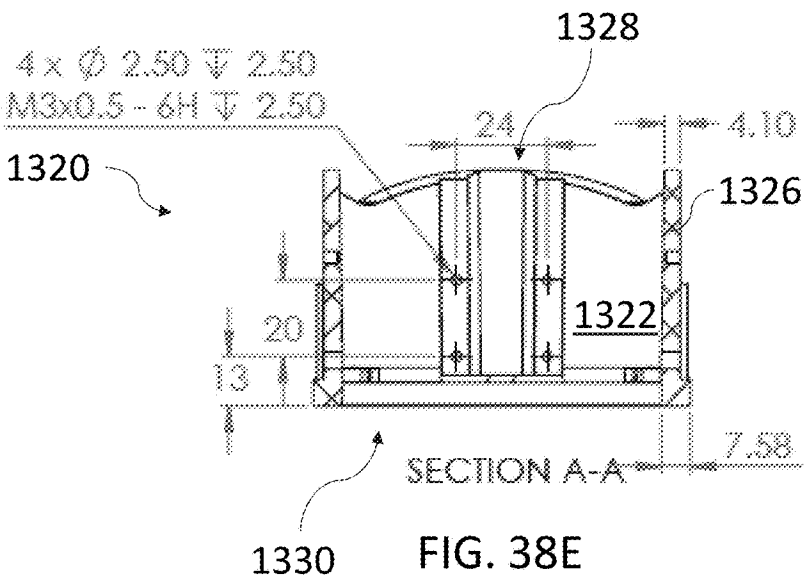

FIG. 38E is a cross-sectional view of the base structure shown in FIG. 38A along the plane A-A.

FIG. 38F is an expanded view of the base structure shown in FIG. 38A in the region labeled B.

Figure 38G:
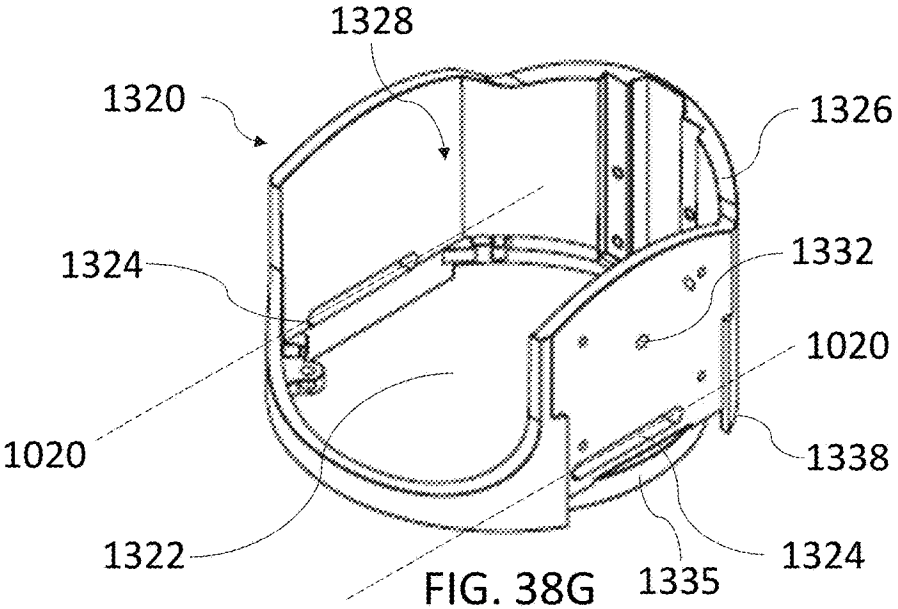

FIG. 38G is a top, front, right perspective view of the base structure shown in FIG. 38A.

Figure 39B:
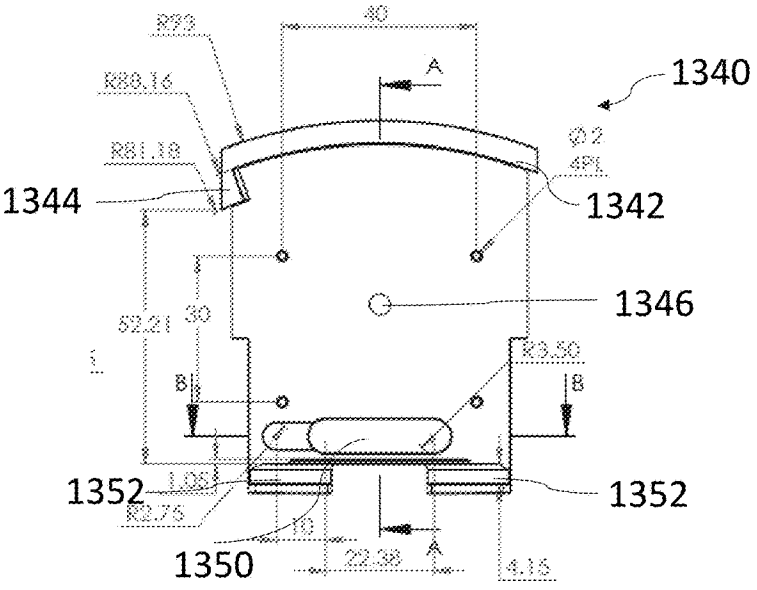
Figure 39D:
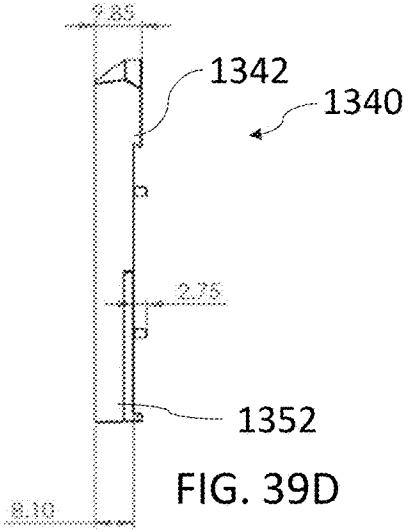
Figure 39A:
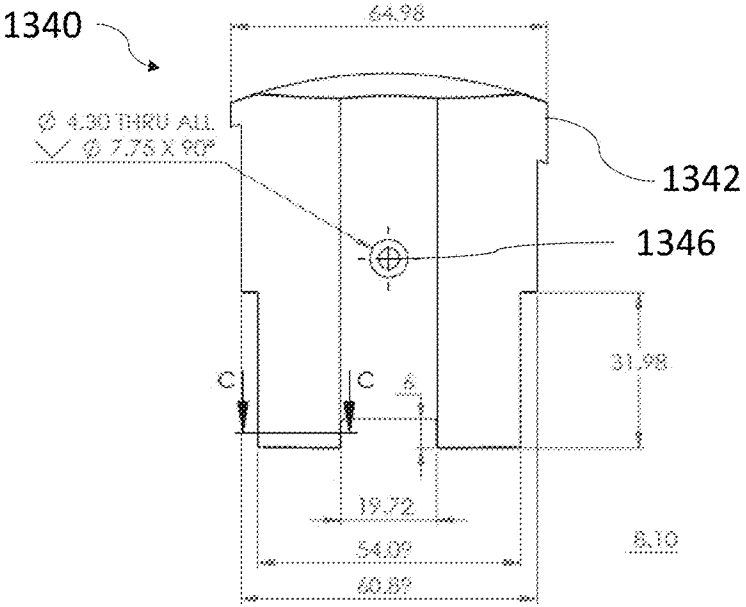

FIG. 39A is front view of a retainer of an adjustable lighting apparatus, according to an implementation.

FIG. 39B is a rear view of the retainer shown in FIG. 39A.

Figure 39C:
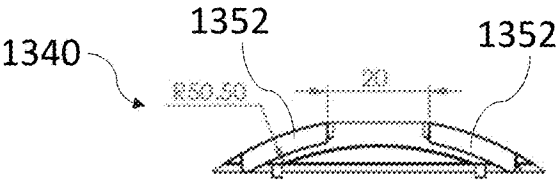

FIG. 39C is a bottom view of the retainer shown in FIG. 39A.

FIG. 39D is a right side view of the retainer shown in FIG. 39A.

Figure 39E:
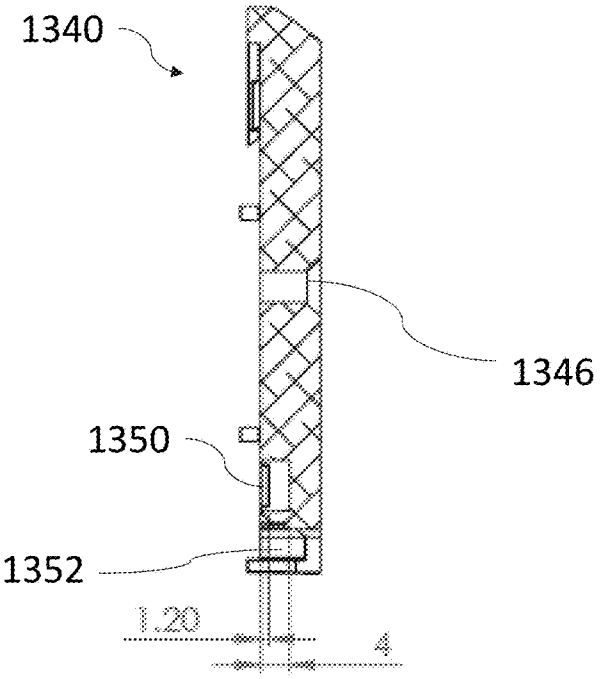

FIG. 39E is a cross-sectional view of the retainer shown in FIG. 39B along the plane A-A.

Figure 39F:
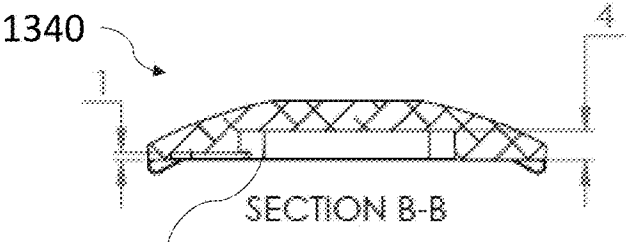

FIG. 39F is a cross-sectional view of the retainer shown in FIG. 39B along the plane B-B.

Figure 39G:
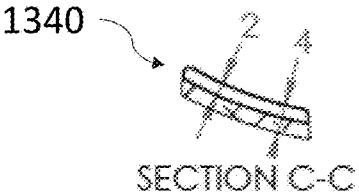

FIG. 39G is a cross-sectional view of the retainer shown in FIG. 39A along the plane C-C.

Figure 39H:
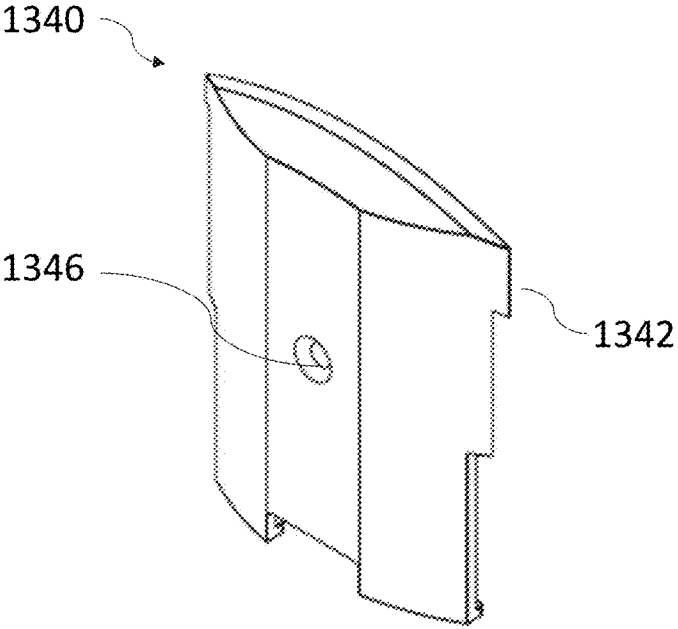

FIG. 39H is a top, front, right perspective view of the retainer shown in FIG. 39A.

Figure 40B:
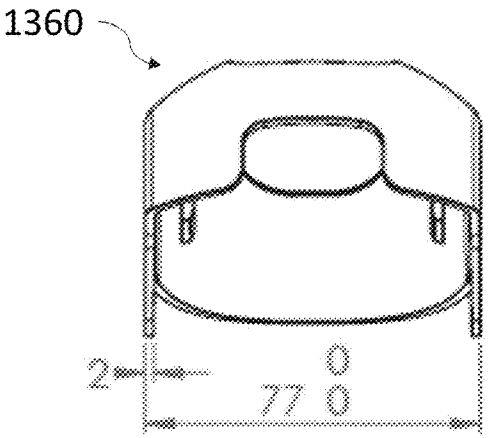
Figure 40A:
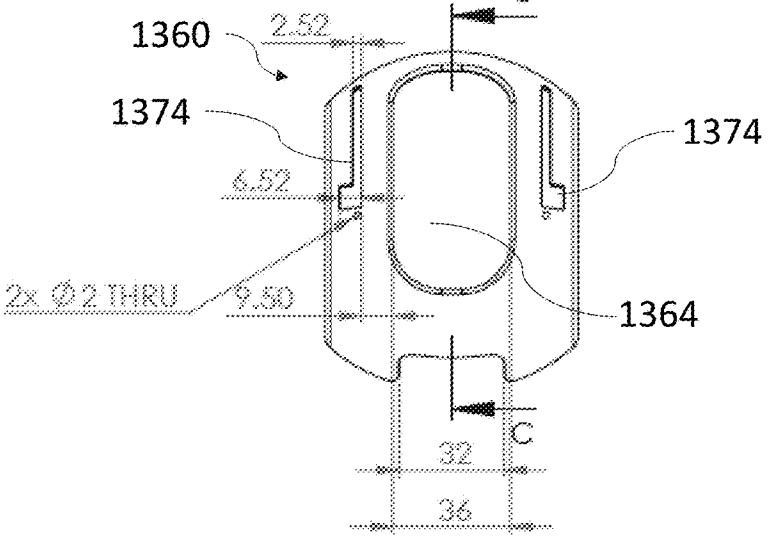

FIG. 40A is a top view of a shield of an adjustable lighting apparatus, according to an implementation.

FIG. 40B is a front view of the shield shown in FIG. 40A.

Figure 40C:
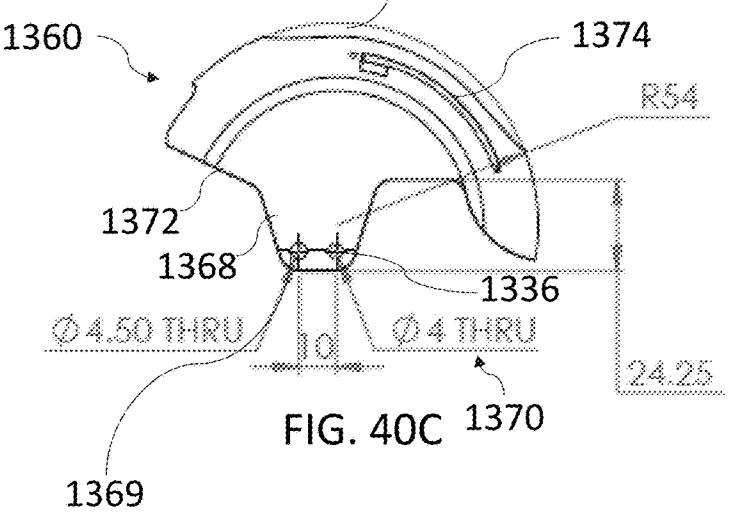

FIG. 40C is a right side view of the shield shown in FIG. 40A.

Figure 40E:
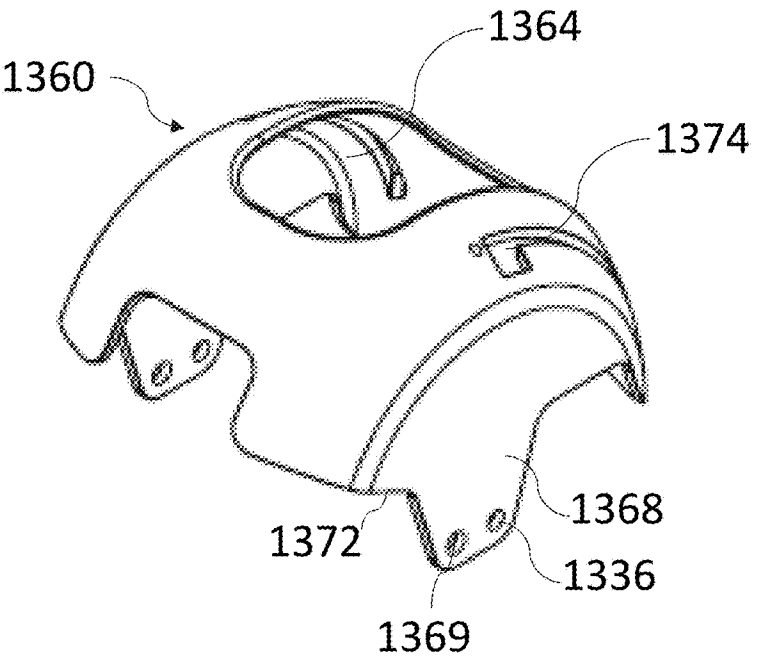
Figure 40D:
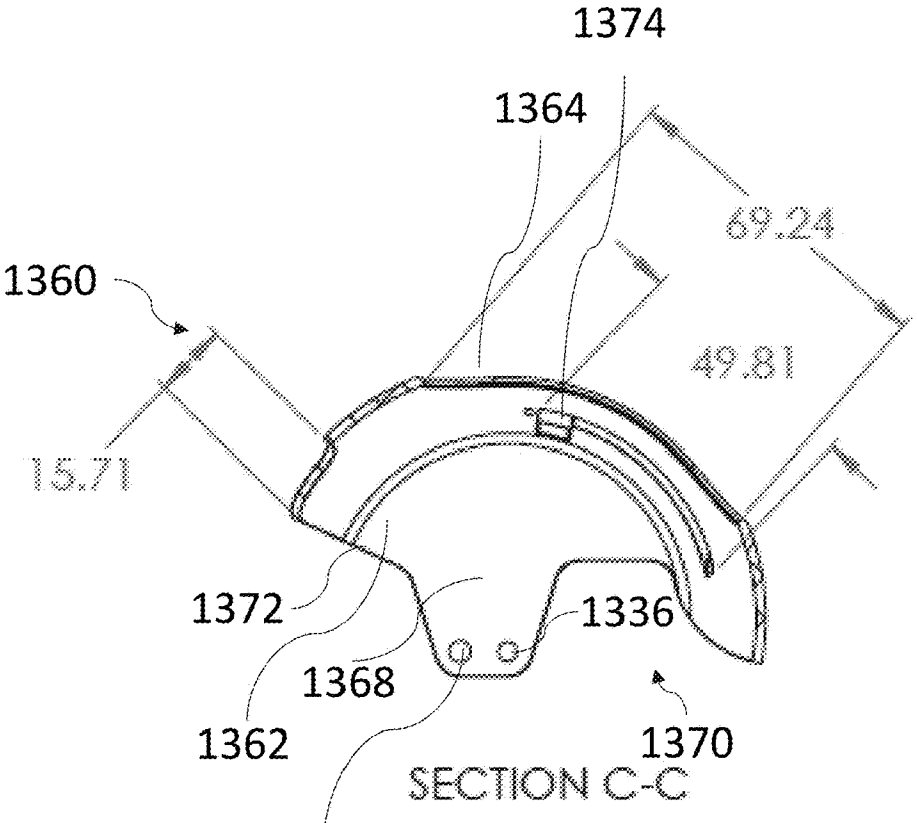

FIG. 40D is a cross-sectional view of the shield shown in FIG. 40A along the plane C-C.

FIG. 40E is a top, front, right perspective view of the shield shown in FIG. 40A.

Figure 41B:
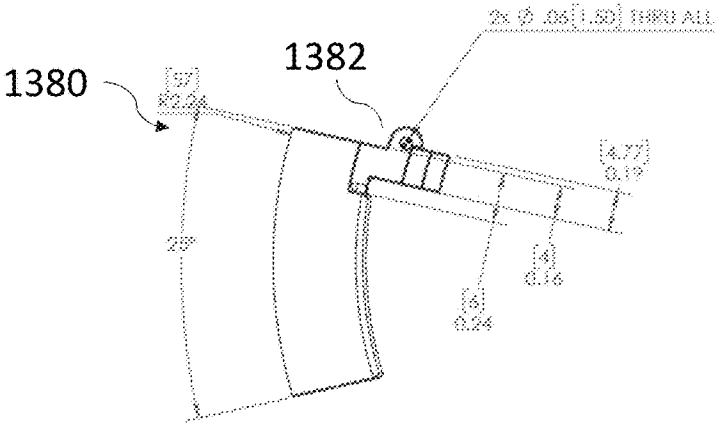
Figure 41A:
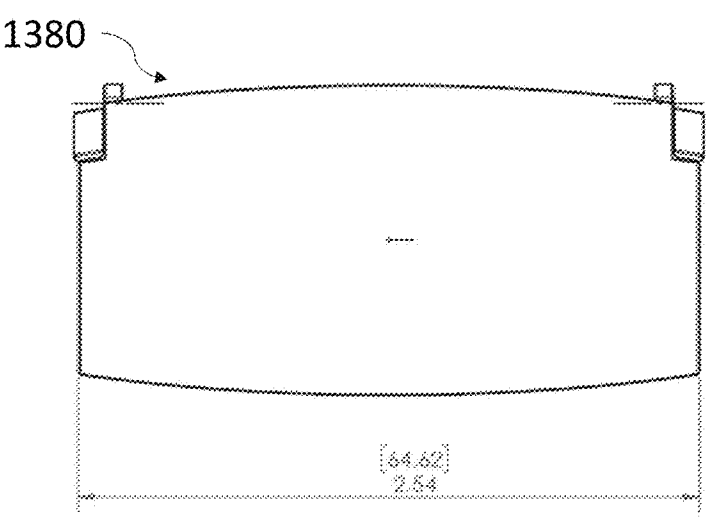

FIG. 41A is a top view of a secondary shield of an adjustable lighting apparatus, according to an implementation.

FIG. 41B is a right side view of the secondary shield shown in FIG. 41A.

Figure 41D:
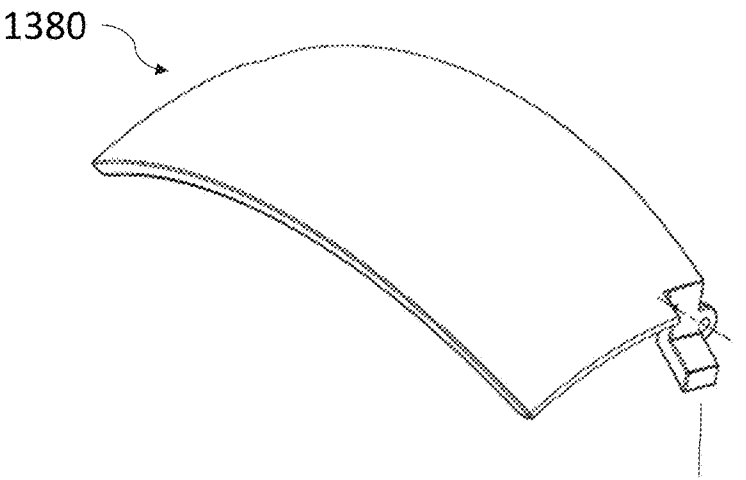
Figure 41C:
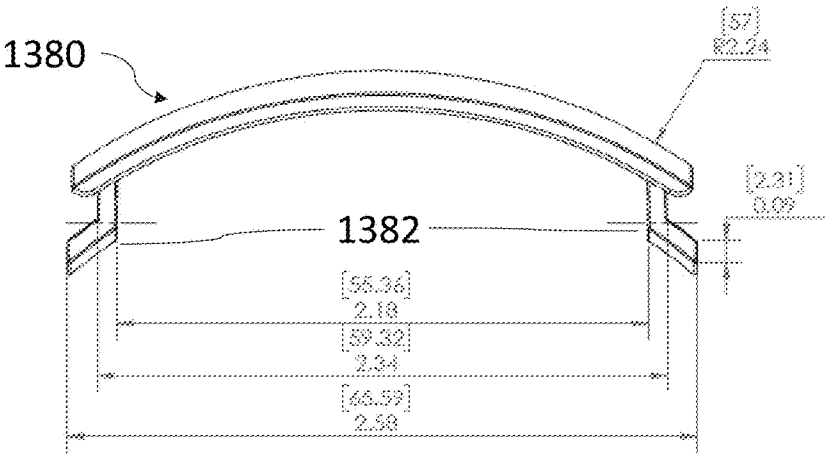

FIG. 41C is a front view of the secondary shield shown in FIG. 41A.

FIG. 41D is a top, front, right perspective view of the secondary shield shown in FIG. 41A.

Figure 42B:
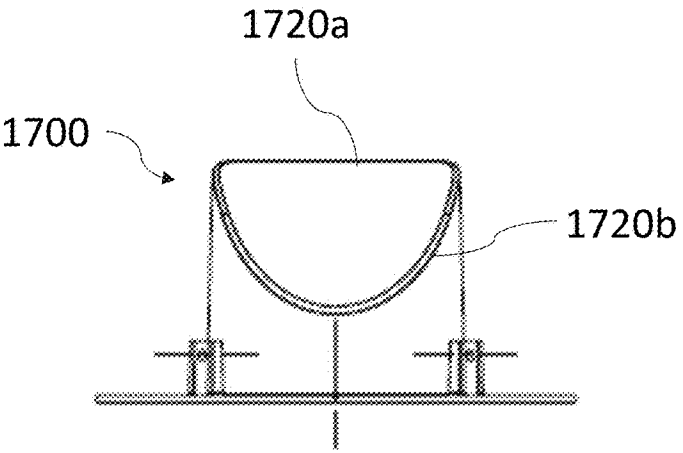
Figure 42D:
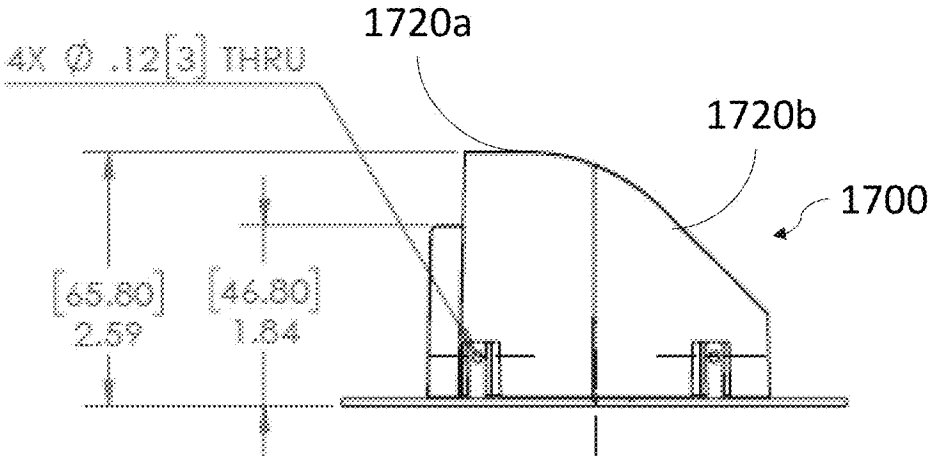
Figure 42A:
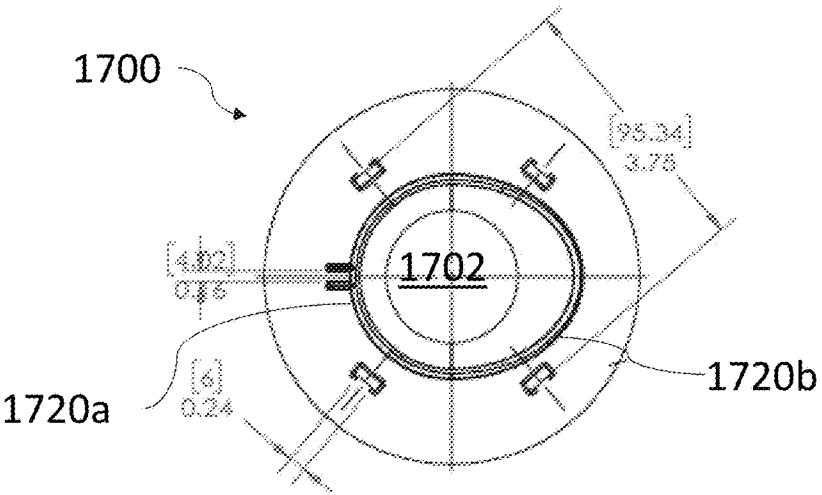

FIG. 42A is a top view of a trim of an adjustable lighting apparatus, according to an implementation.

FIG. 42B is a right side view of the trim shown in FIG. 42A.

Figure 42C:
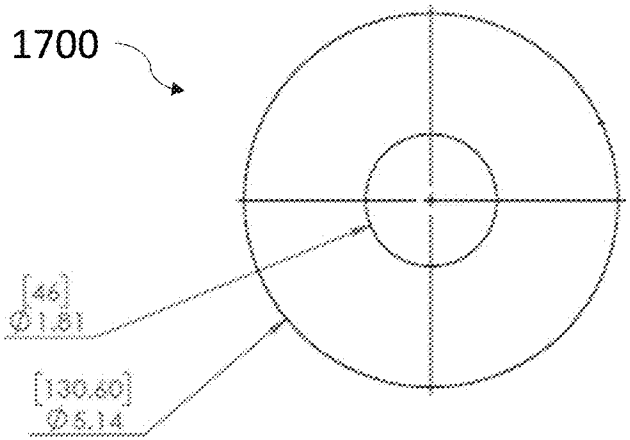

FIG. 42C is a bottom view of the trim shown in FIG. 42A.

FIG. 42D is a front view of the trim shown in FIG. 42A.

Figure 42E:
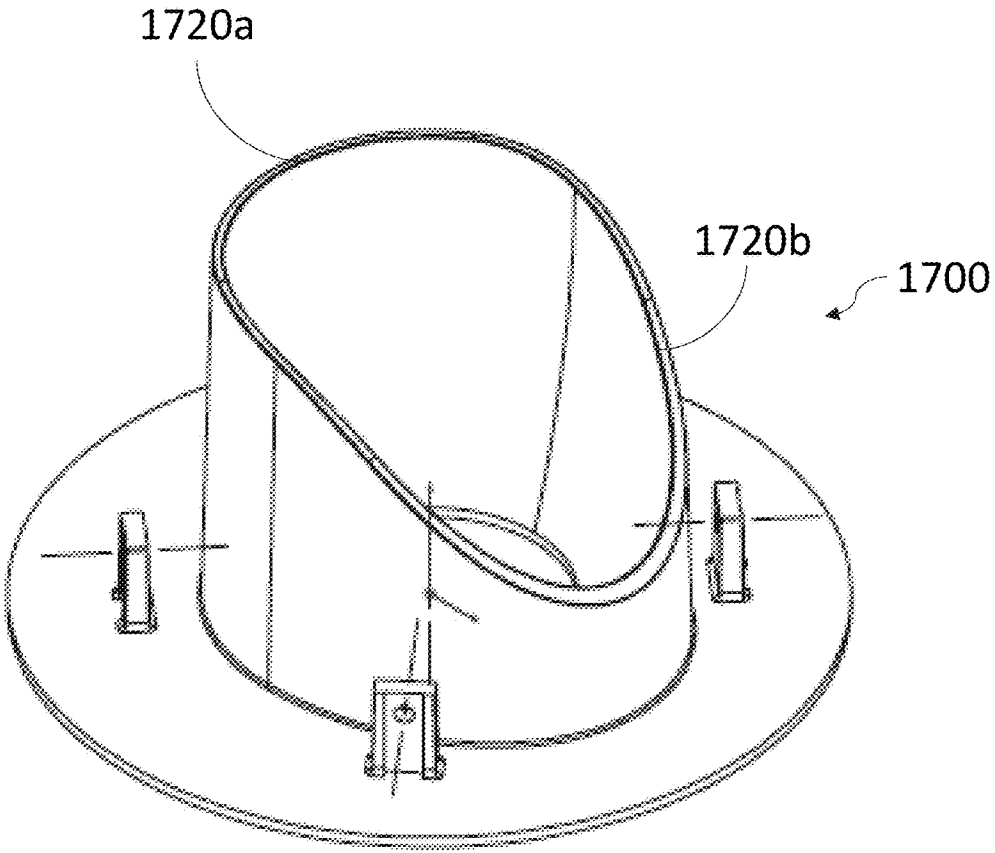

FIG. 42E is a top, front, left perspective view of the trim shown in FIG. 42A.

Figure 43C:
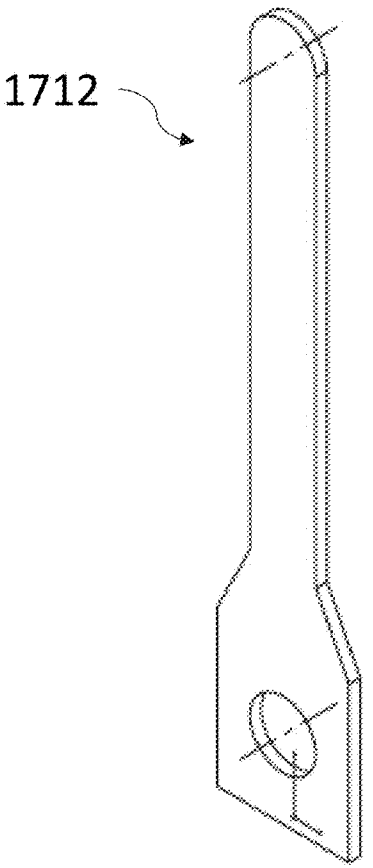
Figure 43B:
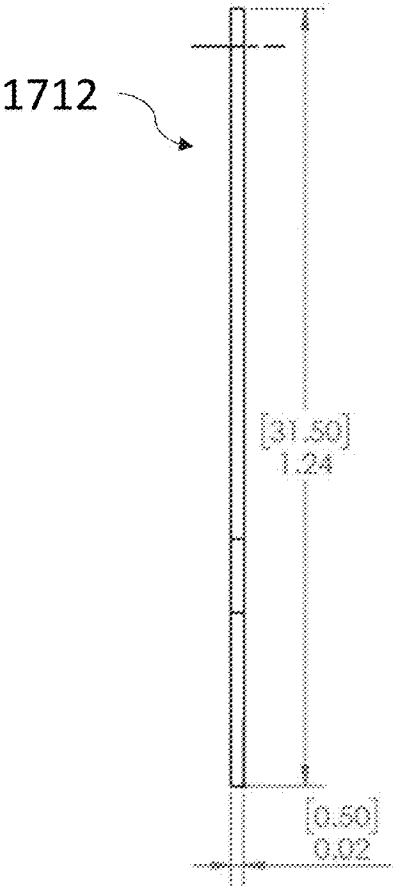
Figure 43A:
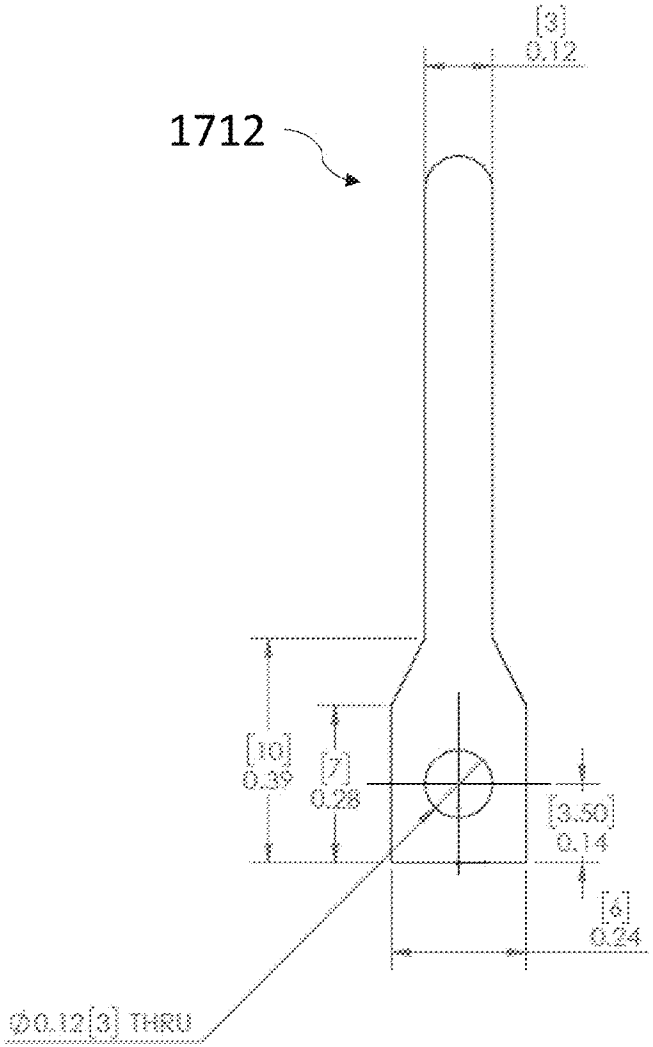

FIG. 43A is a top view of a trim attachment plate of an adjustable lighting apparatus, according to an implementation.

FIG. 43B is a right side view of the trim attachment plate shown in FIG. 43A.

FIG. 43C is a top, right perspective view of the trim attachment plate shown in FIG. 43A.

Figure 44A:
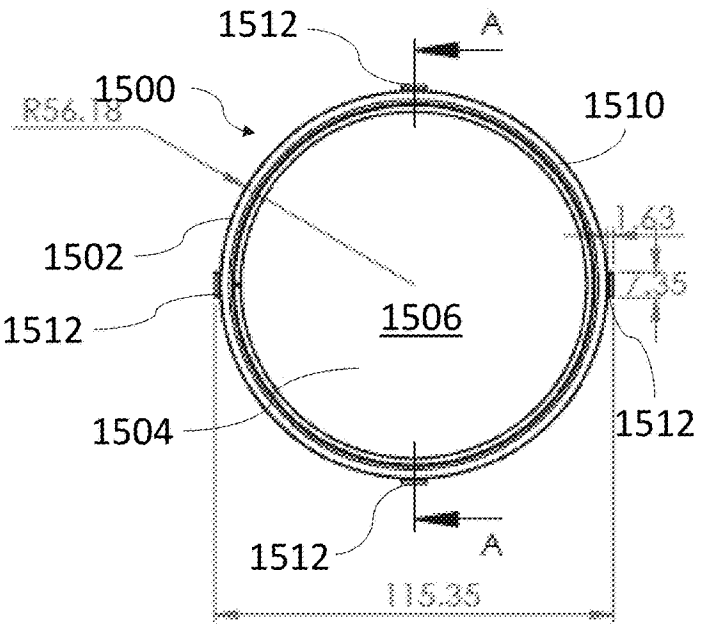

FIG. 44A is a top view of a rotation ring of an adjustable lighting apparatus, according to an implementation.

Figure 44B:
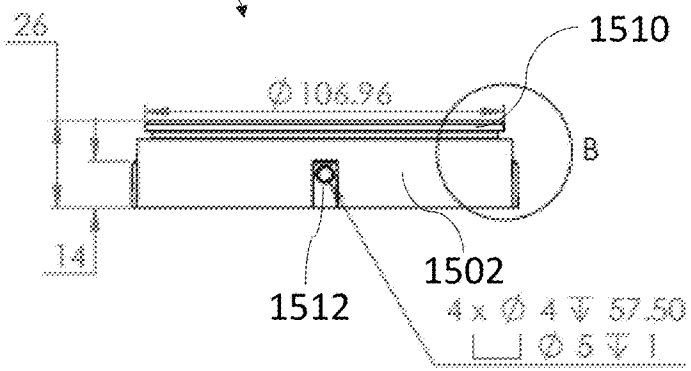

FIG. 44B is a right side view of the rotation ring shown in FIG. 44A.

Figure 44C:
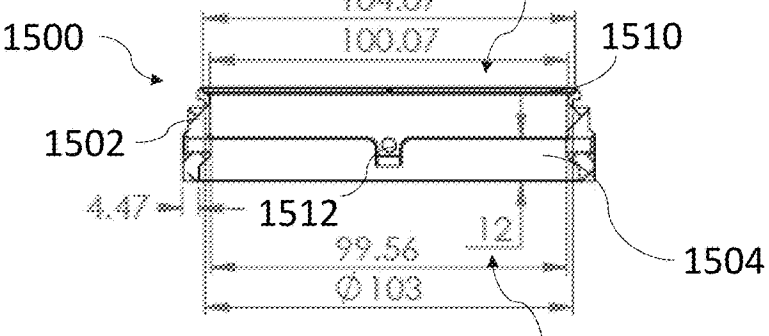

FIG. 44C is a cross-sectional view of the rotation ring shown in FIG. 44A along the plane A-A.

Figure 44D:
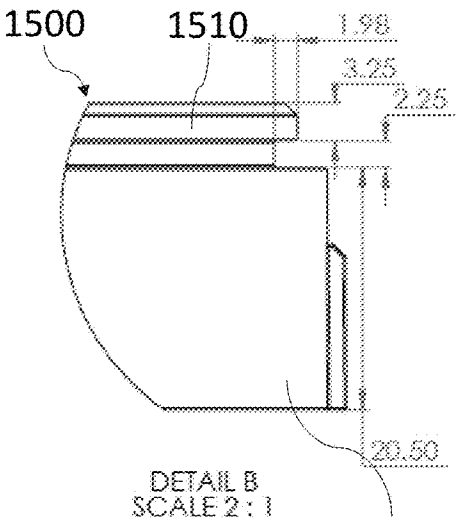

FIG. 44D is an expanded view of the rotation ring shown in FIG. 44B in the region labeled B.

Figure 44E:
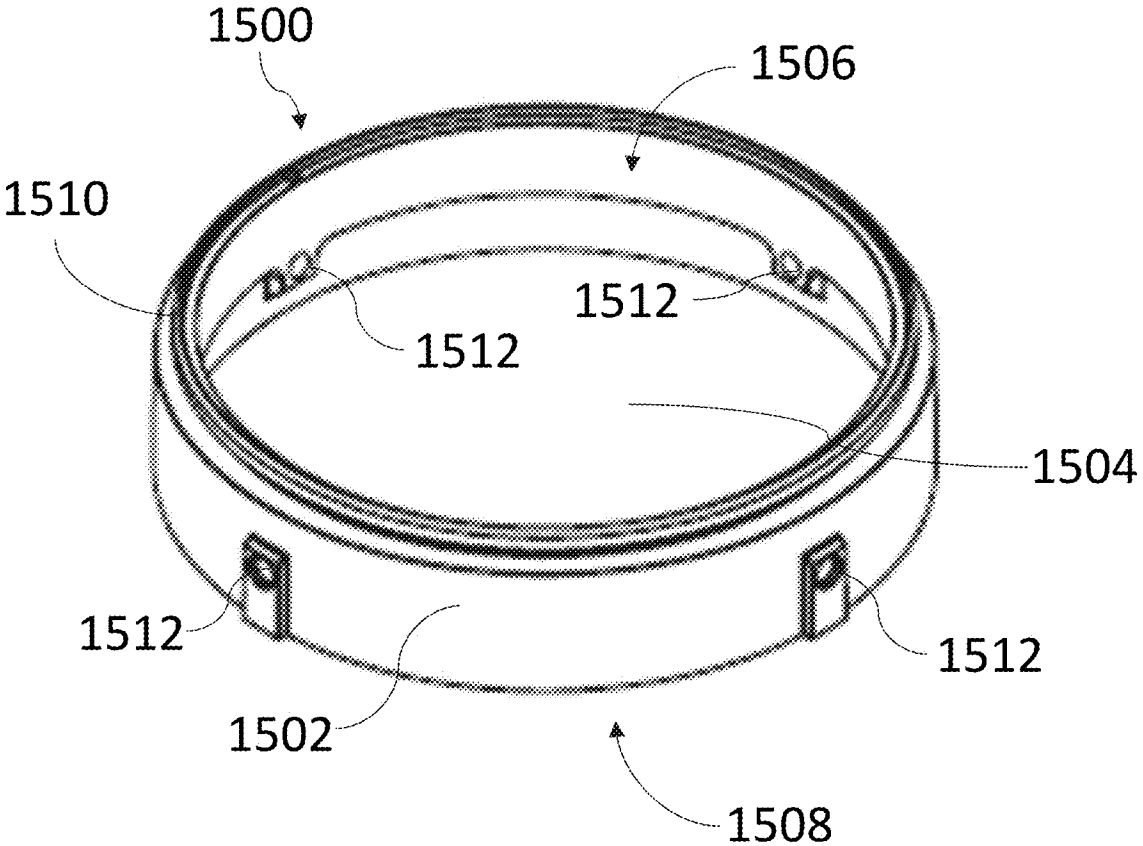

FIG. 44E is a top, front, right perspective view of the rotation ring shown in FIG. 44A.

Figure 45B:
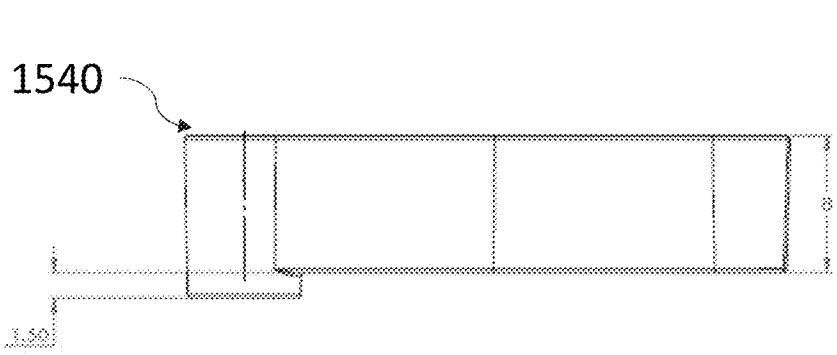
Figure 45A:
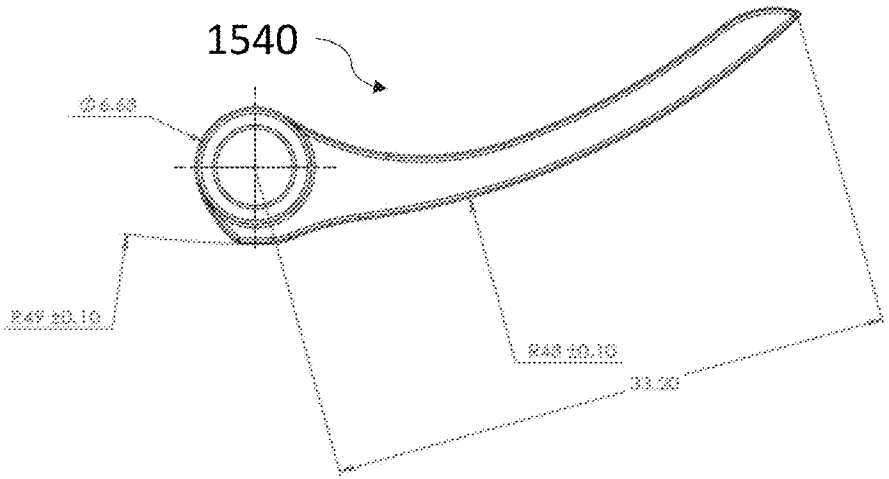

FIG. 45A is a top view of a rotation lock of an adjustable lighting apparatus, according to an implementation.

FIG. 45B is a front view of the rotation lock shown in FIG. 45A.

Figure 45C:
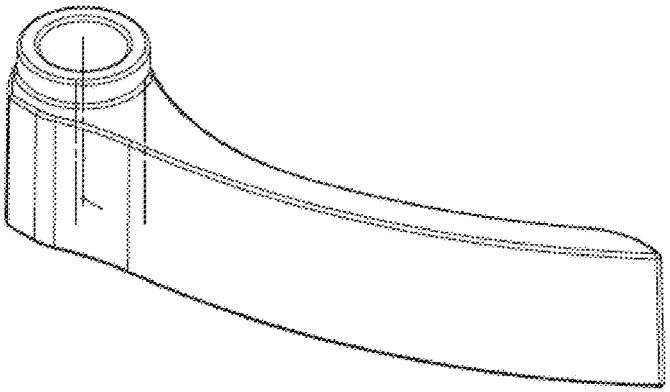

FIG. 45C is a top, front perspective view of the rotation lock shown in FIG. 45A.

Figure 46B:
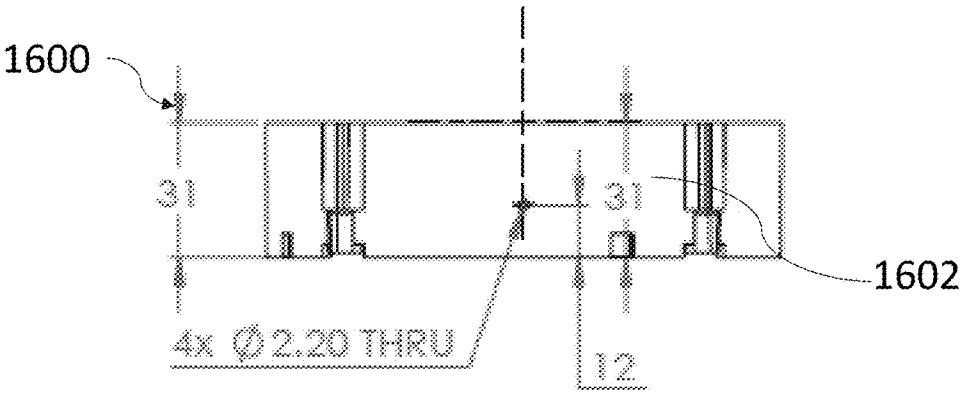
Figure 46D:
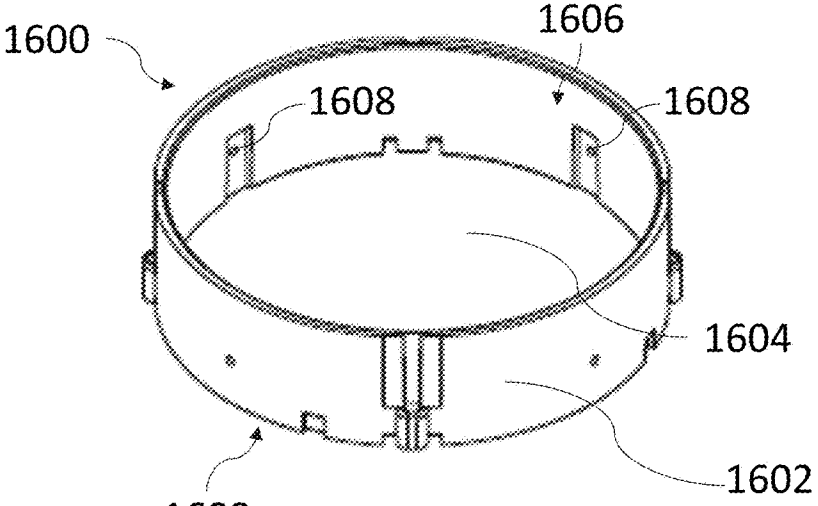
Figure 46A:
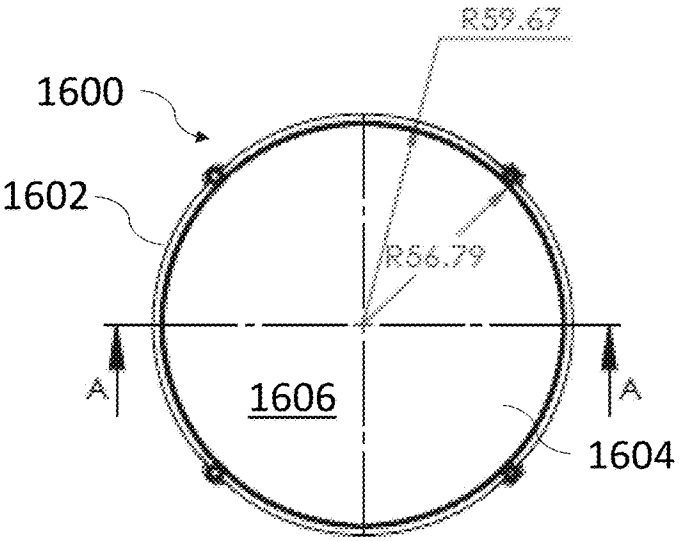

FIG. 46A is a top view of a frame of an adjustable lighting apparatus for new construction applications, according to an implementation.

FIG. 46B is a right side view of the frame shown in FIG. 46A.

Figure 46C:
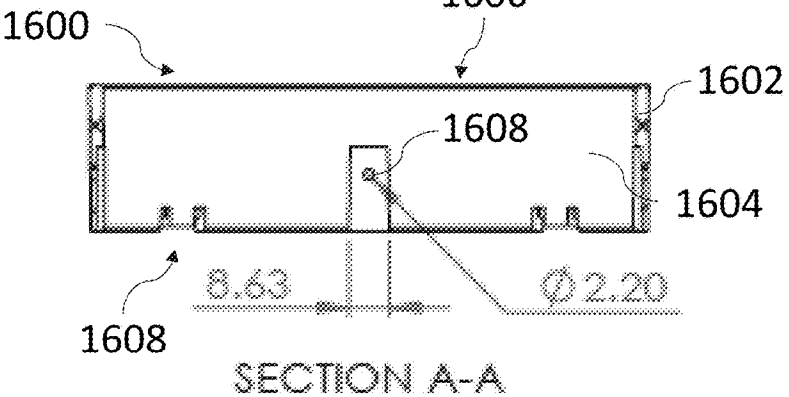

FIG. 46C is a cross-sectional view of the frame shown in FIG. 46A along the plane A-A.

FIG. 46D is a top perspective view of the frame shown in FIG. 46A.

Figure 47A:
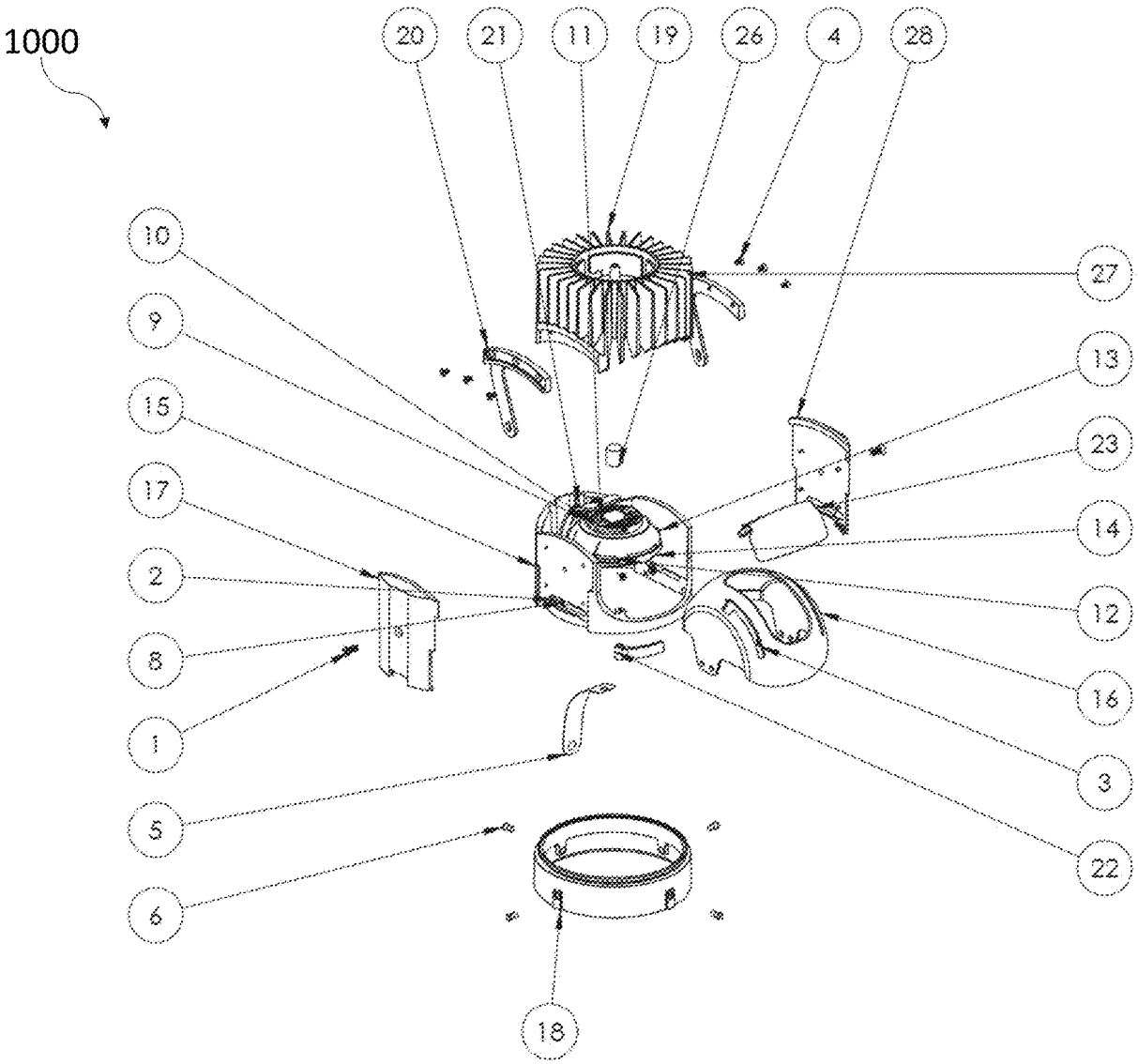

FIG. 47A is an exploded view of an adjustable lighting apparatus, according to an implementation.

FIG. 47B is a table showing the various parts of the adjustable lighting apparatus shown in FIG. 47A.

Figure 48B:
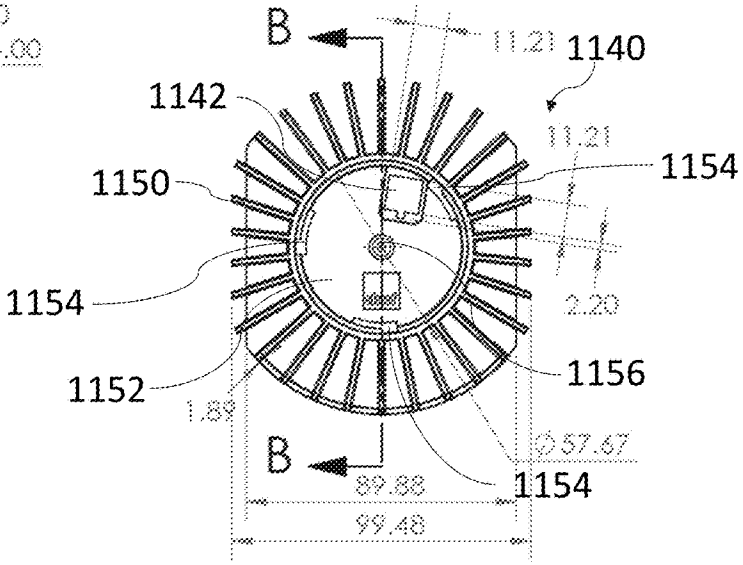
Figure 48D:
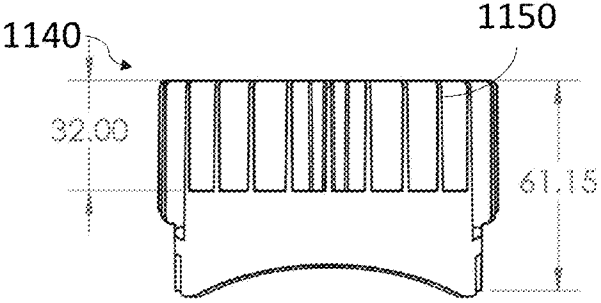
Figure 48A:
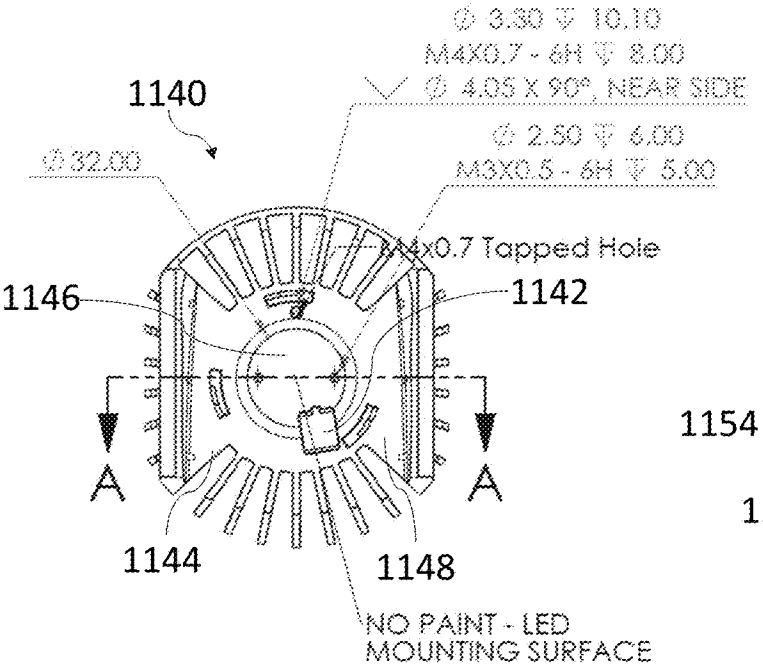

FIG. 48A is a bottom view of a heat sink of an adjustable lighting apparatus, according to an implementation.

FIG. 48B is a top view of the heat sink shown in FIG. 48A.

Figure 48C:
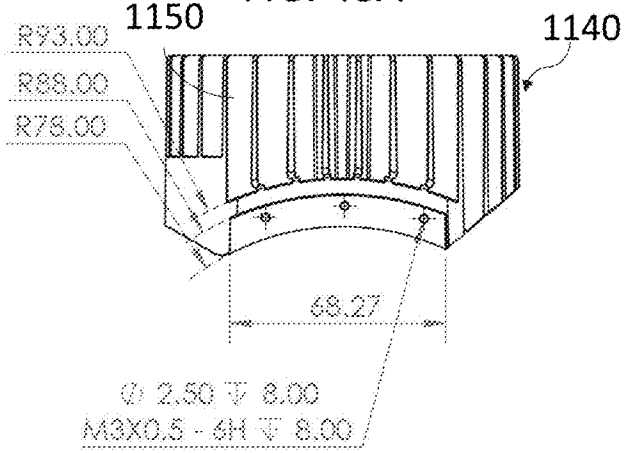

FIG. 48C is a right view of the heat sink shown in FIG. 48A.

FIG. 48D is a rear view of the heat sink shown in FIG. 48A.

Figure 48E:
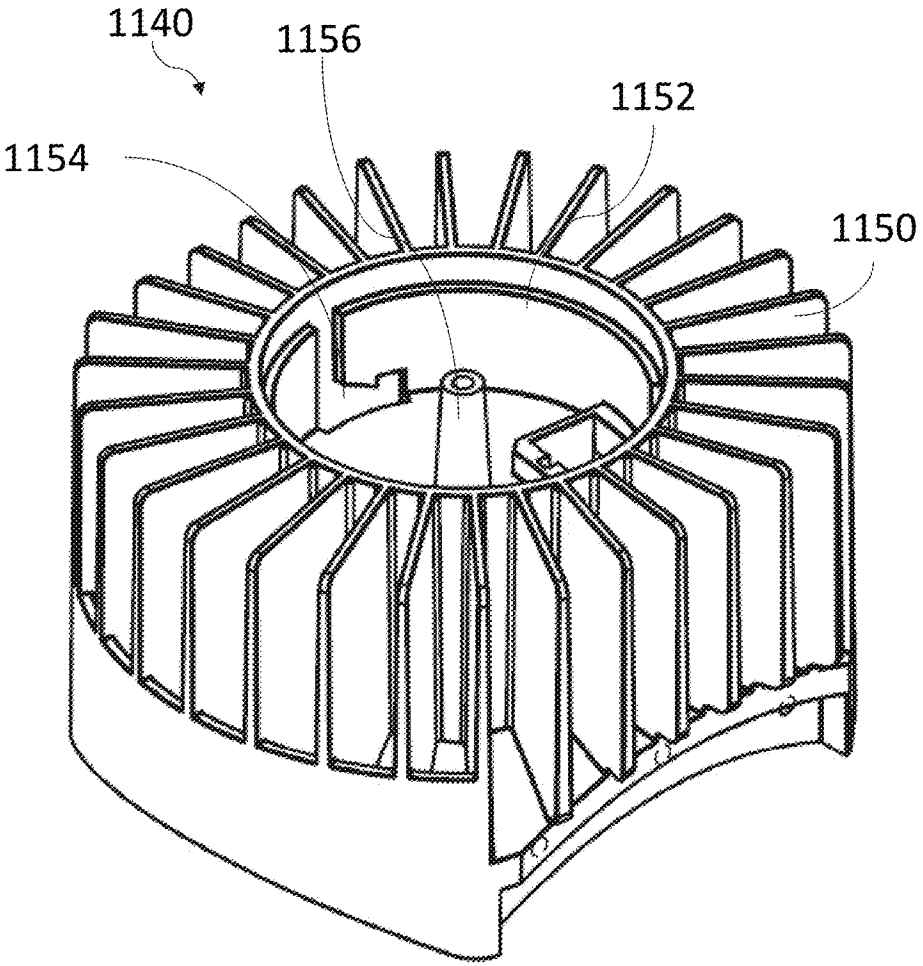

FIG. 48E is a top, rear, left perspective view of the heat sink shown in FIG. 48A.

Figure 48F:
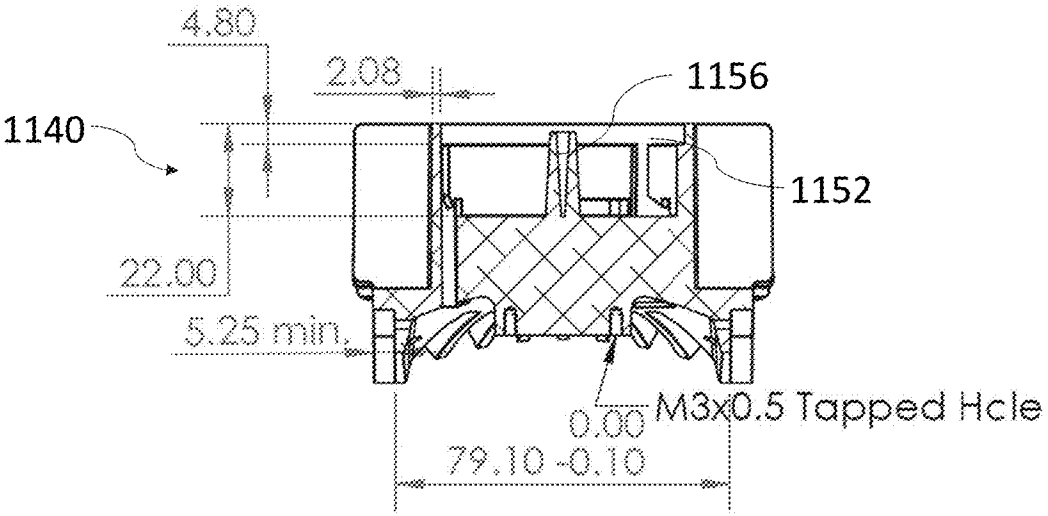

FIG. 48F is a cross-sectional view of the heat sink shown in FIG. 48A along the plane A-A.

Figure 48G:
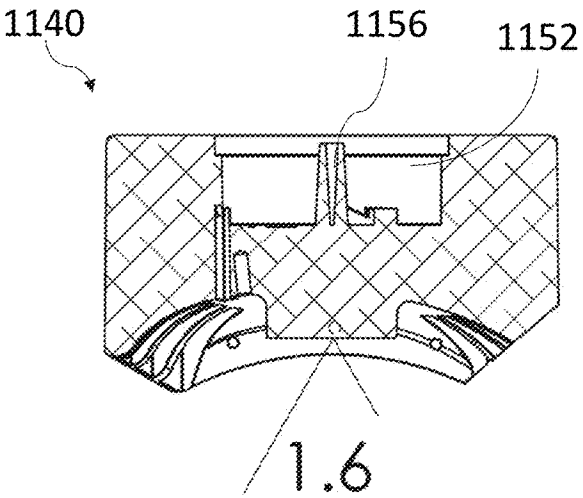

FIG. 48G is a cross-sectional view of the heat sink shown in FIG. 48B along the plane B-B.

Figure 49B:
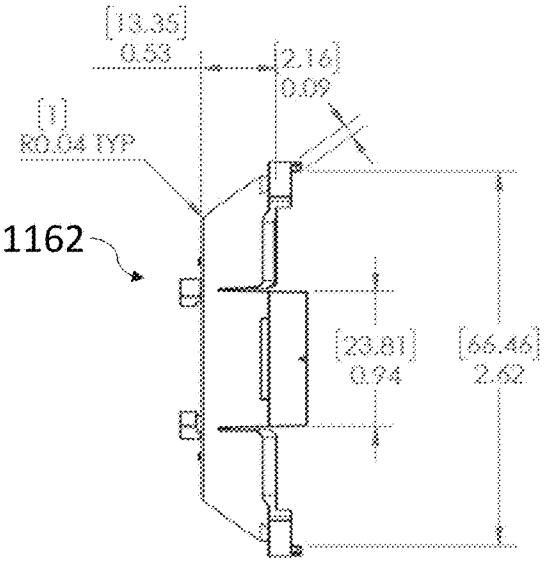
Figure 49D:
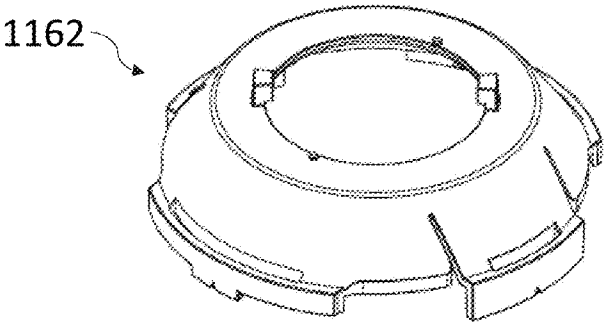
Figure 49A:
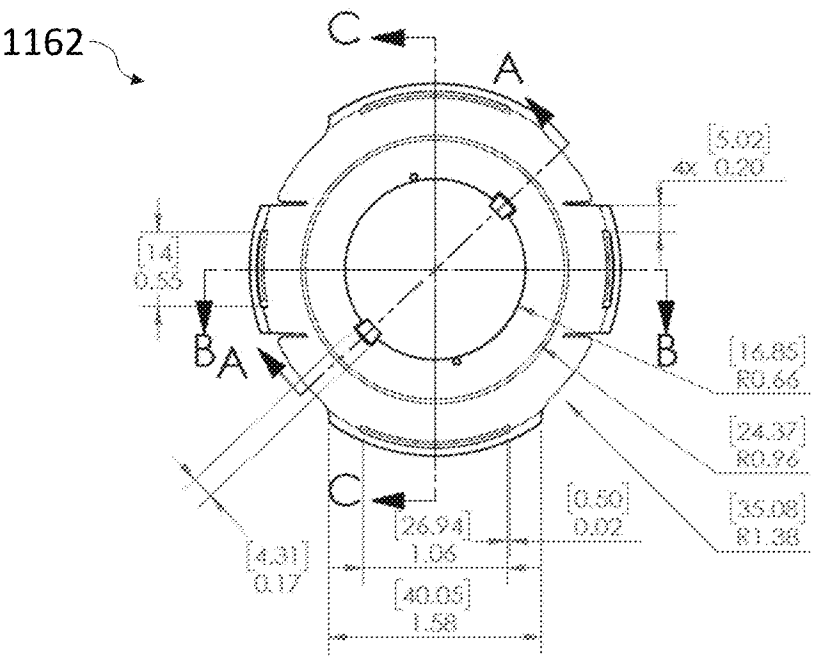

FIG. 49A is a top view of an optic holder of an adjustable lighting apparatus, according to an implementation.

FIG. 49B is a front view of the optic holder shown in FIG. 49A.

Figure 49C:
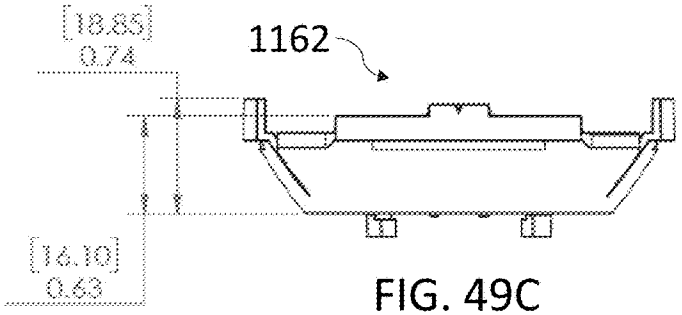

FIG. 49C is a right view of the optic holder shown in FIG. 49A.

FIG. 49D is a rear, front, right perspective view of the optic holder shown in FIG. 49A.

Figure 49F:
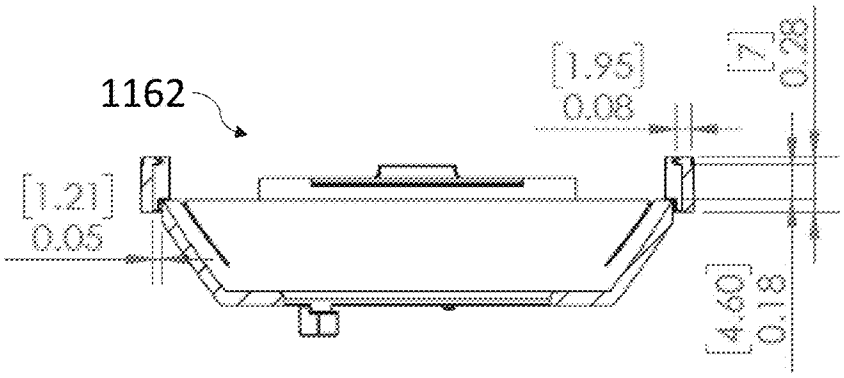
Figure 49G:
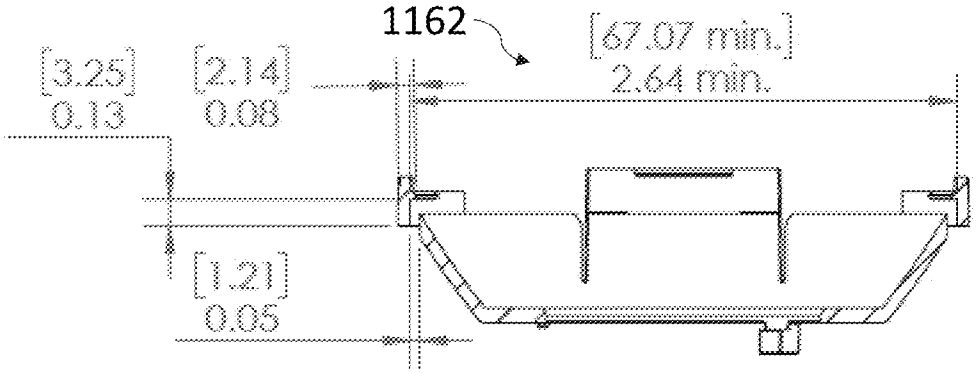
Figure 49E:
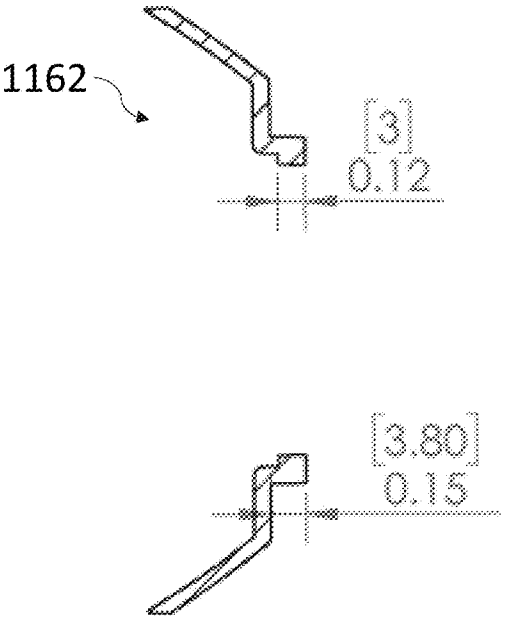

FIG. 49E is a cross-sectional view of the optic holder shown in FIG. 49A along the plane A-A.

FIG. 49F is a cross-sectional view of the optic holder shown in FIG. 49A along the plane B-B.

FIG. 49G is a cross-sectional view of the optic holder shown in FIG. 49A along the plane C-C.

Figure 50B:
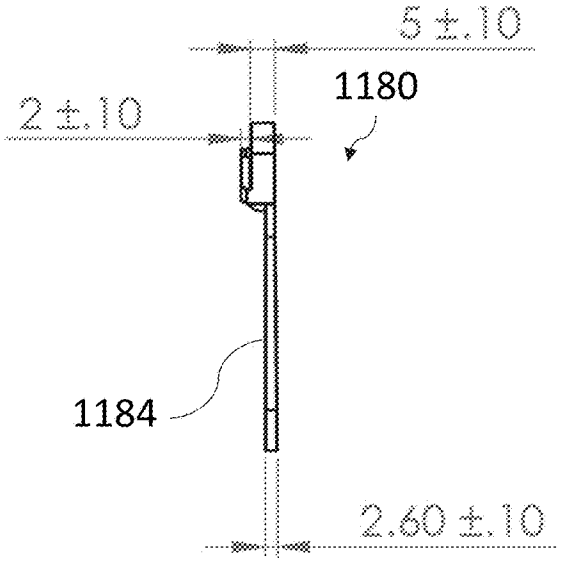
Figure 50D:
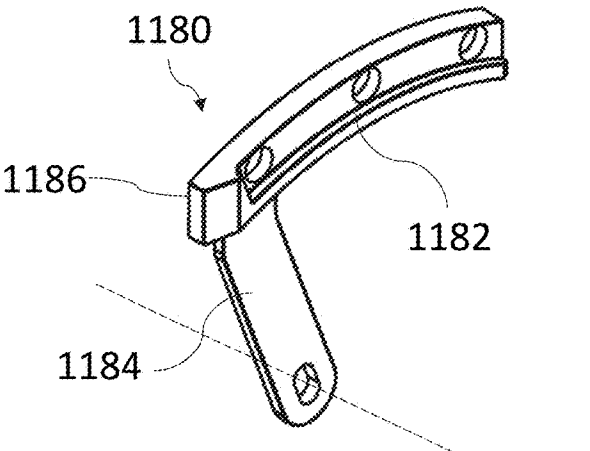
Figure 50A:
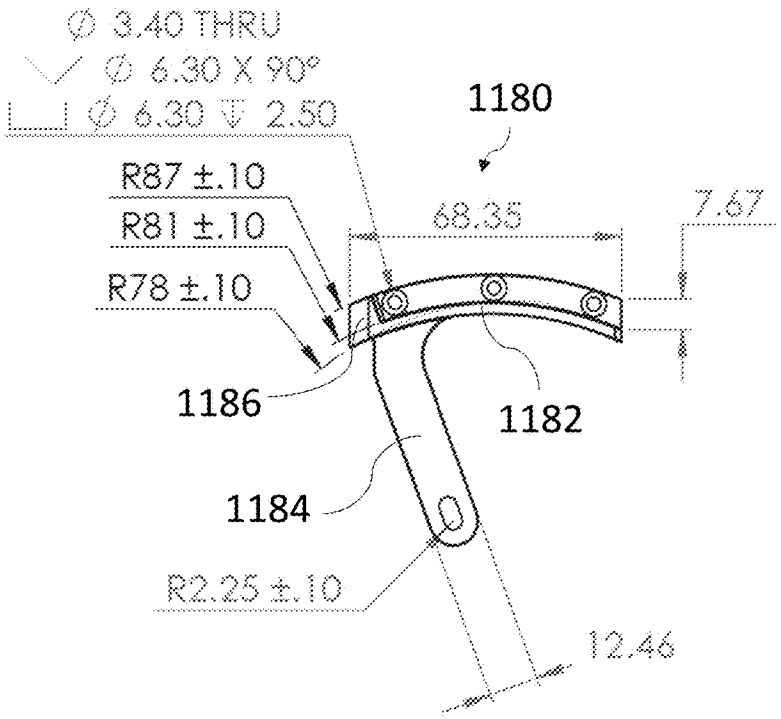

FIG. 50A is a right side view of a heat sink arm of an adjustable lighting apparatus, according to an implementation.

FIG. 50B is a front view of the heat sink arm shown in FIG. 50A.

Figure 50C:
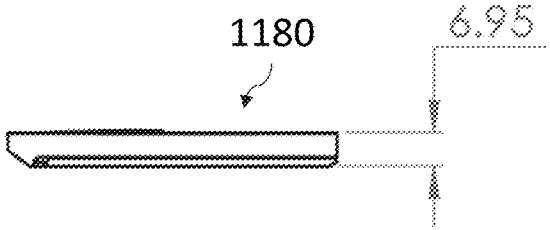

FIG. 50C is a top view of the heat sink arm shown in FIG. 50A.

FIG. 50D is a top, front perspective view of the heat sink arm shown in FIG. 50A.

Figure 51B:
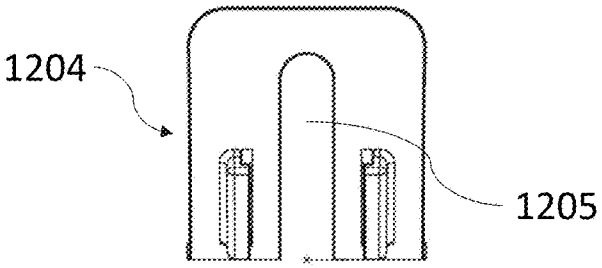
Figure 51C:
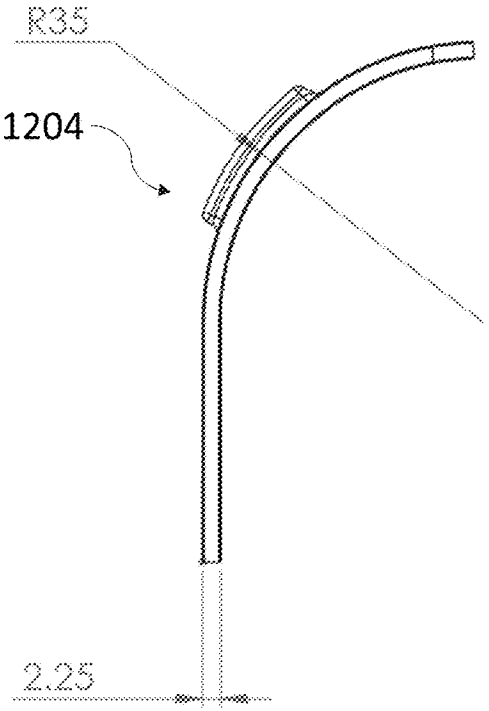
Figure 51A:
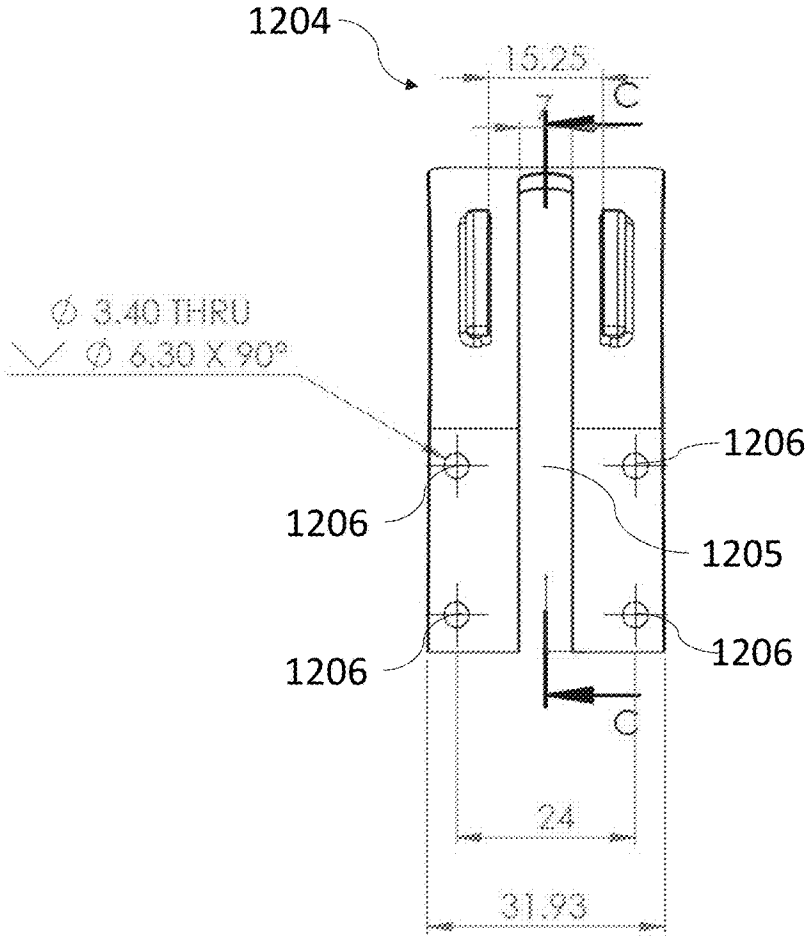

FIG. 51A is a front view of a slider plate of an adjustable lighting apparatus, according to an implementation.

FIG. 51B is a top view of the slider plate shown in FIG. 51A.

FIG. 51C is a left view of the slider plate shown in FIG. 51A.

Figure 51E:
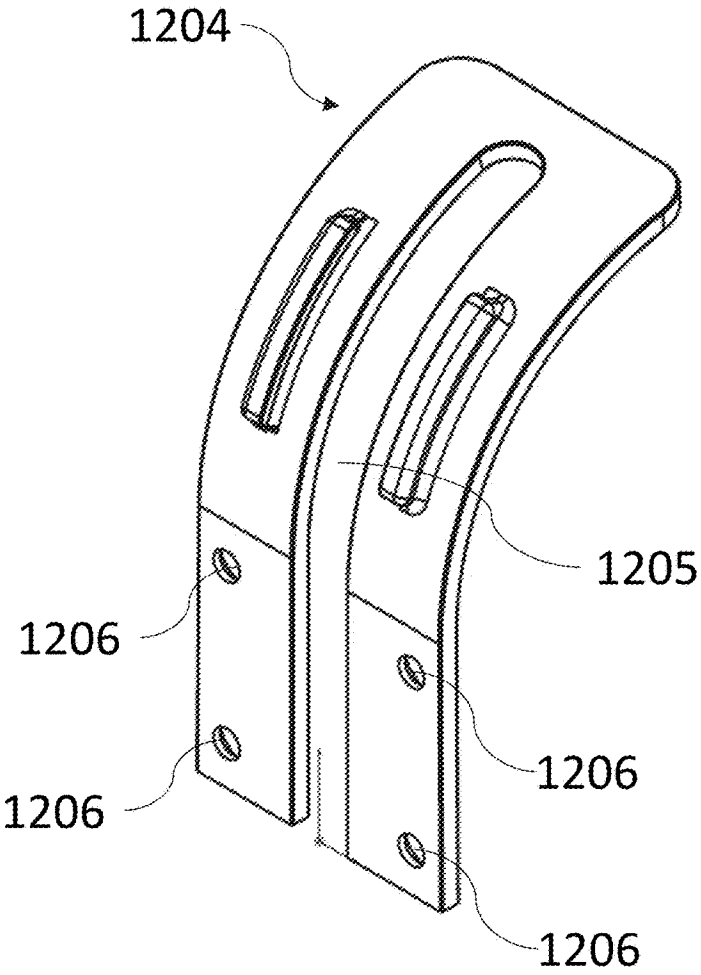
Figure 51D:
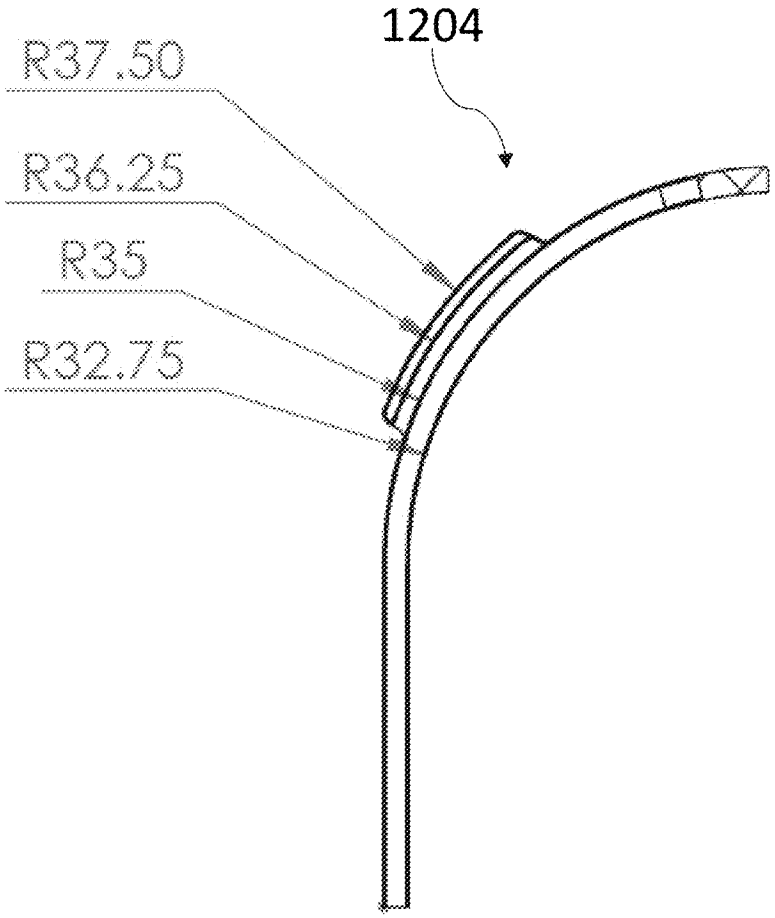

FIG. 51D is a cross-sectional view of the slider plate shown in FIG. 51A along the plane C-C.

FIG. 51E is a top, front, left perspective view of the slider plate shown in FIG. 51A.

Figure 52C:
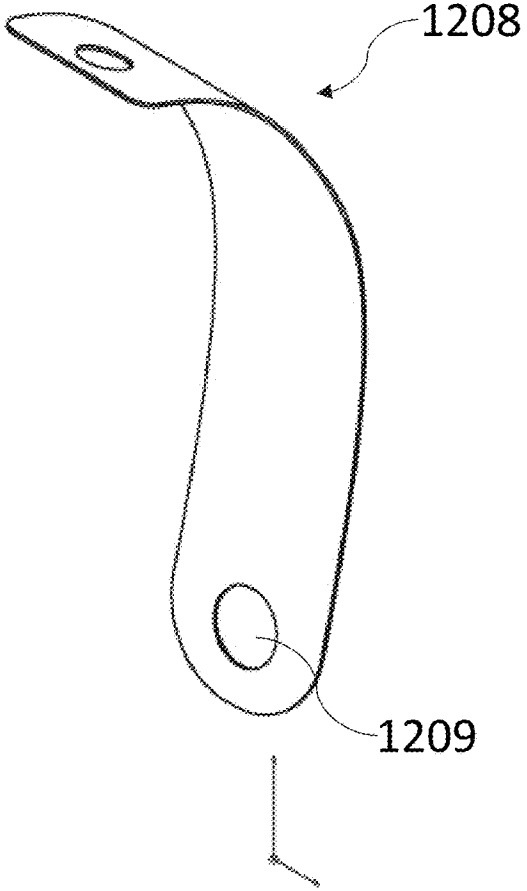
Figure 52B:
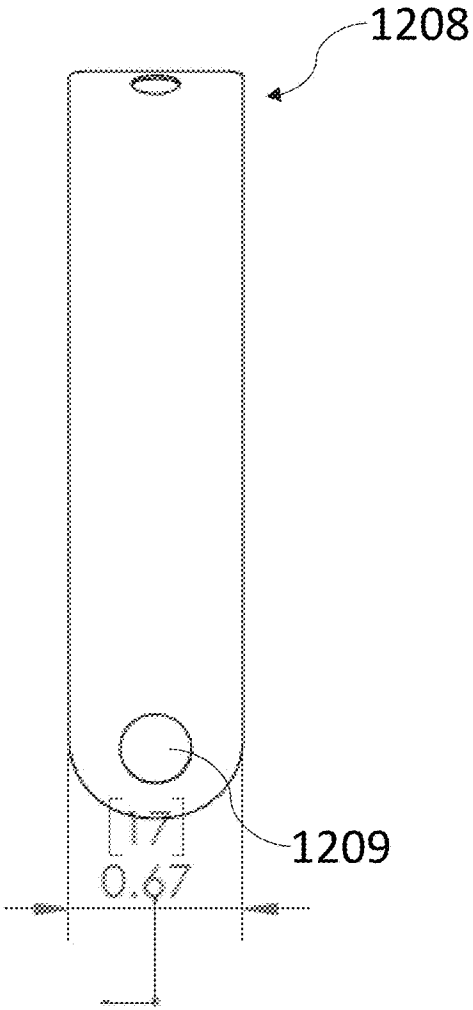
Figure 52A:
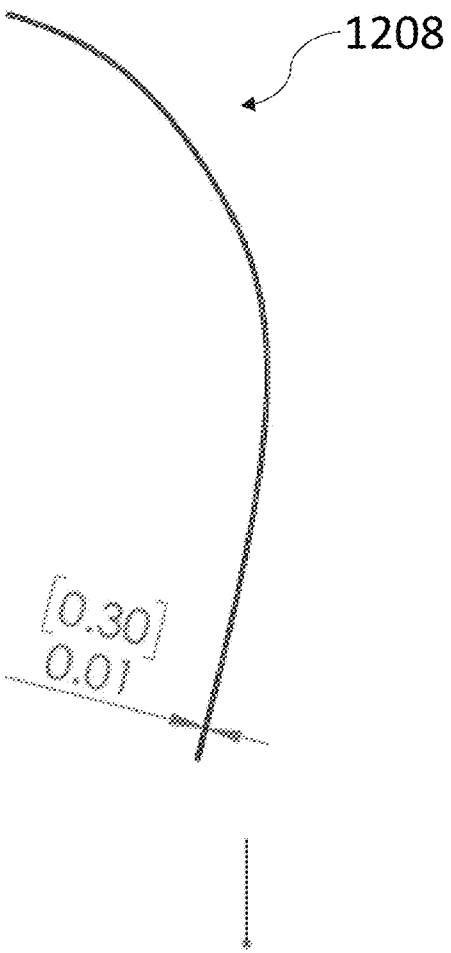

FIG. 52A is a right view of a push spring of an adjustable lighting apparatus, according to an implementation.

FIG. 52B is a front view of the push spring shown in FIG. 52A.

FIG. 52C is a front, right perspective view of the push spring shown in FIG. 52A.

Figure 53B:
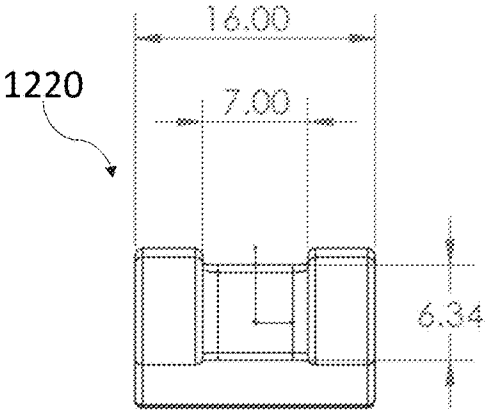
Figure 53D:
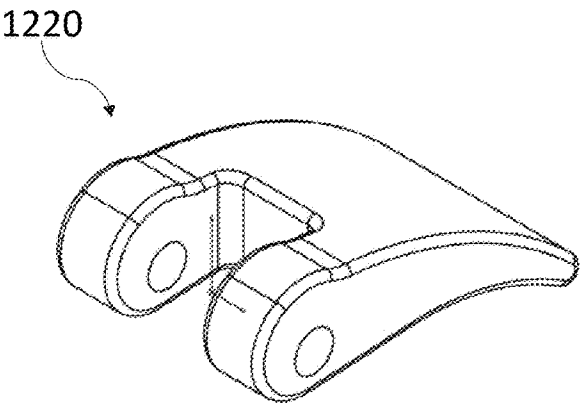
Figure 53A:
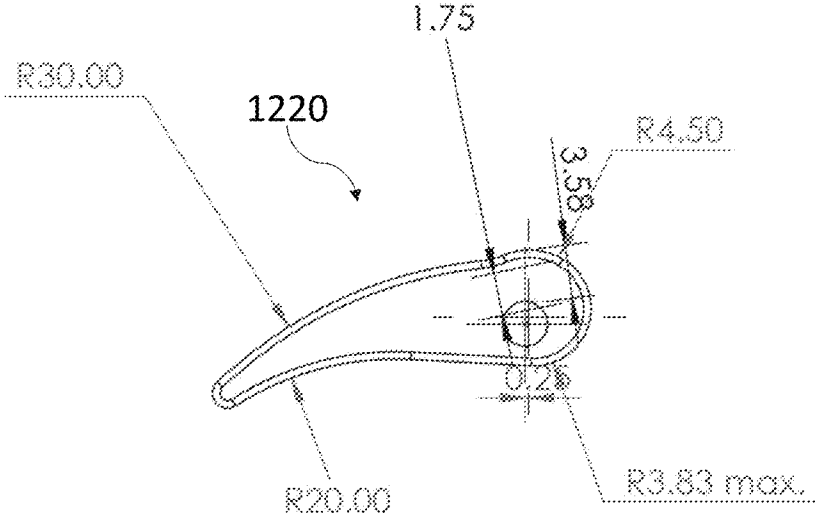

FIG. 53A is a right view of a quick release lever of an adjustable lighting apparatus, according to an implementation.

FIG. 53B is a rear view of the quick release lever shown in FIG. 53A.

Figure 53C:
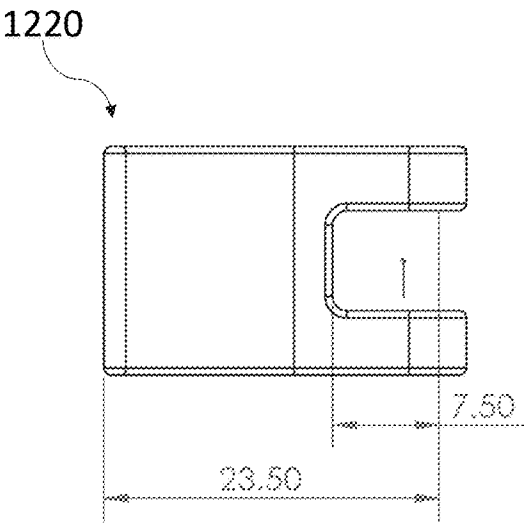

FIG. 53C is a top view of the quick release lever shown in FIG. 53A.

FIG. 53D is a top, rear, right perspective view of the quick release lever shown in FIG. 53A.

Figure 54B:
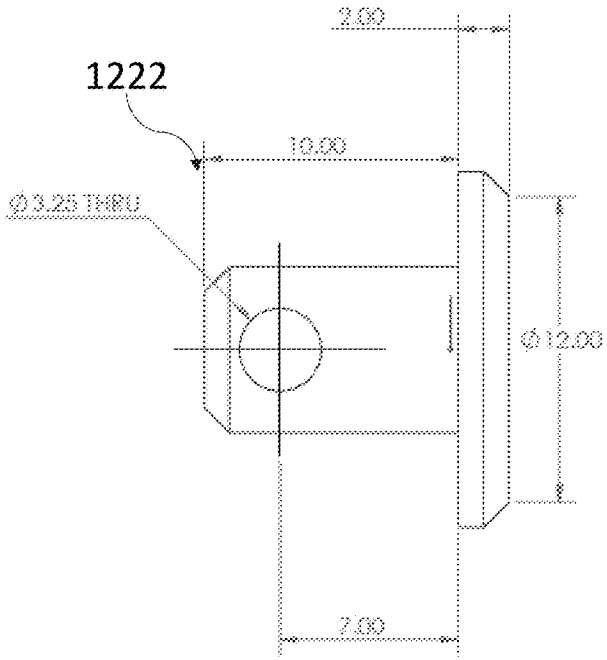
Figure 54A:
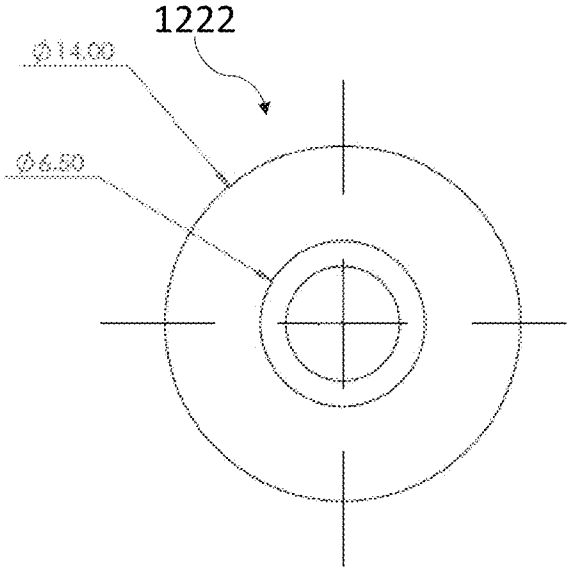

FIG. 54A is a front view of a quick release pin of an adjustable lighting apparatus, according to an implementation.

FIG. 54B is a left view of the quick release pin shown in FIG. 54A.

Figure 54C:
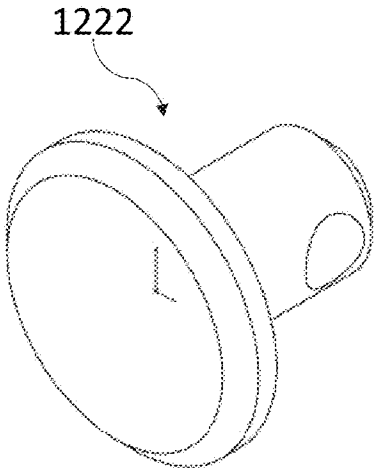

FIG. 54C is a top, rear, right perspective view of the quick release pin shown in FIG. 54A.

Figure 55B:
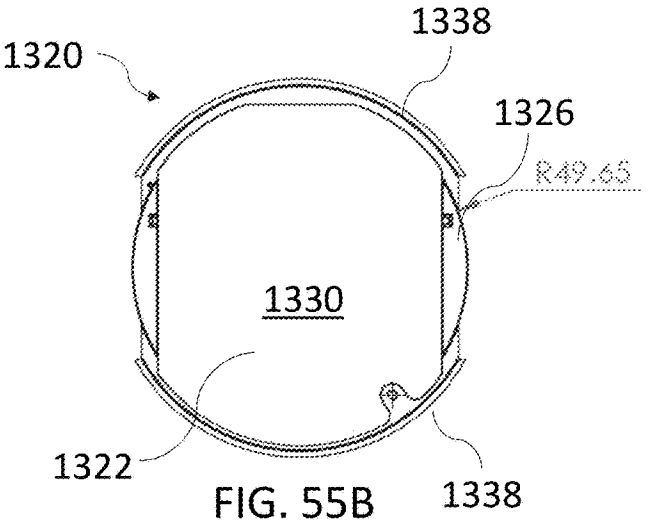
Figure 55A:
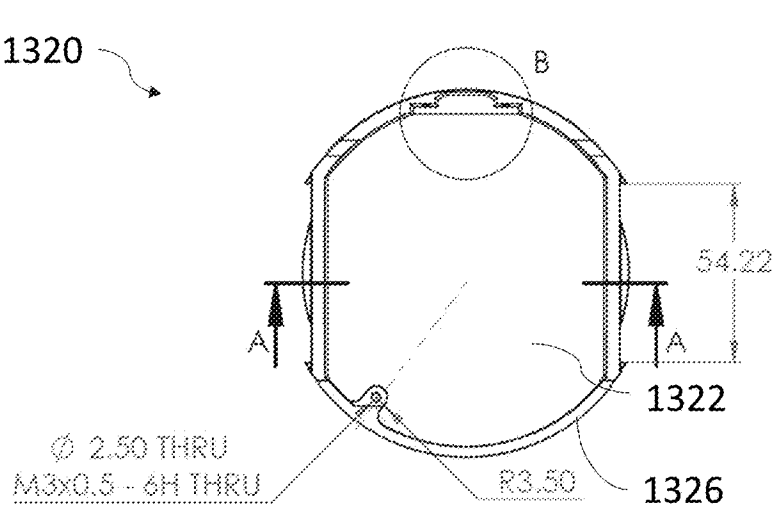

FIG. 55A is a top view of a base structure of an adjustable lighting apparatus, according to an implementation.

FIG. 55B is a bottom view of the base structure shown in FIG. 55A.

Figure 55D:
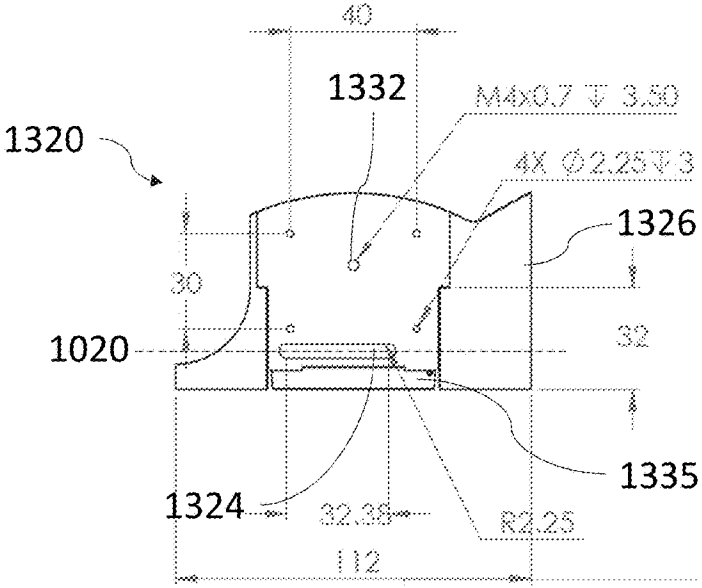
Figure 55C:
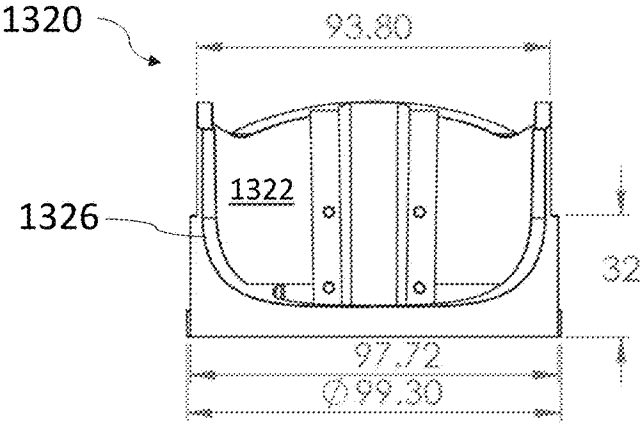

FIG. 55C is a front view of the base structure shown in FIG. 55A.

FIG. 55D is a left view of the base structure shown in FIG. 55A.

Figure 55E:
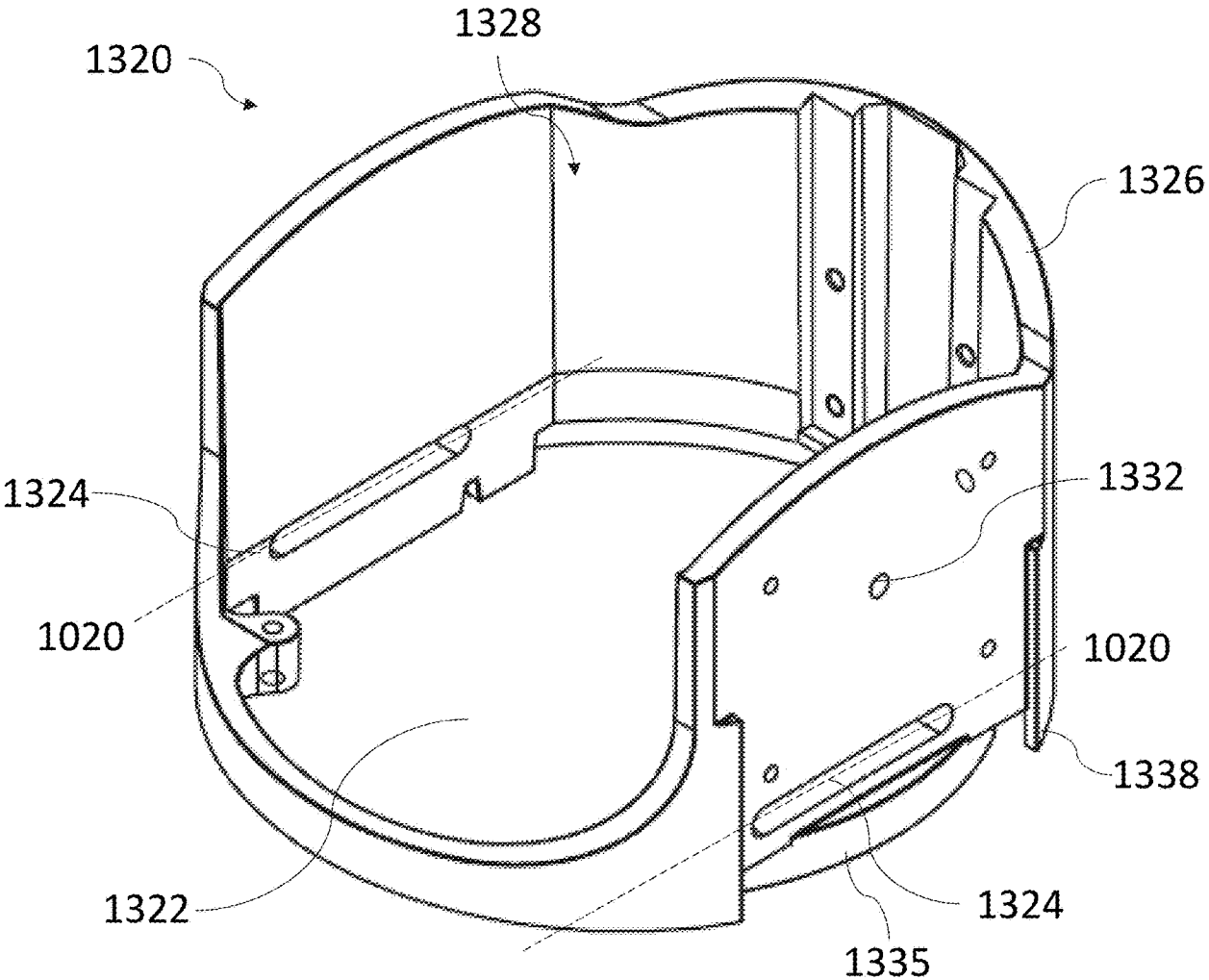

FIG. 55E is a top, front, left perspective view of the base structure shown in FIG. 55A.

Figure 55F:
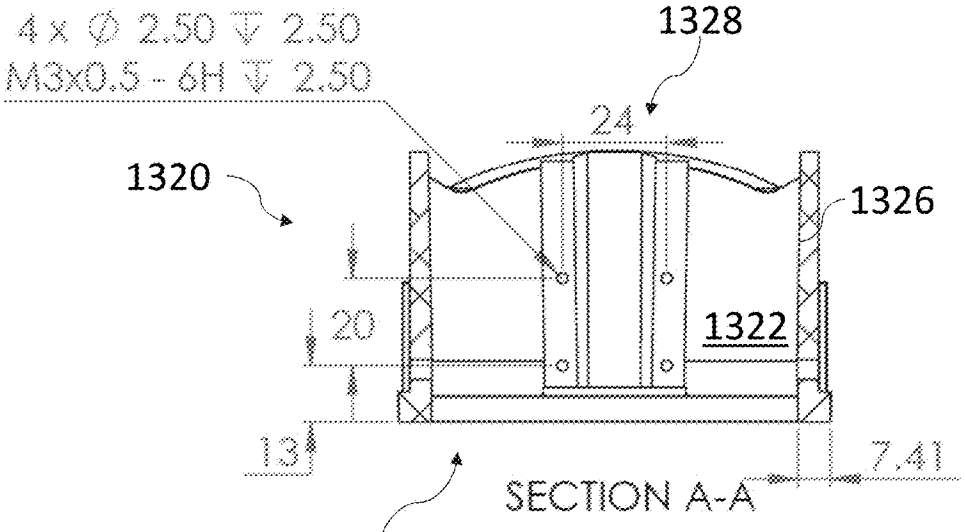

FIG. 55F is a cross-section view of the base structure shown in FIG. 55A along the plane A-A.

Figure 55G:
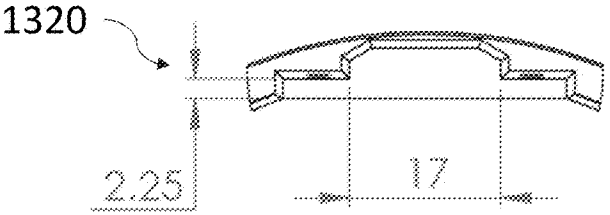

FIG. 55G is a magnified view of the base structure shown in FIG. 55A in the inset B.

FIG. 56A is front view of a retainer of an adjustable lighting apparatus, according to an implementation.

FIG. 56B is a rear view of the retain shown in FIG. 56A.

FIG. 56C is a bottom view of the retainer shown in FIG. 56A.

FIG. 56D is a left view of the retainer shown in FIG. 56A.

Figure 56E:
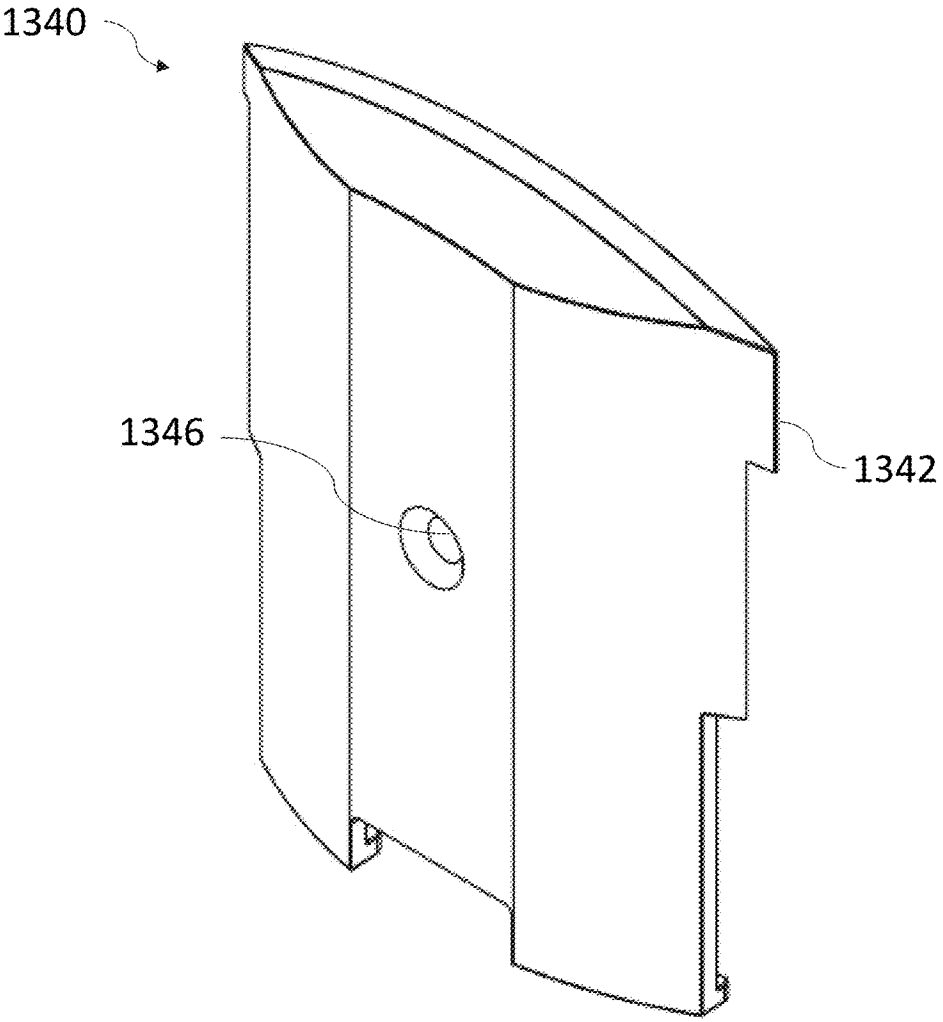

FIG. 56E is a top, front, left perspective view of the retainer shown in FIG. 56A.

Figure 56G:
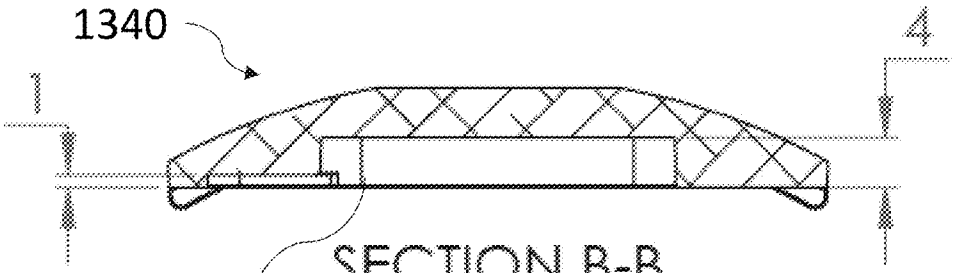
Figure 56H:
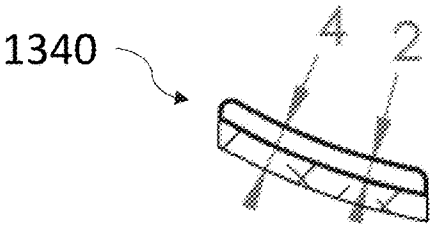
Figure 56F:
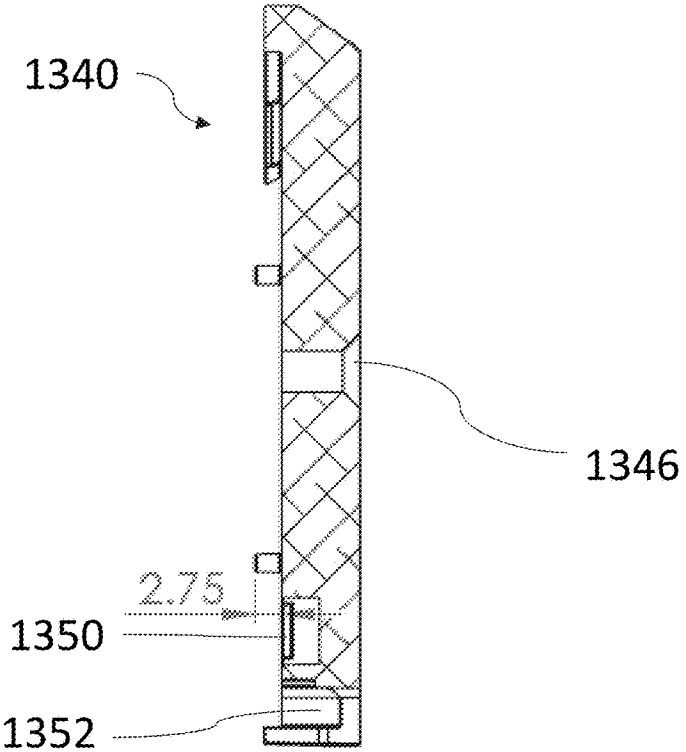

FIG. 56F is a cross-sectional view of the retainer shown in FIG. 56B along the plane A-A.

FIG. 56G is a cross-sectional view of the retainer shown in FIG. 56B along the plane B-B.

FIG. 56H is a cross-sectional view of the retainer shown in FIG. 56A along the plane C-C.

Figure 57B:
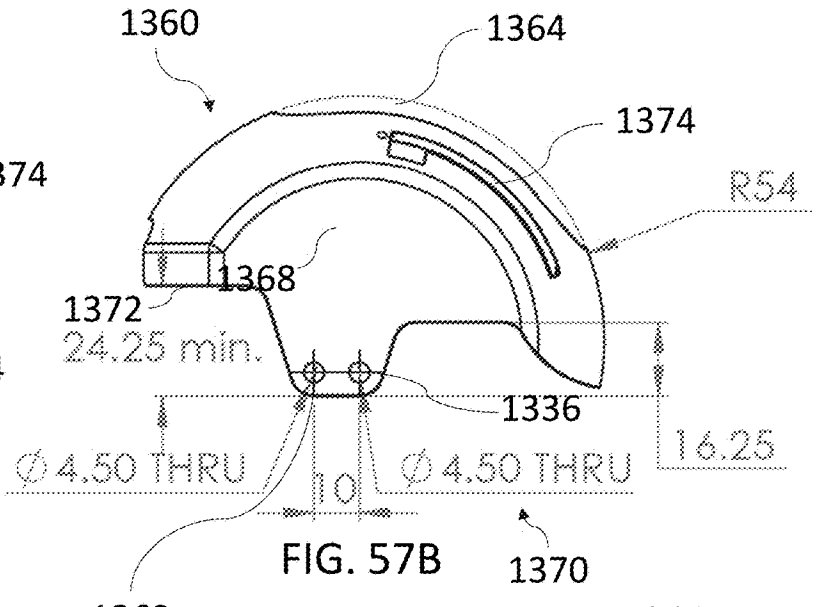
Figure 57D:
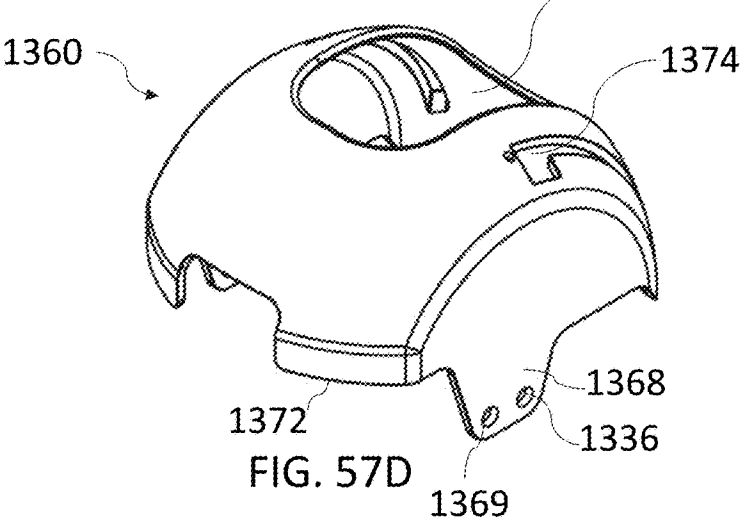
Figure 57A:
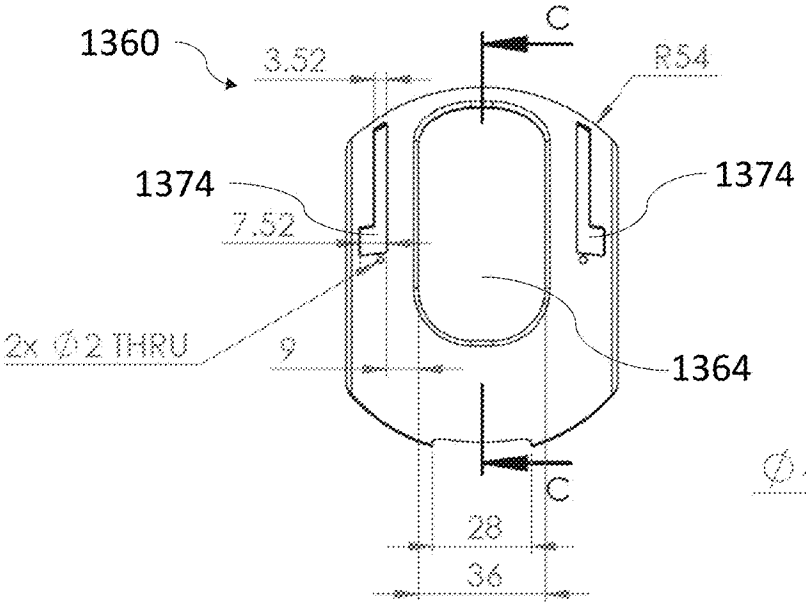

FIG. 57A is a top view of a shield of an adjustable lighting apparatus, according to an implementation.

FIG. 57B is a left view of the shield shown in FIG. 57A.

Figure 57C:
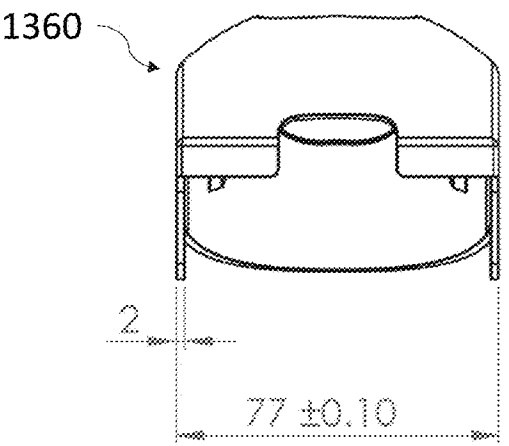

FIG. 57C is a front view of the shield shown in FIG. 57A.

FIG. 57D is a top, front, left perspective view of the shield shown in FIG. 57A.

Figure 57E:
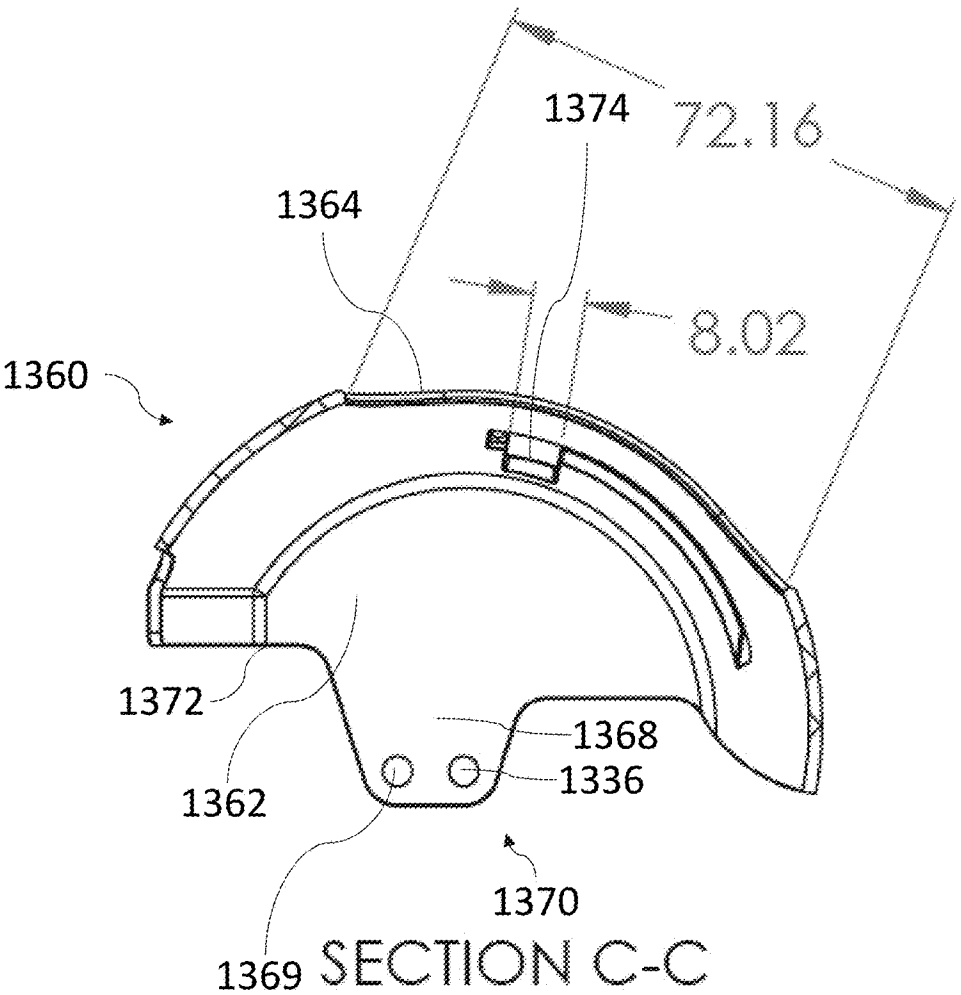

FIG. 57E is a cross-sectional view of the shield shown in FIG. 57A along the plane C-C.

Figure 58B:
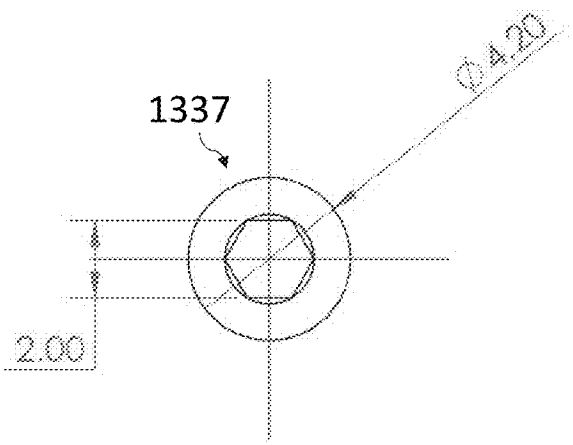
Figure 58A:
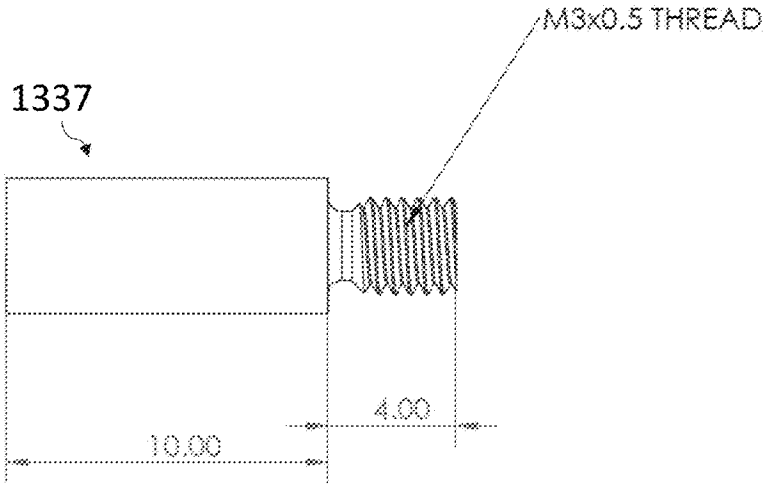

FIG. 58A is a right view of a stabilizing pin of an adjustable lighting apparatus, according to an implementation.

FIG. 58B is a front view of the threaded pin shown in FIG. 58A.

Figure 58C:
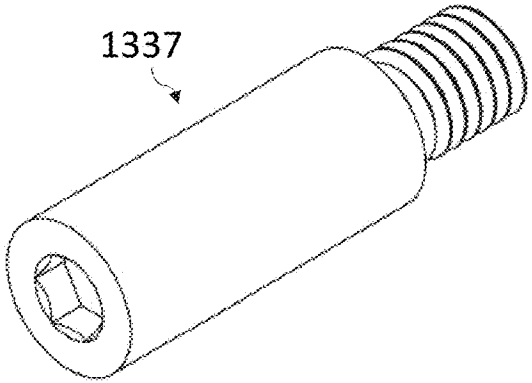

FIG. 58C is a right, front perspective view of the threaded pin shown in FIG. 58A.

Figure 59B:
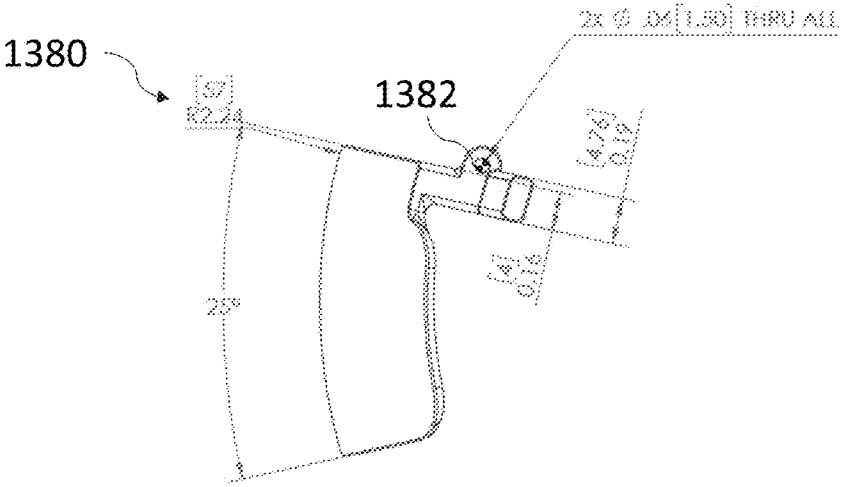
Figure 59A:
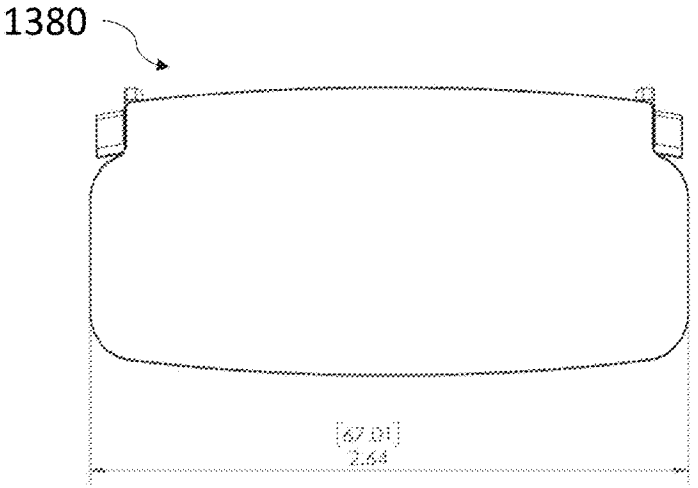

FIG. 59A is a front view of a secondary shield of an adjustable lighting apparatus, according to an implementation.

FIG. 59B is a left view of the secondary shield shown in FIG. 59A.

Figure 59D:
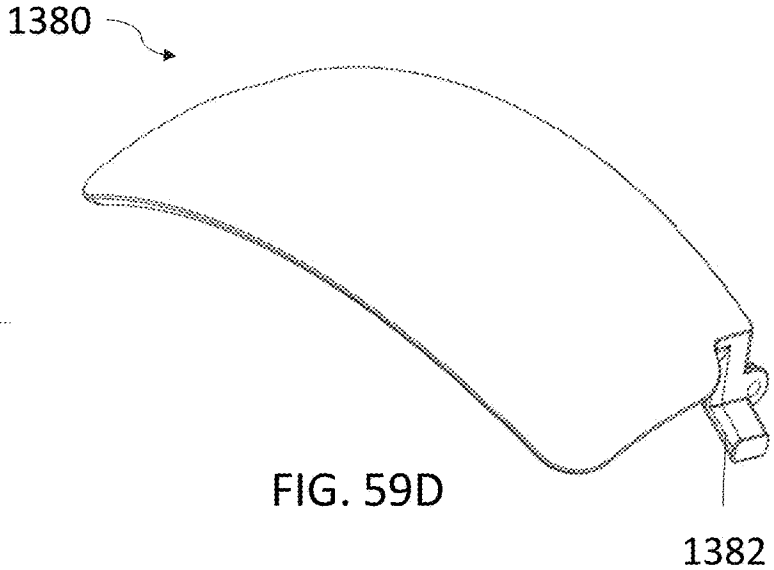
Figure 59C:
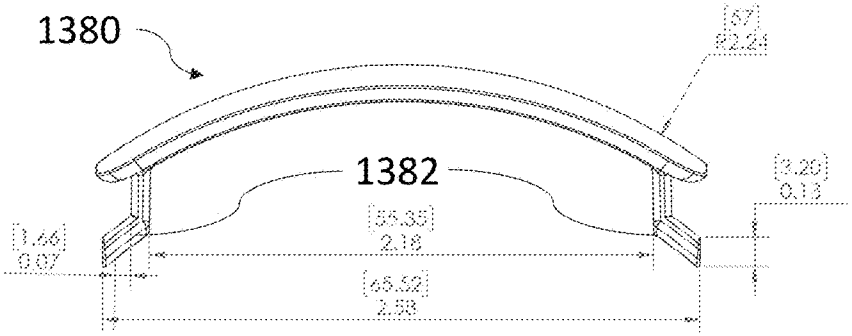

FIG. 59C is a top view of the secondary shield shown in FIG. 59A.

FIG. 59D is a front, left perspective view of the secondary shield shown in FIG. 59A.

Figure 60B:
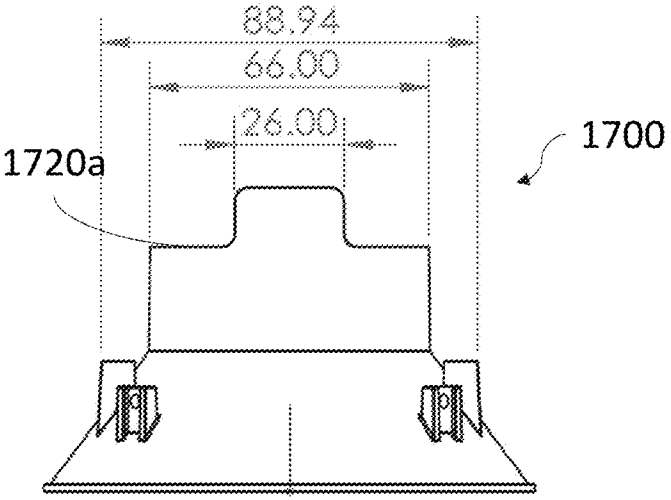
Figure 60A:
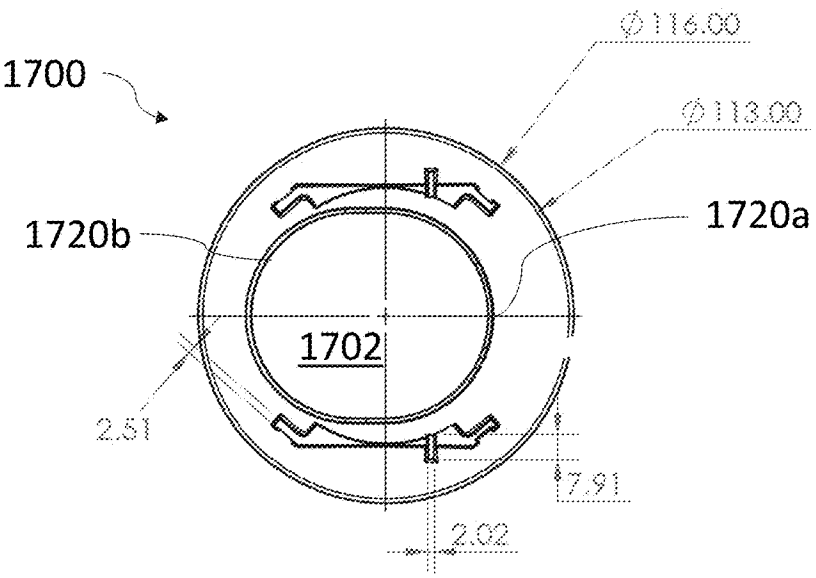

FIG. 60A is a top view of a trim of an adjustable lighting apparatus, according to an implementation.

FIG. 60B is a front side view of the trim shown in FIG. 60A.

Figure 60D:
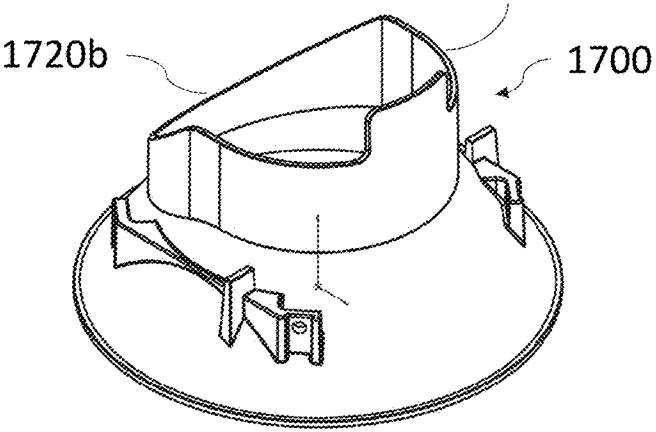
Figure 60C:
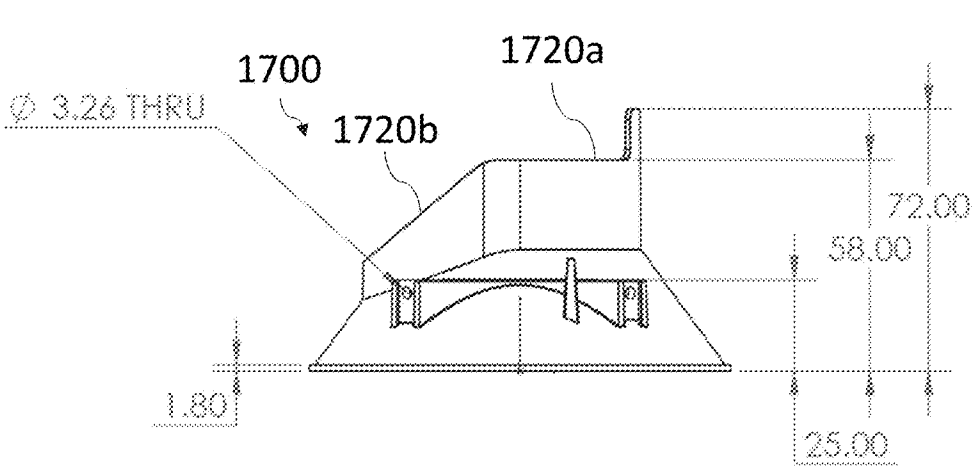

FIG. 60C is a right view of the trim shown in FIG. 60A.

FIG. 60D is a top, front, right perspective view of the trim shown in FIG. 60A.

Figure 61A:
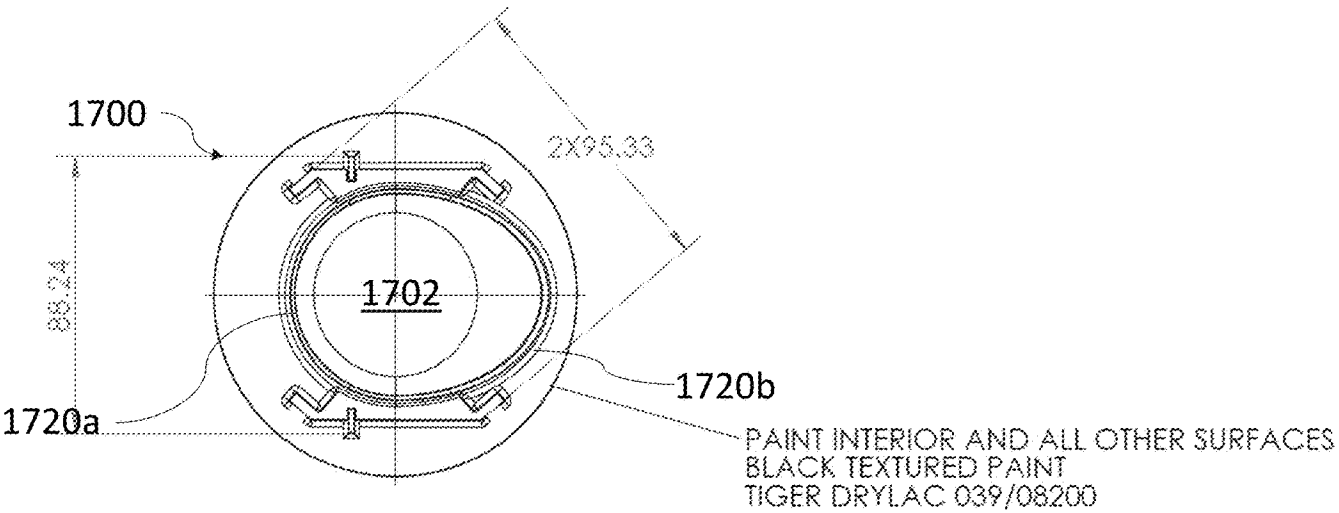

FIG. 61A is a top view of a trim of an adjustable lighting apparatus, according to an implementation.

Figure 61B:
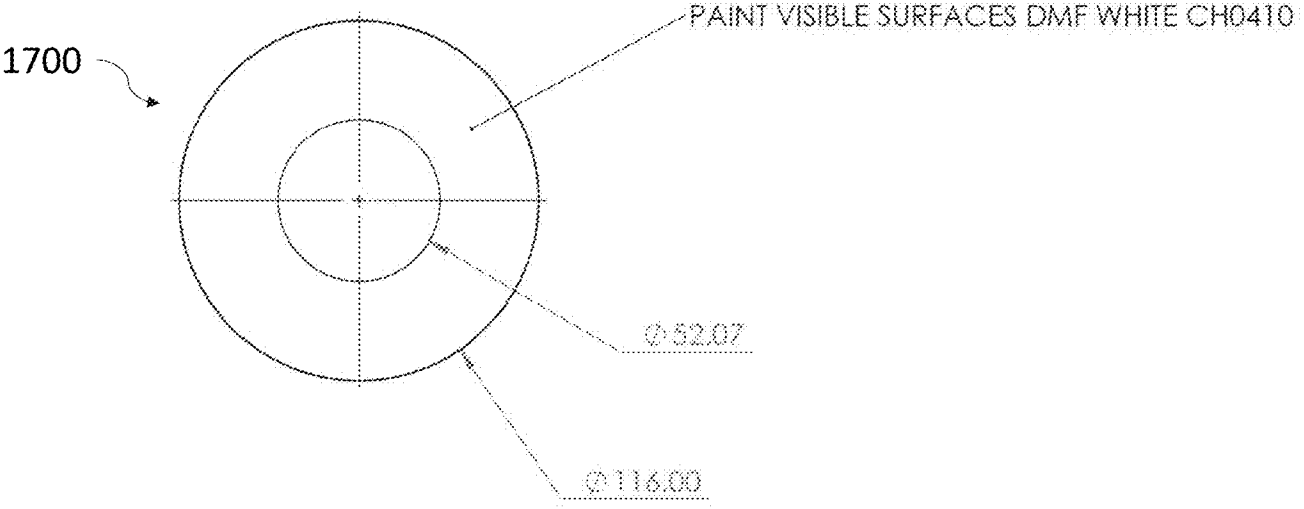

FIG. 61B is a bottom view of the trim shown in FIG. 61A.

Figure 61C:
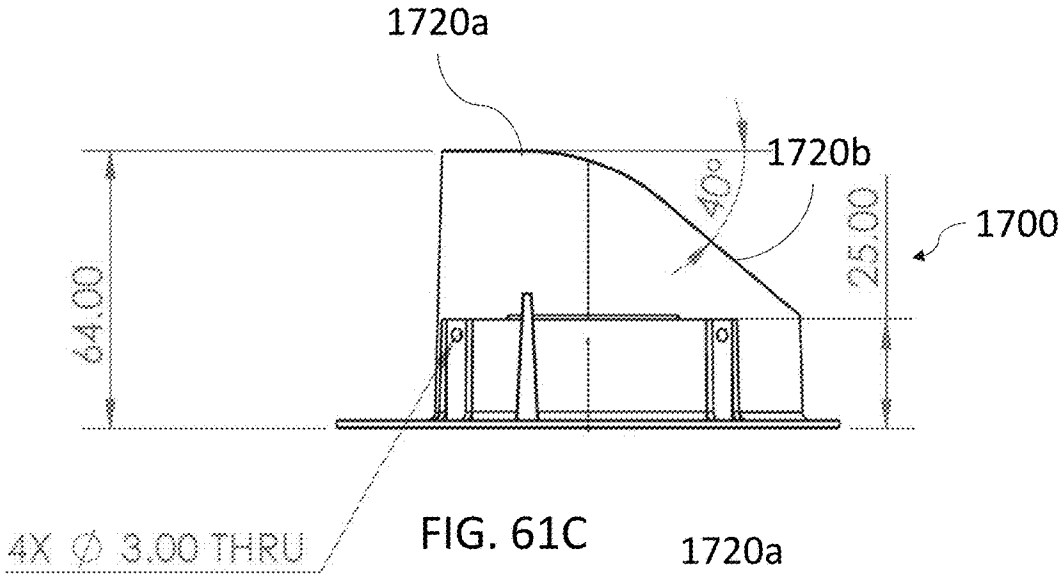

FIG. 61C is a right view of the trim shown in FIG. 61A.

Figure 61E:
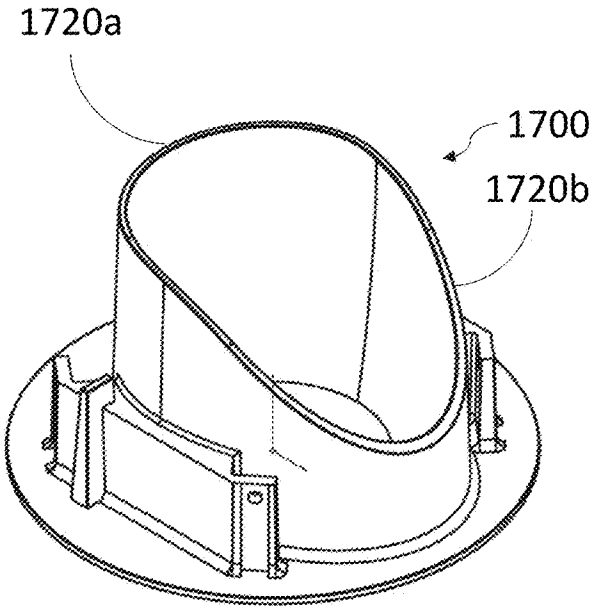
Figure 61D:
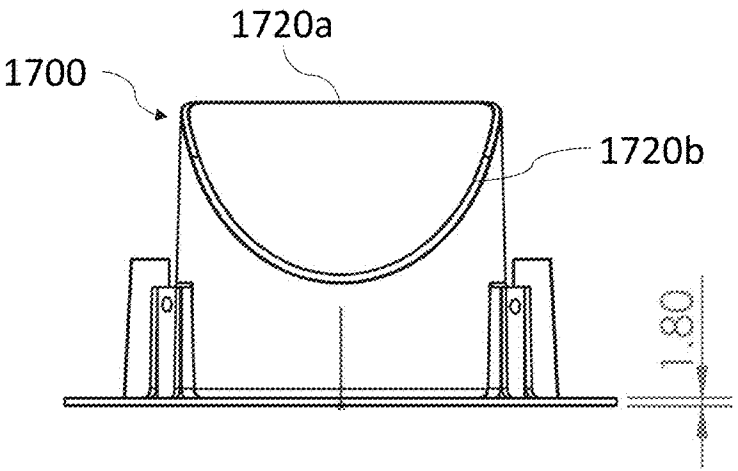

FIG. 61D is a front view of the trim shown in FIG. 61A.

FIG. 61E is a top, front, right perspective view of the trim shown in FIG. 61A.

Figure 62A:
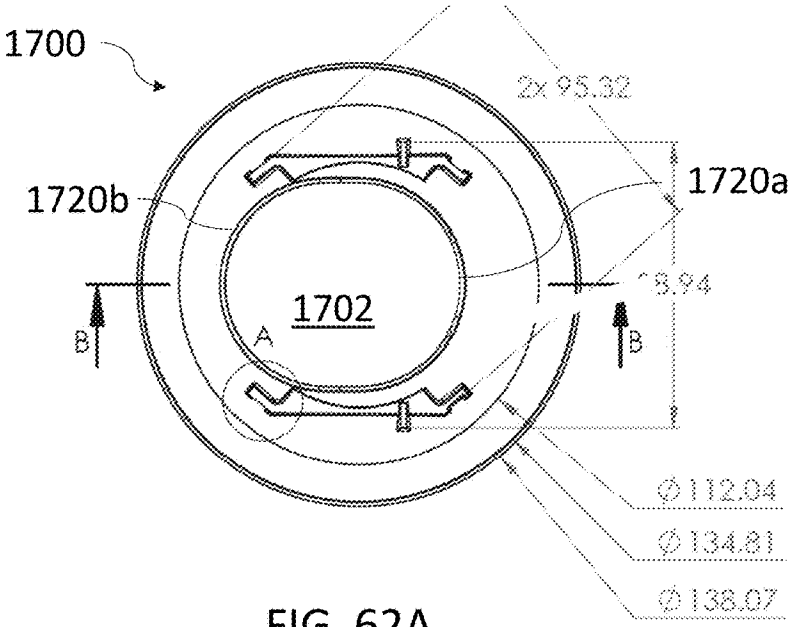

FIG. 62A is a top view of a trim of an adjustable lighting apparatus, according to an implementation.

Figure 62B:
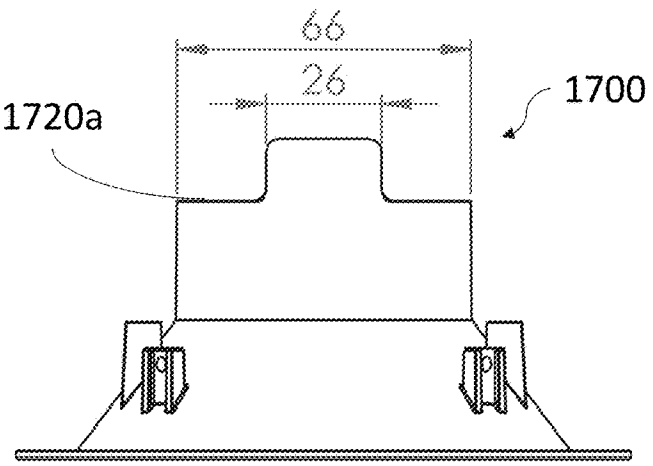

FIG. 62B is a front side view of the trim shown in FIG. 62A.

Figure 62C:
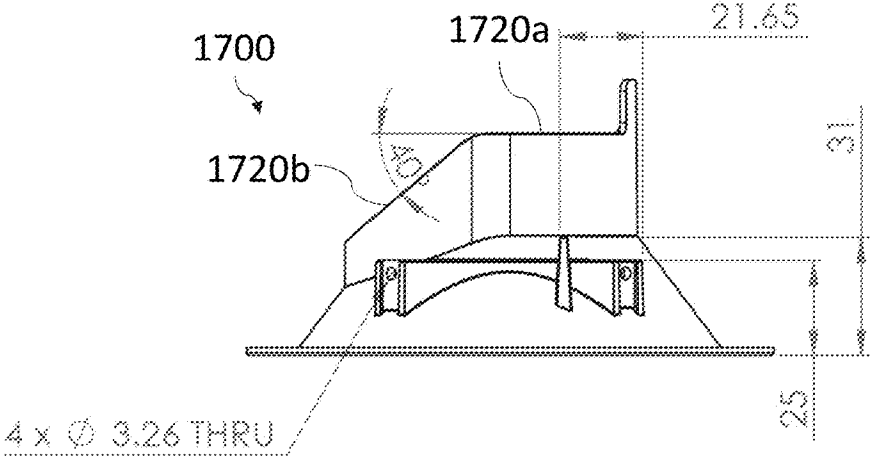

FIG. 62C is a right view of the trim shown in FIG. 62A.

Figure 62D:
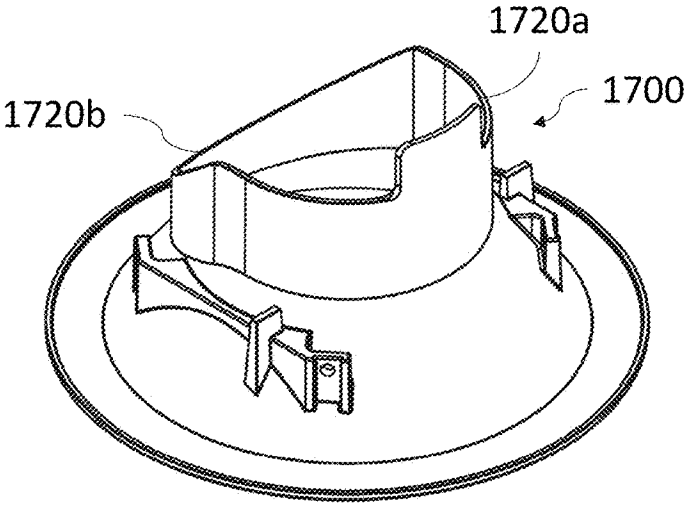

FIG. 62D is a top, front, right perspective view of the trim shown in FIG. 62A.

Figure 62E:
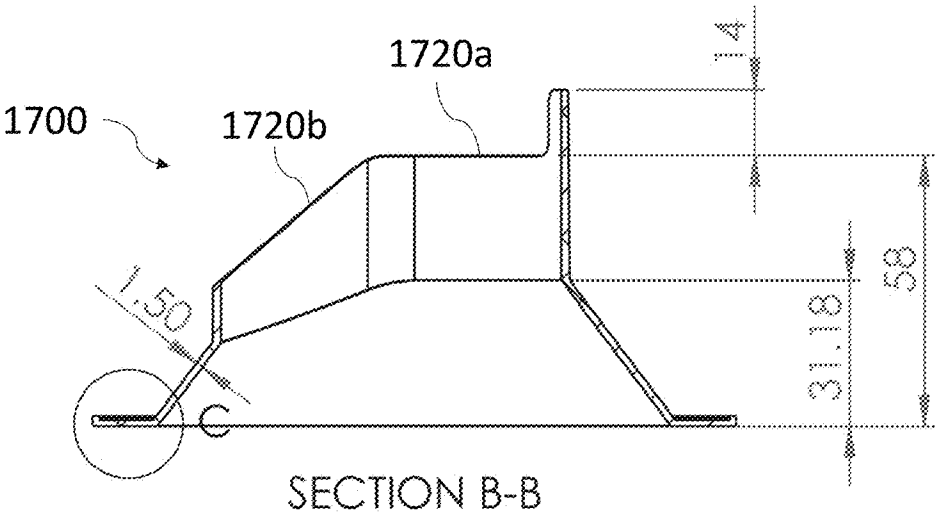

FIG. 62E is a cross-sectional view of the trim shown in FIG. 62A along the plane B-B.

Figure 62G:
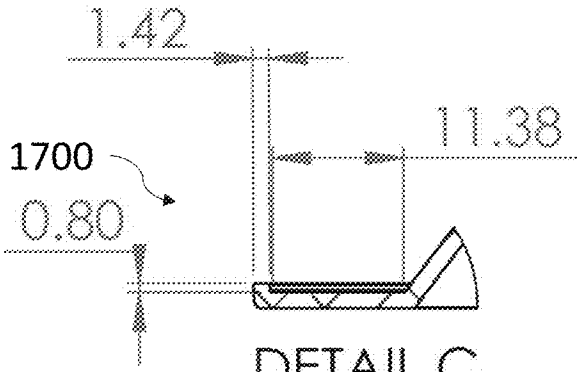
Figure 62F:
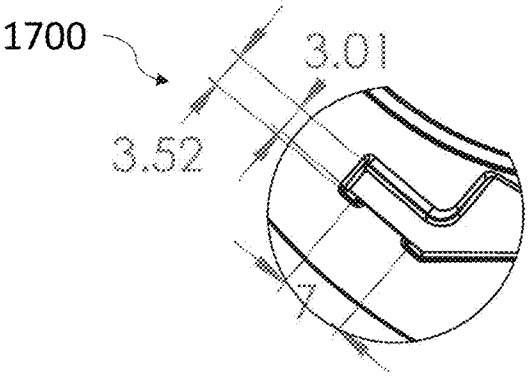

FIG. 62F is a magnified view of the trim shown in FIG. 62A in inset A.

FIG. 62G is a magnified view of the trim shown in FIG. 62E in inset C.

Figure 63A:
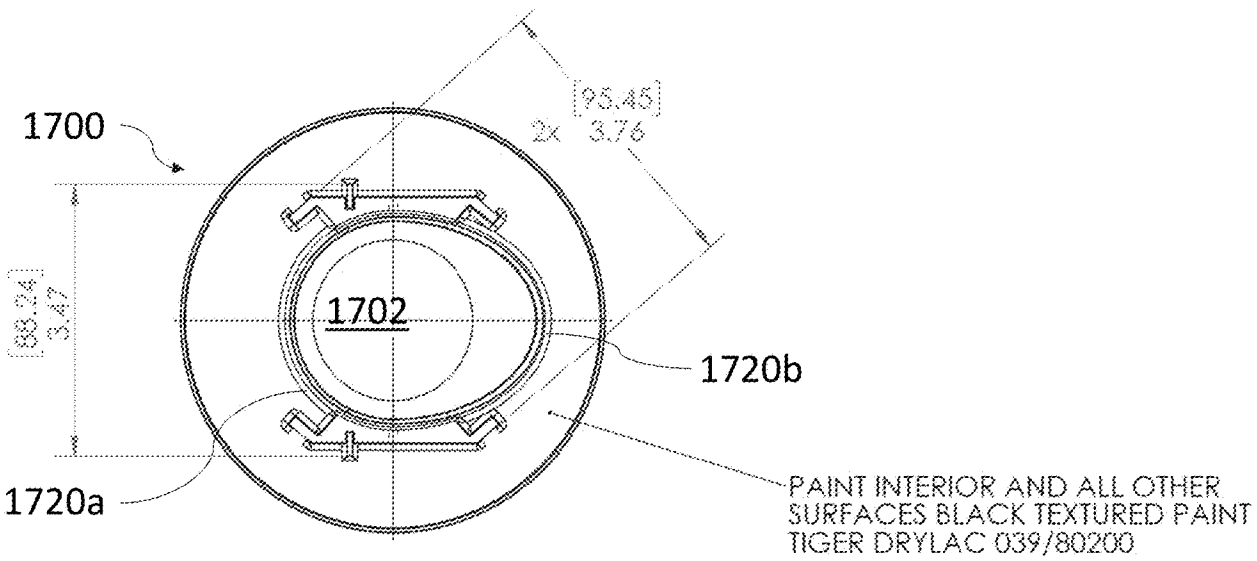

FIG. 63A is a top view of a trim of an adjustable lighting apparatus, according to an implementation.

Figure 63B:
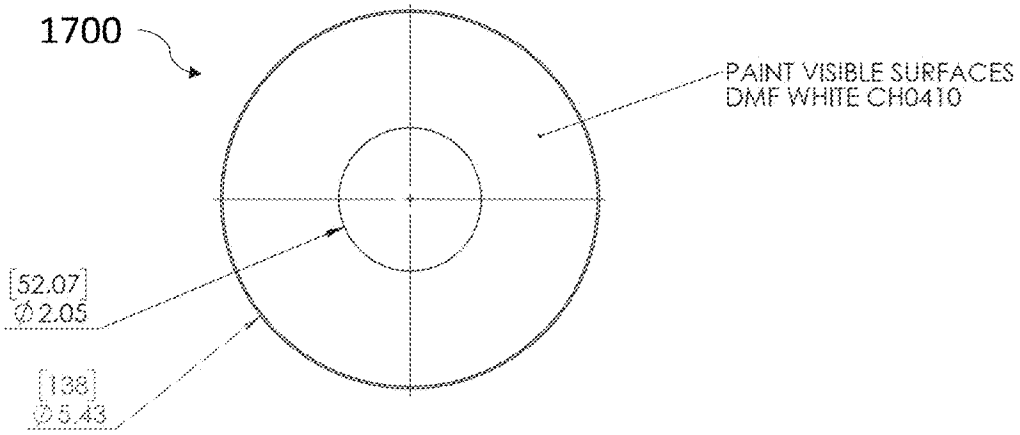

FIG. 63B is a bottom view of the trim shown in FIG. 63A.

Figure 63C:
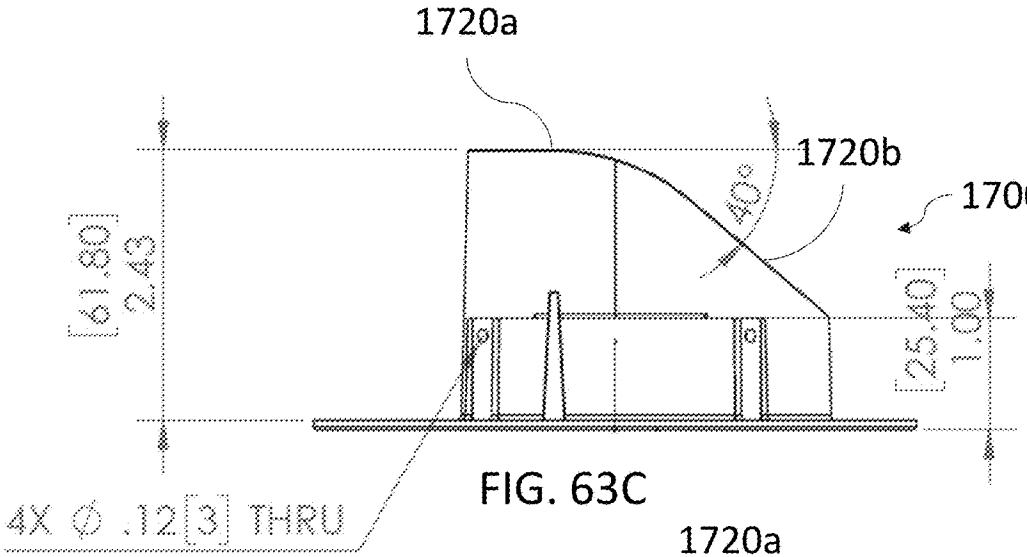

FIG. 63C is a right view of the trim shown in FIG. 63A.

Figure 63E:
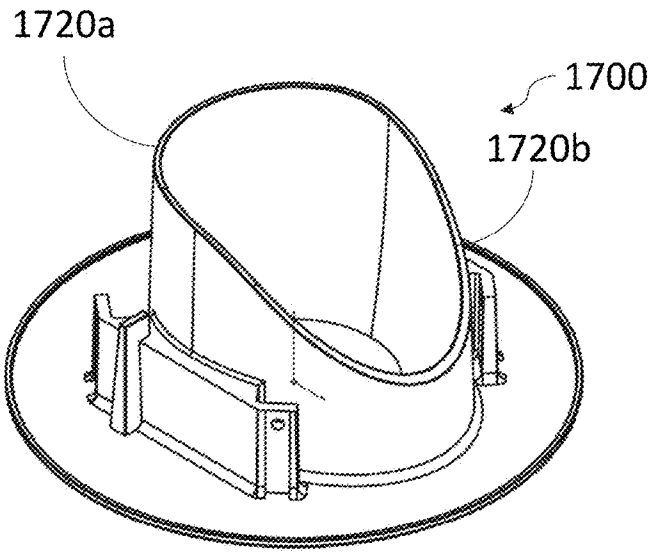
Figure 63D:
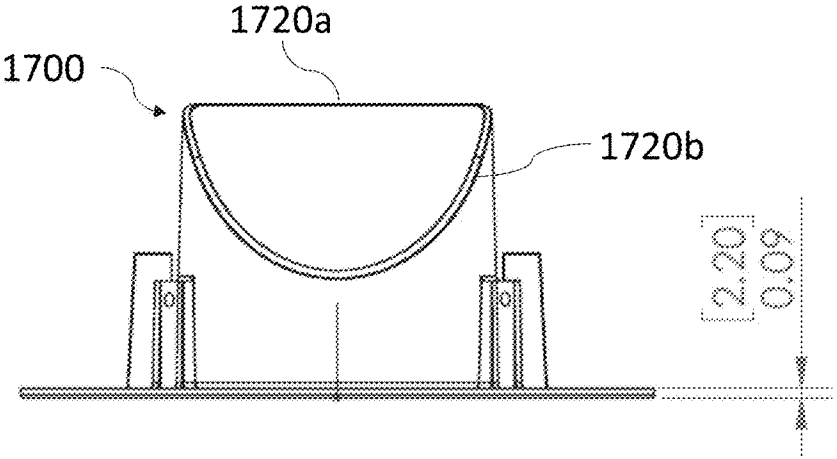

FIG. 63D is a front view of the trim shown in FIG. 63A.

FIG. 63E is a top, front, right perspective view of the trim shown in FIG. 63A.

Figure 64B:
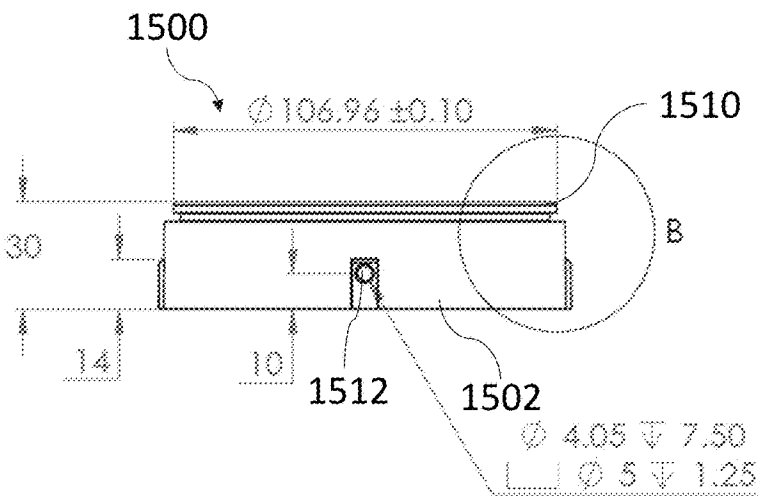
Figure 64D:
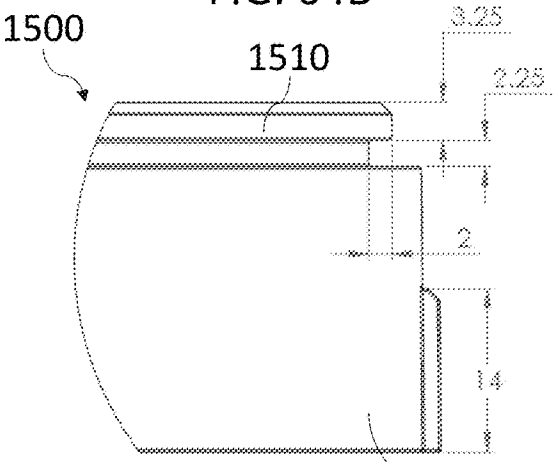
Figure 64A:
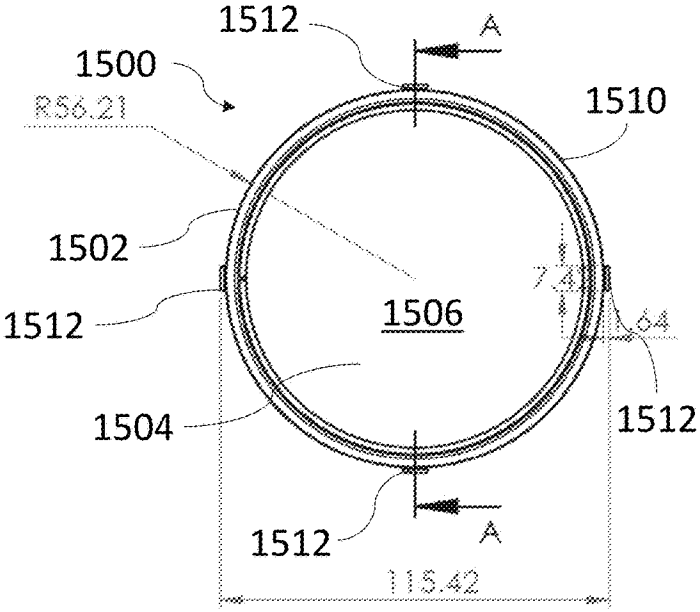

FIG. 64A is a top view of a rotation ring of an adjustable lighting apparatus, according to an implementation.

FIG. 64B is a right view of the rotation ring shown in FIG. 64A.

Figure 64C:
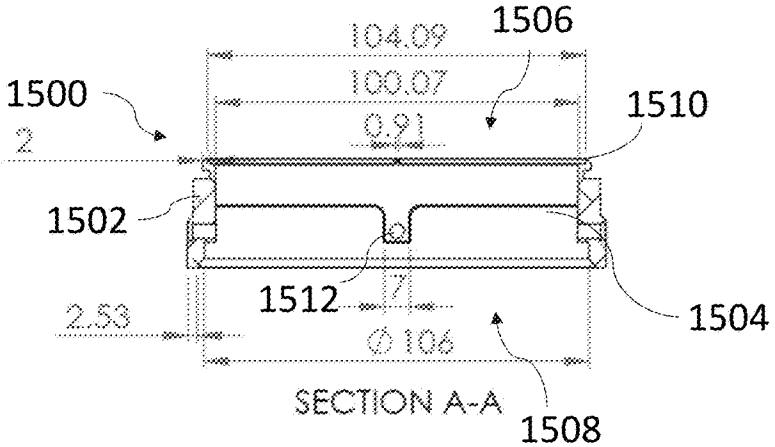

FIG. 64C is a cross-sectional view of the rotation ring shown in FIG. 64A along the plane A-A.

FIG. 64D is a magnified view of the rotation ring shown in FIG. 64B in inset B.

Figure 64E:
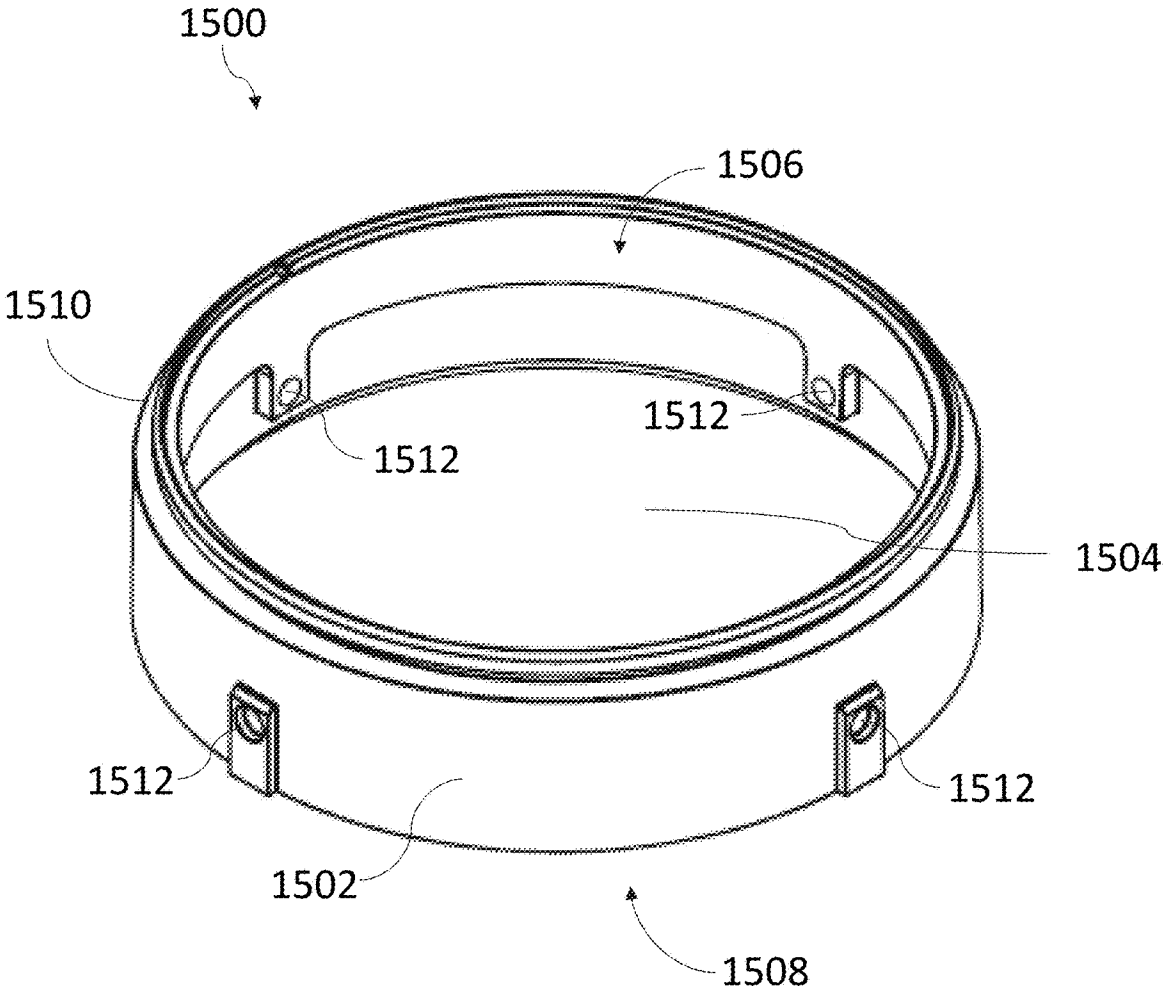

FIG. 64E is a top, right perspective view of the rotation ring shown in FIG. 64A.

Figure 65A:
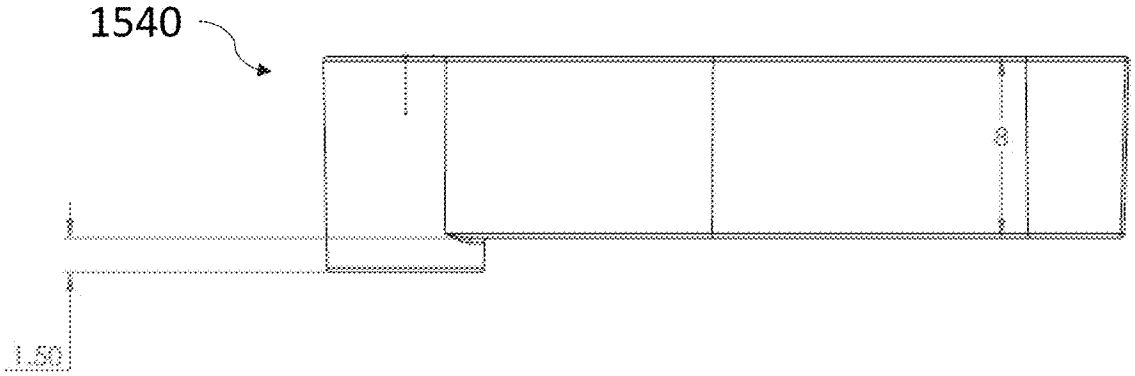

FIG. 65A is a right view of a rotation lock of an adjustable lighting apparatus, according to an implementation.

Figure 65C:
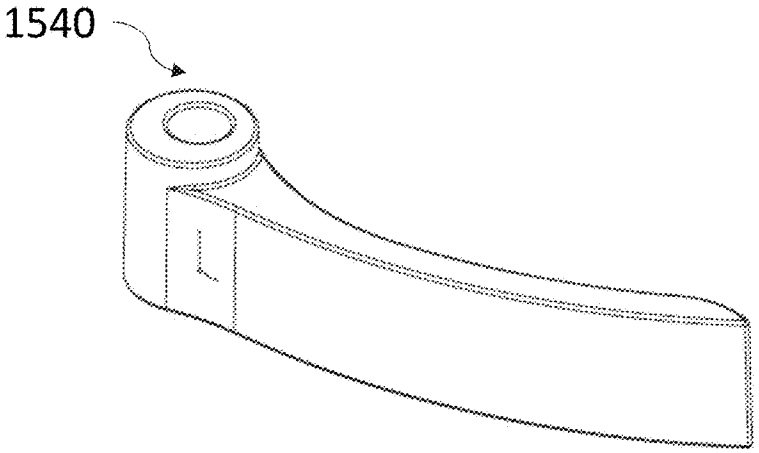
Figure 65B:
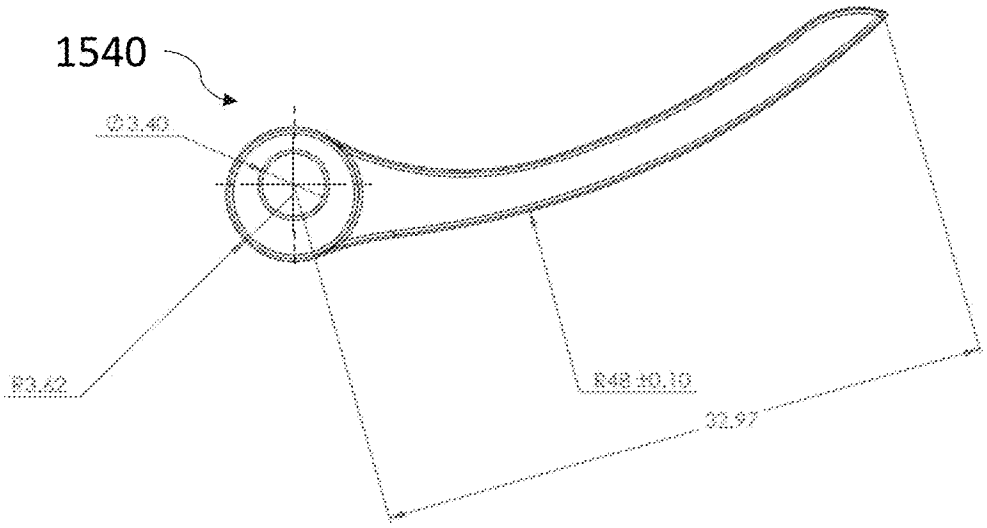

FIG. 65B is a top view of the rotation lock shown in FIG. 65A.

FIG. 65C is a top, right perspective view of the rotation lock shown in FIG. 65A.

Figure 66A:
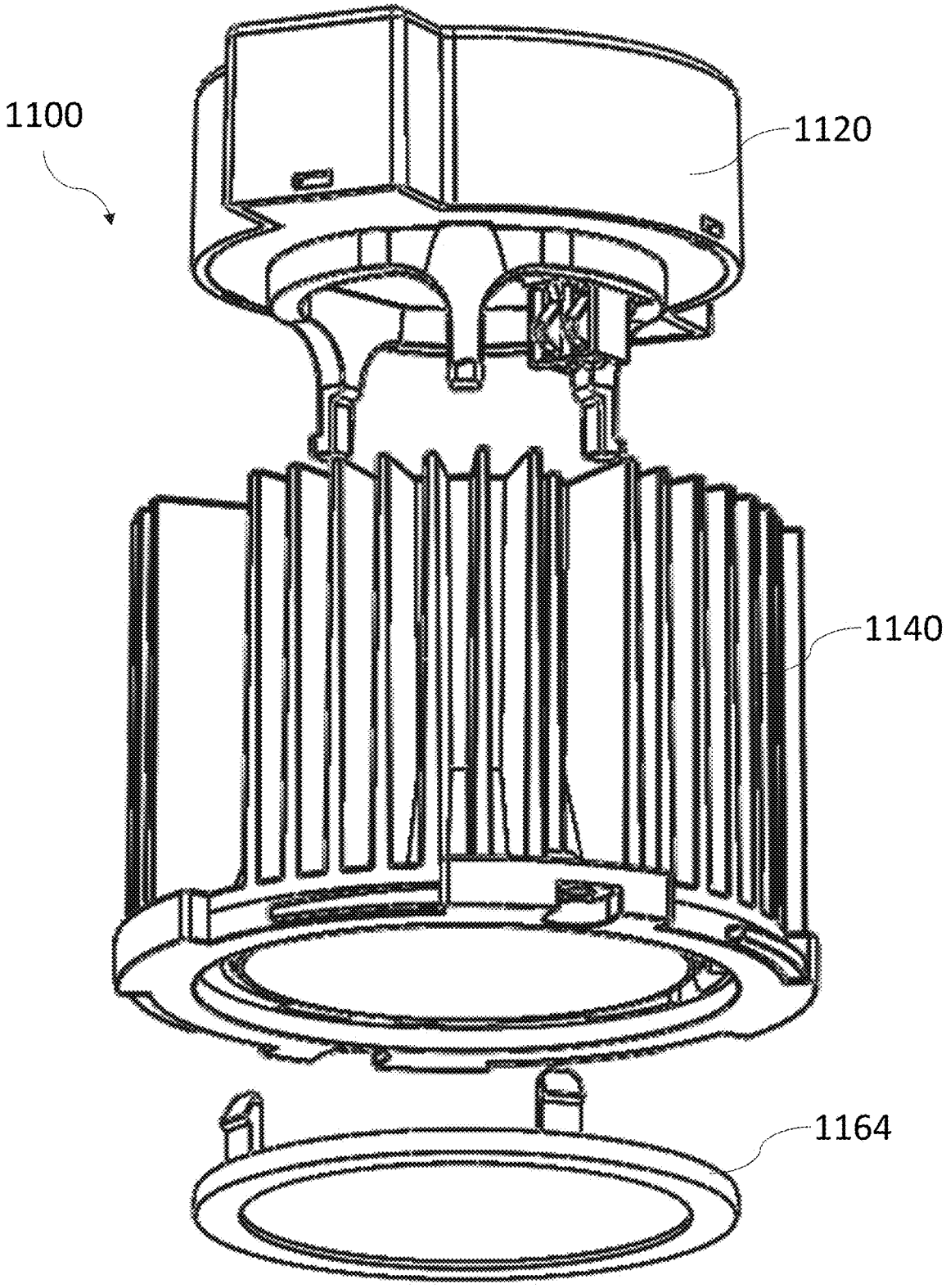

FIG. 66A is a bottom, front perspective exploded view of a light module with a driver assembly and an optic, according to an implementation.

Figure 66B:
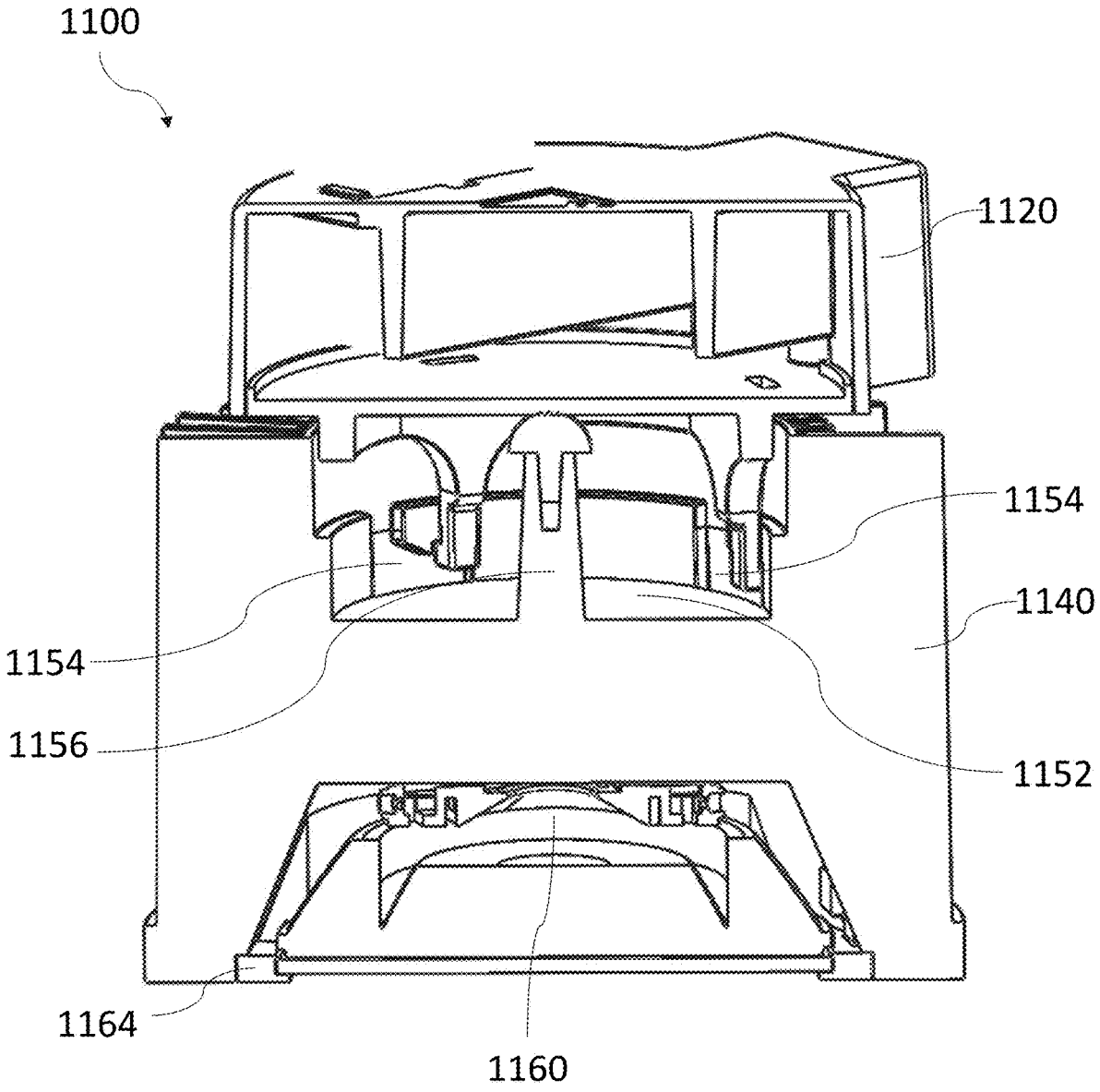

FIG. 66B is a top, front cross-sectional view of the light module, the driver assembly, and the optic shown in FIG. 66A assembled together.

Figure 66C:
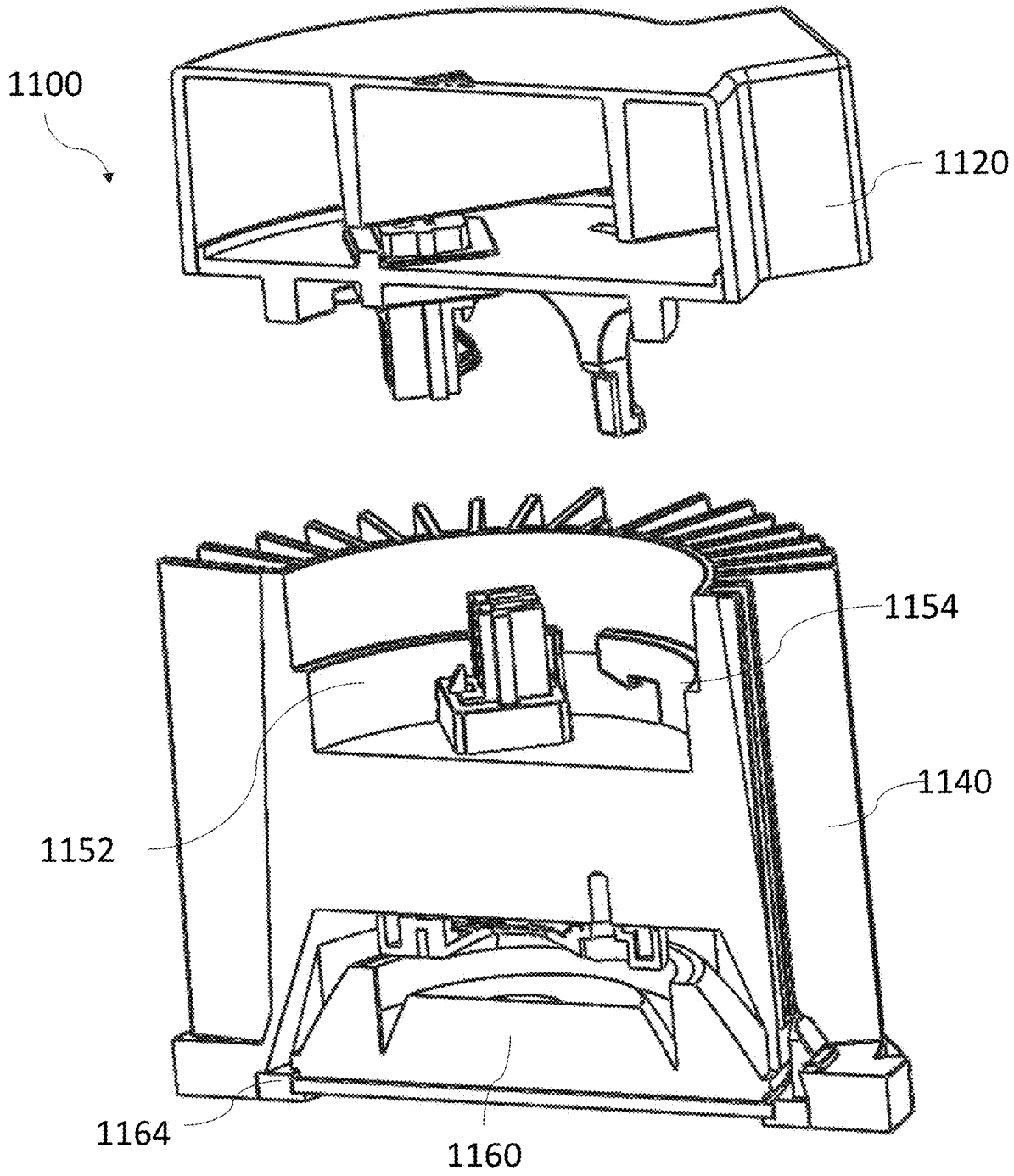

FIG. 66C is a top, front cross-sectional exploded view of the light module, the driver assembly, and the optic shown in FIG. 66A.

Figure 66D:
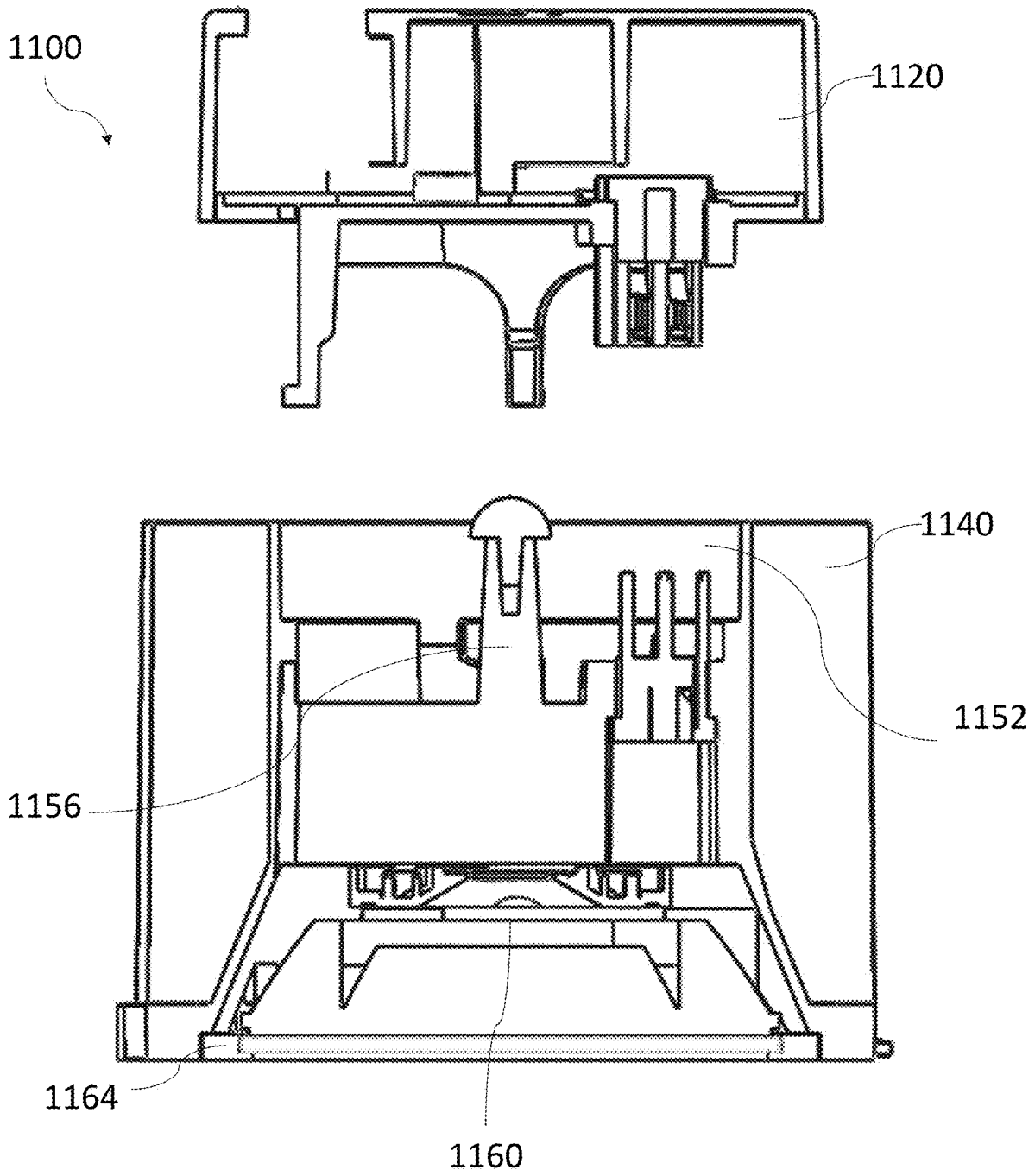

FIG. 66D is a front cross-sectional exploded view of the light module, the driver, and the optic shown in FIG. 66A.

Figure 66E:
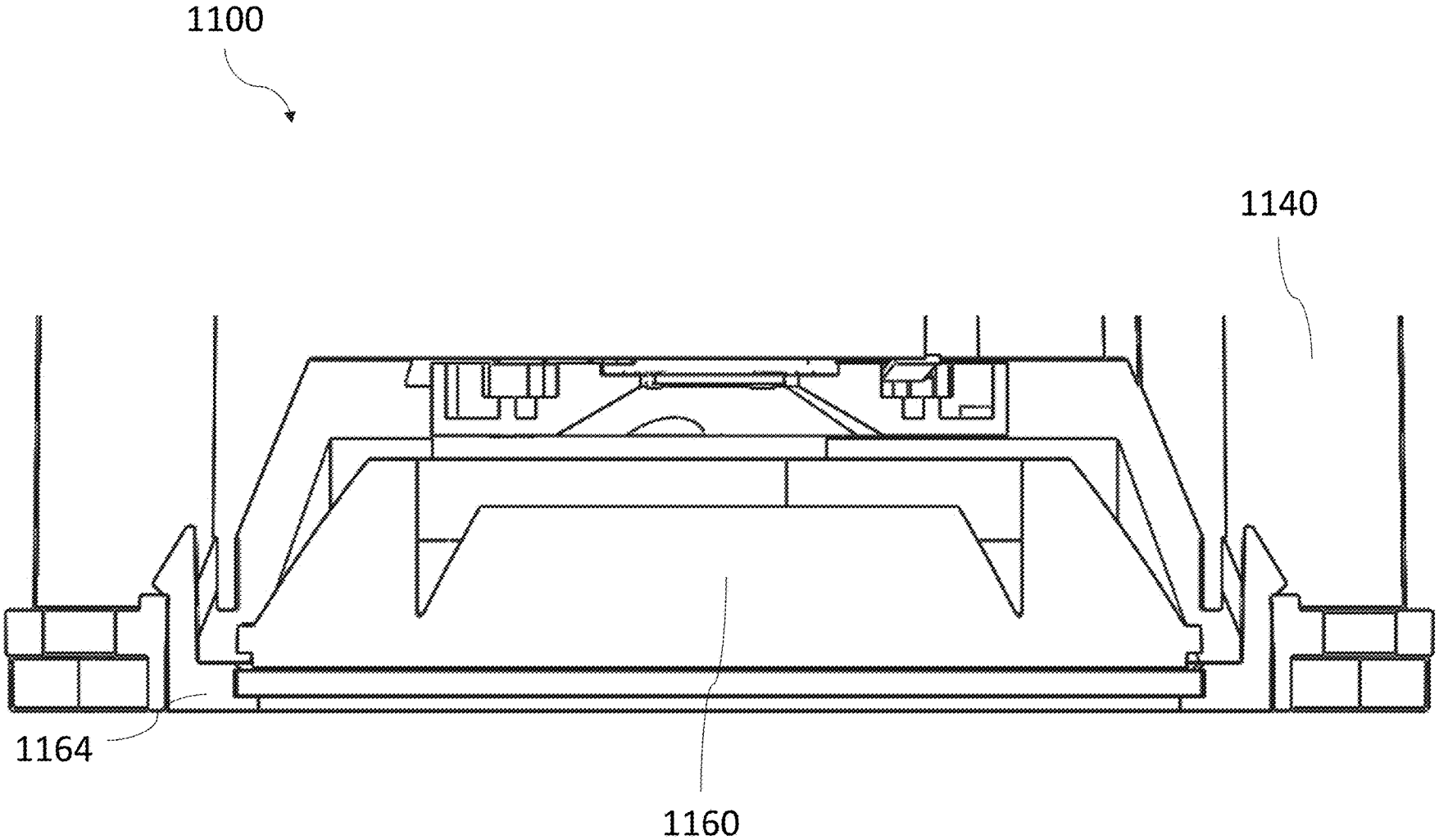

FIG. 66E is an expanded view of the light module and the optic shown in FIG. 66D.

Figure 67A:
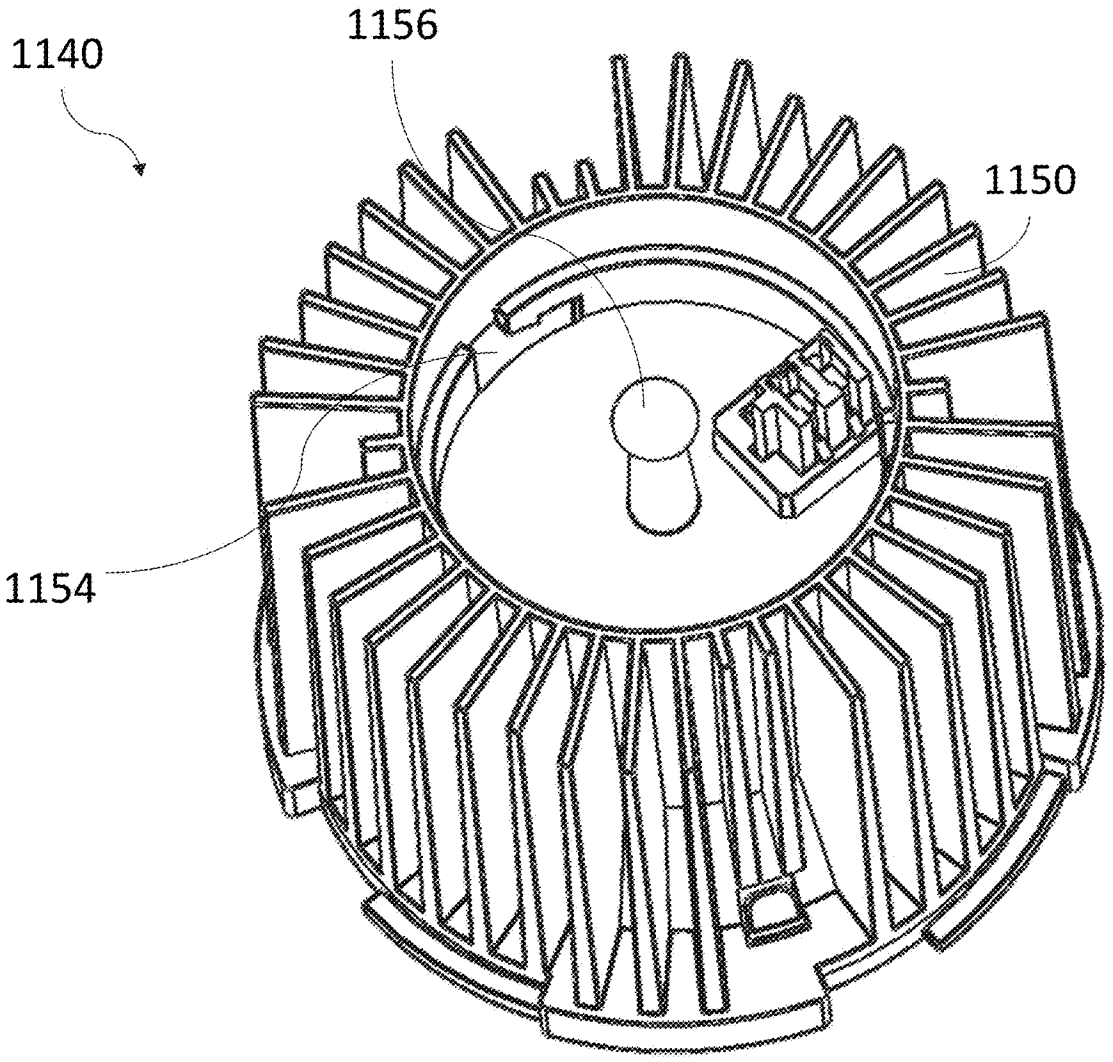

FIG. 67A is a top, front perspective view of a light module, according to an implementation.

Figure 67B:
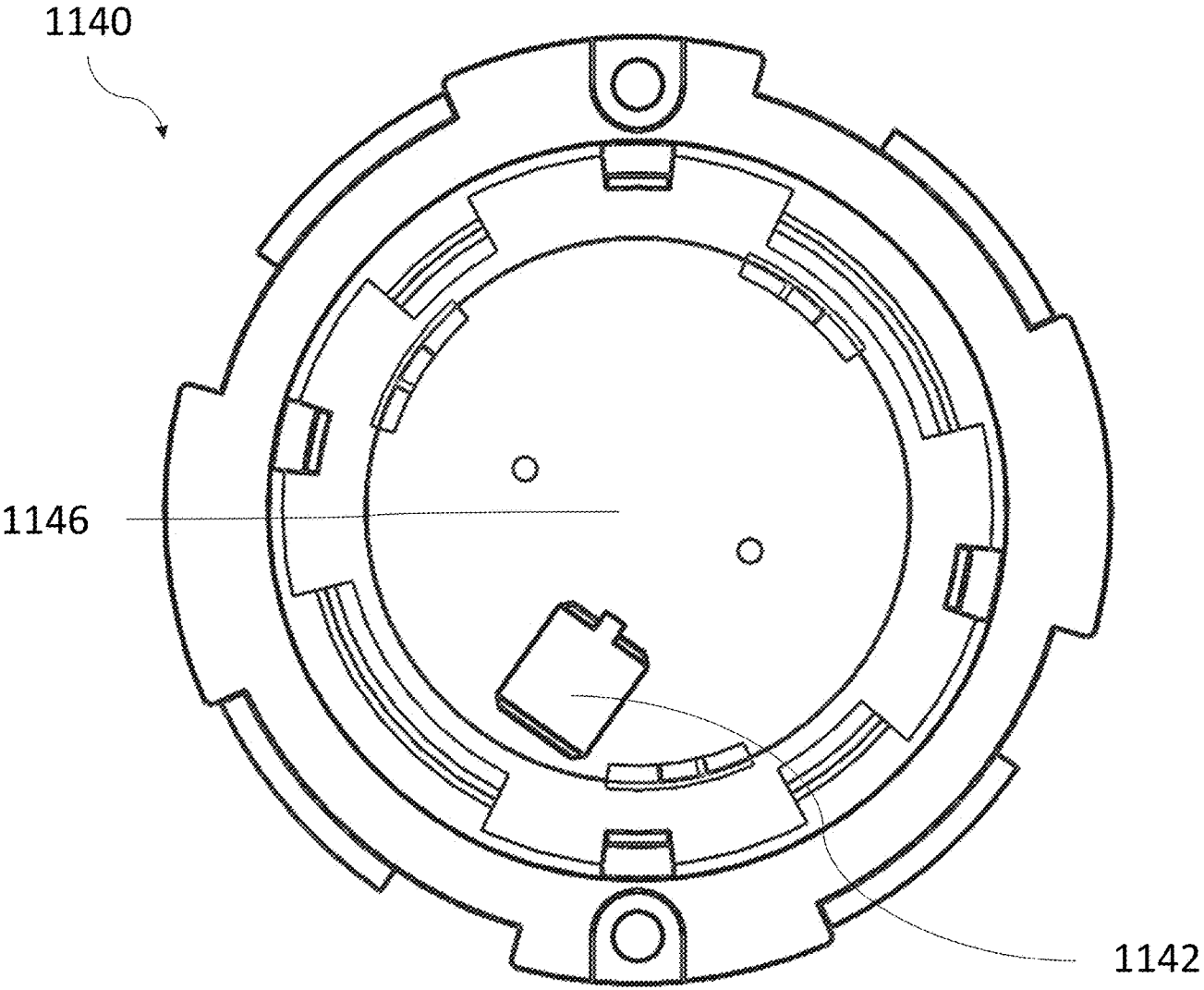

FIG. 67B is a bottom view of the light module shown in FIG. 67A.

Figure 68A:
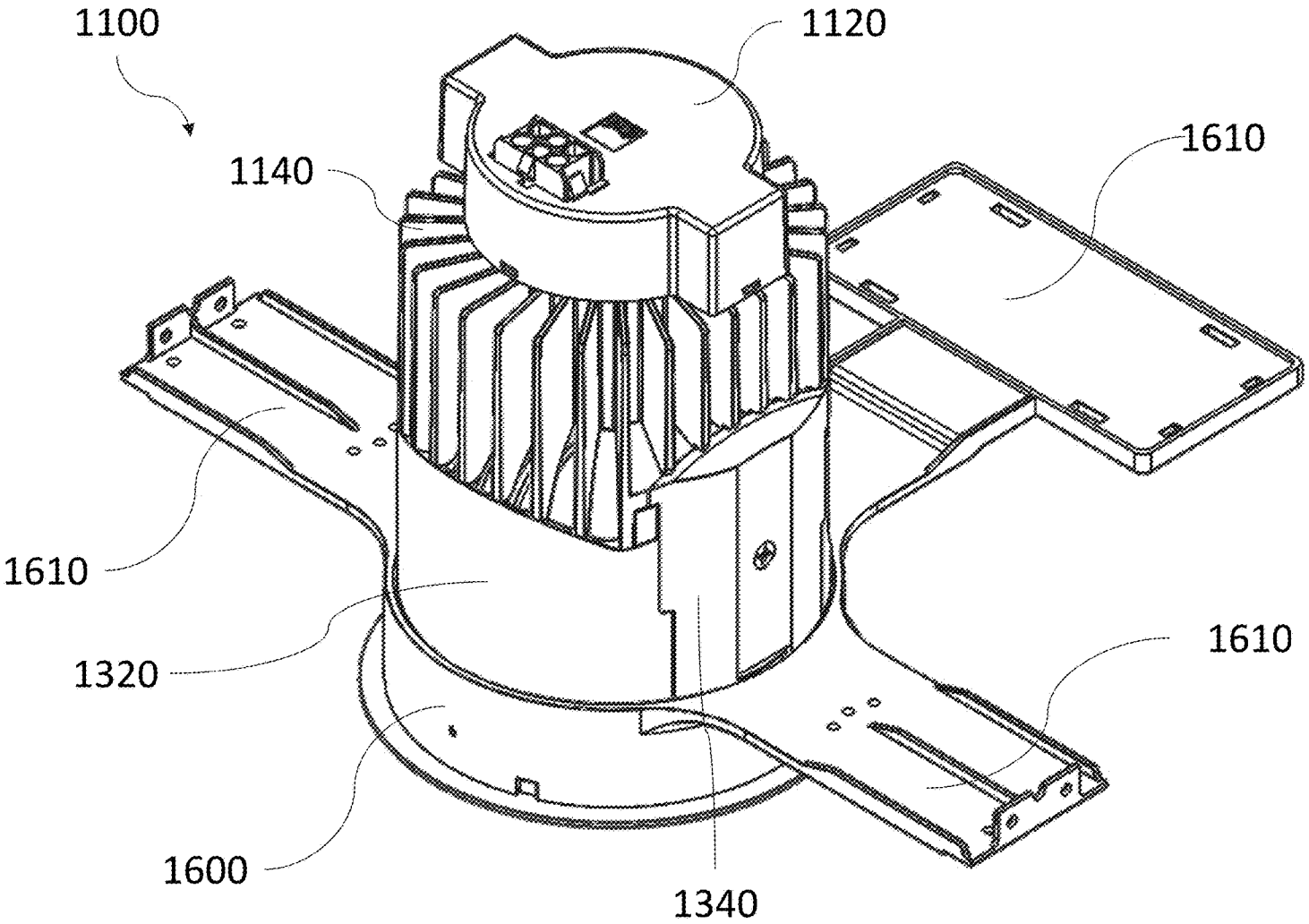

FIG. 68A is a top, front, right perspective view of an adjustable lighting apparatus, according to an implementation.

Figure 68B:
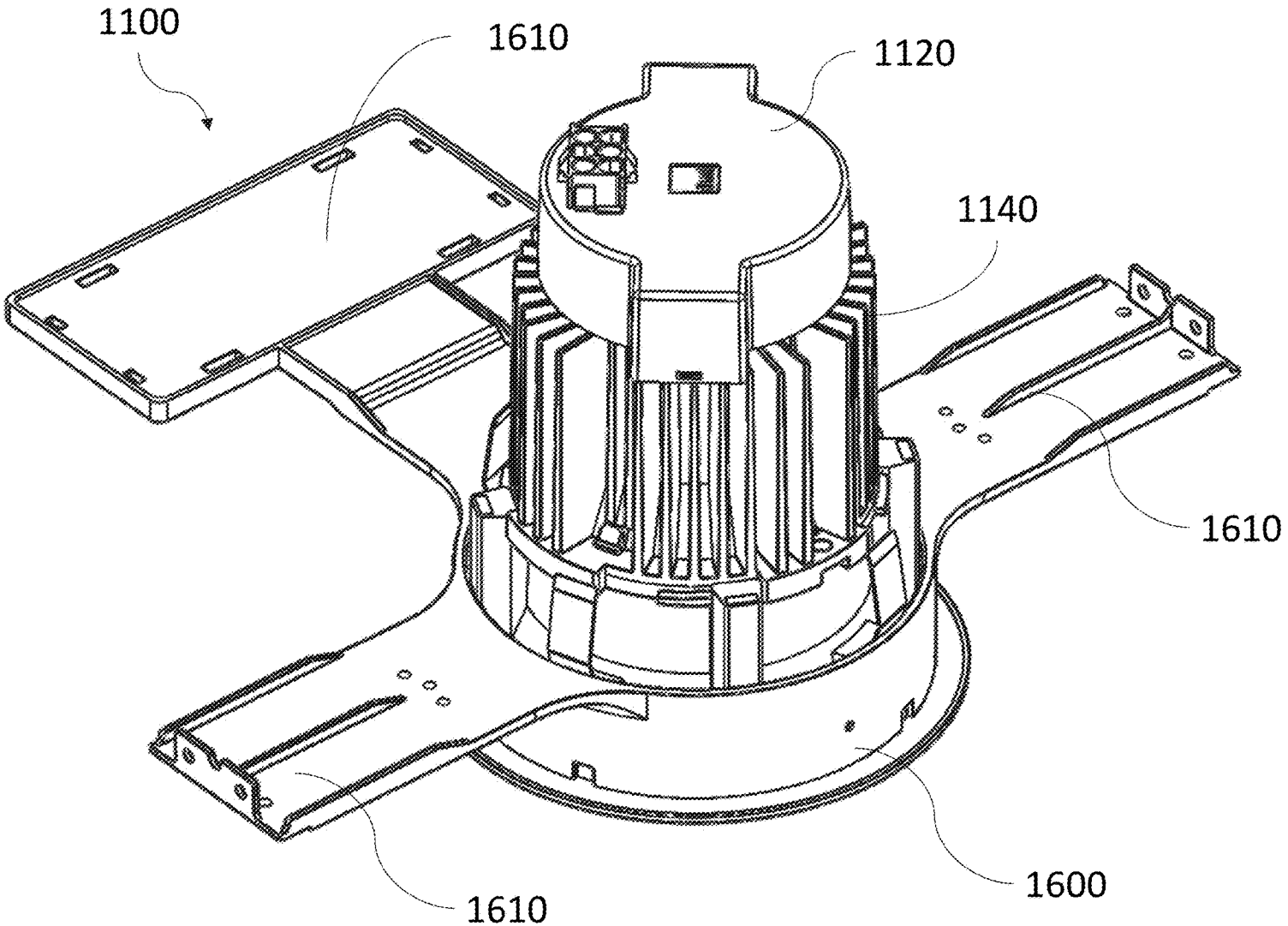
Figure 68C:
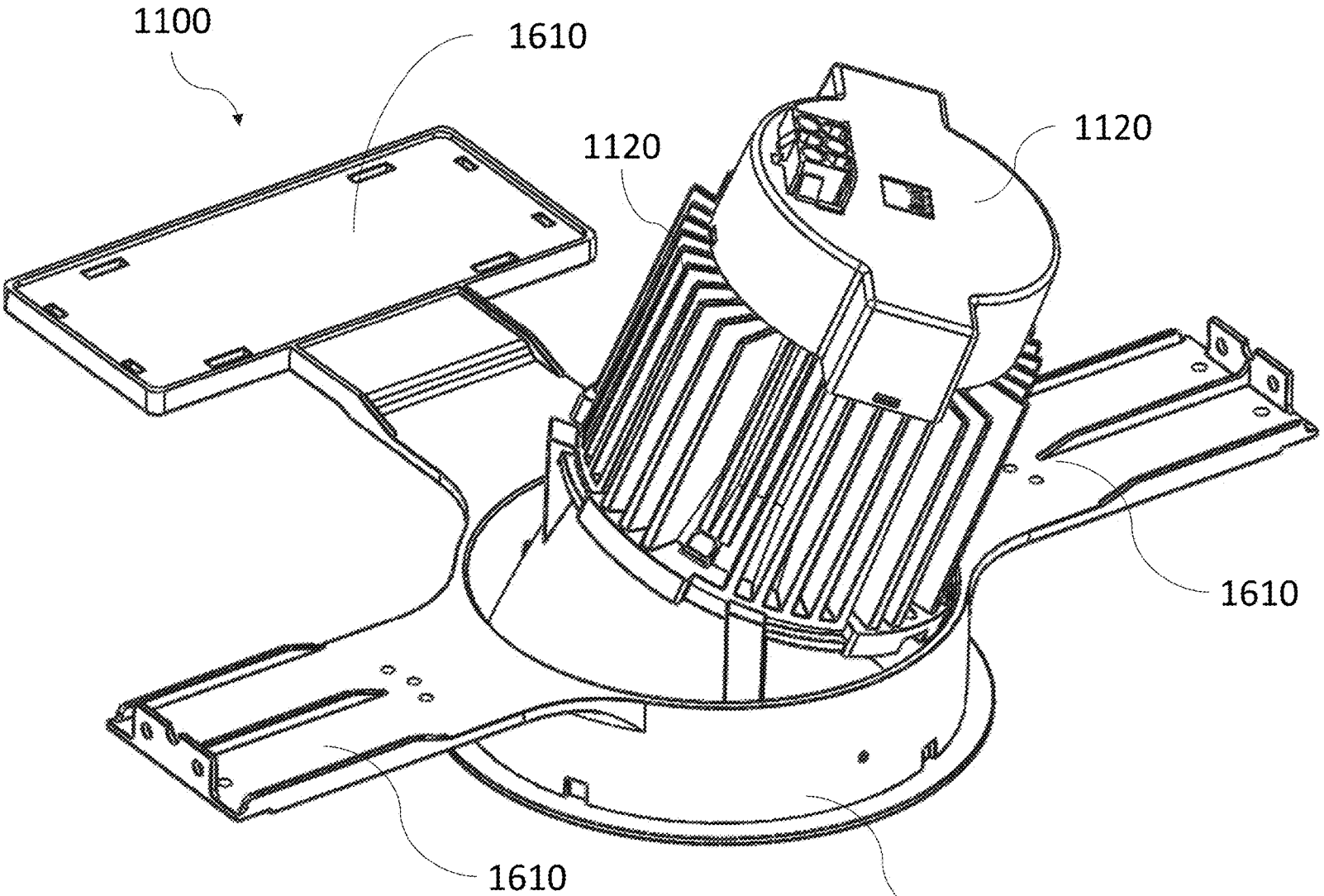

FIG. 68B is a top, front, left perspective view of the adjustable lighting apparatus shown in FIG. 68A FIG. 68C is a top, front, left perspective view of the adjustable lighting apparatus shown in FIG. 68A in a rotated state.

DETAILED DESCRIPTION

The present disclosure is directed towards inventive apparatuses and methods for adjustable lighting apparatus. Some inventive implementations are particularly directed to a recessed adjustable lighting apparatus designed for installation through or in a hole in a wall or a ceiling of a built environment. Some inventive aspects of such fixtures, as discussed in further detail below, relate in part to adjusting an orientation of a light source of the adjustable lighting apparatus such that openings in a housing coupled to the light source are substantially covered throughout significant adjustment of the light source (e.g., rotational adjustments about one or more axes), such that a viewer in the built environment and observing the installed lighting apparatus (a "user") is effectively precluded from seeing into a ceiling or wall space in which the lighting apparatus is installed. In other inventive aspects, the form factor (e.g., dimensions, structure, and/or mechanical/industrial design) of the lighting fixture readily facilitates installation into confined ceiling or wall spaces without use of an additional enclosure.

In some implementations, an adjustable lighting apparatus includes a lighting module that rotates about a first rotation axis relative to an adjustable mount. In some designs, the lighting module may include a light source disposed within a cavity of the adjustable lighting apparatus, wherein the light source may be substantially rotated without "shading loss." For example, in conventional adjustable lighting apparatus designs, rotation of the light source may result in a portion of the light emitted by the light source being blocked by an adjustable mount to which the light source is coupled (e.g., depending on the location of the first rotation axis within the conventional adjustable lighting apparatus and/or the size of the opening from which light couples out of the adjustable lighting apparatus relative to the size of the light beam). To reduce or, in some instances, entirely mitigate such shading losses, in example implementations the inventive lighting module disclosed herein is also designed to translate along a first translation axis while rotating about the first rotation axis to provide additional clearance for the light beam to couple out of the adjustable lighting apparatus. The translational movement of the lighting module may also provide additional clearance to avoid collision with the adjustable mount. In some implementations, the lighting module may also translate along a second translation axis to further improve the light outcoupling efficiency of the adjustable lighting apparatus.

The adjustable lighting apparatus may also include a primary shield that translates with the lighting module in order to cover an opening in the adjustable mount that, if left uncovered, would allow a user to see through the adjustable mount. Depending on the rotational position of the lighting module, a trim may also be used to cover any remaining opening in the adjustable mount that may not be entirely covered by the primary shield. The primary shield may include a rotation slot to constrain the range of rotation of the lighting module. Depending on the rotational position of the lighting module, any exposed portions of the rotation slot may also be covered by at least a heat sink in the lighting module and/or a secondary shield coupled to the primary shield. In this manner, the adjustable lighting apparatus according to various inventive implementations provides for significant rotation of a lighting module about one or more axis of roatation without forming aesthetically undesirable openings in the apparatus and without using a separate enclosure (as is used in conventional installations to block a user's view into a ceiling or wall space), thus reducing the overall form factor. The adjustable lighting apparatus may further be mounted onto a frame to facilitate installation into a ceiling or a wall space.

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

Overview

Referring generally to the FIGURES, an adjustable light apparatus is described.

In one aspect, a disclosed adjustable light apparatus includes a module light assembly with separate modular components. In one aspect, a light source is coupled to a heat sink and a driver for electrically operating the light source is coupled to a housing. The housing and the heat sink may be in separate modular components that can be mechanically coupled or decoupled through twist and lock operation. Twist and lock operating of the separate components simplifies integration of the driver and the light source, or simplifies replacement of any of the driver and the light source.

In one aspect, the light assembly is coupled to an adjustable mount allowing the light assembly to direct light in different directions. In one embodiment, the adjustable mount is mounted on a ceiling or a wall, and allows a facing direction of the light assembly to be slanted from an orthogonal direction of a surface of the ceiling or the wall. Moreover, the adjustable mount allows the light assembly to be rotated in a circular direction along the surface of the ceiling or the wall. Hence, the light assembly may direct light in varying directions.

In one aspect, the disclosed adjustable light apparatus includes a reconfigurable light cover that may be coupled between the light assembly and the adjustable mount. When the light source directs light in a particular direction (e.g., a slanted direction from the orthogonal direction of the wall), a gap between the light source and the adjustable mount may exist. Such gap may allow a user to see behind the ceiling or the wall. In one aspect, the reconfigurable light cover prevents the user to see through the gap between the light source and the adjustable mount. When the configuration of the light source is adjusted to change the direction of the light, the configuration of the light cover is also adjusted to prevent others to see through the gap.

In one aspect, the adjustable mount includes a wheel allowing the configuration of the light assembly and the light cover to be changed together. The wheel may be turned by a finger without uninstalling the light assembly or reassembling the light assembly. Turning the wheel in a particular direction allows the light source and the light cover to be configured, such that an angle between the orthogonal direction of the wall and a facing direction of the light source increases. Similarly, turning the wheel in an opposite direction allows the light source and the light cover to be configured, such that an angle between the orthogonal direction of the wall and the facing direction of the light source decreases. By turning the wheel using the finger, the process of reconfiguring the light apparatus and the light cover can be simplified without external tools (e.g., a screw driver, wrench, hexagonal key, etc.)

In one aspect, the light apparatus is coupled to a hanger frame to secure the light apparatus to a stud or a ceiling beam. The light apparatus may be coupled to the hanger frame through various couplers. The hanger frame may include stud mounts to couple the hanger frame to the stud. The hanger frame may further include or may be coupled to a junction box mount on which a junction box can be positioned.

Example Switching Power Converter

Referring to FIGS. 1A through 1H, a modular light assembly 100 according to one or more embodiments are shown. In one or more embodiments, the modular light assembly 100 includes a housing 110 and a heat sink 120. The heat sink 120 is coupled to a light source 130 that emits light. The housing 110 includes a driver that electrically controls the light source 130. The heat sink 120 and the housing 110 may be coupled to each other through a twist and lock operation. Thus, the driver, the light source 130, or a combination of them may be easily replaced or reassembled.

The housing 110 is a hardware component that can be mechanically locked to the heat sink 120. The housing 110 may comprise plastic, metal, or any materials. The housing 110 may have a cylinder shape with a top surface 102 having a slot to receive the driver, and a bottom surface 106 coupled to an electrical connector 112. The top surface 102 and the bottom surface 106 may have a generally circular shape with indents 154 around the periphery. The indents 154 allow a user to easily grab and twist the housing 110. The housing 110 further includes a side wall 174 between edges of the top surface 102 and the bottom surface 106. In one aspect, the bottom surface 106 further includes a locking guide 118 on the bottom surface 106. The locking guide 118 helps align the housing 110 to the heat sink 120 when performing twist and lock operation. The locking guide 118 may have a tubular shape. The bottom surface 106 further includes one or more mechanical couplers 116 protruding from the locking guide 118. Each mechanical coupler 116 includes a tip 146 protruding in a direction (e.g., inward or outward) traversing the protruding direction of the mechanical coupler 116. The tip 146 of the mechanical coupler 116A may be secured to the heat sink 120 through the twist and lock operation.

In one aspect, the driver is an electrical component that provides electrical power to the light source 130, when the housing 110 is mounted on the heat sink 120. The driver may be coupled to the electrical connector 112A through a wire (not shown). When the housing 110 is twist and locked to the heat sink 120, the electrical connector 112A is electrically coupled to a corresponding electrical connector 112B of the heat sink 120. Hence, the driver can provide electrical power to the light source 130 through the electrical connectors 112A, 112B, when the housing 110 is mechanically locked to the heat sink 120.

Figure 1B:
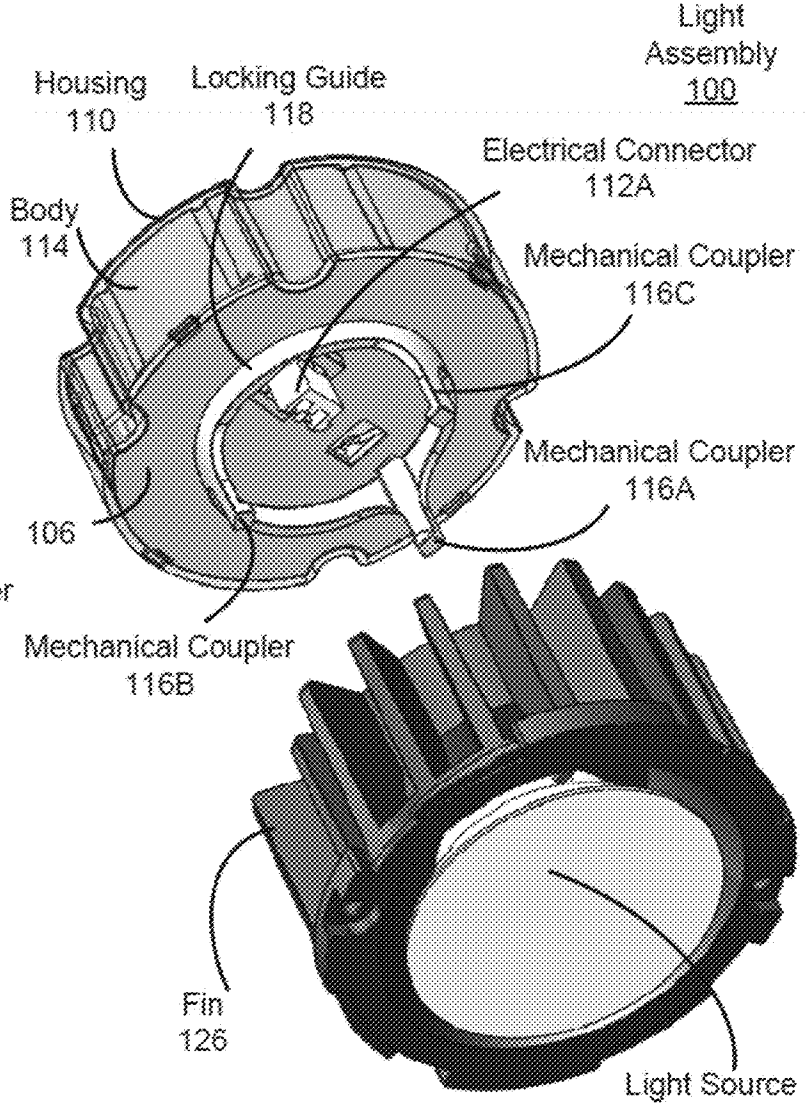
FIG. 1B illustrates another exploded view of a light assembly, according to one or more embodiments.
Figure 1A:
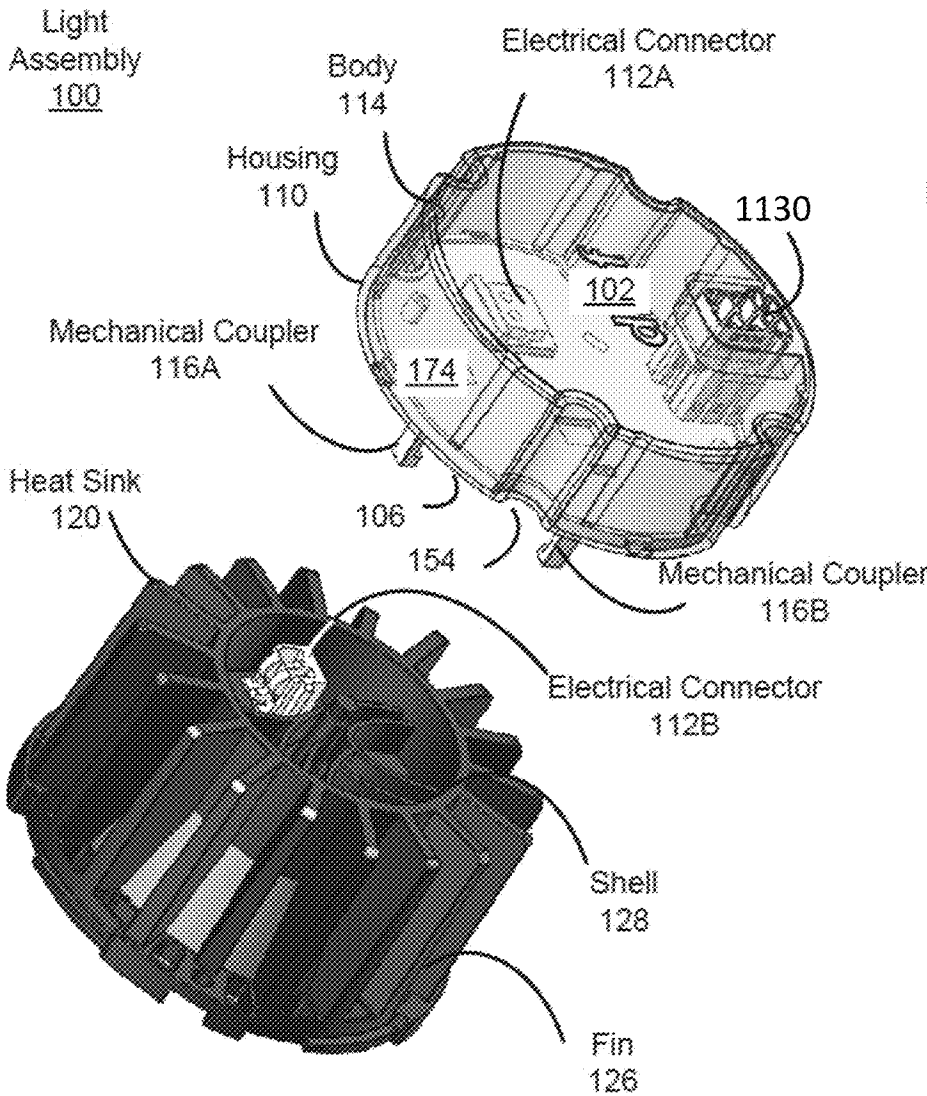
FIG. 1A illustrates an exploded view of a light assembly, according to one or more embodiments.
Figure 1D:
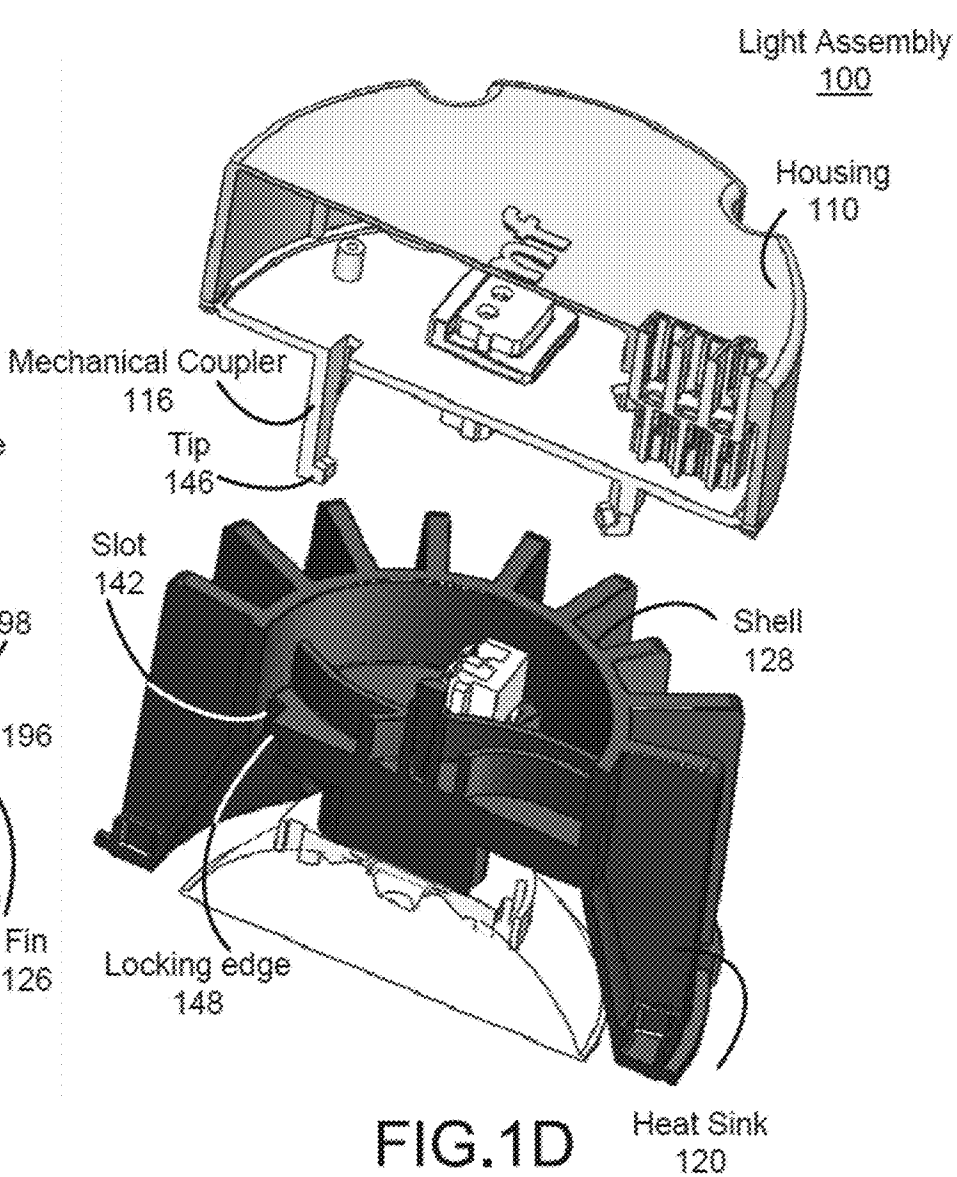
FIG. 1D illustrates another cross section view of the light assembly, according to one or more embodiments.
Figure 1C:
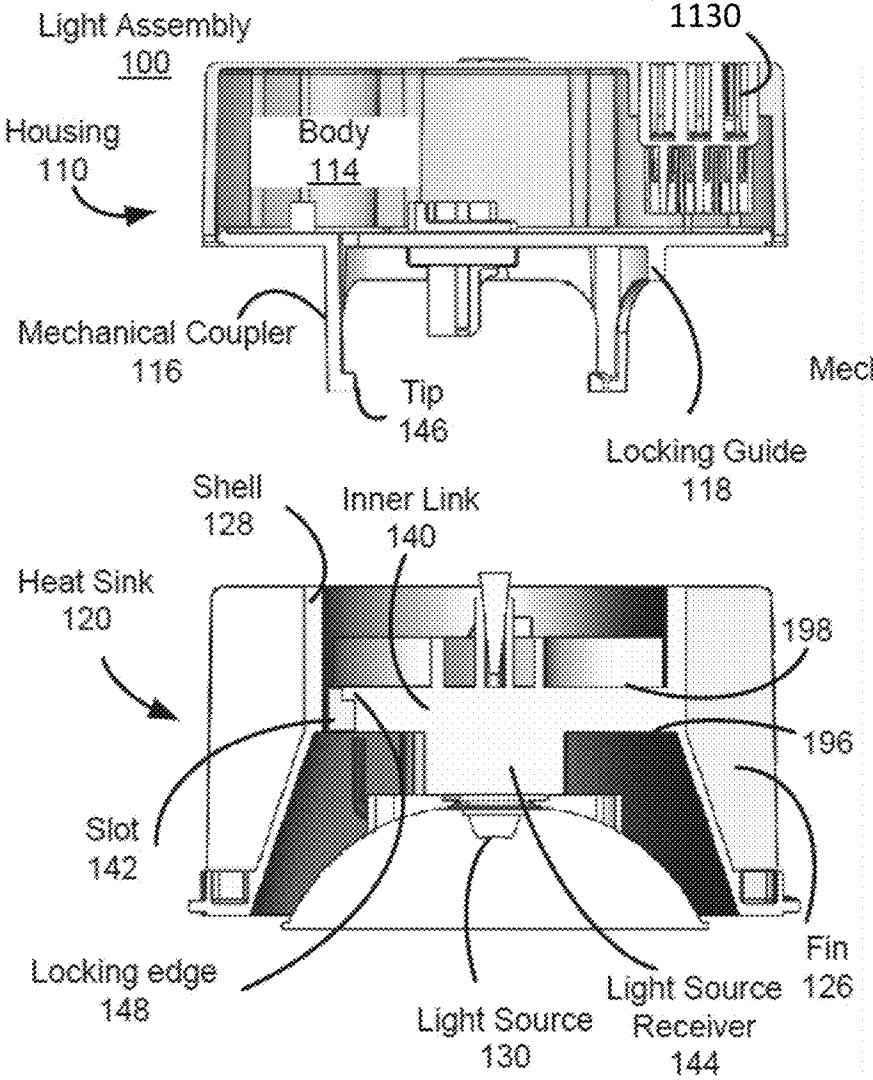
FIG. 1C illustrates a cross section view of the light assembly showing a mechanical coupler and a corresponding slot, according to one or more embodiments.
Figure 1F:
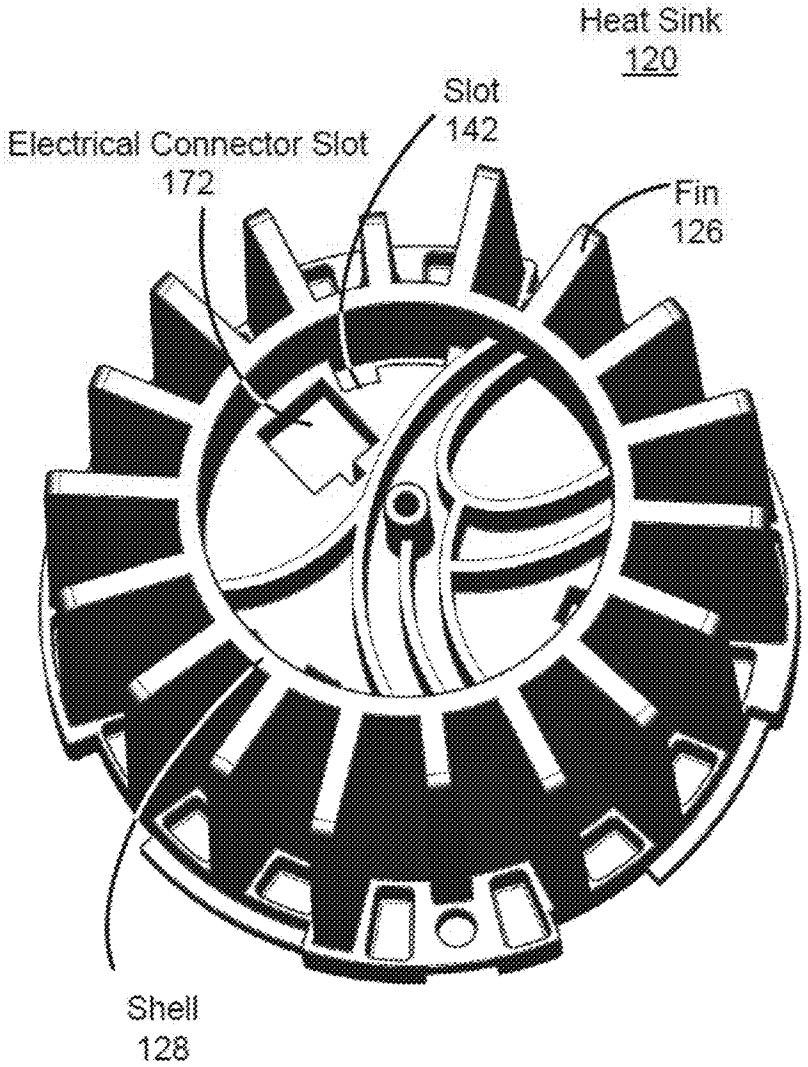
FIG. 1F illustrates a perspective view of the heat sink, according to one or more embodiments.
Figure 1E:
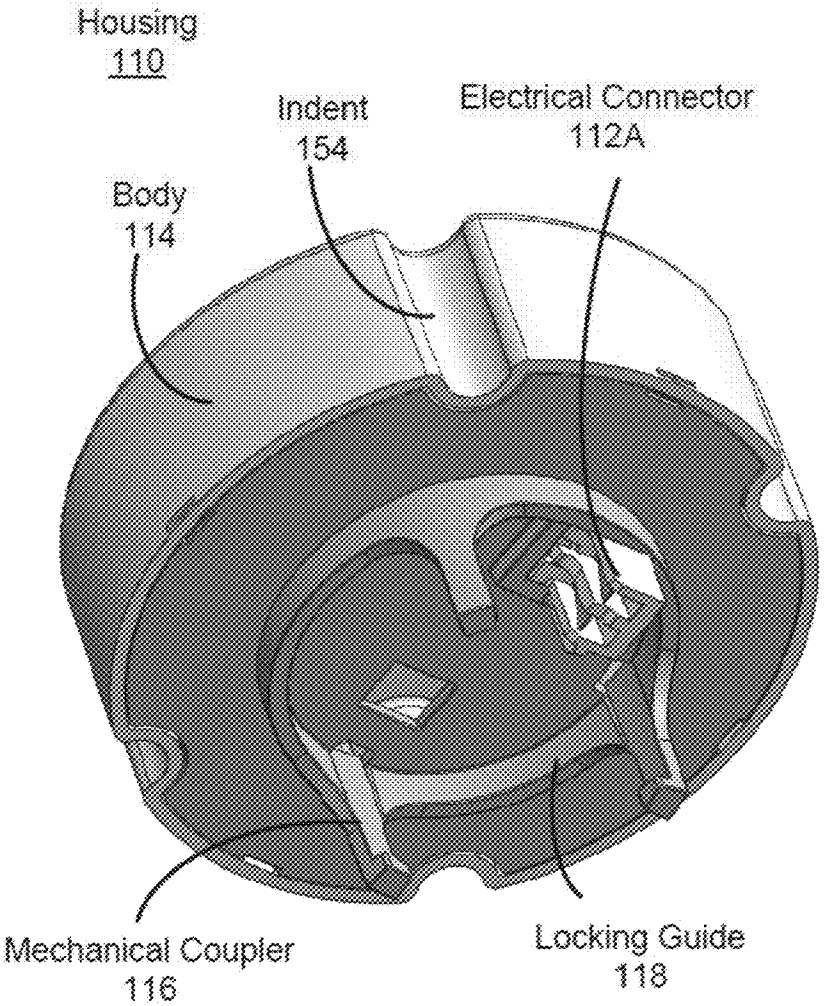
FIG. 1E illustrates a perspective view of a housing of the light assembly, according to one or more embodiments.
Figure 1G:
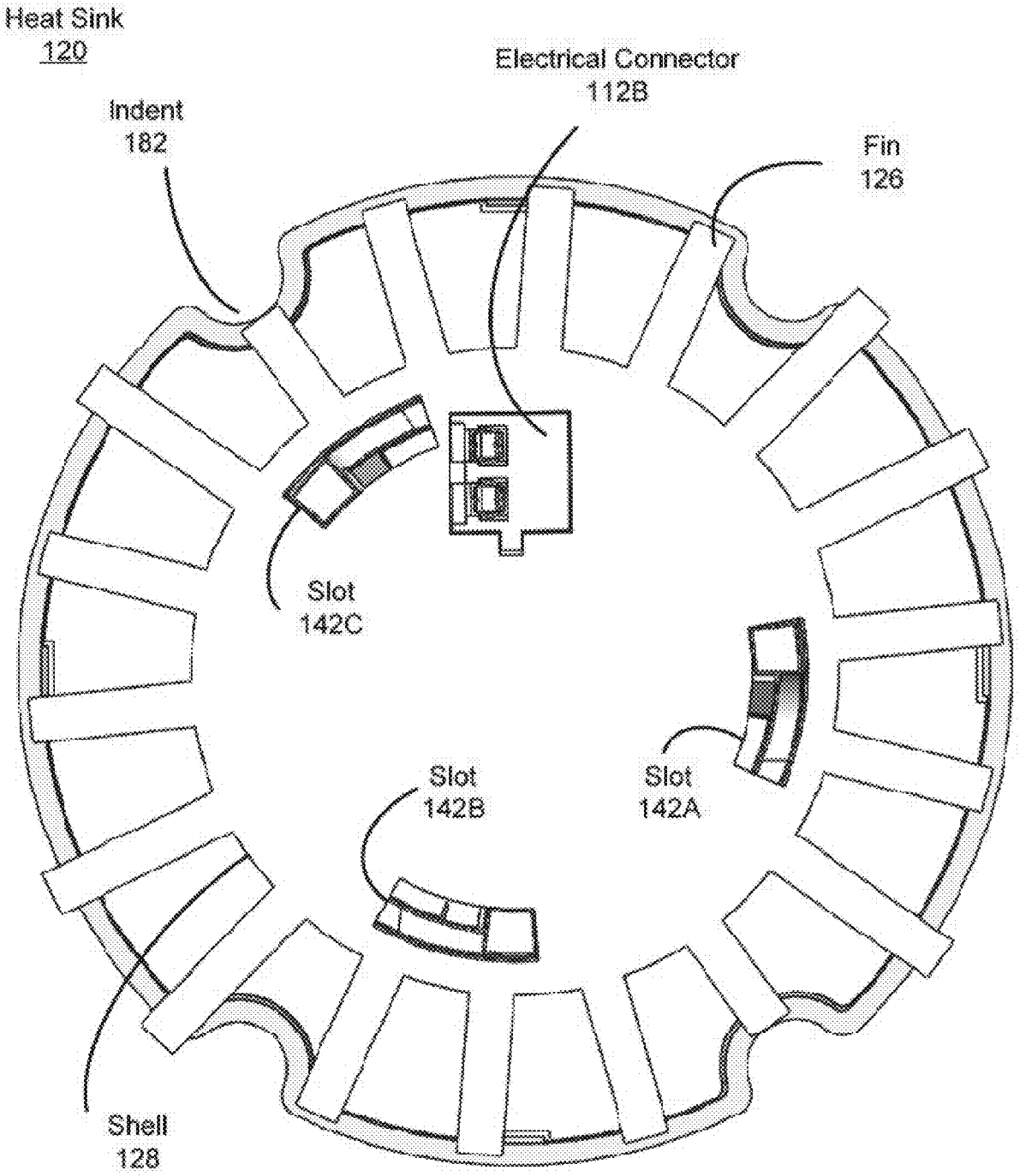
FIG. 1G illustrates a top plan view of the heat sink, according to one or more embodiments.
Figure 1H:
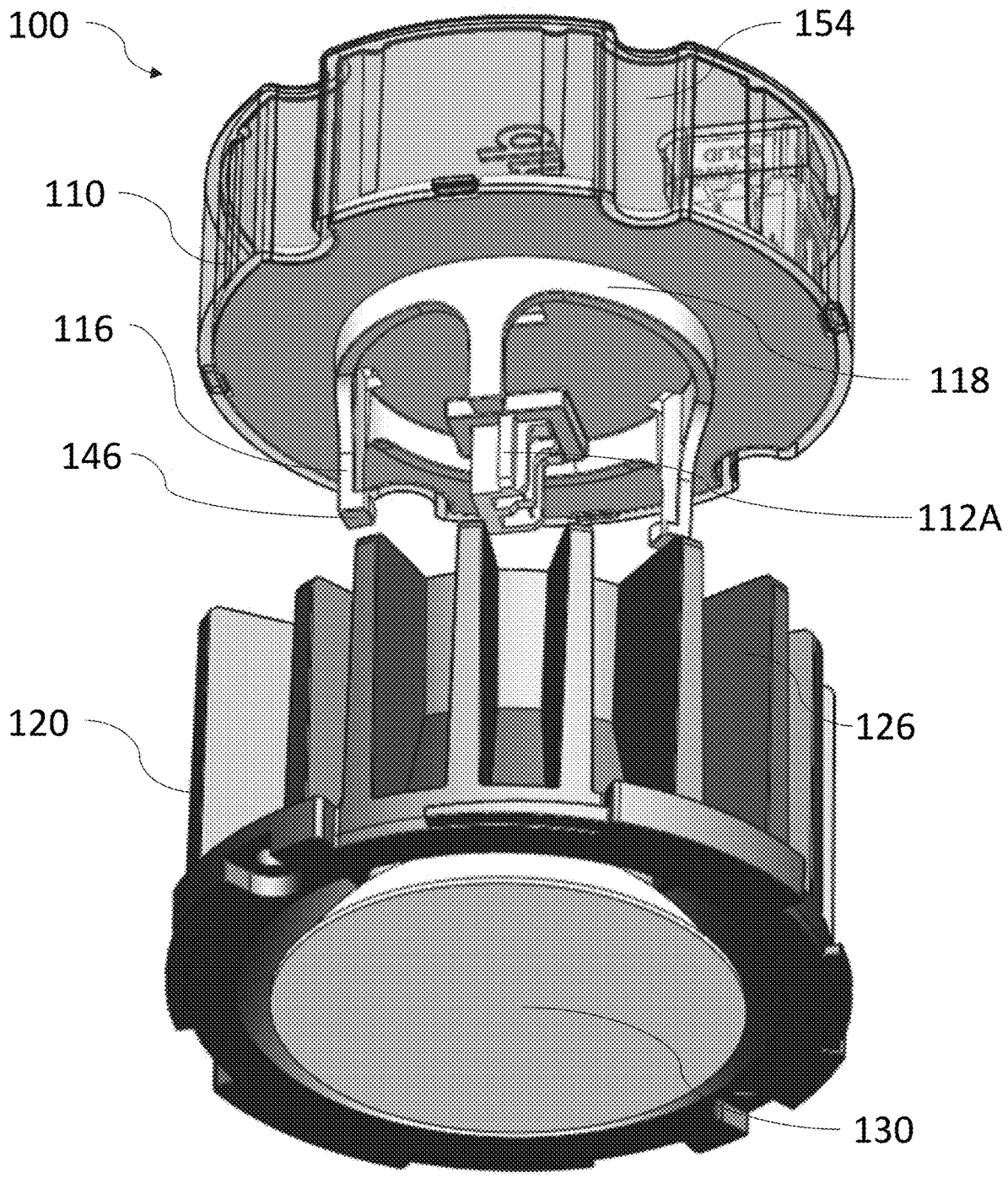
FIG. 1H is a bottom perspective view of a light module with a driver assembly, according to an implementation.

The heat sink 120 is a hardware component that dissipates heat from the light source 130. As shown in FIG. 1C, the heat sink 120 includes a shell 128, on which a plurality of fins 126 are formed. The shell 128 may have a tubular shape (or a hollow cylindrical shape) with a radius larger than the radius of tubular shape of the locking guide 118. When the housing 110 and the heat sink 120 are proximate to each other, the shell 128 helps the locking guide 118 to be within the shell 128, thereby assisting the housing 110 and the heat sink 120 to be aligned with each other. The heat sink 120 further includes an inner link 140 and a light source receiver 144 on a surface 196 of the inner link 140. The light source receiver 144 secures the light source 130, and the inner link 140 couples the light source receiver 144 to the shell 128. The shell 128, the fins 126, the inner link 140, and the light source receiver 144 may be formed of metal or other materials with high thermal conductivity. Hence, the heat generated by the light source 130 can be dissipated through the light source receiver 144, the inner link 140, the shell 128, and the fins 126.

The heat sink 120 may be mechanically coupled to the housing 110 through twist and lock operations. In one embodiment, the inner link 140 covers inside of the shell 128 with one or more slots 142. The inner link 140 also includes a locking edge 148 that covers a portion of the slot 142 to fasten the housing 110. When locking the housing 110 to the heat sink 120, the mechanical couplers 116 are inserted into corresponding slots 142. After the mechanical couplers 116 are inserted into corresponding slots 142, the housing 110, the heat sink 120, or a combination of them can be twisted, causing the tips 146 to latch to the corresponding locking edges 148. In the embodiments shown in FIGS. 1E through 1F, the inner link 140 includes three slots 142A, 142B, 142C to receive corresponding mechanical couplers 116A, 116B, 116C, respectively. In other embodiments, the inner link 140 includes a different number of slots 142, and the housing 110 includes a corresponding number of mechanical couplers 116.

Figure 2B:
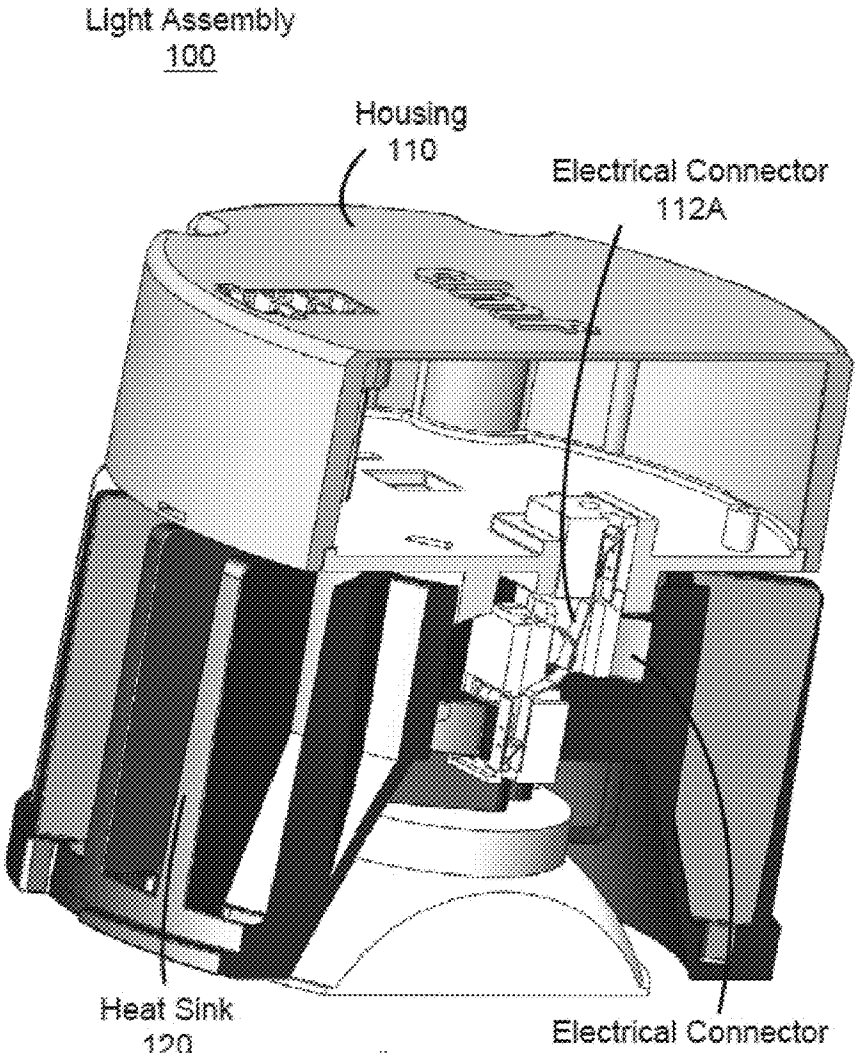
FIG. 2B illustrates another cross section of the heat sink and the housing twist and locked to each other, according to one or more embodiments.
Figure 2A:
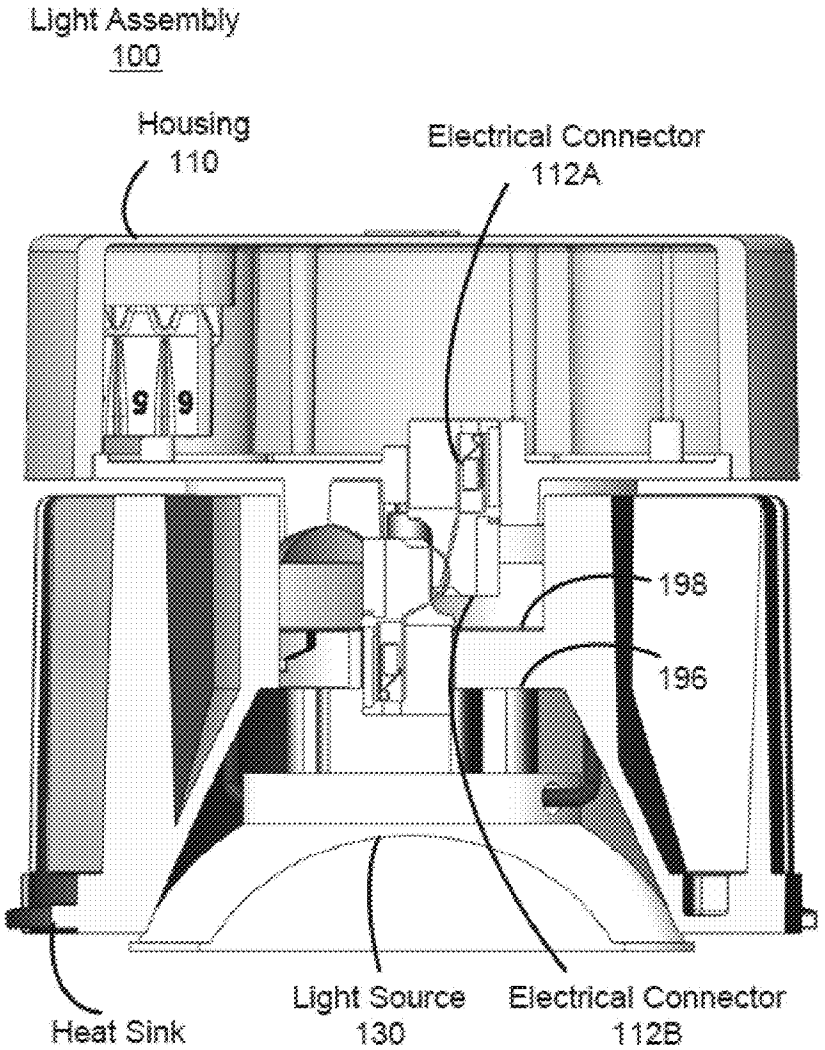
FIG. 2A illustrates a cross section of the heat sink and the housing twist and locked to each other, according to one or more embodiments.

Referring to FIGS. 2A and 2B, illustrated are cross sections of the heat sink 120 and the housing 110 twist and locked to each other, according to one or more embodiments. The heat sink 120 further includes the electrical connector 112B to electrically couple the driver to the light source 130. The electrical connector 112B is coupled to the light source 130 through a wire (not shown). The electrical connector 112B is located on a surface 198 facing away from the light source 130 such that, when the heat sink 120 is secured to the housing 110, the electrical connectors 112A 112B can be electrically connected. Hence, when the heat sink 120 and the housing 110 are twist and locked to each other, the driver can provide electrical power to the light source 130 through the electrical connectors 112A, 112B for emitting light.

Figure 3A:
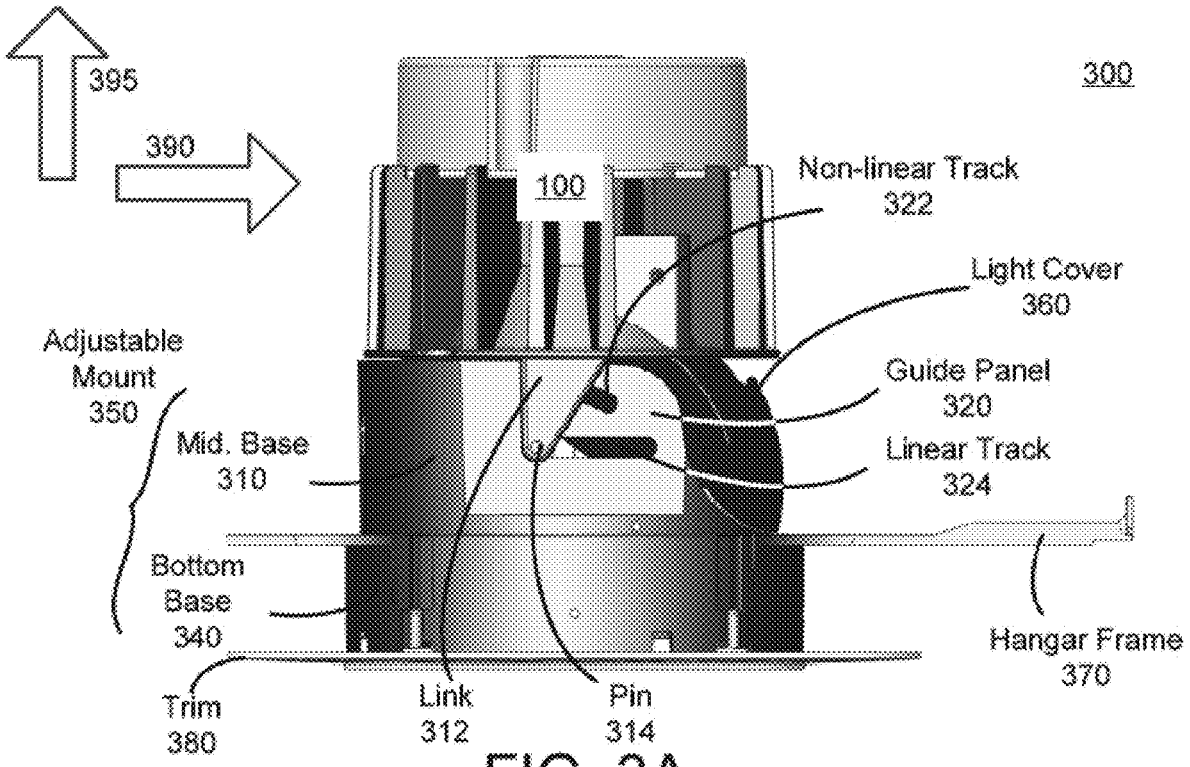
FIG. 3A illustrates a side view of an adjustable light apparatus in a first state, according to one or more embodiments.
Figure 3B:
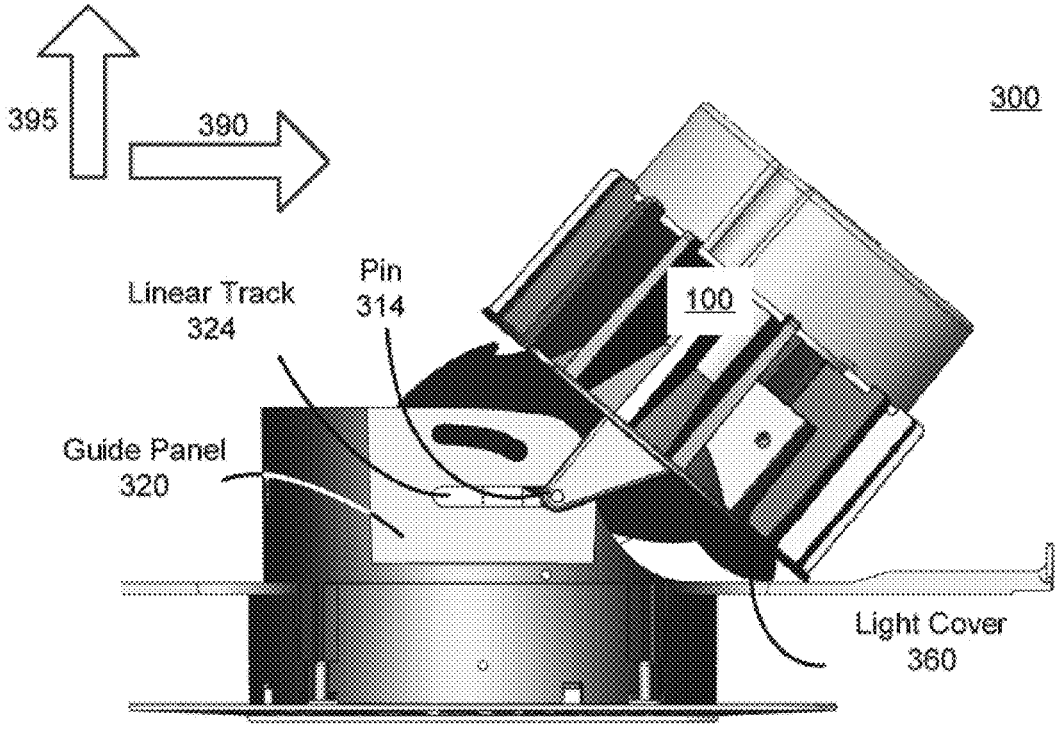
FIG. 3B illustrates a side view of the adjustable light apparatus in a second state, according to one or more embodiments.

Referring to FIG. 3A, illustrated is a side view of an adjustable light apparatus 300 in a first state, according to one or more embodiments. Referring to FIG. 3B, illustrated is a side view of the adjustable light apparatus 300 in a second state, according to one or more embodiments. In some embodiments, the adjustable light apparatus 300 includes the modular light assembly 100, an adjustable mount 350, a light cover 360, and a trim 380. The adjustable mount 350 allows the modular light assembly 100 to be oriented in different directions. In the first state, the modular light assembly 100 is aligned with an orthogonal direction 395 of a surface of the trim 380 (or a surface of the wall or the ceiling mounted). In the second state, the modular light assembly 100 is oriented in a slanted direction slanted from the orthogonal direction 395. The light cover 360 covers any line of sight through the adjustable light apparatus 300 from outside, while passing light projected from the light source 130. In some embodiments, the adjustable light apparatus 300 includes more, fewer, or different components than shown in FIGS. 3A and 3B.

The trim 380 is a cover covering a space between the adjustable light apparatus 300 and the ceiling or the wall. The trim 380 may have a disk shape. When the adjustable light apparatus 300 is mounted on the wall or the ceiling, the trim 380 may be fixed to or in a direct contact with a surface of the wall or the ceiling.

The adjustable mount 350 is a component that couples the modular light assembly 100 to the trim 380, while allowing light from the modular light assembly 100 to be directed in different directions. In one embodiment, the adjustable mount 350 includes a middle base 310 and a bottom base 340. The bottom base 340 couples the middle base 310 to the trim 380. The bottom base 340 may have a hollow cylindrical shape. The middle base 310 allows the modular light assembly 100 to be configured in a slanted direction that is slanted from the orthogonal direction 395. In some embodiments, the middle base 310 may be rotated in a circular direction along the surface of the trim 380. Thus, the modular light assembly 100 can be oriented to direct light in various directions.

In one embodiment, the middle base 310 includes a guide panel 320 allowing the modular light assembly 100 and the light cover 360 to be repositioned. According to the guide panel 320, the modular light assembly 100 can be positioned in a slanted direction with respect to the orthogonal direction 395, and the light cover 360 may travel along a lateral direction 390 to cover any gap between the modular light assembly 100 and the adjustable mount 350. Although one guide panel is shown in FIGS. 3A and 3B, another guide panel 320 may be located on an opposite side such that the guide panels 320 face each other.

In one implementation, the guide panel 320 includes a linear track 324 and a non-linear track 322 for defining movements of the modular light assembly 100 and the light cover 360. In one implementation, the linear track 324 receives a pin 314 that is coupled to the heat sink 120 through the link 312 extending from the heat sink 120. In addition, the non-linear track 322 receives a pin (not shown) coupled to the light cover 360. The linear track 324 may be closer to the bottom base 340, and the non-linear track 322 may be closer to the modular light assembly 100. In this configuration, the pins can slide along the corresponding tracks. Accordingly, a facing direction of the modular light assembly 100 can be adjusted with respect to the orthogonal direction 395. Moreover, the light cover 360 can be shifted along the lateral direction 390 to prevent any line of sight from outside through a gap between the adjustable mount 350 and the modular light assembly 100. The non-linear track 332 is designed to keep the bottom edge of light cover 360 moving only in the lateral direction 390, regardless of the direction of traveling the light assembly 100 along the linear track 324. The modular light assembly 100 travels along the linear track 324 in order to fulfill the simultaneous rotation (tilt) and linear travel along the lateral direction 390. Such combined motion would maintain the light visibility and beam angle at each tilting angle. The light cover 360 is designed in a way to eliminate any collision with/jamming inside the light module during tilting of the module. Such design restriction dictates the positioning of linear track 324 below non-linear track 322 in this example embodiment.

The light cover 360 is a component that prevents a line of sight from outside through the adjustable mount 350. The light cover 360 is formed between the adjustable mount 350 and the modular light assembly 100. The light cover 360 may have a half dome shape (or a portion of the dome shape) with an exposure near the light source 130. Through the exposure, the light source 130 can project light. The light cover 360 may move in the lateral direction 390 according to the non-linear track 322 of the guide panel 320. The half-dome shape of the light cover 360 is intended to perfectly match the half-spherical shape inside the heatsink 120, which helps smooth movement between the two surfaces. Such shape also guarantees enough coverage inside the light module.

In some embodiments, the adjustable light apparatus 300 may further include or is coupled to a hanger frame 370, through which the adjustable light apparatus 300 can be secured to a beam or stud behind the wall or ceiling. Detailed description of the hanger frame 370 is provided below with respect to FIGS. 9A through 9C.

Figure 4A:
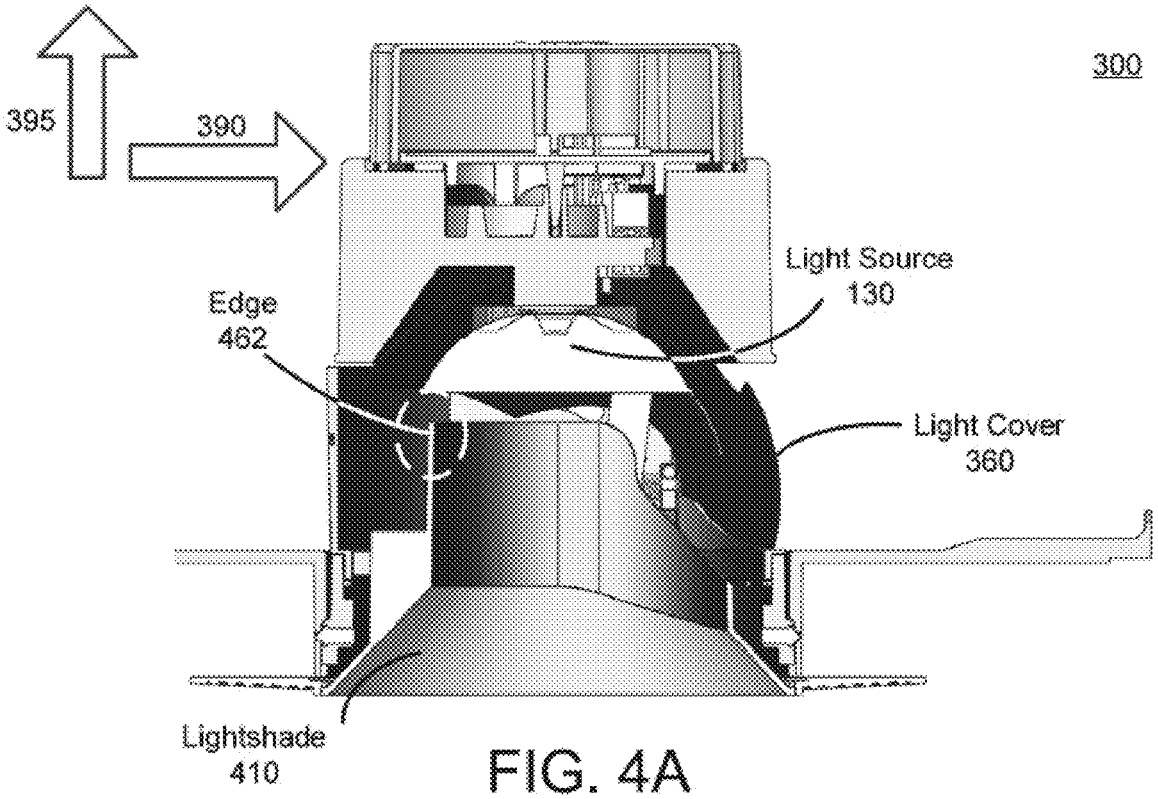
FIG. 4A illustrates a cross section of the adjustable light apparatus in a first state with the lampshade, according to one or more embodiments.
Figure 4B:
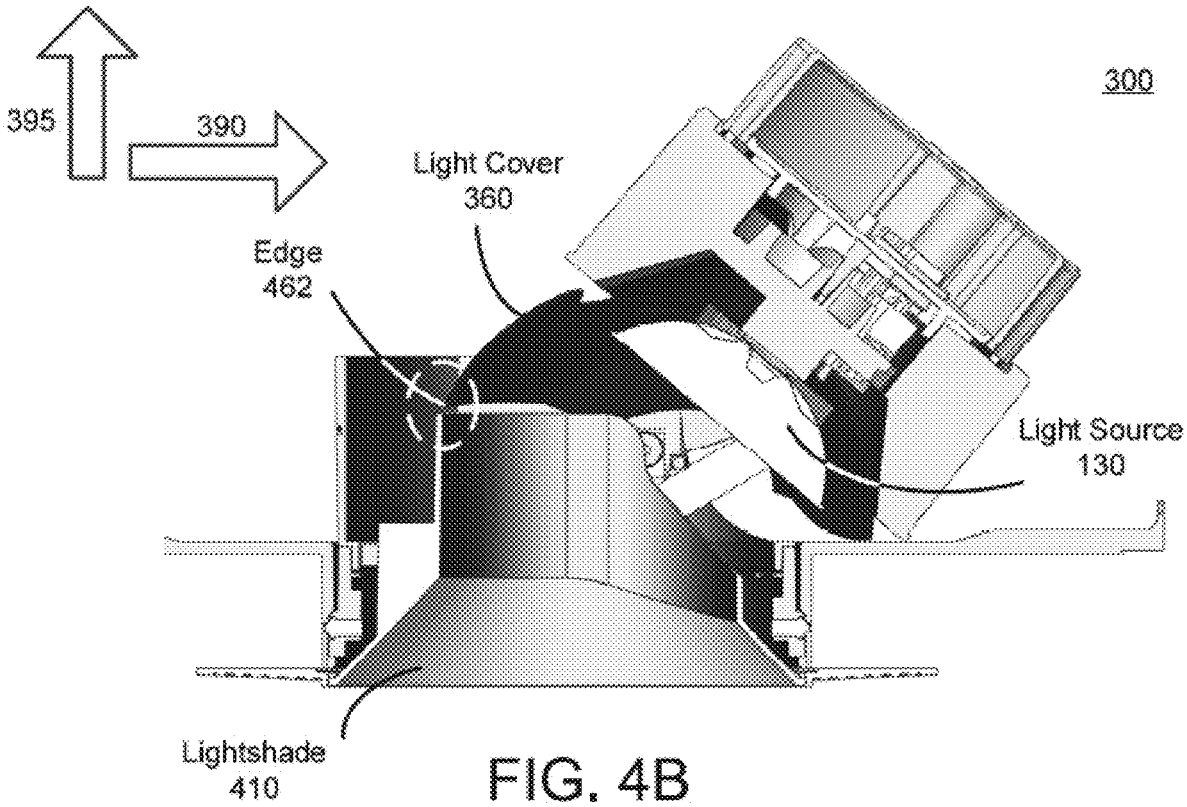
FIG. 4B illustrates a cross section of the adjustable light apparatus in a second state with the lampshade, according to one or more embodiments.

Referring to FIG. 4A, illustrated is a cross section of the adjustable light apparatus 300 in a first state with a lightshade 410, according to one or more embodiments. Referring to FIG. 4B, illustrated is a cross section of the adjustable light apparatus 300 in a second state with the lightshade 410, according to one or more embodiments. In some embodiments, the adjustable light apparatus 300 further includes a lightshade 410 that helps prevent any line of sight through the adjustable mount 350 from outside. The lightshade 410 may have a funnel shape, a hollow cylindrical shape, or any combination of them. In this configuration, when the adjustable light apparatus 300 is configured in the first state, the modular light assembly 100 is oriented along the orthogonal direction 395, such that the modular light assembly 100 blocks any line of sight through the adjustable mount 350 from outside. When the adjustable light apparatus 300 is configured in the second state, the modular light assembly 100 is oriented along a direction slanted from the orthogonal direction 395, such a gap between the modular light assembly 100 and the adjustable light apparatus 300 may exist. However, even when the light cover 360 is pushed furthest away from the orthogonal direction 395 as possible according to the guide panel 320, an end of the light cover 360 is aligned with the edge 462 of the lightshade 410. Hence, the line of sight through the adjustable light apparatus 300 can be blocked by the light cover 360 even when the modular light assembly 100 is in the second state.

Figure 5A:
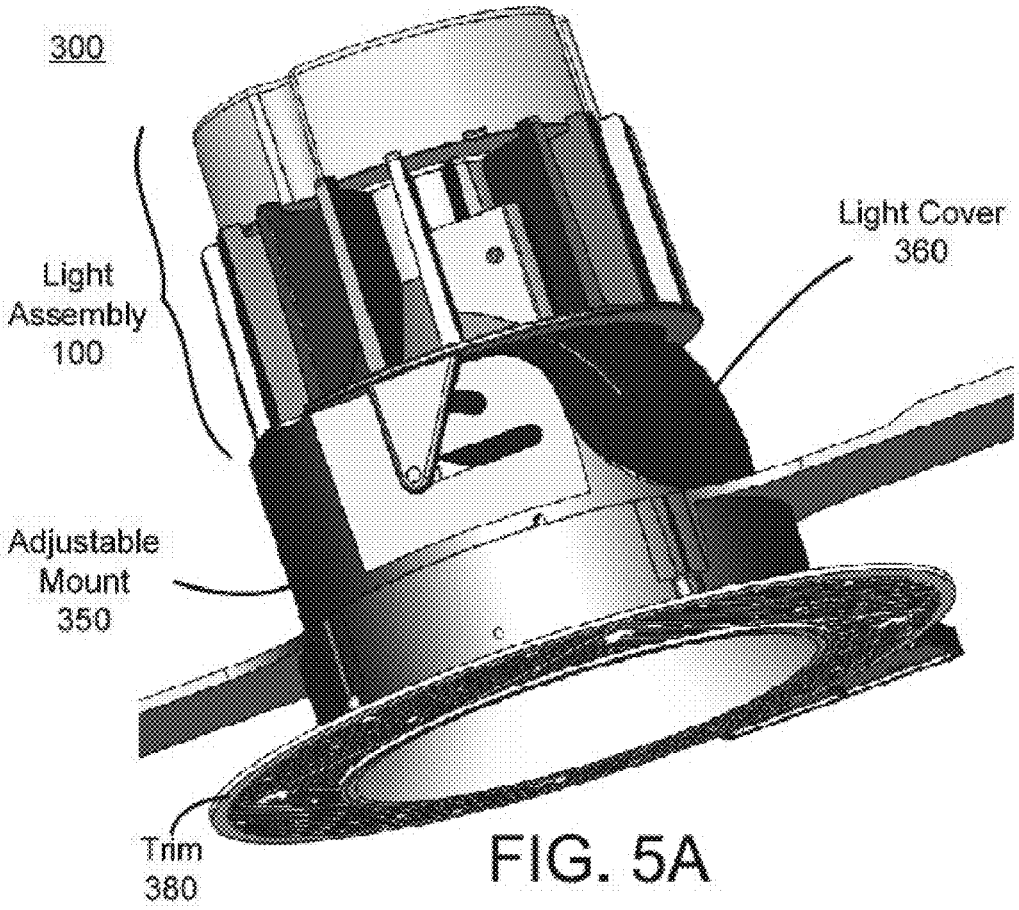
FIG. 5A illustrates a perspective view of the adjustable light apparatus in a first state, according to one or more embodiments.
Figure 5B:
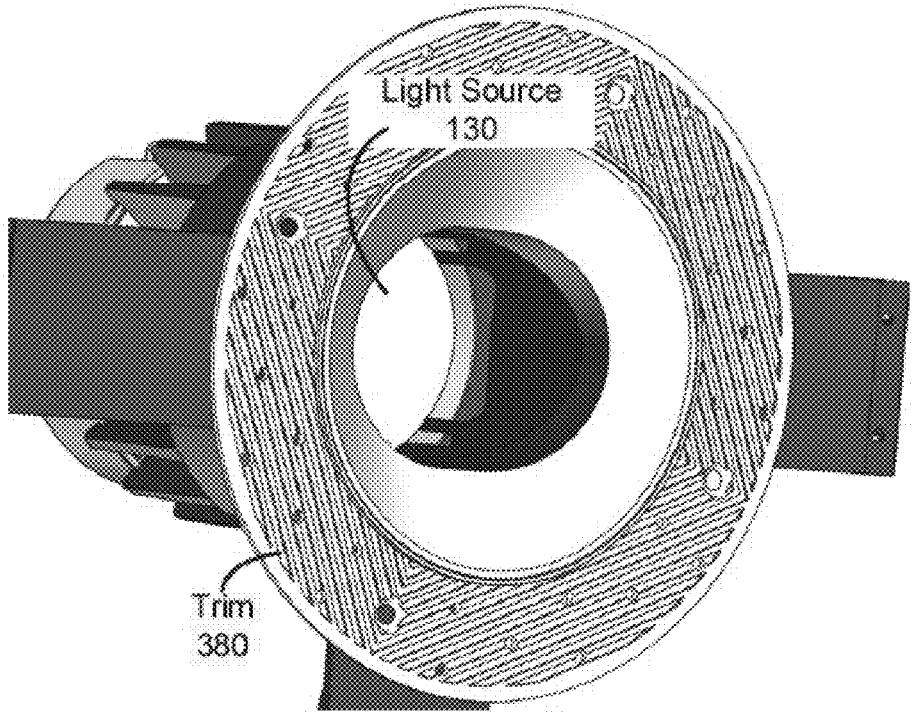
FIG. 5B illustrates a bottom view of the adjustable light apparatus in the first state, according to one or more embodiments.

Referring to FIG. 5A, illustrated is a perspective view of the adjustable light apparatus 300 in a first state, according to one or more embodiments. Referring FIG. 5B illustrated is a bottom view of the adjustable light apparatus in the first state, according to one or more embodiments. When the adjustable light apparatus 300 is configured in the first state, the modular light assembly 100 is aligned in the orthogonal direction of the trim 380. In this state, the light cover 360 may be aligned between the adjustable mount 350 and the modular light assembly 100. Accordingly, a line of sight through the adjustable light apparatus 300 from outside is blocked by the light cover 360.

Figure 6A:
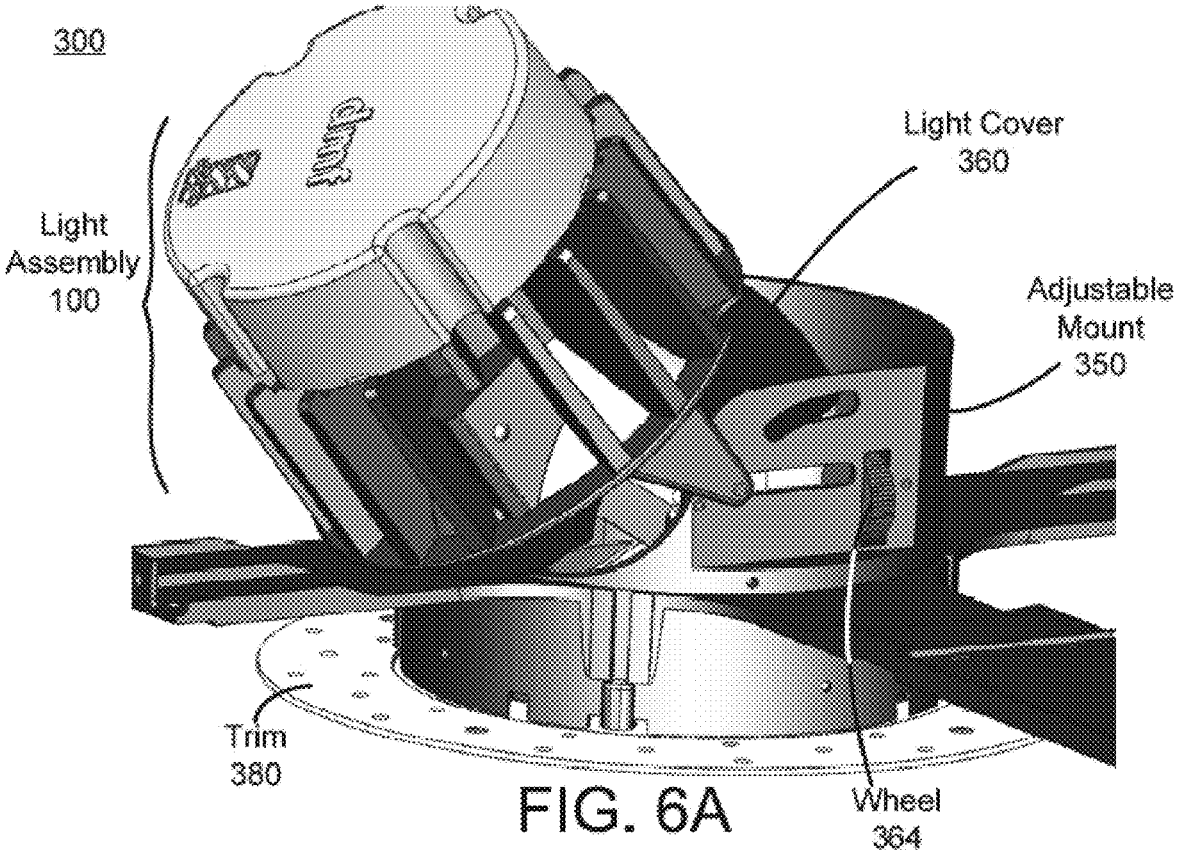
FIG. 6A illustrates a perspective view of the adjustable light apparatus in a second state, according to one or more embodiments.
Figure 6B:
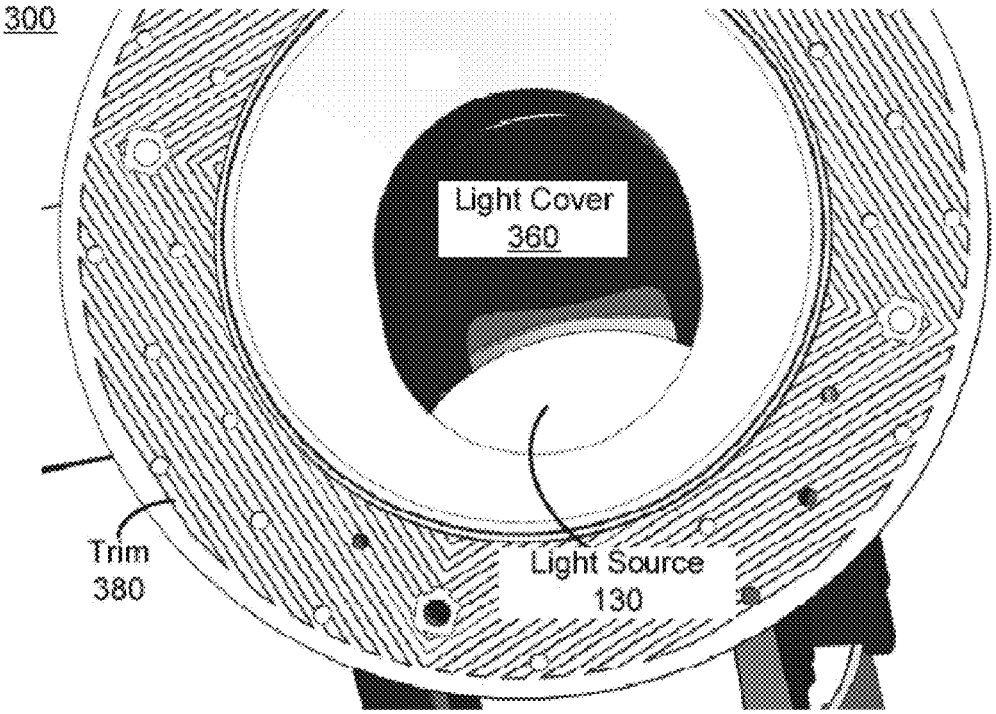
FIG. 6B illustrates a bottom view of the adjustable light apparatus in the second state, according to one or more embodiments.

Referring to FIG. 6A, illustrated is a perspective view of the adjustable light apparatus 300 in a second state, according to one or more embodiments. Referring to FIG. 6B, illustrated is a bottom view of the adjustable light apparatus 300 in the second state, according to one or more embodiments. When the adjustable light apparatus 300 is configured in the second state, the modular light assembly 100 is oriented in the slanted direction from the orthogonal direction of the trim 380. In this state, the light cover 360 is also shifted together with the modular light assembly 100. Although the light cover 360 and the modular light assembly 100 are shifted from the orthogonal direction 395 in the second state, the guide panel 320 ensures that there is no gap exposed between the adjustable mount 350 and the light cover 360. Hence, a line of sight through the adjustable light apparatus 300 from outside is blocked by the light cover 360.

Figure 7B:
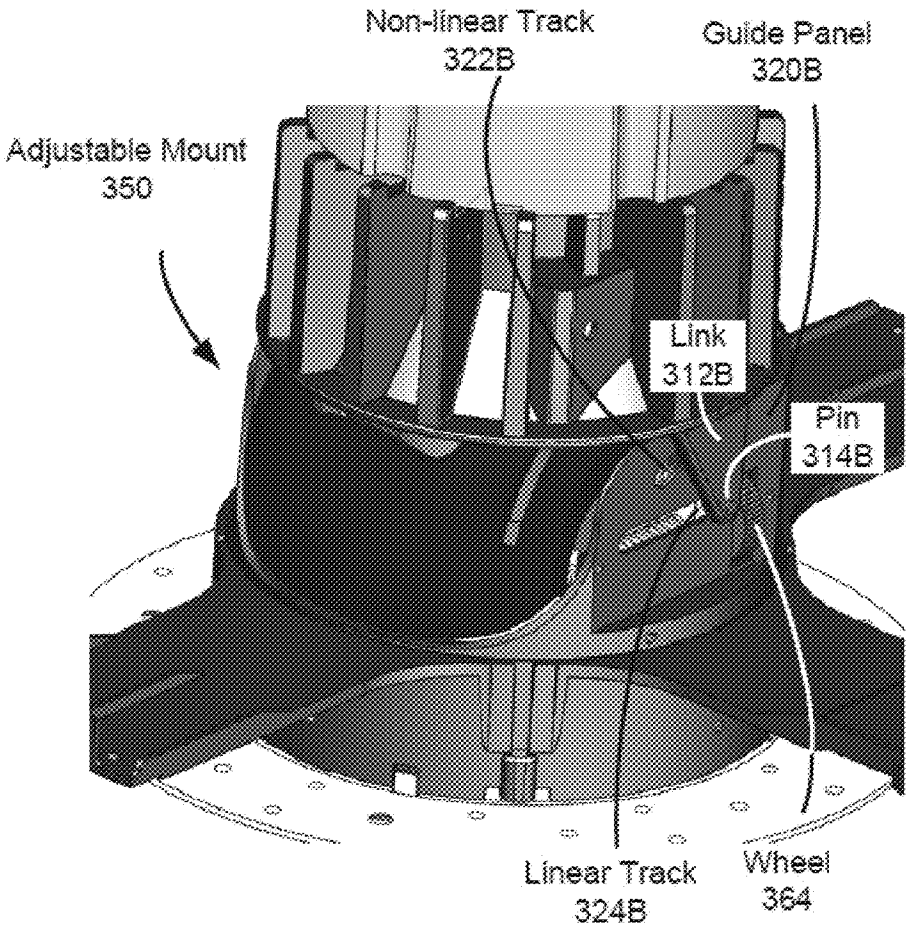
FIG. 7B illustrates another perspective view of the adjustable mount, according to one or more embodiments.
Figure 7A:
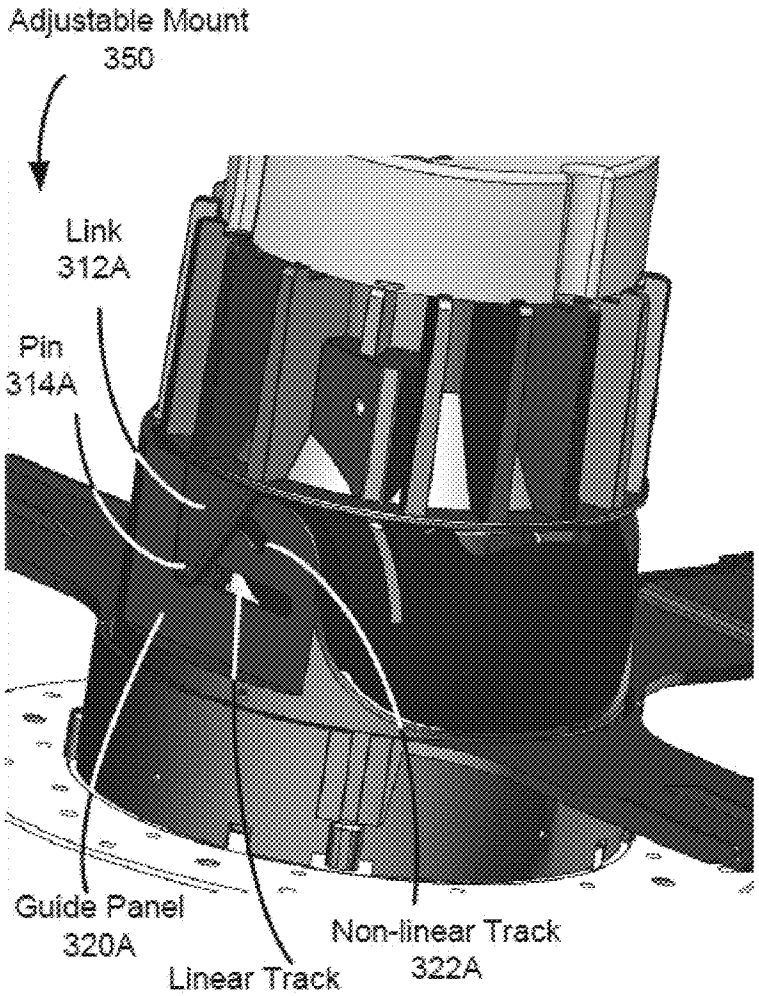
FIG. 7A illustrates a perspective view of an adjustable mount, according to one or more embodiments.

Referring to FIGS. 7A and 7B, illustrated are perspective views of the adjustable mounts 350A, 350B, according to one or more embodiments. As shown in FIGS. 7A and 7B, the adjustable light apparatus 300 includes two guide panels 320A, 320B. In one embodiment, the guide panel 320A is coupled to a side of the adjustable mount 350, where the guide panel 320B is coupled to an opposite side of the adjustable mount 350. In one aspect, the guide panel 320B includes a slot at which a wheel 364 can be located, where the guide panel 320A lacks such wheel. By turning the wheel 364, orientations of the modular light assembly 100 can the light cover 360 can be adjusted together.

Figure 8A:
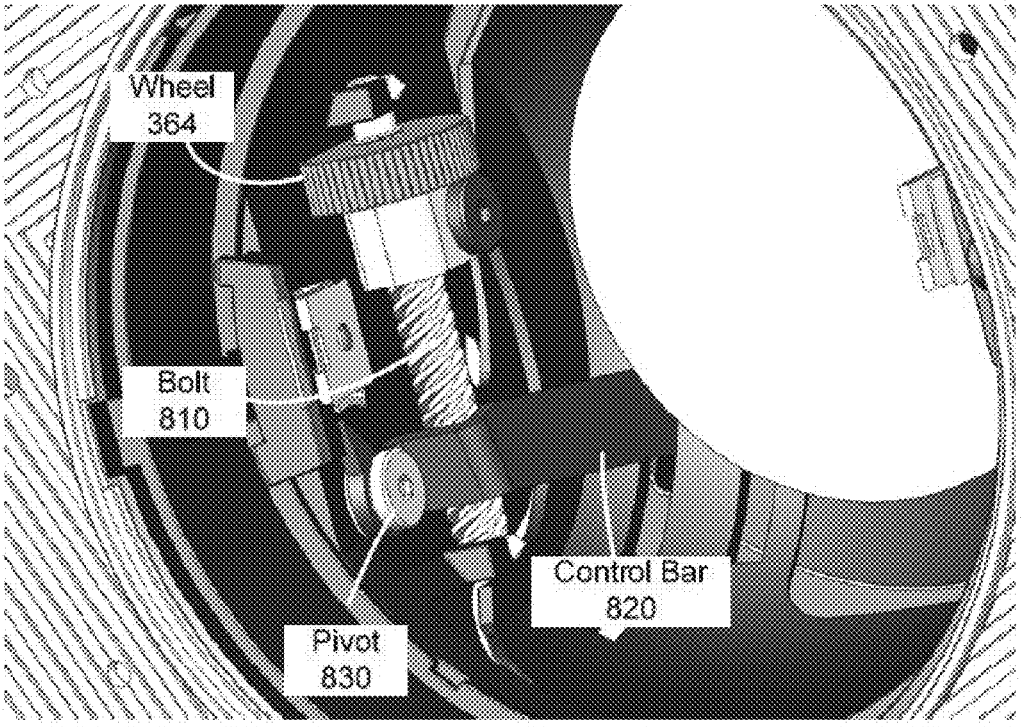
FIG. 8A illustrates an inside of the adjustable mount, according to one or more embodiments.
Figure 8B:
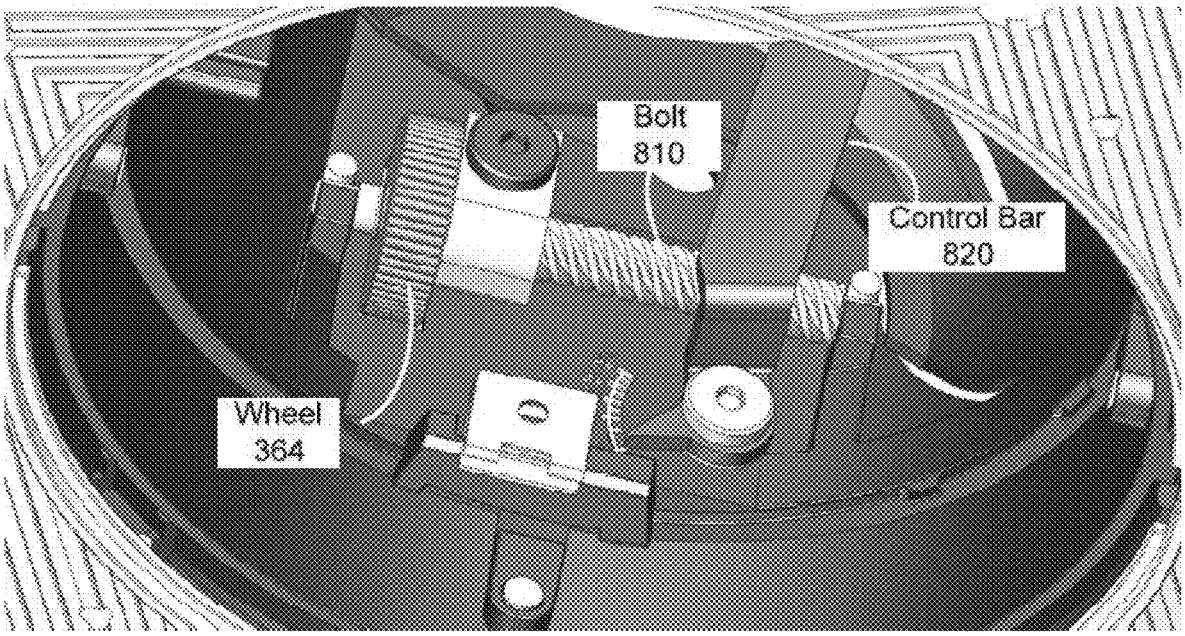
FIG. 8B is a zoom-in diagram of the adjustable mount, according to one or more embodiments.

Referring to FIG. 8A, illustrated is an inside of the adjustable mount 350, according to one or more embodiments. Referring to FIG. 8B, illustrated is a zoom-in diagram of the adjustable mount 350, according to one or more embodiments. As shown in FIGS. 8A and 8B, the wheel 364 is coupled to the inside of the adjustable mount 350. The wheel 364 may be coupled to the middle base 310, and located at a corresponding slot of the guide panel 320. A portion of the wheel 364 may be exposed to the outside of the adjustable mount 350 through a slot in the guide panel as shown in FIG. 7B. In one embodiment, a center of the wheel 364 is coupled to one portion of a bolt 810, and another portion of the bolt 810 is coupled to a control bar 820. In addition, one end of the control bar 820 may be affixed by a pivot 830 and another end of the control bar 820 is coupled to the modular light assembly 100. In this configuration, turning the wheel 364 causes the bolt 810 to be rotated. Turning of the bolt 810 causes an intersection of the bolt 810 and the control bar 820 to be changed. Because one end of the control bar 820 is fixed to the pivot 830, the control bar 820 rotates with respect to the pivot 830 according to the change in the intersection of the bolt 810 and the control bar 820. Thus, an orientation of the modular light assembly 100 may be adjusted by turning the wheel 364. Although not shown in FIGS. 8A and 8B, the control bar 820 may be directly or indirectly coupled to the light cover 360. Hence, the orientation of the lighting cover 360 may be simultaneously adjusted by turning the wheel 364. The light cover 360 and the bottom surface of the module 100 are coupled through the control bar 820. Moreover, two small guidance features located at the bottom surface of the module also help maintaining the side stability of the light cover 360 during its rotation.

Figure 9A:
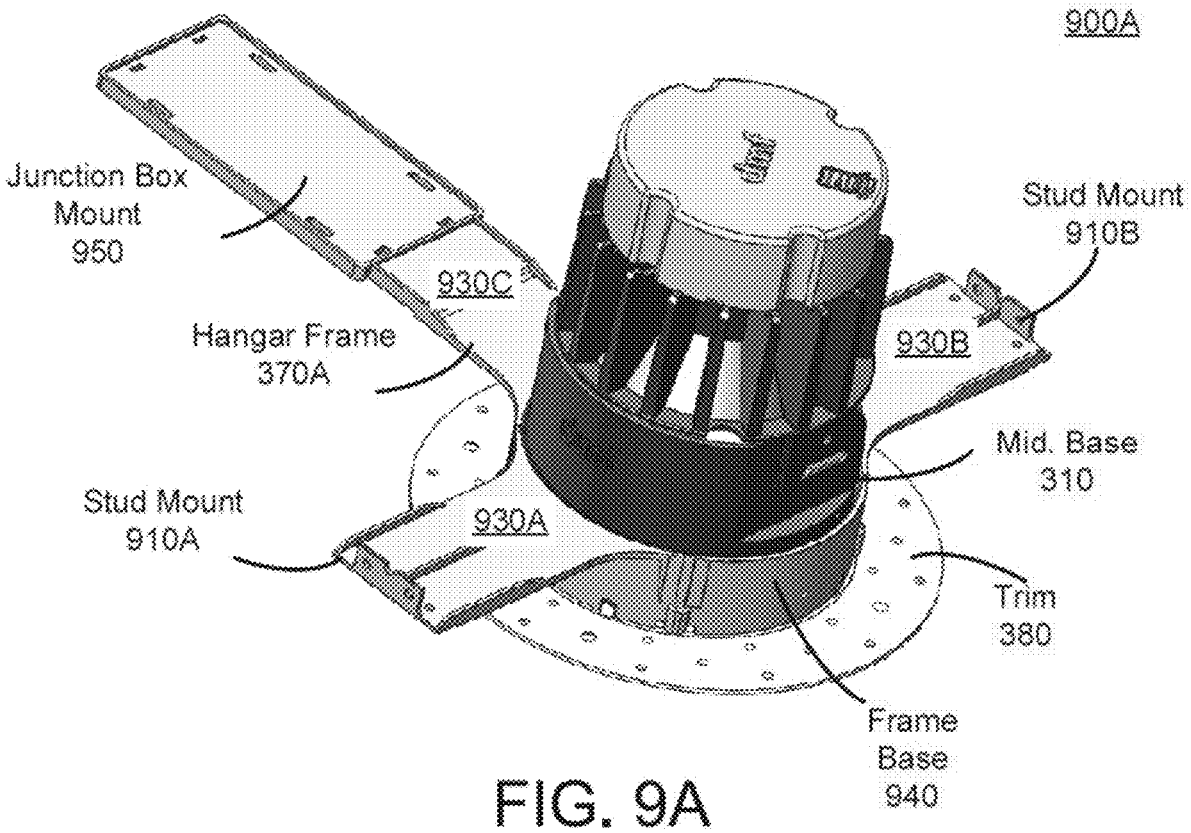
FIG. 9A illustrates a perspective view of a light apparatus with a hanger frame, according to one or more embodiments.

Referring to FIG. 9A, illustrated is a perspective view of a light apparatus 900A with a hanger frame 370A, according to one or more embodiments. The light apparatus 900A may be the adjustable light apparatus 300. The hanger frame 370A is a component that allows the modular light assembly 100 to be secured to a stud or a beam in a ceiling or a wall. In one embodiment, the hanger frame 370A includes a frame base 940, wings 930A, 930B, 930C, stud mounts 910A, 910B, and a junction box mount 950. The frame base 940 may have a hollow cylindrical shape to cover the bottom base 340 of the adjustable light apparatus 300. In one embodiment, the wing 930A extends from a first joint at an end of the frame base 940; the wing 930B extends from a second joint at another end of the frame base 940; and the wing 930C extends from a third joint at another end of the frame base 940. In one aspect, the wing 930A extends in a direction parallel to the frame base 940 (or a wall, or a ceiling), and the wing 930B extends in the opposite direction. The wing 930C extends in a direction parallel to the frame base 940 and traversing the extending direction of the wing 930A. The stud mount 910A is coupled to an end of the wing 930A away from the first joint; the stud mount 910B is coupled to an end of the wing 930B away from the second joint; and the junction box mount 950 is coupled to an end of the wing 930C away from the third joint. In this configuration, the stud mounts 910A, 910B can secure the light apparatus 900A through the wings 930A, 930B, respectively. Moreover, a junction box (not shown) for providing power to the driver can be placed on the junction box mount 950. When installed, the junction box can be connected to the driver through an electrical wire (not shown).

Figure 9B:
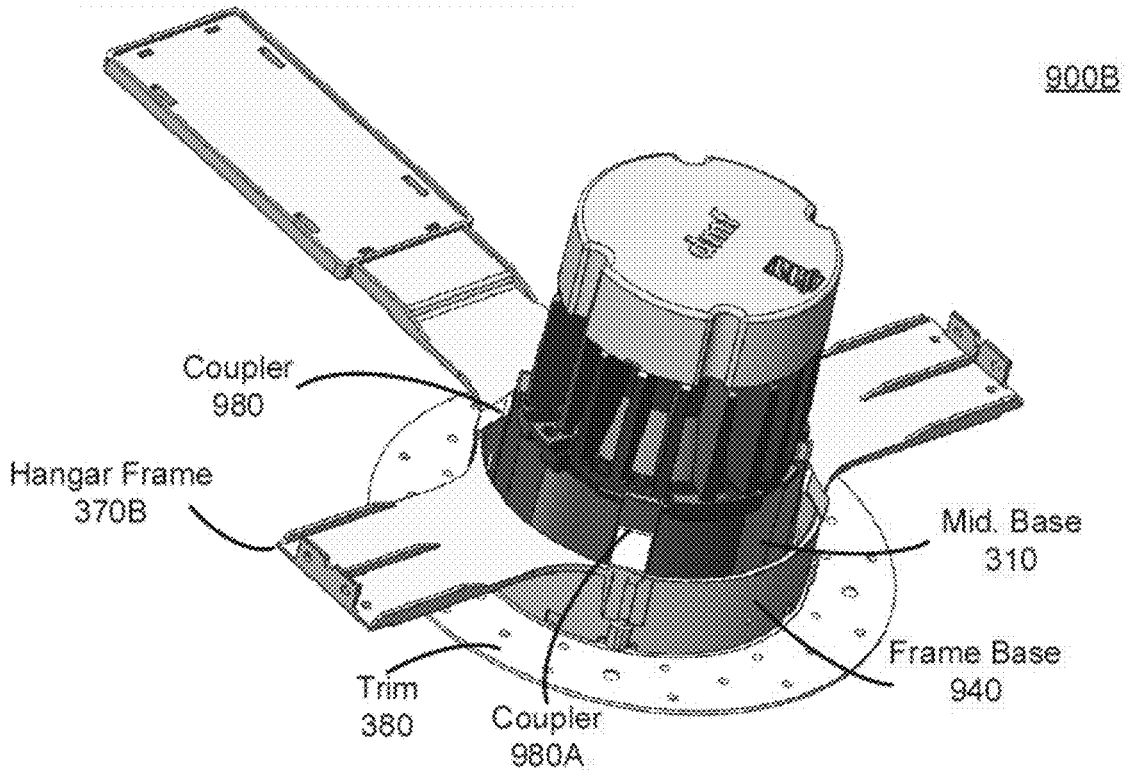
FIG. 9B illustrates a perspective view of a light apparatus with a hanger frame, according to one or more embodiments.

Referring to FIG. 9B, illustrated is a perspective view of the light apparatus 900B with the hanger frame 370B, according to one or more embodiments. The light apparatus 900B may be the adjustable light apparatus 300. As shown in FIG. 9B, couplers 980 may be added to secure the frame base 940 and the middle base 310. The couplers 980 may extend from an edge of the frame base 940 away from the trim 380. The couplers 980 may be clips, mechanical latches or locks that fasten the frame base 940 to the middle base 310.

Figure 9C:
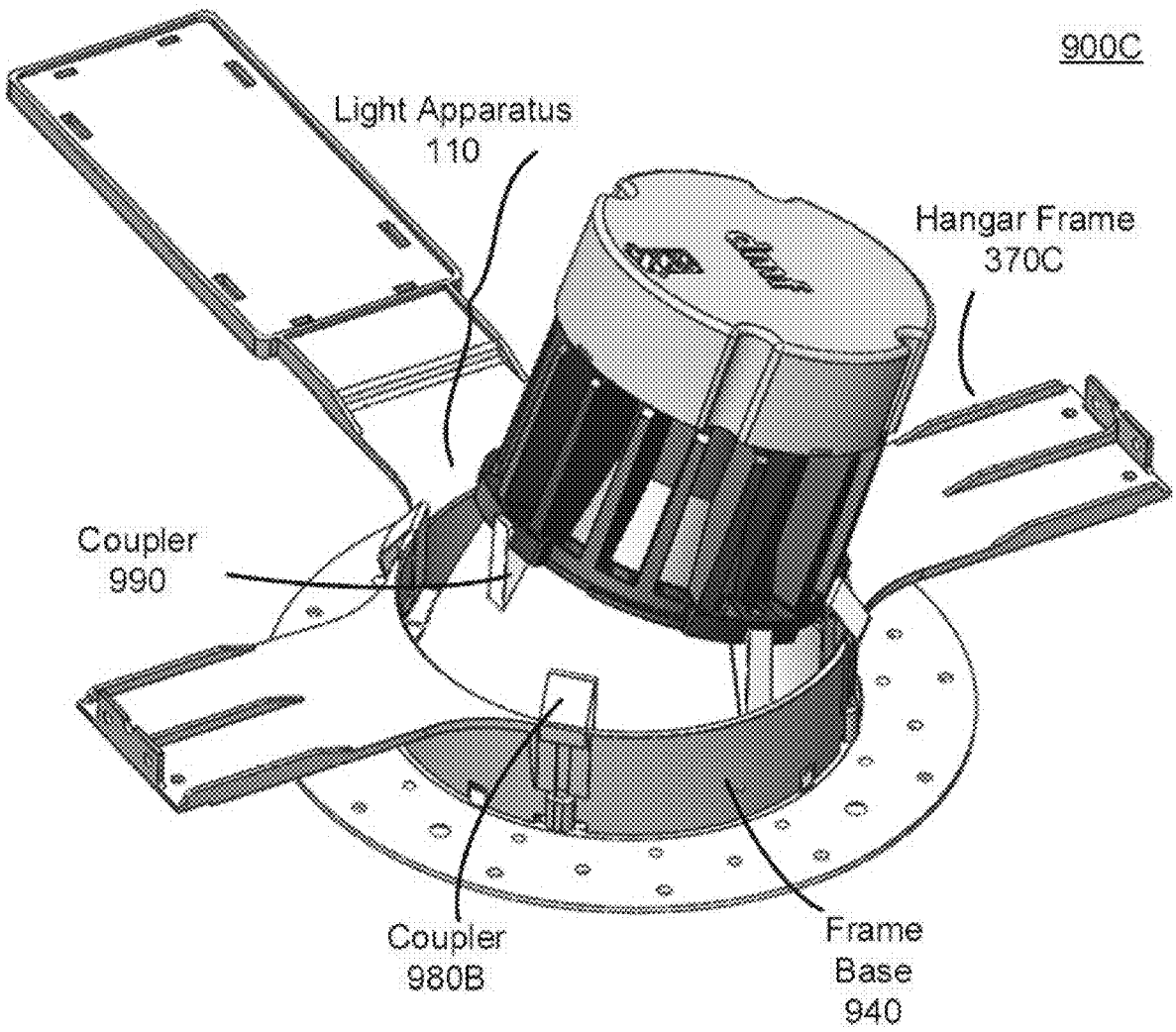
FIG. 9C illustrates a perspective view of a light apparatus with a hanger frame, according to one or more embodiments.

Referring to FIG. 9C, illustrated is a perspective view of the light apparatus 900C with the hanger frame 370C, according to one or more embodiments. The light apparatus 900C may be the modular light assembly 100 without the adjustable mount 350. As shown in FIG. 9C, the couplers 990 may be added to a bottom of the heat sink 120 to directly secure the modular light assembly 100 to the frame base 940. This is wall-wash module which works at a certain pre-defined angle. As should be appreciated, the application of a wall-wash fixture is to illuminate a wall uniformly. A benefit of the present design is that a universal frame can accommodate either wall-wash, adjustable, or regular downlight fixture.

A First Exemplary Design for an Adjustable Lighting Apparatus

FIGS. 10A-10L show an exemplary adjustable lighting apparatus 1000 according to one inventive implementation. The adjustable lighting apparatus 1000 may include a lighting module 1100 that is rotatably adjustable. The lighting module 1100 may include a light source 1160 to emit light, a driver 1120 to supply power to the light source 1160, a heat sink 1140 to dissipate heat generated by the light source 1160, and a heat sink arm 1180 that defines the mechanical motion of the lighting module 1100 relative to the adjustable mount 1300. The lighting module 1100 may be coupled to an adjustable mount 1300. The adjustable mount 1300 may include a base structure 1320, which supports at least the lighting module 1100, a retainer 1340, and a shield 1360. The base structure 1320 may mechanically constrain, at least in part, the axes of motion of the lighting module 1100. The retainer 1340 may be coupled to the base structure 1320 to provide additional mechanical constraint to the lighting module 1100 and to enclose, at least in part, the exterior of the adjustable lighting apparatus 1000. A shield 1360 may be disposed within an interior cavity 1322 of the base structure 1320 to substantially cover the openings in the base structure 1320. A trim 1700 may be attached to the interior cavity 1322 of the base structure 1320 to cover a hole in a ceiling or wall into which the adjustable lighting apparatus 1000 is installed or placed. A rotation ring 1500 may be coupled to the base structure 1320 to provide a coupling mechanism to securely couple the adjustable mount 1300 and the lighting module 1100 to a frame 1600 mounted in the ceiling or wall space.

Figure 10A:
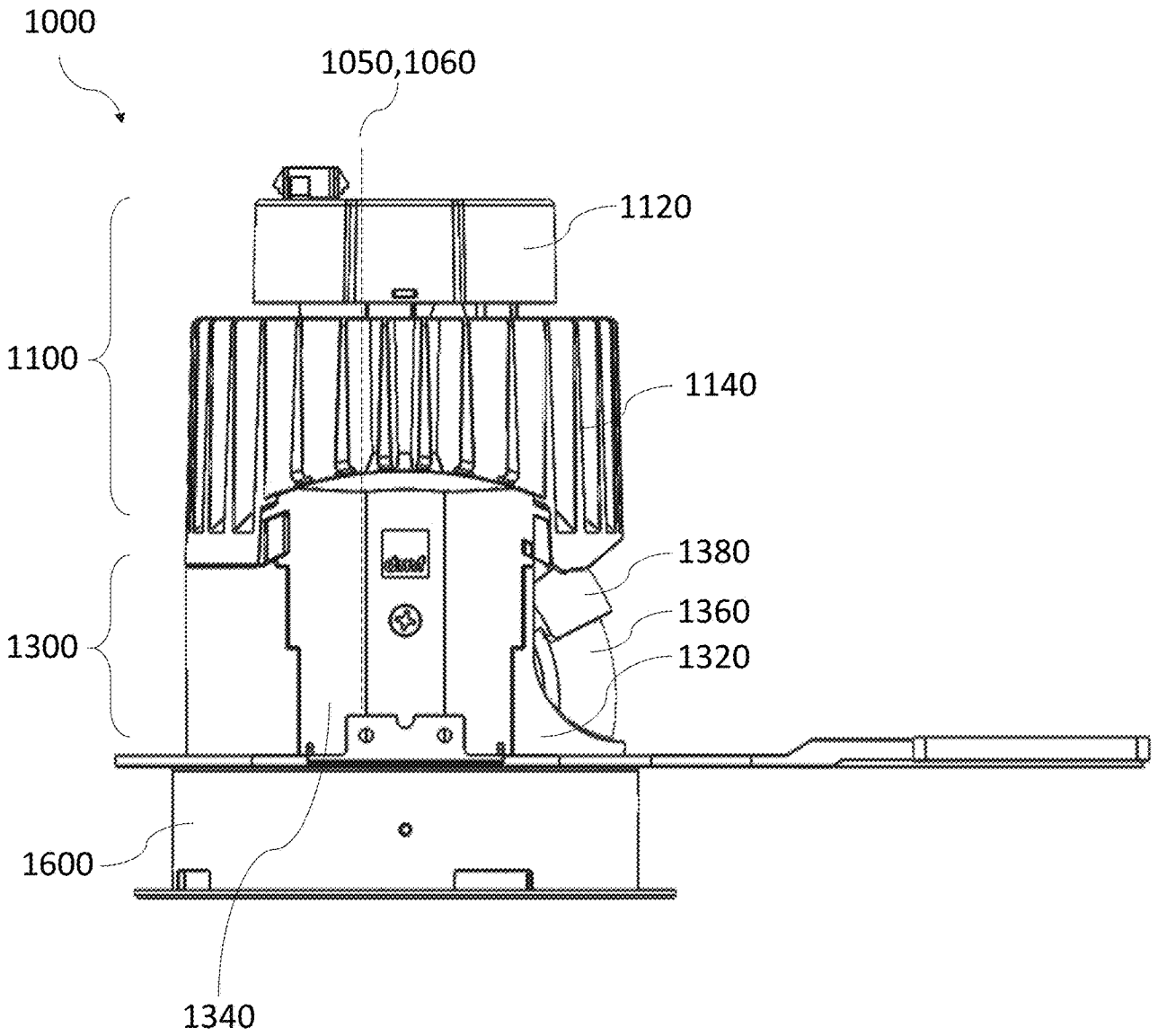
FIG. 10A is a right view of an adjustable lighting apparatus, according to an implementation.
Figure 10B:
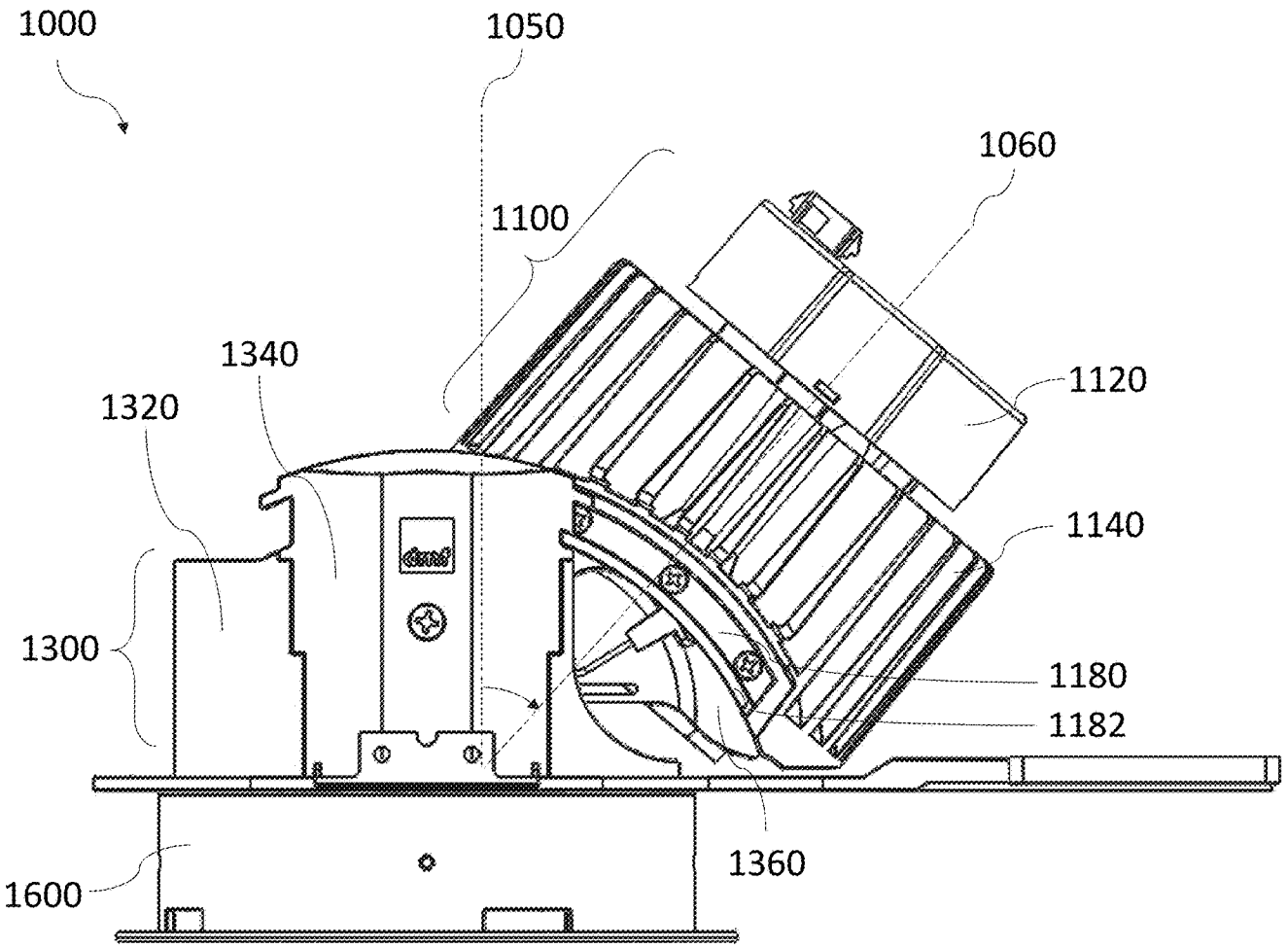
FIG. 10B is a right view of the lighting assembly shown in FIG. 10A in a rotated state.

FIGS. 10A-10H show various side views and cross-sectional views of the adjustable lighting apparatus 1000 to illustrate the manner by which the lighting module 1100 is rotatably adjustable with respect to the adjustable mount 1300. Specifically, FIGS. 10A and 10B show right side views of the adjustable lighting apparatus 1000 in a first rotational position and a second rotational position, respectively. The first rotational position and the second rotational position may be defined as the angle between (1) a reference axis 1050 and (2) a lighting module axis 1060. The reference axis 1050 may be defined orthogonal with respect to a first rotation axis 1010 (which may translate along a first translation axis 1020) and the first translation axis 1020. For the adjustable lighting apparatus 1000 shown in FIGS. 10A and 10B, the first rotation axis 1010 is perpendicular to the right plane (i.e., in other words, oriented to point out of the page of the drawing sheet), the first translation axis 1020 is perpendicular to the front plane, and thus the reference axis 1050 perpendicular to the top plane. The lighting module axis 1060 rotates about the first rotation axis 1010 with the lighting module 1100. For instance, FIG. 10A shows the reference axis 1050 and the lighting module axis 1060 as being coincident and FIG. 10B shows the reference axis 1050 and the lighting module axis 1060 as being rotated with respect to one another. In some implementations, the first rotational position may be about 0 degrees, which may correspond to the reference axis 1050 and the lighting module axis 1060 being coincident. In some implementations, the second rotational position may be about 40 degrees between the reference axis 1050 and the lighting module axis 1060. It should be appreciated that the first rotational position and the second rotational position may be different depending on the application.

Figure 10C:
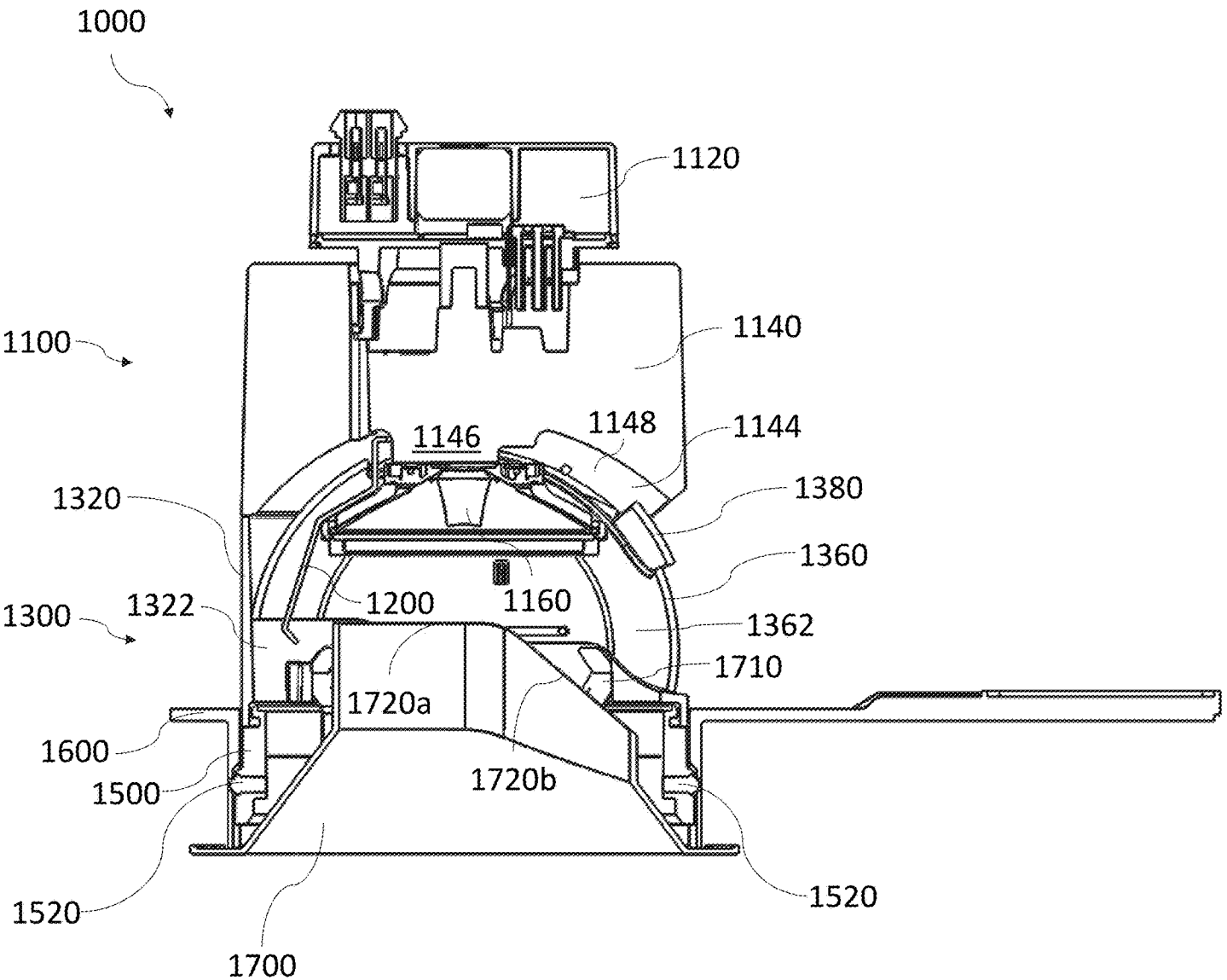
FIG. 10C is a right cross-sectional view of the lighting assembly shown in FIG. 10A.
Figure 10D:
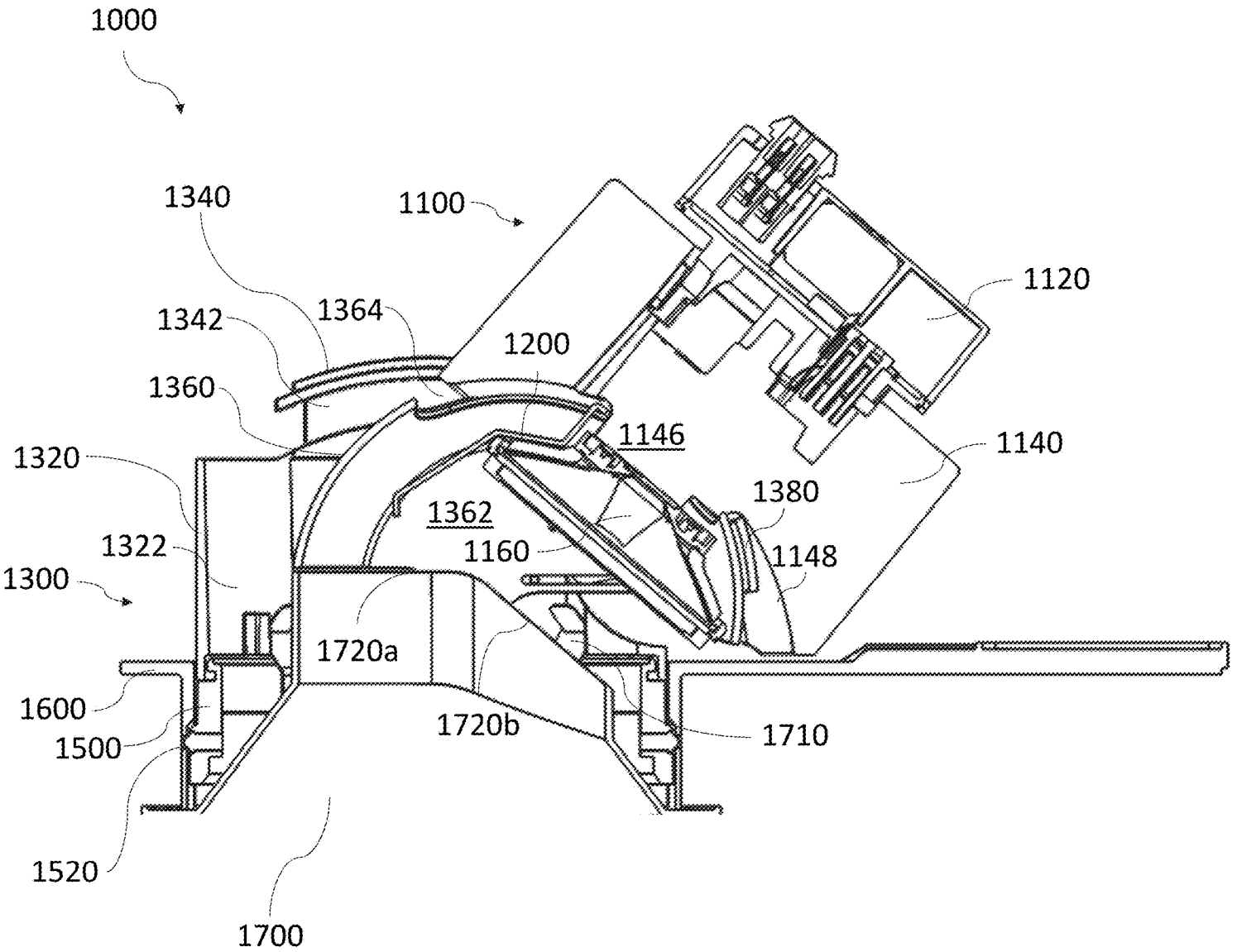
FIG. 10D is a right cross-sectional view of the lighting assembly shown in FIG. 10C in a rotated state.

FIGS. 10C and 10D show cross-sectional right side views of the adjustable lighting apparatus 1000 in the first rotational position and the second rotational position, respectively, along a plane that intersects the interior cavity 1322 of the base structure 1320. FIGS. 10C and 10D show cross-sectional left side views of the adjustable lighting apparatus 1000 in the first rotational position and the second rotational position, respectively, along a plane that shows only the heat sink arm 1180 without the retainer 1340. FIGS. 10C and 10D show cross-sectional left side views of the adjustable lighting apparatus 1000 in the first rotational position and the second rotational position, respectively, along a plane that shows the retainer 1340 and a portion of the heat sink arm 1180.

Figure 10E:
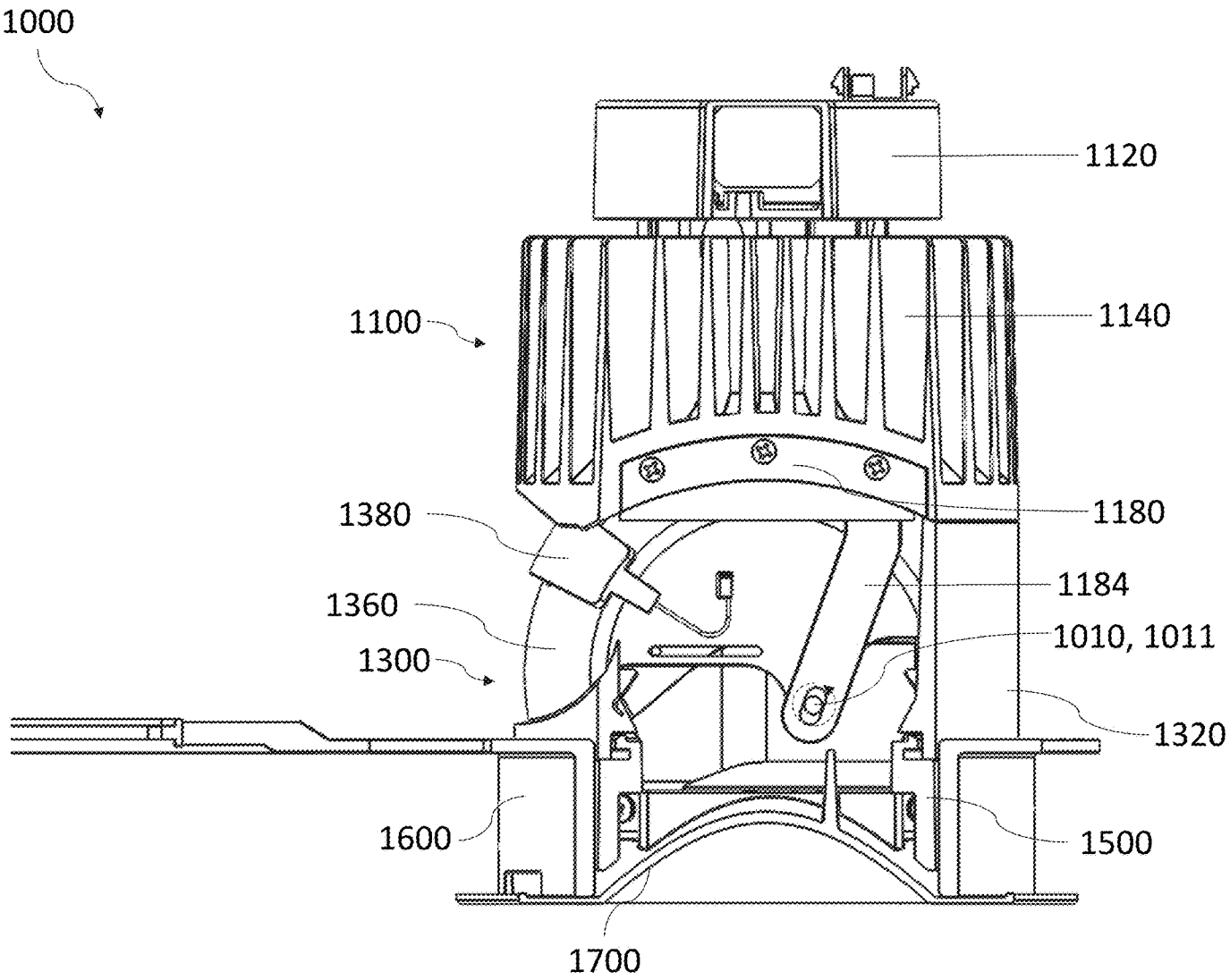
FIG. 10E is a left cross-sectional view of the lighting assembly shown in FIG. 10A.
Figure 10F:
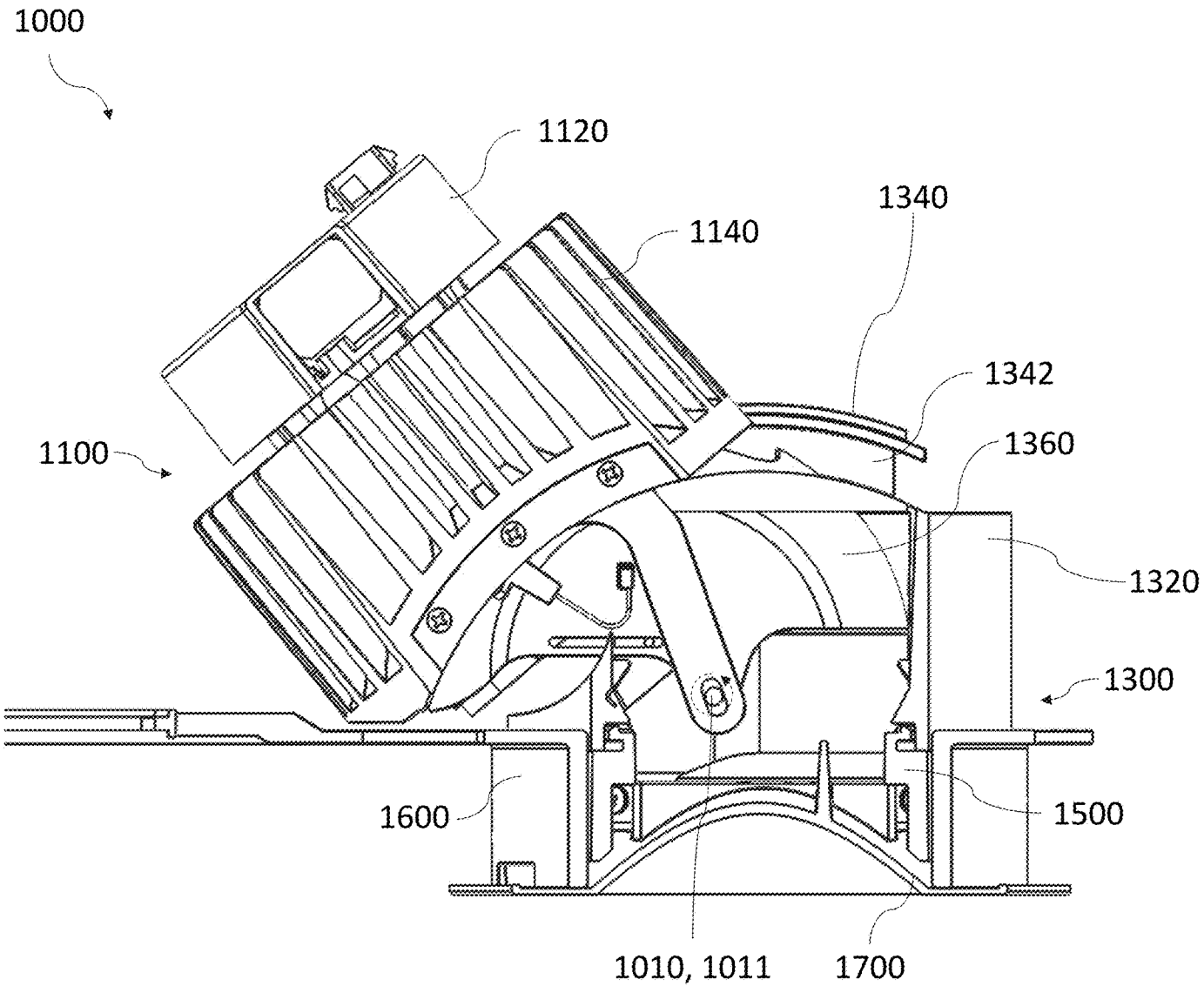
FIG. 10F is a left cross-sectional view of the lighting assembly shown in FIG. 10E in a rotated state.

For the adjustable lighting apparatus 1000 shown in FIGS. 10E-10F, the motion of the lighting module 1100 relative to the adjustable mount 1300 is constrained, in part, by the base structure 1320 and the retainer 1340. In particular, the lighting module 1100 rotates about the first rotation axis 1010 via the heat sink arm 1180. The first rotation axis 1010 is constrained to translate along a slot 1324 on the base structure 1320, the orientation of which defines the first translation axis 1020. The heat sink arm 1180 of the lighting module 1100 also includes a motion track 1182 that couples to a corresponding motion rail 1342 on the retainer 1340. In some implementations, the motion track 1182 on the heat sink arm 1180 and the motion rail 142 on the retainer 1340 limit the range of rotation of the lighting module 1100. The motion track 1182 and the motion rail 1342 may have a curvature with a corresponding center of curvature that is not coincident with the first rotation axis 1010. In this manner, when rotating the lighting module 1100 about the first rotation axis 1010, the curvature of the motion track 1182 and the motion rail 1342 generate a force that is imparted on the lighting module 1100 causing the lighting module 1100 to also translate along the first translation axis 1020. The combination of rotation and translation enables, in part, redirection of light from the lighting module 1100 with reduced shading losses caused by the stationary components of the adjustable lighting apparatus 1000.

Figure 10G:
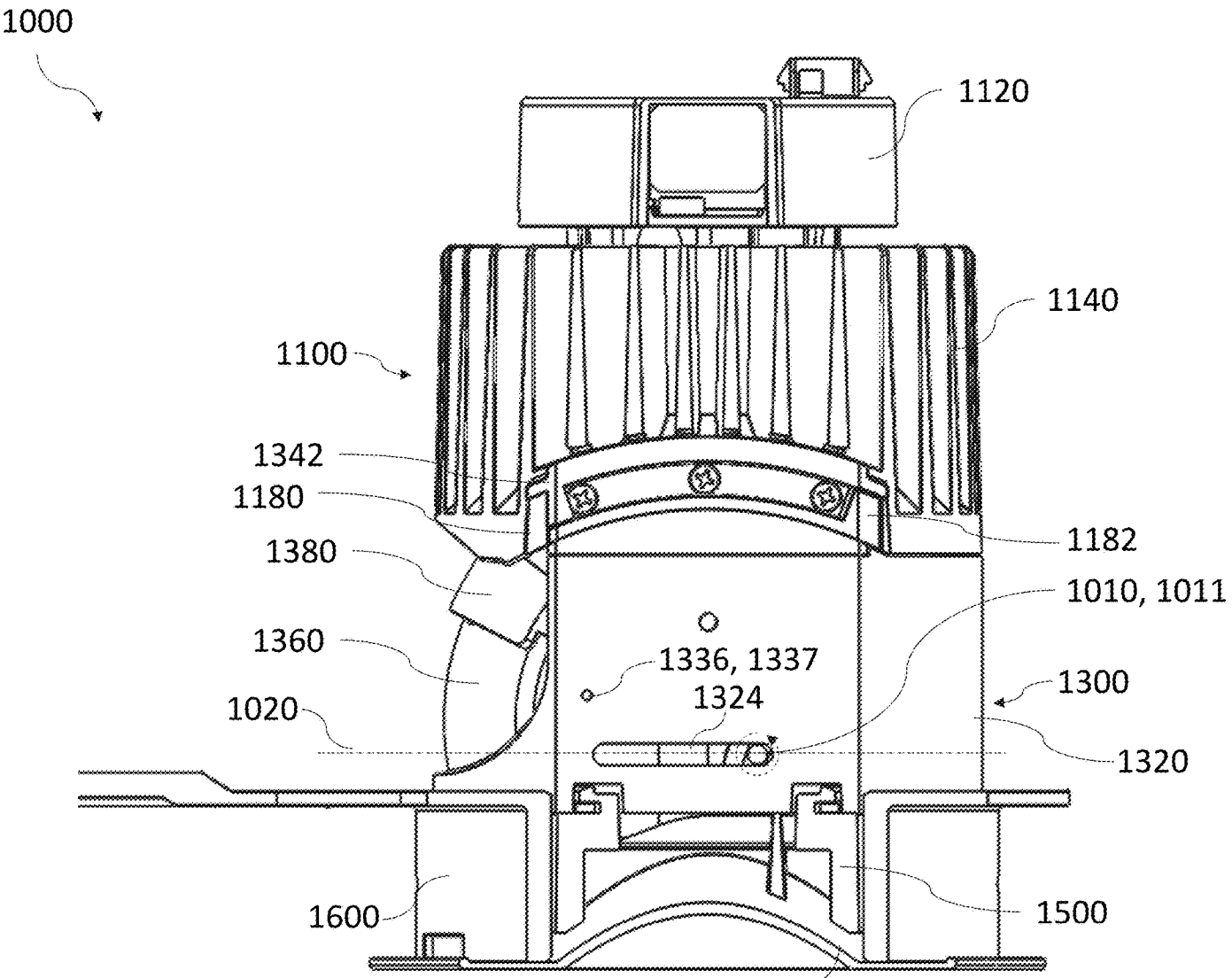
FIG. 10G is another left cross-sectional view of the lighting assembly shown in FIG. 10A.
Figure 10H:
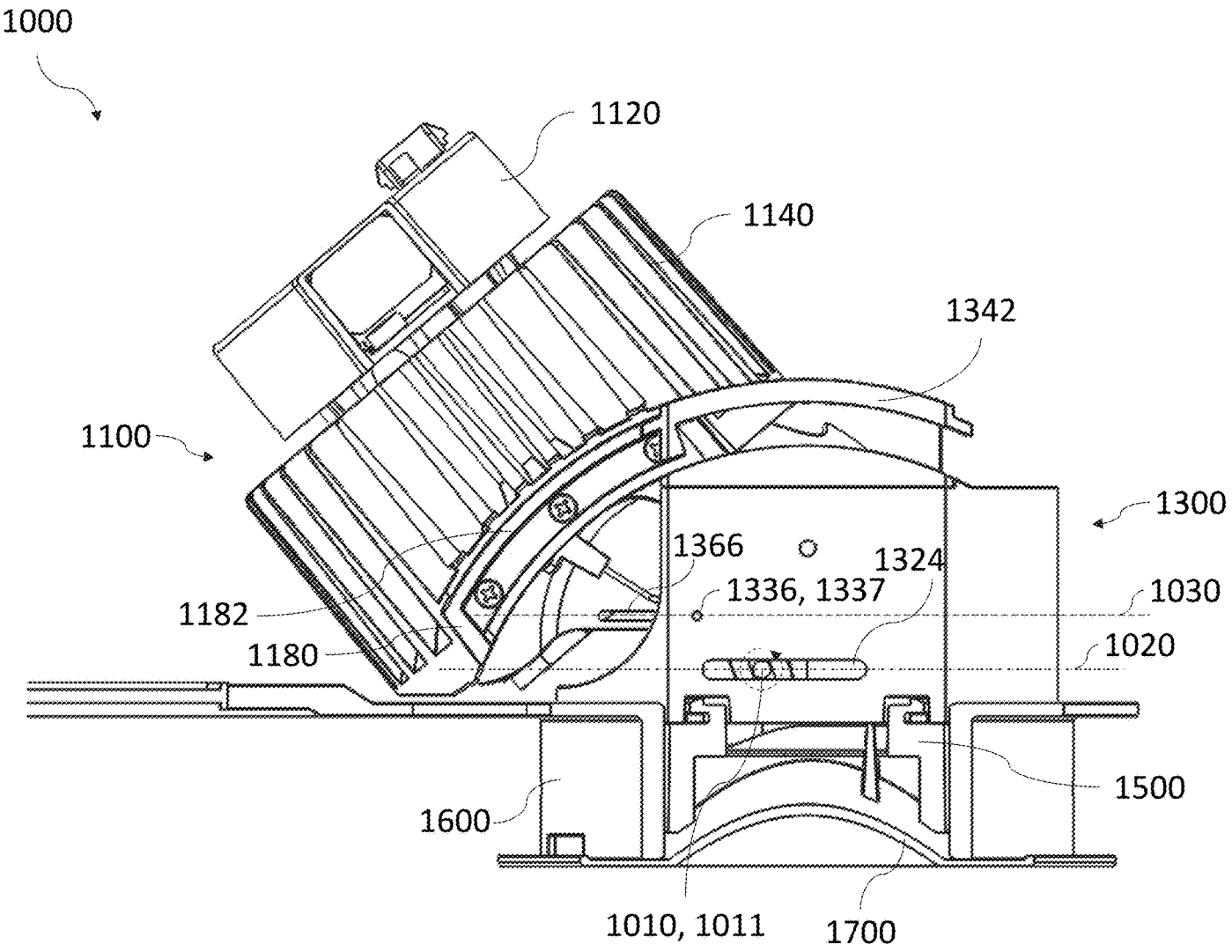
FIG. 10H is a left cross-sectional view of the lighting assembly shown in FIG. 10G in a rotated state.

As shown in FIGS. 10C and 10D, the rotational range of motion of the lighting module 1100 is constrained, in part, by a rotation slot 1364 on the shield 1360. The rotation slot 1364 may be disposed around the base of the light source 1160 of the lighting module 1100 such that the lighting module 1100 physically contacts the respective edges of the rotation slot 1364 when rotated to the respective limits of the rotational range of motion. The motion track 1182 and the motion rail 1342 may also each include a mechanical stop that physically contacts one another when the lighting module 1100 is rotated to the second rotational position, as shown in FIGS. 10G and 10H. Additionally, the length of the slot 1324 and the respective position of the first rotation axis 1010 within the slot 1324 may be tailored to correspond to the first rotational position and the second rotational position.

The shield 1360 may also be coupled to the lighting module 1100 at the first rotation axis 1010. However, the shield 1360 may be designed to only translate along the first translation axis 1020 with the lighting module 1100 in order to preserve the relative rotational motion between the lighting module 1100 and the shield 1360. This may be accomplished, in part, by coupling the shield 1360 to the lighting module 1100 with a pin joint along the first rotation axis 1010. Additionally, the shield 1360 may include a stabilizing slot 1366 substantially parallel to the slot 1324. A pin 1337, rigidly coupled to the base structure 1320 via a hole 1336, may be inserted into the stabilizing slot 1366 to guide the shield 1360 when translating along the first translation axis 1020. In this manner, the combination of the stabilizing slot 1366 and the slot 1324 reduces undesirable rotational motion of the shield 1360.

It should be appreciated in some implementations, it may be preferable to rotate the shield 1360 and/or translate the shield 1360 along at least a second translational axis. Such motion may allow the shield 1360 to better cover openings in the adjustable mount 1300. For example, the base structure 1320 may include a curved slot 1324 that in combination with the motion track 1182 and the motion rail 1342 causes both the lighting module 1100 and the shield 1360 to rotate and translate along multiple axes.

An adjustment mechanism, disposed within the interior cavity 1322 of the base structure 1320, may be used to rotate the lighting module 1100 to a desired rotational position. The actuation mechanism may also include a locking mechanism to secure the lighting module 1100 at the desired rotational position. Additional details of exemplary adjustment mechanisms and locking mechanisms will be provided below.

In order to accommodate the rotational motion of the lighting module 1100, the base structure 1320 has a first opening 1328 that is aligned proximate to and, in some instances, abuts the heat sink 1140 of the lighting module 1100. The first opening 1328 extends along the top of the base structure 1320 to a portion on the side of the base structure 1320 corresponding to the physical limits imposed on the rotational motion of the lighting module 1100. As a result, portions of the first opening 1328 of the base structure 1320 may be exposed for a user to see through. The first opening 1328 of the base structure 1320 may thus be covered by a combination of the shield 1360 and the trim 1700 depending on the rotational position of the lighting module 1100. For instance, in FIG. 10C, when the lighting module 1100 is at the first rotational position, the shield 1360 is shaped and dimensioned to substantially cover the first opening 1328. As shown in FIG. 10D, when the lighting module 1100 is at the second rotational position, the shield 1360 is translated along the first translation axis 1020, leaving a portion of the first opening 1328 uncovered. As shown in FIG. 10D, the trim 1700 may be shaped to cover this remaining portion of the first opening 1328 where the trim has a first opening 1702 that is arranged to align proximate to the edge of the shield 1360 when the lighting module 1100 is rotated to its largest rotation angle (e.g., the second rotational position). In this manner, the first opening 1328 of the base structure 1320 remains substantially covered for all rotational positions.

Depending on the rotational position of the lighting module 1100, various portions of the rotation slot 1364 on the shield 1360 may also allow users to see through the adjustable lighting apparatus 1000. The adjustable lighting apparatus 1000 may utilize a combination of the heat sink 1140 and a secondary shield 1380, mounted onto the shield 1360, to substantially cover the rotation slot 1364. In FIG. 10C, when the adjustable lighting apparatus 1000 is in the first rotational position, the heat sink 1140 covers a portion of the rotation slot 1364. The remaining portion of the rotation slot 1364 that is not covered by the heat sink 1140 is covered by the secondary shield 1380. As shown, the secondary shield 1380 is disposed above a portion of the rotation slot 1364 corresponding to an edge of the rotation slot 1364. In FIG. 10D, when the adjustable lighting apparatus 1000 is in the second rotational position, the heat sink 1140 substantially covers the rotation slot 1364. As shown, the secondary shield 1380 may be movable such that when the lighting module 1100 rotates towards the second rotational position, the lighting module 1100 contacts the secondary shield 1380 causing the secondary shield 1380 to move so as not to cover the rotation slot 1364. In this manner, the rotation slot 1364 of the shield 1360 remains substantially covered for all rotational positions.

Figure 10I:
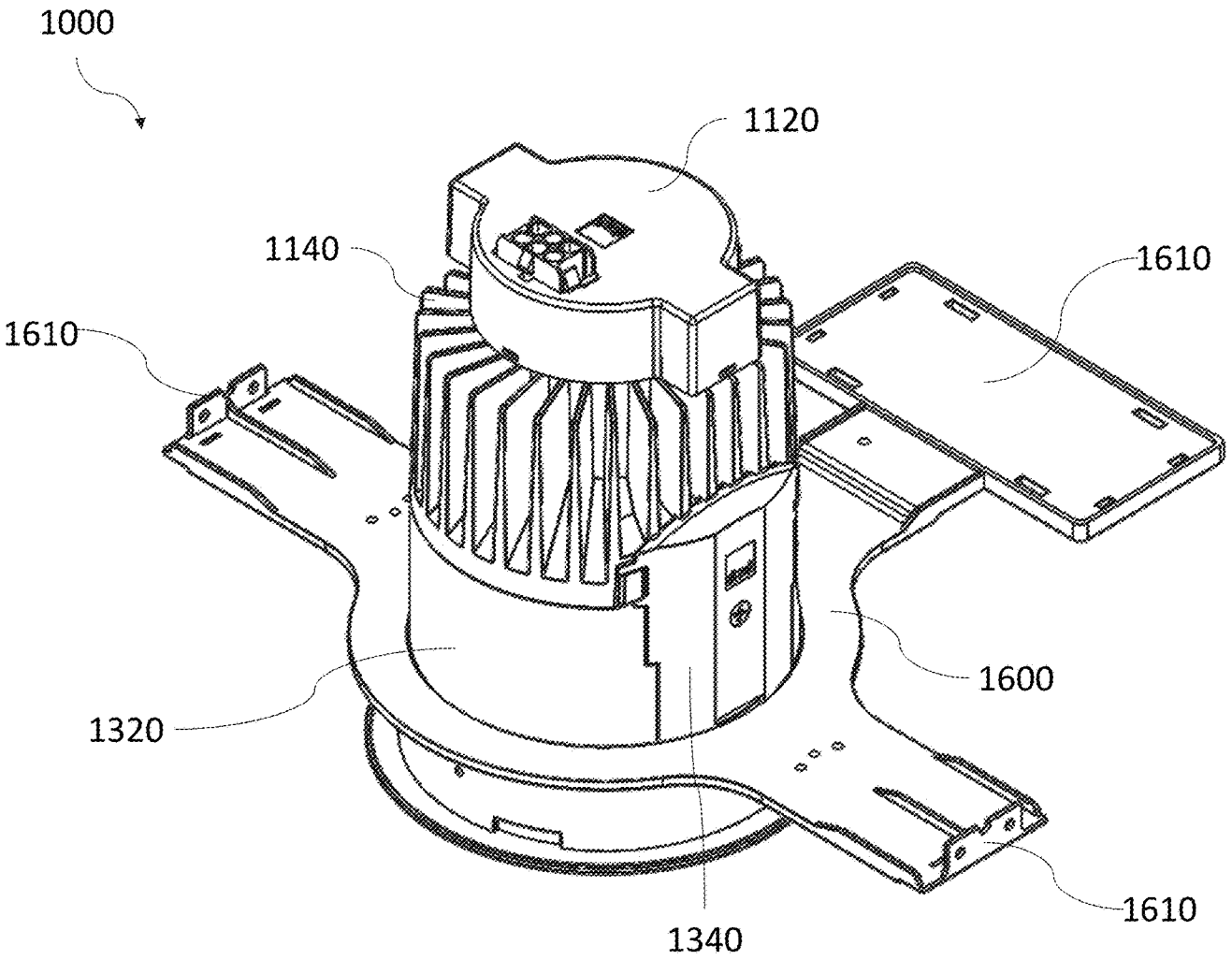
FIG. 10I is a top, right, rear perspective view of the lighting assembly shown in FIG. 10A.
Figure 10J:
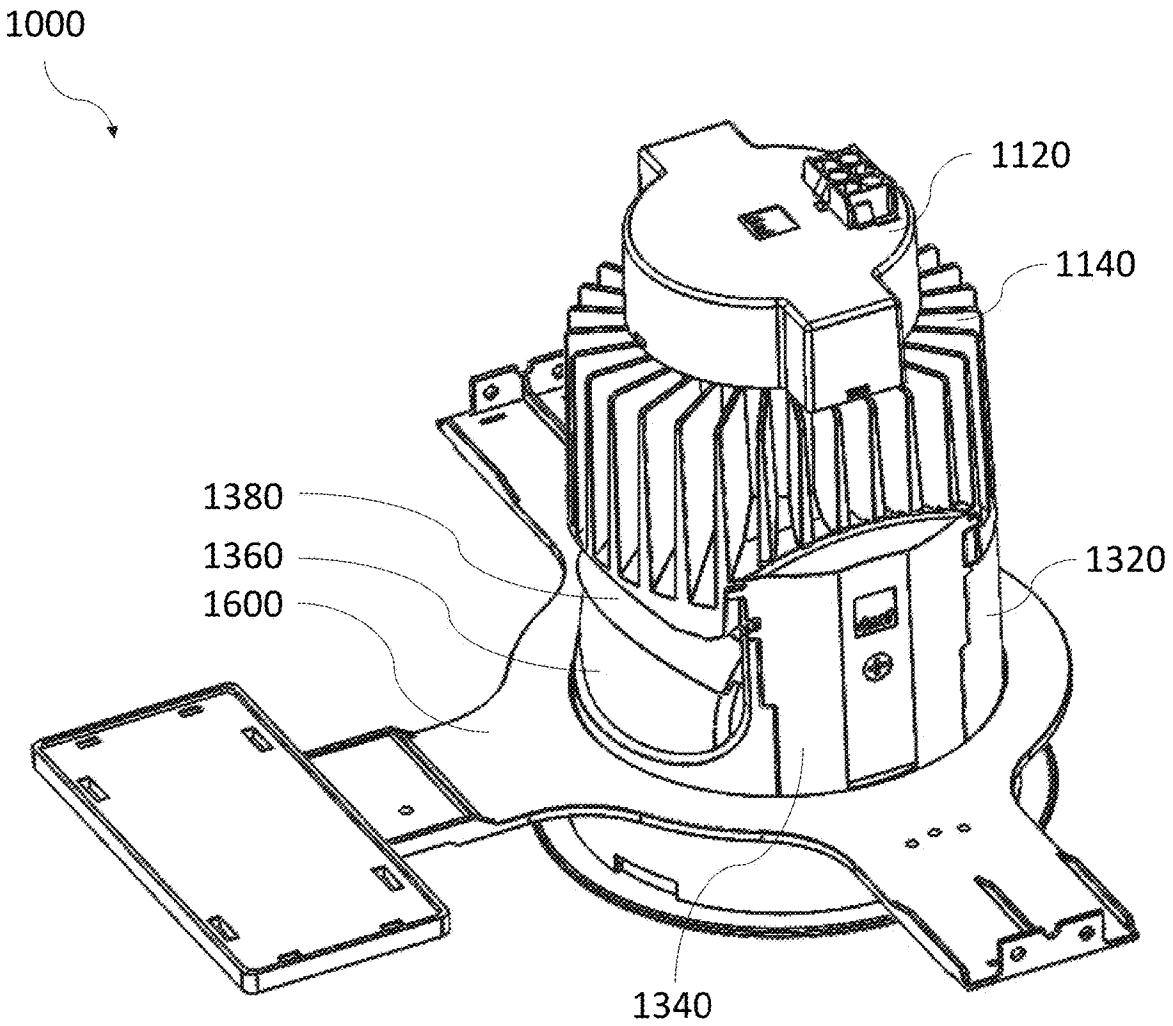
FIG. 10J is a top, left, front perspective view of the lighting assembly shown in FIG. 10A.
Figure 10K:
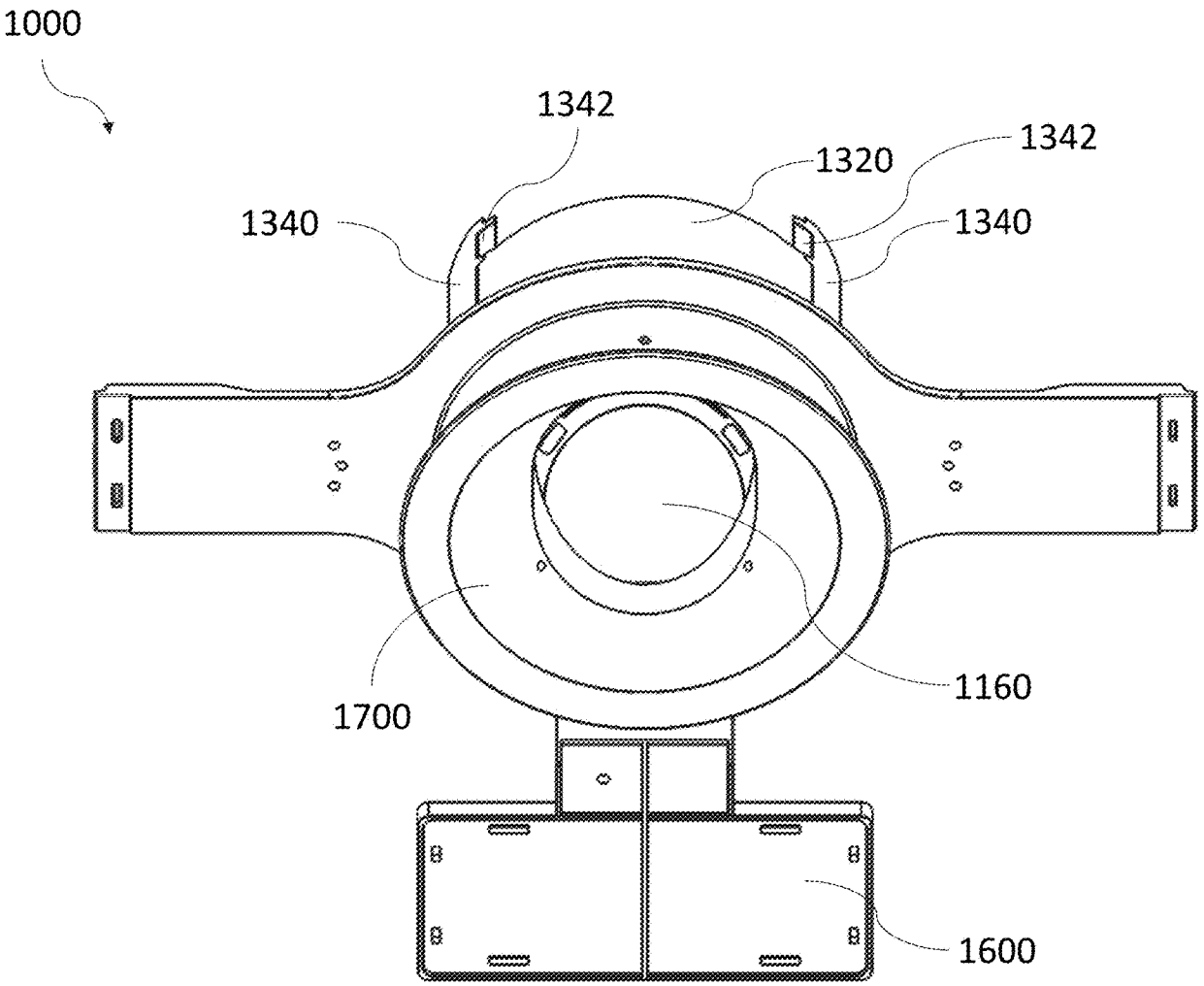
FIG. 10K is a bottom, rear perspective view of the lighting assembly shown in FIG. 10A in a rotated state.
Figure 10L:
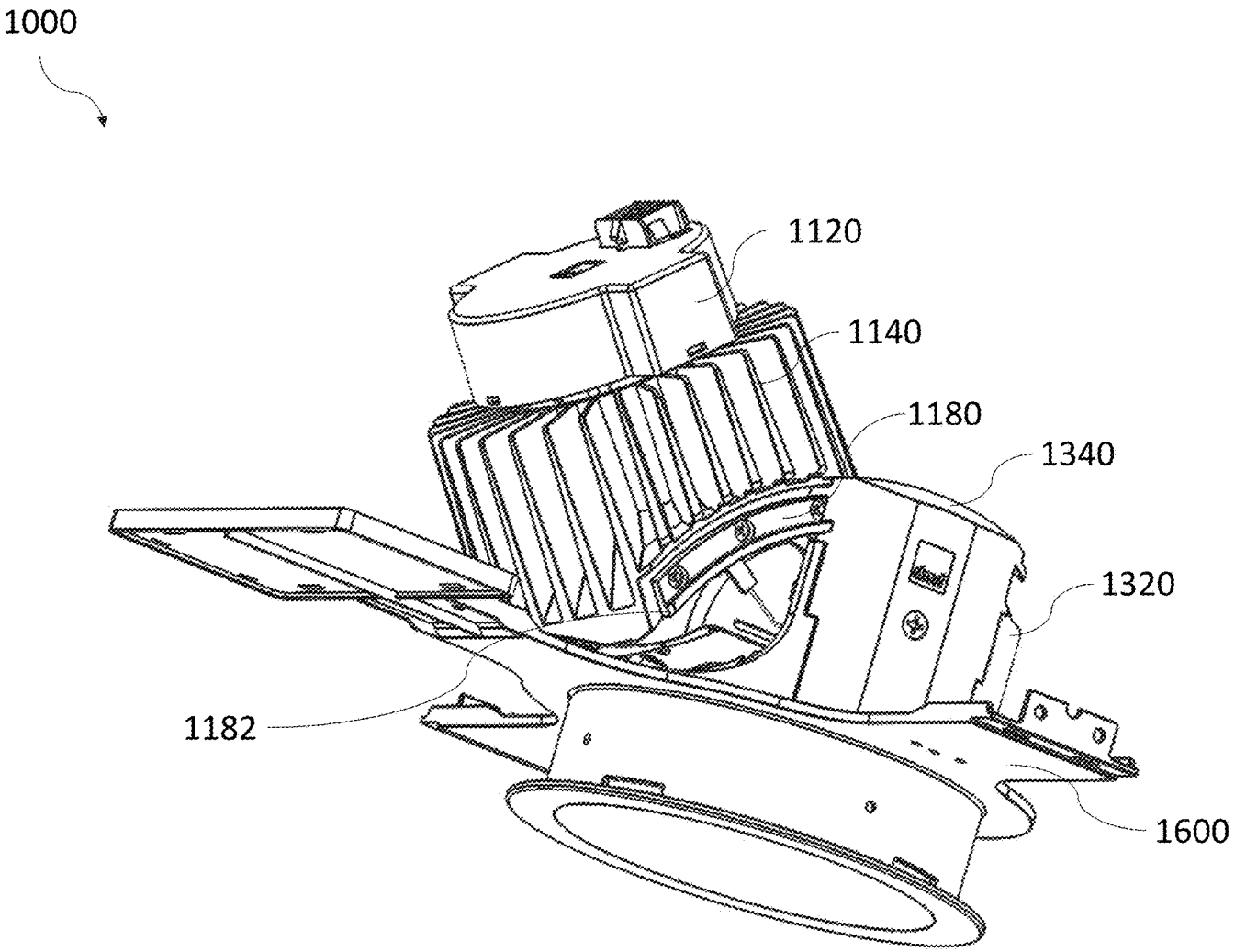
FIG. 10L is a bottom, left, front perspective view of the lighting assembly shown in FIG. 10A in a rotated state.

FIGS. 10I and 10J show a rear perspective and front perspective view of the adjustable lighting apparatus 1000, respectively, in the first rotational position. As shown, the frame 1600 includes several mounting tabs 1610 used to facilitate connection to a building support structure. The adjustable lighting apparatus 1000 may be coupled to various types of building support structures including, but not limited to struts, T-bars, metal studs, or any other building support structure known to a person of ordinary skill in the art. The frame 1600 may also include a through hole opening into which the adjustable mount 1300 is inserted into the through hole opening. The rotation ring 1500 may be used to mechanically secure the adjustable mount 1300 to the frame 1600. In some implementations, the rotation ring 1500 and the base structure 1320 may be coupled via a track/rail structure that allows the adjustable mount 1300 to rotate relative to the rotation ring 1500 along a rotation axis substantially perpendicular to the first rotation axis 1010. FIGS. 10K and 10L show a bottom perspective and front perspective view of the adjustable lighting apparatus 1000, respectively, in the second rotational position. In particular, FIG. 10K provides a perspective of the light source 1160 along the lighting module axis 1060. As shown, rotating and translating the lighting module 1100 allows a substantial portion of the light source 1160 to remain unshaded by the trim 1700.

Figure 11A:
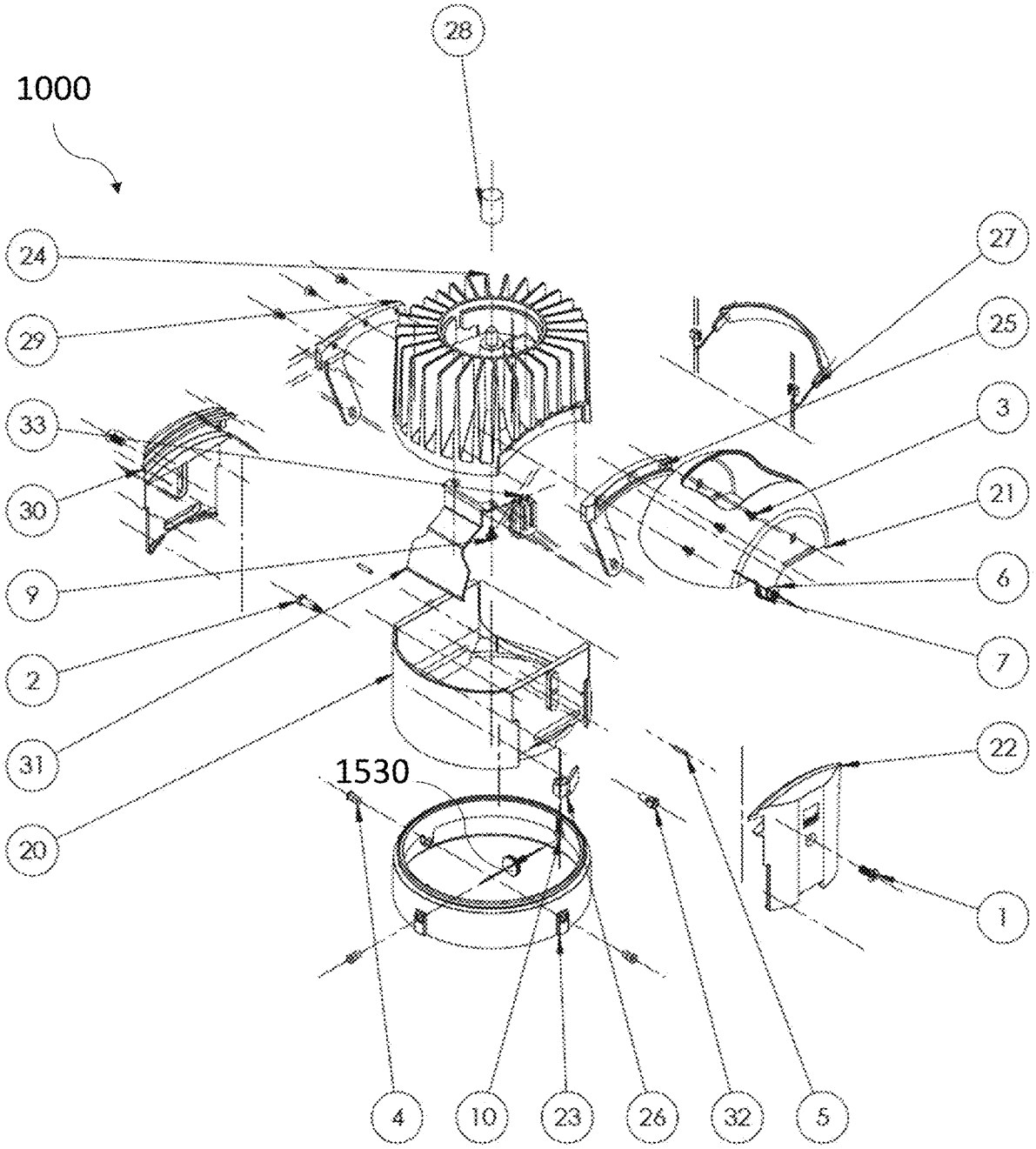
FIG. 11A is an exploded view of an adjustable lighting apparatus, according to an implementation.

FIG. 11A shows an exploded view of several components in the adjustable lighting apparatus 1000 along with the positional relationship of said components for assembly. Subsequent figures provide additional detail of each component below. FIG. 11B shows a corresponding table of the various parts in FIG. 11A used in the assembly of the adjustable lighting apparatus 1000.

Figure 12E:
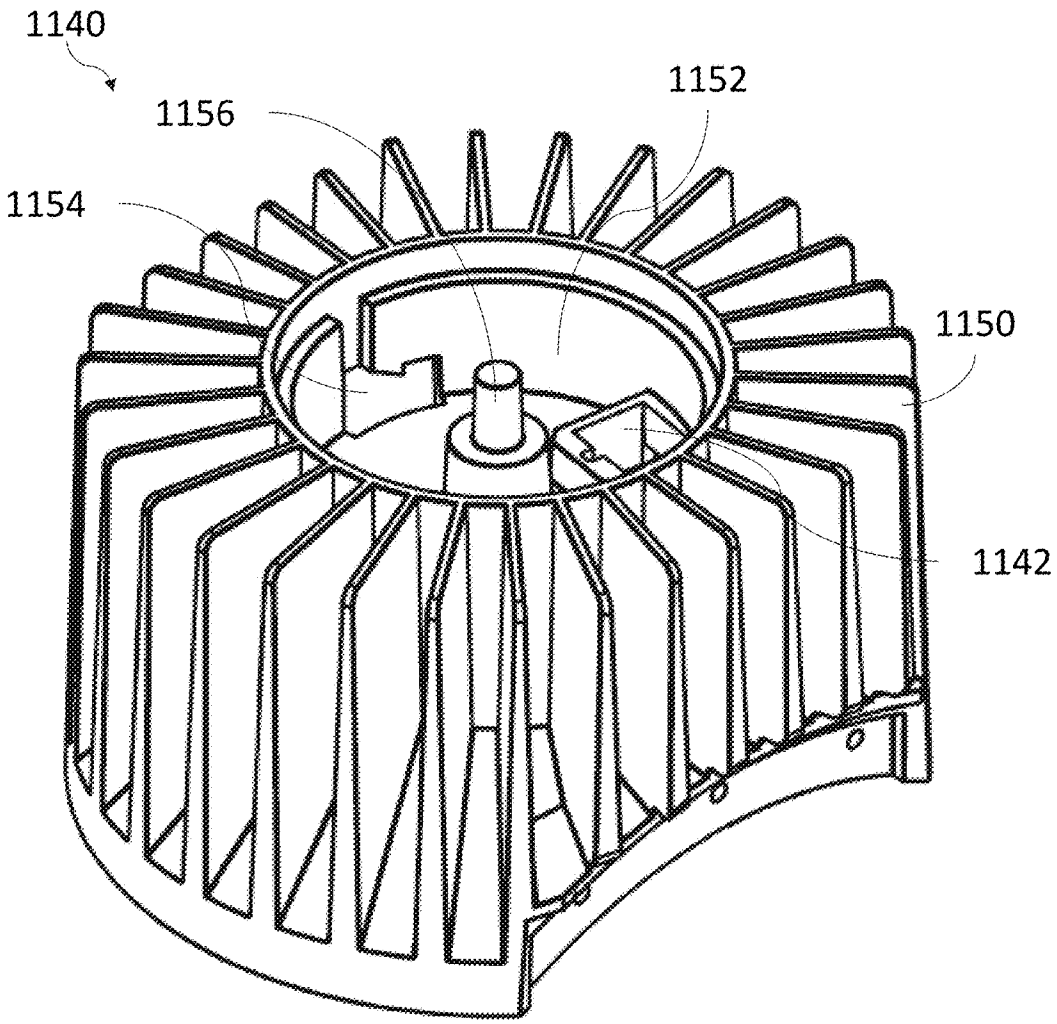
FIG. 12E is a top, rear, right perspective view of the heat sink shown in FIG. 12A.
Figure 12G:
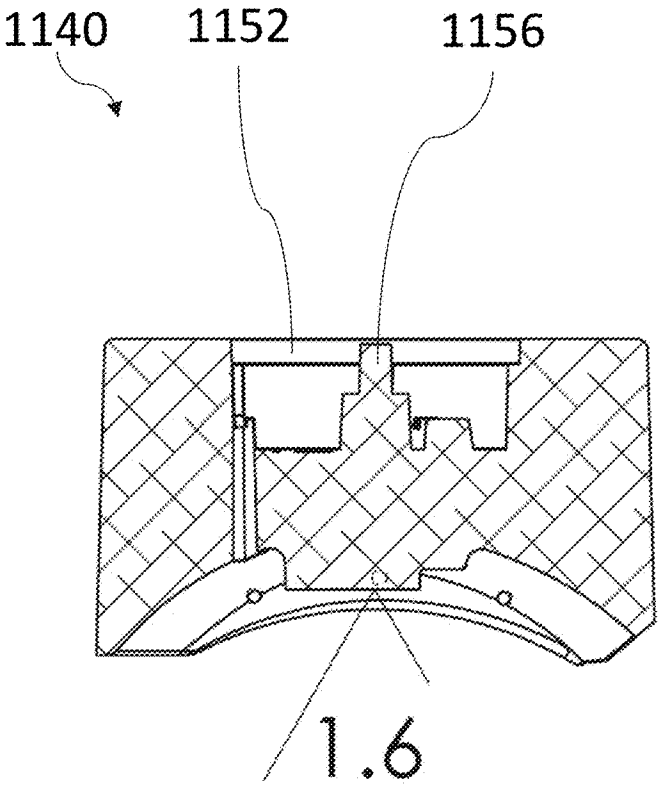
FIG. 12G is a cross-sectional view of the heat sink shown in FIG. 12B along the plane B-B.
Figure 12F:
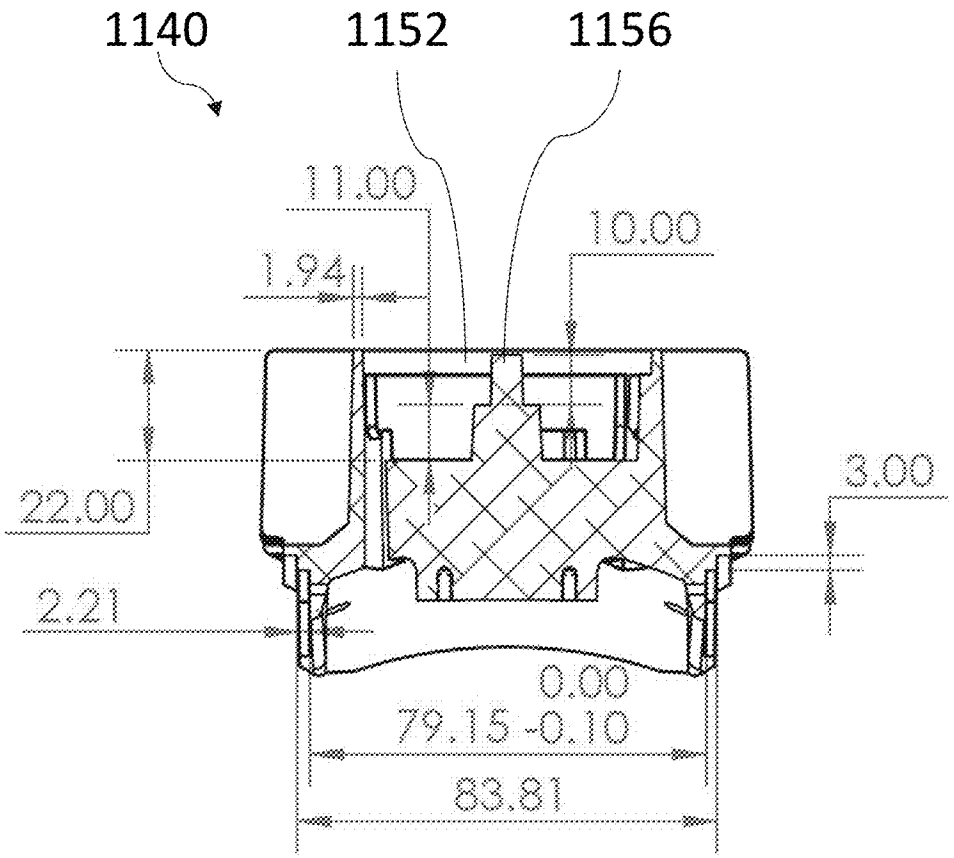
FIG. 12F is a cross-sectional view of the heat sink shown in FIG. 12A along the plane A-A.

FIGS. 12A-12E show several views of an exemplary heat sink 1140, according to an implementation. FIGS. 12F and 12G show cross-sectional views of the heat sink 1140 along plane A-A in FIG. 12A and plane B-B in FIG. 12B, respectively. As discussed earlier, the heat sink 1140 is used, in part, to dissipate heat generated by the light source 1160. As such, the heat sink 1140 includes one or more fins 1150 to increase convective heat transfer to the surrounding ambient environment. The one or more fins 1150 may be shaped so that the overall form factor of the heat sink 1140 is substantially similar to the adjustable mount 1300. In some implementations, the heat sink 1140 may have a cross-sectional shape that includes, but is not limited to a circle, an ellipse, a square, a rectangle, a polygon, or any combination of the foregoing. Additionally, the cross-section of the heat sink 1140 may vary in shape and/or dimension along at least one axis. In some implementations, the heat sink 1140 may include a recess 1152 centered along the top surface of the heat sink 1140. The recess 1152 may include a through hole port 1142 to receive an electrical connector 1126 on the driver 1120, and one or more twist-n-lock friction receptacles 1154. The driver 1120 may have one or more corresponding twist-n-lock friction connectors 1124 to couple the driver 1120 to the heat sink 1140 via the twist-n-lock friction receptacles 1154. In some implementations, the heat sink 1140 may include a central support 1156 that positions the driver 1120 above the recess 1152 in order to reduce physical contact between the driver 1120 and the heat sink 1140, thereby reducing heat transfer from the heat sink 1140 to the driver 1120.

In some implementations, the heat sink 1140 may also include a cavity 1144 disposed on the bottom of the heat sink 1140, as shown in FIG. 12A. The cavity 1144 may be subdivided into a central region 1146 and an annular region 1148. The central region 1146 provides an area to mount the light source 1160 and may include one or more holes for screw fasteners as shown in FIG. 12F or any other coupling mechanism to couple the light source 1160 to the heat sink 1140. The annular region 1148 may be shaped and dimensioned to at least cover a portion of the rotation slot 1364 on the shield 1360. The through hole port 1142 may partially intersect the central region 1146, thus allowing the electrical connector 1126 on the driver 1120 to be located proximate to the light source 1160 for ease of connectivity.

The heat sink 1140 may be formed from various heat conducting materials including, but not limited to aluminum, copper, carbon steel, stainless steel, metallic alloys, polymer composites, thermally conducting polymers, ceramics, or any other heat conducting materials known to one of ordinary skill in the art. In some implementations, the heat sink 1140 may be painted/coated to improve various aspects of the heat sink 1140 such as corrosion resistance, durability, thermal emissivity, or aesthetic quality.

Figure 13B:
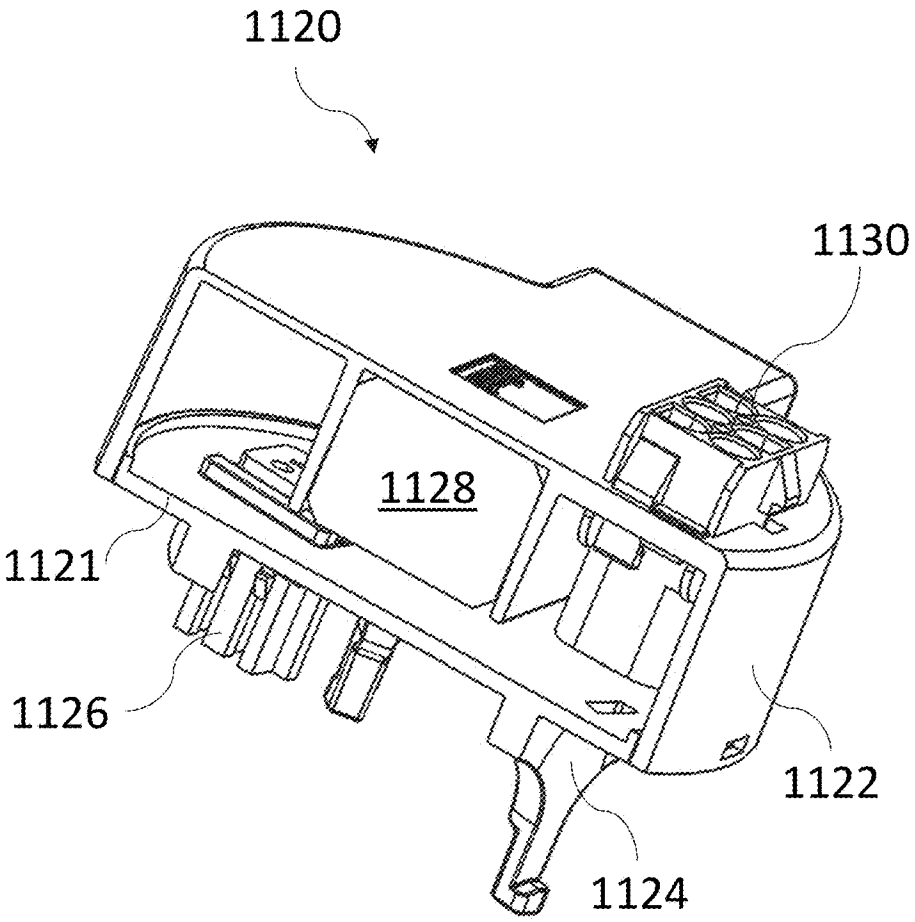
FIG. 13B is a top perspective, cross-sectional view of the driver assembly shown in FIG. 13A.
Figure 13A:
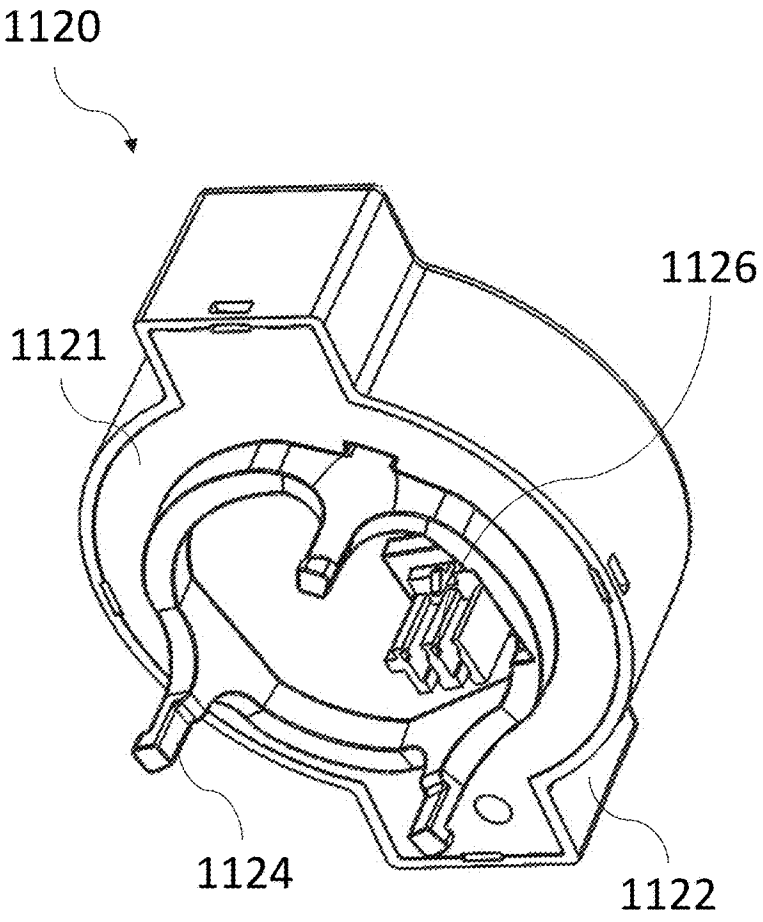
FIG. 13A is a bottom perspective view of a driver assembly, according to an implementation.
Figure 14A:
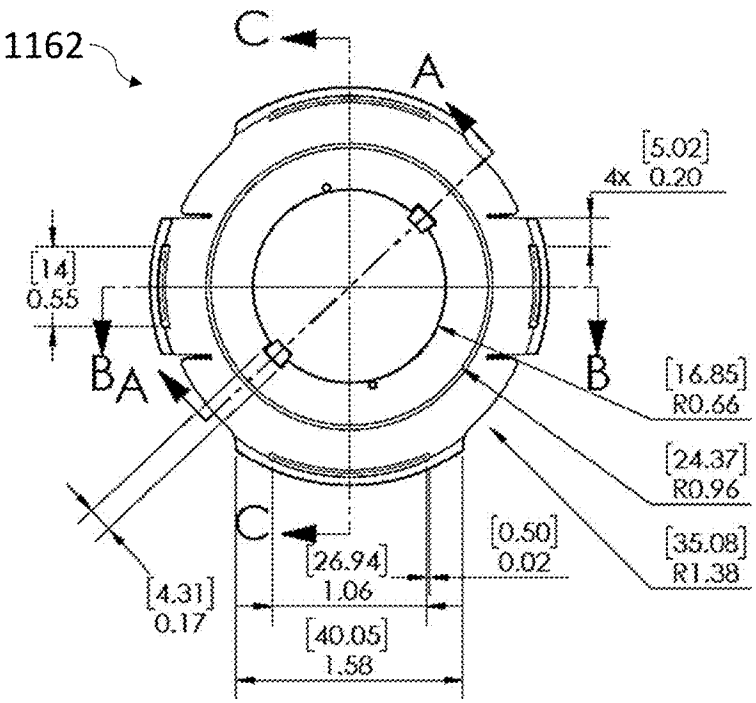
FIG. 14A is a top view of an optic holder of an adjustable lighting apparatus, according to an implementation.
Figure 14B:
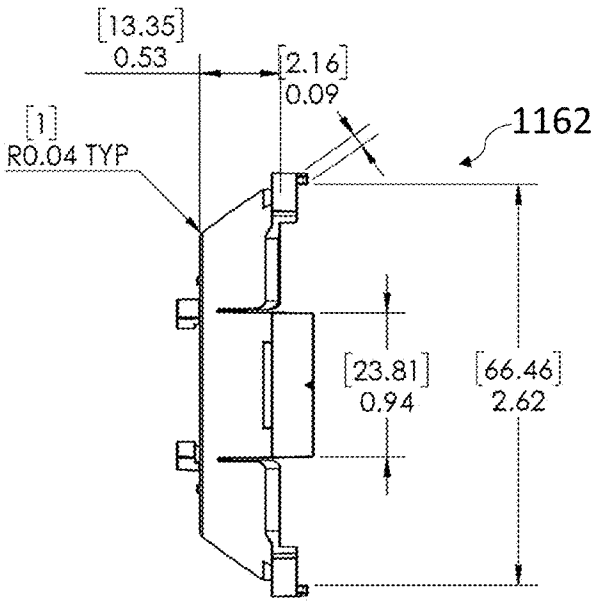
FIG. 14B is a front view of the optic holder shown in FIG. 14A.
Figure 14C:
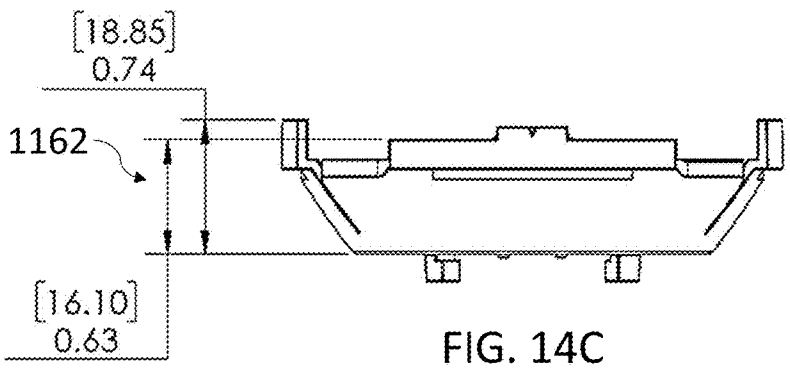
FIG. 14C is a right view of the optic holder shown in FIG. 14A.
Figure 14D:
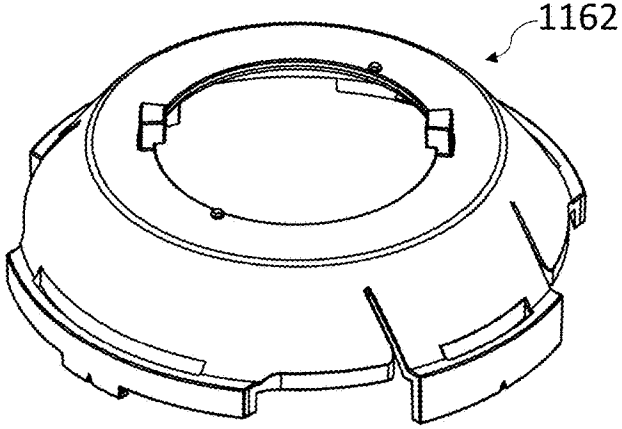
FIG. 14D is a rear, front, right perspective view of the optic holder shown in FIG. 14A.
Figure 14F:
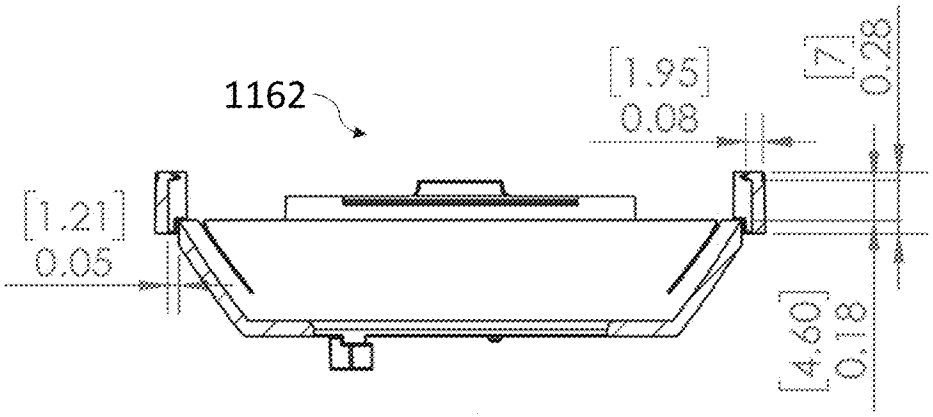
FIG. 14F is a cross-sectional view of the optic holder shown in FIG. 14A along the plane B-B.
Figure 14G:
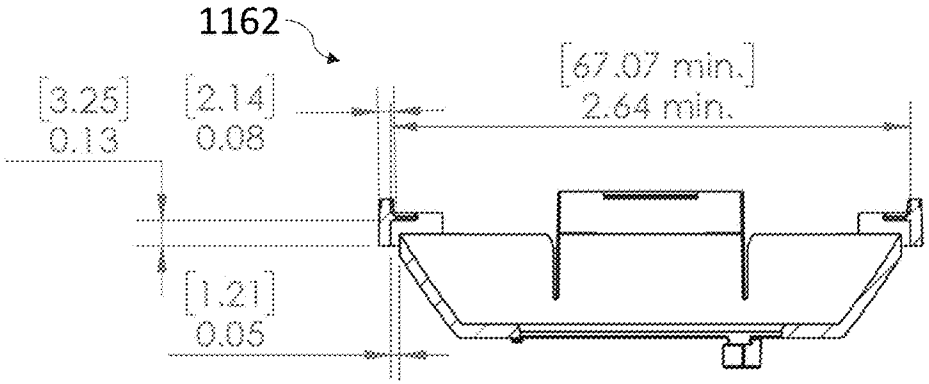
FIG. 14G is a cross-sectional view of the optic holder shown in FIG. 14A along the plane C-C.
Figure 14E:
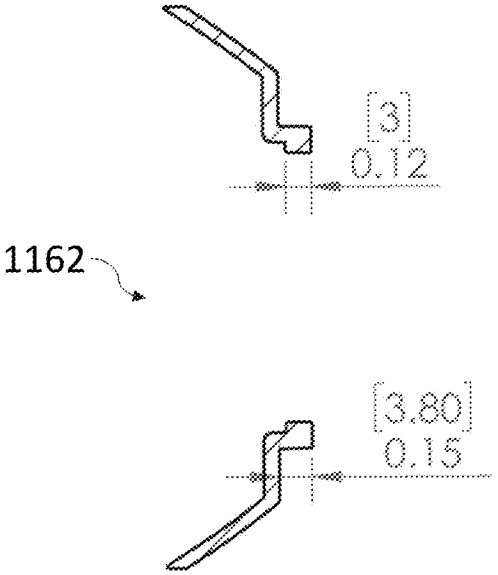
FIG. 14E is a cross-sectional view of the optic holder shown in FIG. 14A along the plane A-A.
Figure 15B:
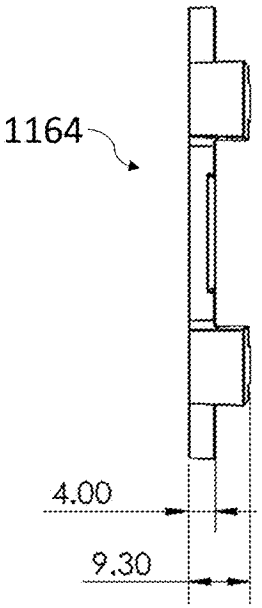
FIG. 15B is a right view of the retaining ring shown in FIG. 15A.
Figure 15D:
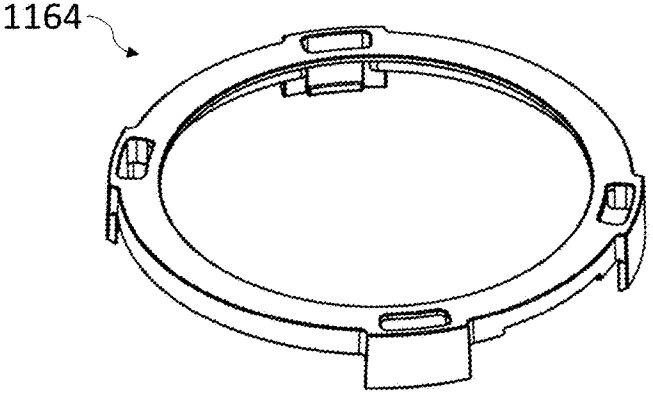
FIG. 15D is a top, right perspective view of the retaining ring shown in FIG. 15A.
Figure 15A:
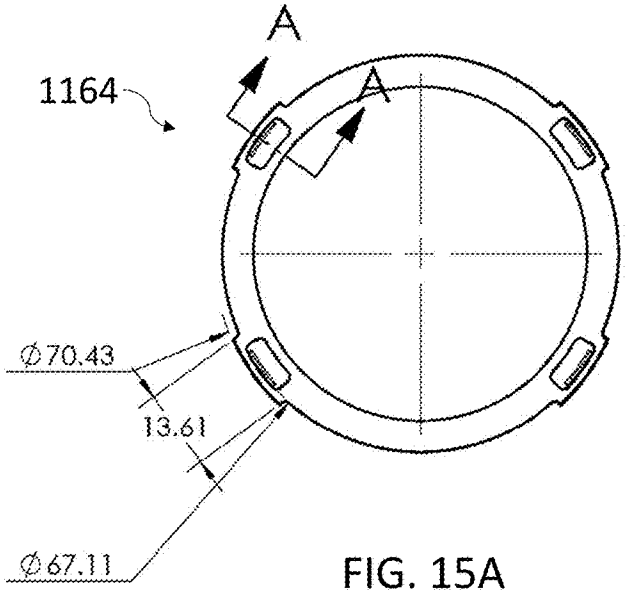
FIG. 15A is a top view of a retaining ring of an adjustable lighting apparatus, according to an implementation.
Figure 15C:
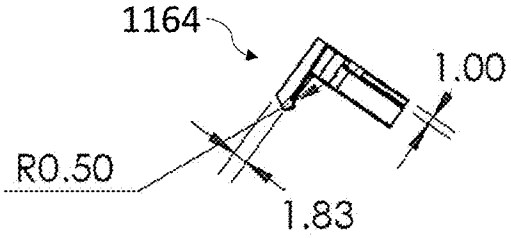
FIG. 15C is a cross-sectional view of the retaining ring shown in FIG. 15A along the plane A-A.
Figure 16A:
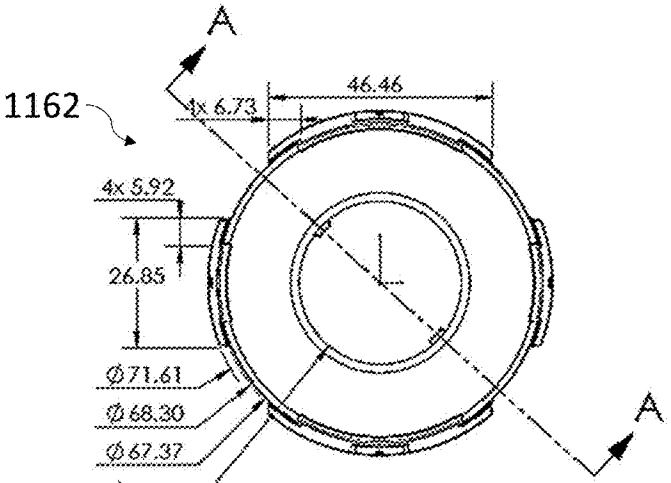
FIG. 16A is a bottom view of an optic holder of an adjustable lighting apparatus, according to an implementation.
Figure 16B:
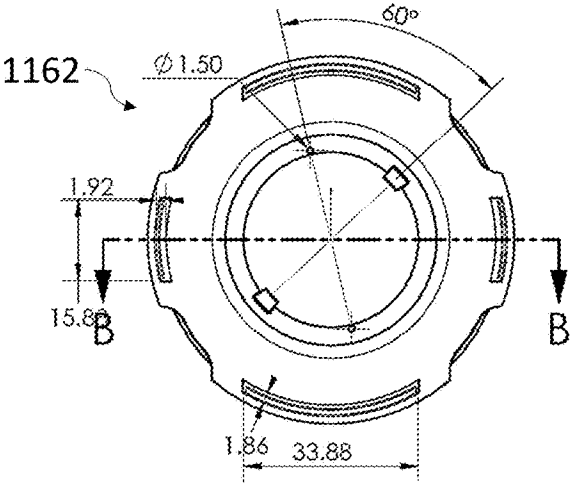
FIG. 16B is a top view of the optic holder shown in FIG. 16A.
Figure 16C:
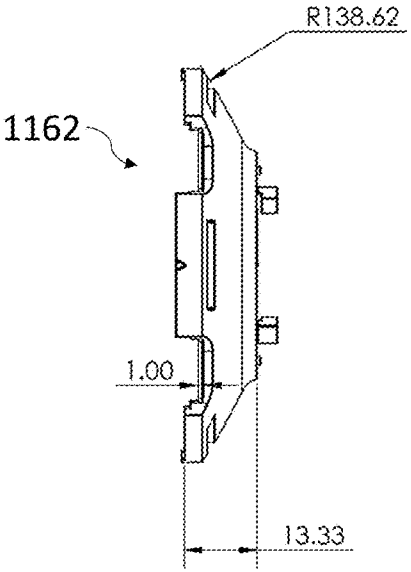
FIG. 16C is a right view of the optic holder shown in FIG. 16A.
Figure 16D:
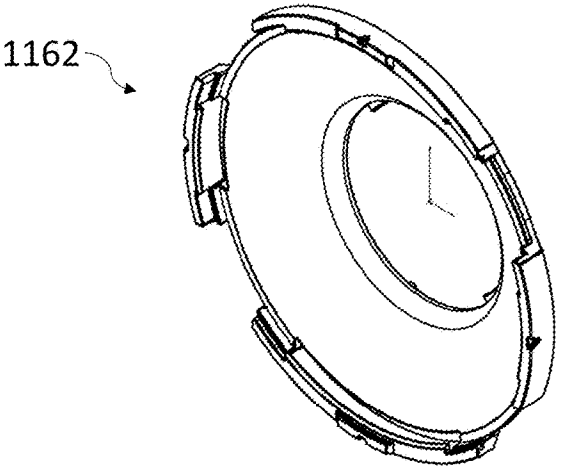
FIG. 16D is a bottom, right perspective view of the optic holder shown in FIG. 16A.
Figure 16E:
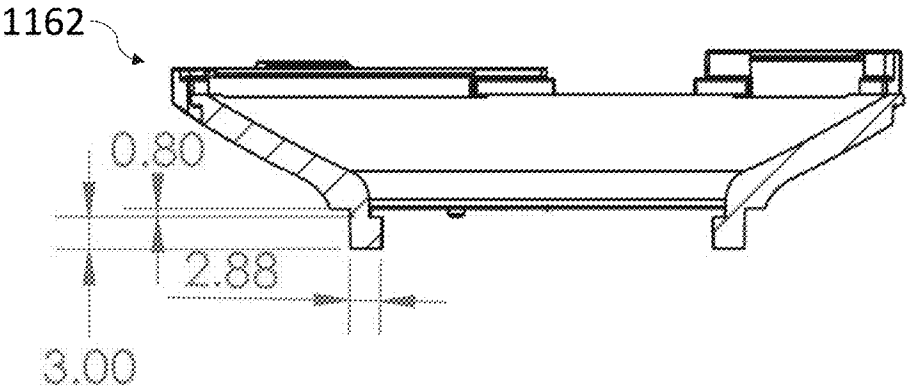
FIG. 16E is a cross-sectional view of the optic holder shown in FIG. 16A along the plane A-A.
Figure 16F:
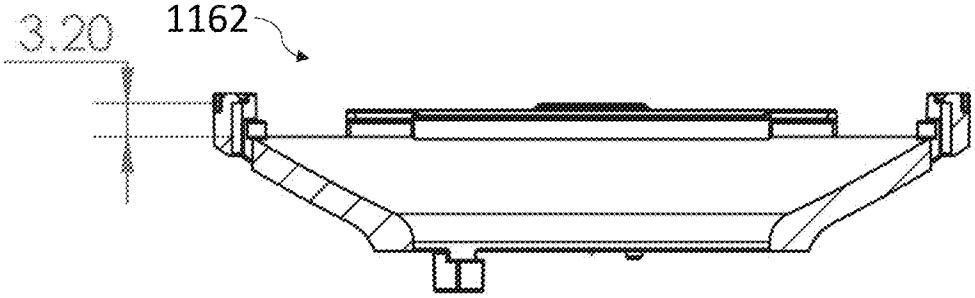
FIG. 16F is a cross-sectional view of the optic holder shown in FIG. 16A along the plane B-B.

FIGS. 13A and 13B show a perspective view and a cross-sectional view of an exemplary driver 1120, according to an implementation. In some implementations, the driver 1120 may include a two-piece housing with a base component 1121 and an enclosure component 1122 forming an interior cavity. The base component 1121 and the enclosure component 1122 may be formed from various materials including, but not limited to polymers, metals, metallic alloys, composites, or ceramics. Driver circuitry 1128 may be disposed within the interior cavity of the housing, as shown in FIG. 13B. The base component 1121 may include the one or more twist-n-lock connectors 1124 previously described above. The driver 1120 may also include a connector 1130 electrically coupled to the driver circuitry 1128. The connector 1130 may be used to electrically couple the adjustable lighting apparatus to an external power source, such as an electrical supply system in a building. The driver 1120 may also include the connector 1126 to electrically couple the driver 1120 to the light source 1160. The connectors 1126 and 1130 may be electrically coupled to the driver circuitry 1128 with electrical wiring (not shown). The connectors 1126 and 1130 may be male or female and may be interlocking.

As described above, the lighting module 1100 includes the light source 1160 to emit light. The light source 1160 may include one or more light emitting elements that each emit light at a desired wavelength. In some implementations, the one or more light emitting elements may be various types of electro-optical devices including, but not limited to a light emitting diode (LED), an organic light emitting diode (OLED), a polymer light emitting diode (PLED), or a quantum dot light emitting diode (QLED). The light source 1160 may also include an optic to modify the properties of the light beam (e.g., the divergence angle). In some implementations, the optic may focus or diverge the light beam outputted from the adjustable lighting apparatus 1000. In some implementations, the optic may be used to substantially collimate the light beam (i.e., a beam divergence angle less than 15 degrees). The light source 1160 may include an optic holder 1162 to mount the one or more light emitting elements and the optic and to facilitate coupling to the heat sink 1140.

FIGS. 14A-14G show several views of an exemplary optic holder 1162 that incorporates mechanical snap fits to secure and position the optic. FIGS. 15A-15D show several views of an exemplary retaining ring 1164 that couples to the optic holder 1162 shown in FIGS. 14A-14G in order to secure the optic. The optic holder 1162 may be tailored to accommodate light emitting elements and optics of varying size and shape. For example, FIGS. 16A-16F show several views of another exemplary optic holder 1162 designed to support a larger diameter, flatter optic. The optic holder 1162 may incorporate coupling features to couple the light source 1160 to the central region 1146 of the heat sink 1140. Various coupling features may be used including, but not limited to a twist-n-lock connector or holes for screw fasteners or bolt fasteners. In some implementations, thermal contact between the light emitting elements and the heat sink 1140 may be improved by disposing thermal paste between the light emitting elements and the heat sink 1140.

Figure 17B:
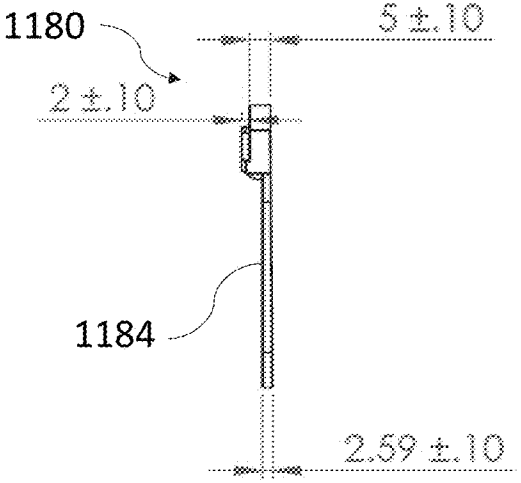
FIG. 17B is a front view of the heat sink arm shown in FIG. 17A.
Figure 17D:
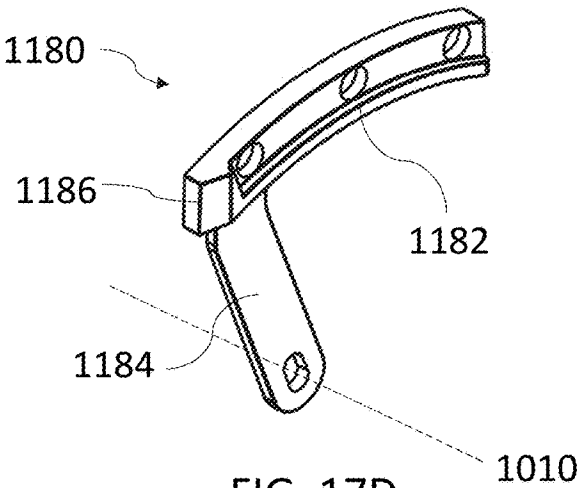
FIG. 17D is a top, front perspective view of the heat sink arm shown in FIG. 17A.

FIGS. 17A-17D show several views of an exemplary heat sink arm 1180. The heat sink arm 1180 is used to rotate the lighting module 1100 about the first rotation axis 1010 and translate the lighting module 1100 along the first translation axis 1020. The heat sink arm 1180 may be comprised of a motion track 1182 and a pivot arm 1184 that intersects the first rotation axis 1010. For example, FIG. 17D shows the pivot arm 1184 includes a hole that receives a pin/rod that is coaxial with the first rotation axis 1010. The heat sink arm 1180 may be coupled to the pin/rod with a rigid joint (i.e., the heat sink arm 1180 and the pin/rod rotates together) or a pin joint (i.e., the heat sink arm 1180 and the pin/rod rotates relative to one another).

Figure 17A:
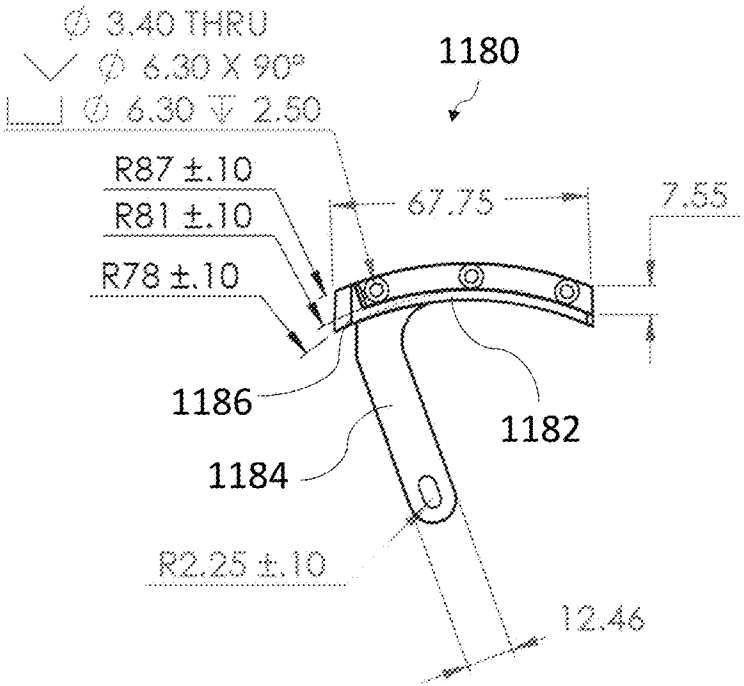
FIG. 17A is a right side view of a heat sink arm of an adjustable lighting apparatus, according to an implementation.
Figure 17C:
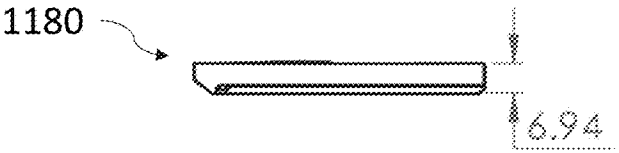
FIG. 17C is a top view of the heat sink arm shown in FIG. 17A.
Figure 18B:
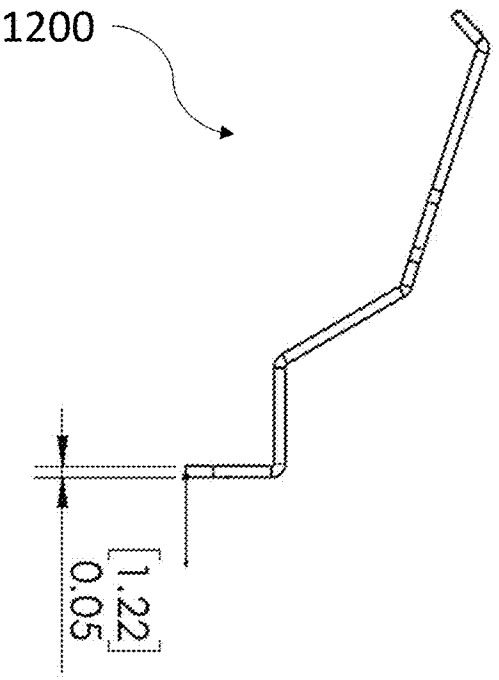
FIG. 18B is a right view of the push bracket shown in FIG. 18A.
Figure 18A:
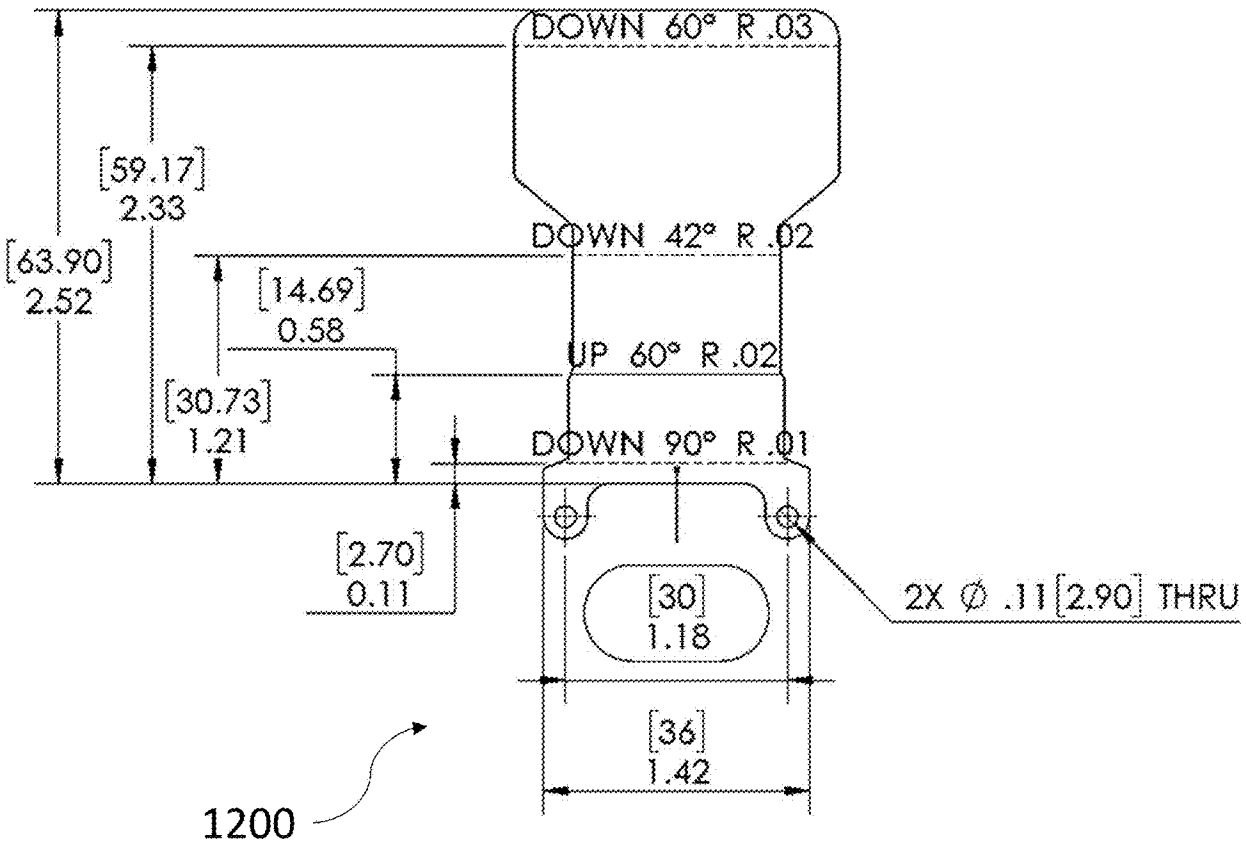
FIG. 18A is front view of a push bracket of an adjustable lighting apparatus, according to an implementation.
Figure 18D:
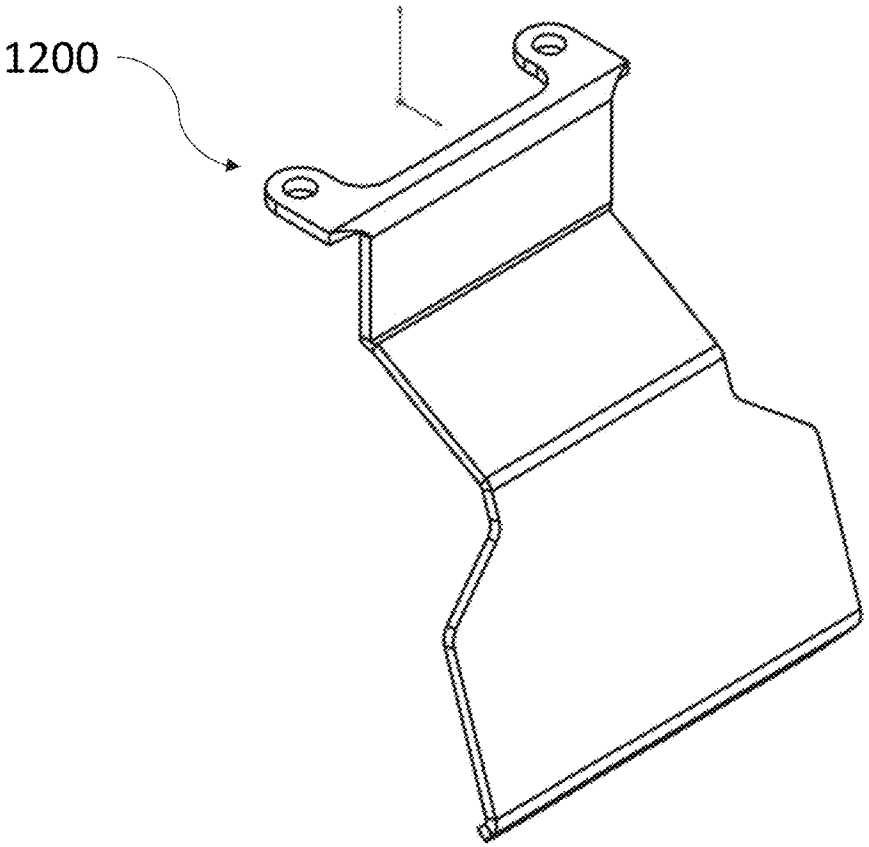
FIG. 18D is a top, front, right view of the push bracket shown in FIG. 18A.
Figure 18C:
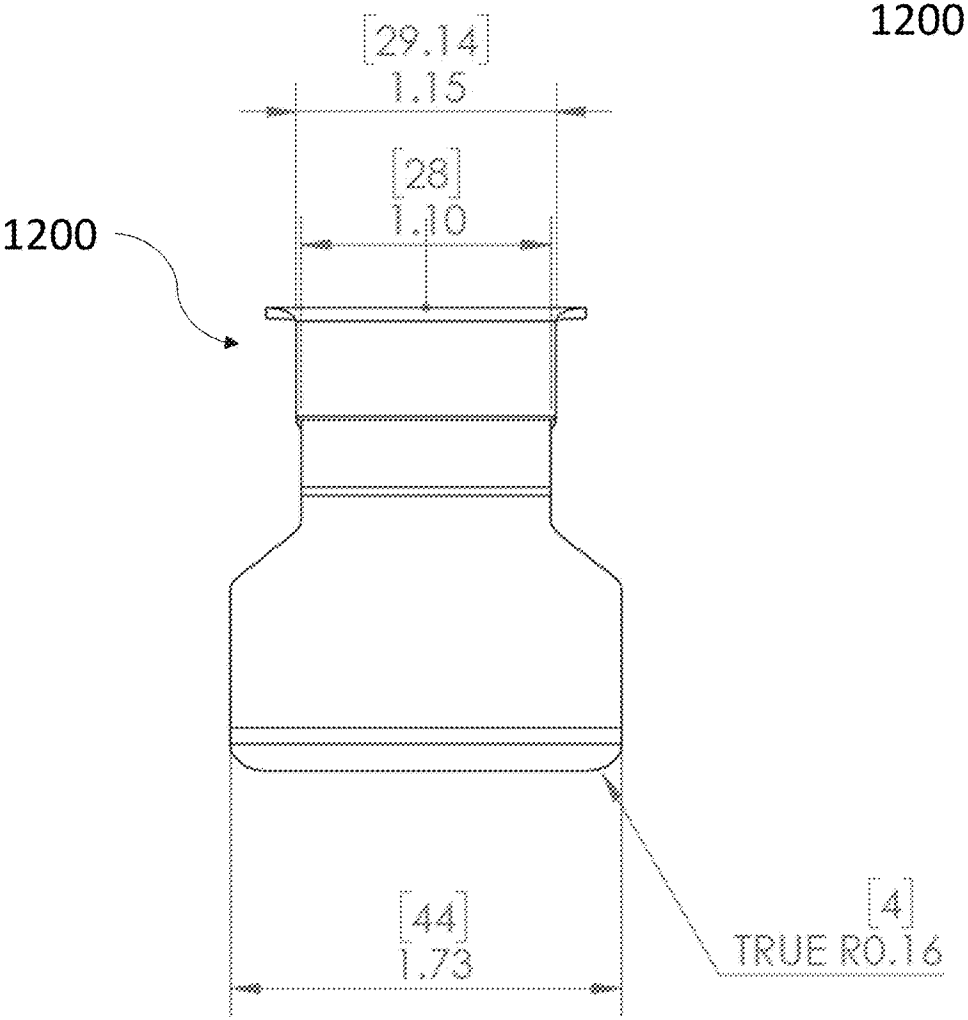
FIG. 18C is a bottom view of the push bracket shown in FIG. 18A.
Figure 19A:
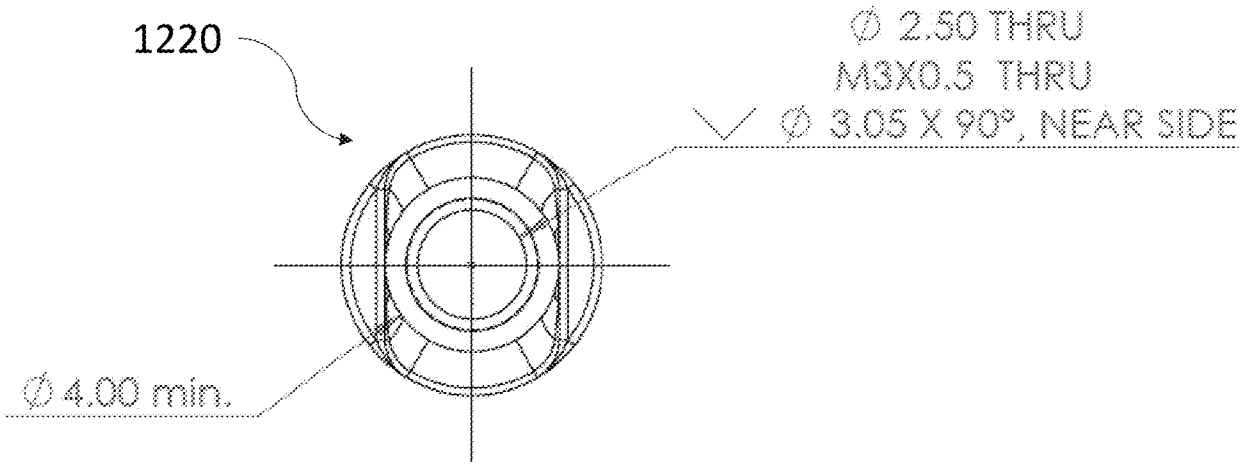
FIG. 19A is a top view of a locking nut of an adjustable lighting apparatus, according to an implementation.
Figure 19C:
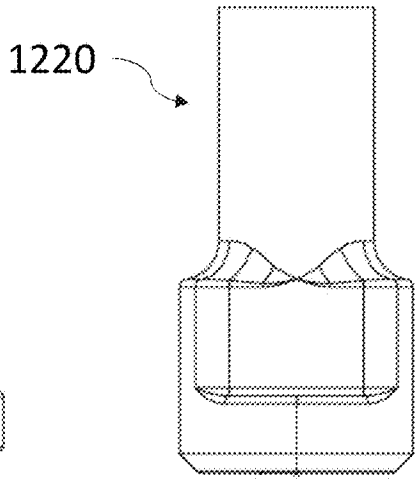
FIG. 19C is a right view of the locking nut shown in FIG. 19A.
Figure 19D:
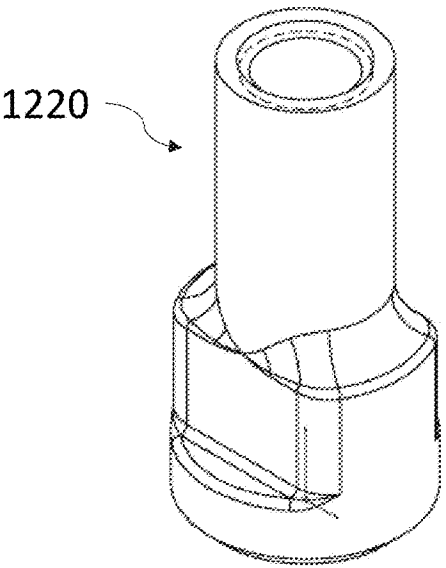
FIG. 19D is a top, front, right view of the locking nut shown in FIG. 19A.
Figure 19B:
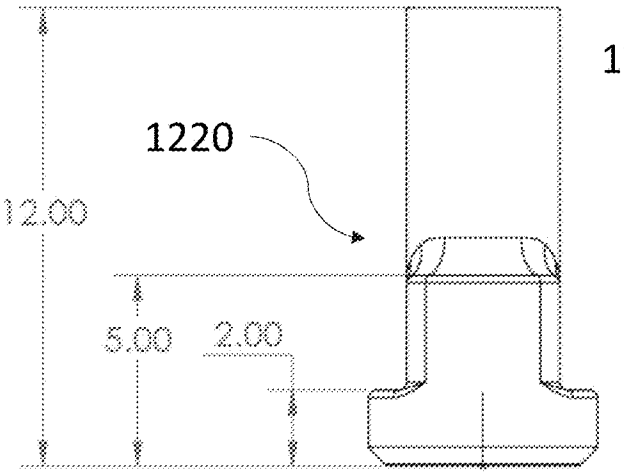
FIG. 19B is a front view of the locking nut shown in FIG. 19A.

The motion track 1182 may be used, in part, to guide the motion of the lighting module 1100 as the lighting module 1100 rotates about the first rotation axis 1010. The motion track 1182 may couple to a corresponding motion rail 1342 on the retainer 1340. In some implementations, the motion track 1182 and the motion rail 1342 limits the rotational range of motion of the lighting module 1100. In some implementations, the motion track 1182 and the motion rail 1342 may have a curved profile with a corresponding center of curvature about which the curved profile is defined. Depending on the definition of the curved profile and the location of the center of curvature with respect to the location of the first rotation axis 1010 on the pivot arm 1184, the degree to which the lighting module 1100 translates along the first translation axis and rotates about the first rotation axis 1010 may be varied. Additionally, the forces imparted onto the adjustable mount 1300 and/or the lighting module 1100 may vary depending on the mechanical constraints imposed by the curved profile and the relative location of the center of curvature. For example, the curvature may be circular and the center of curvature coincident with the first rotation axis 1010. In this case, the lighting module 1100 will rotate about the first rotation axis 1010 with negligible translation along the first translation axis 1020. In another example, the curvature may again be circular and the center of curvature offset relative to the first rotation axis 1010 as shown in FIG. 17A. In this case, as the lighting module 1100 rotates about the first rotation axis 1010, a force is produced between the motion track 1182 and the motion rail 1342 that causes the lighting module 1100 to translate along the first translation axis 1020.

The motion track 1182 may also include a mechanical stop 1186 that physically contacts a corresponding mechanical stop 1344 on the retainer 1340 to limit the rotational range of motion of the lighting module 1100. The heat sink arm 1180 may be coupled to the heat sink 1140 using various coupling mechanisms including, but not limited to screw fasteners, bolt fasteners, welding, brazing, or adhesive. In some implementations, multiple heat sink arms 1180 may be coupled to the heat sink 1140 to improve mechanical stability, especially when rotatably adjusting the lighting module 1100. For example, FIG. 11A shows two heat sink arms 1180 disposed on opposing sides of the heat sink 1140. In some implementations, the heat sink arms 1180 may be substantially mirror symmetric.

The heat sink arm 1180 may be formed from various materials, preferably materials having a low coefficient of friction, including, but not limited to aluminum, polyoxymethylene (e.g., Delrin), polytetrafluoroethene (e.g., Teflon), graphite, composite materials, or any other low friction materials known to one of ordinary skill in the art. In particular, the heat sink arm 1180 may be formed from a material different from the heat sink 1140, which allows for greater flexibility in tailoring the preferred properties of each respective component (e.g., low coefficient of friction for the heat sink arm 1180, high thermal conductance for the heat sink 1140). Additionally, in some implementations, the heat sink arm 1180 may be formed from a material with a low coefficient of friction while the retainer 1340 is formed from another material, such as aluminum. Depending on the material used, a portion of the heat sink arm 1180 (e.g., the motion track 1182) may be polished to further reduce the coefficient of friction. Additionally, a lubricant may be disposed onto the heat sink arm 1180 to further reduce friction. For example, a thin layer of lubricant may be coated onto the motion track 1182.

The lighting module 1100 may also include an adjustment mechanism designed to improve ease of use when adjusting the orientation of the lighting module 1100. FIGS. 10C and 10D show one example where a push bracket 1200 is coupled to the lighting module 1100 to provide a handle for a user to use to rotate the lighting module 1100. As shown in FIG. 10C, the push bracket 1200 may be disposed within at least the interior cavity 1322 of the base structure 1320 surrounded, in part, by the shield 1360. The push bracket 1200 may be coupled to the heat sink 1140 using various coupling mechanisms, including but not limited to screw fasteners, bolt fasteners, welding, brazing, or adhesive. Once the lighting module 1100 is positioned at a particular rotational position, a locking mechanism may be used to secure the lighting module 1100 to the adjustable mount 1300. FIGS. 18A-18D show several views of an exemplary locking nut 1220 used as a locking mechanism. The locking nut 1220 may be coupled to the pin/rod coaxial with the first rotation axis 1010. As the locking nut 1220 is tightened, a portion of the locking nut 1220 presses the pivot arm 1184 of the heat sink 1140 against a portion of the adjustable mount 1300 generating a frictional force sufficient to prevent unwanted rotational motion of the lighting module 1100.

In some implementations, the adjustment mechanism may incorporate a spring that imparts a restoring force onto the lighting module 1100 to rotate the lighting module 1100 to a default rotational position when the locking mechanism is released. For example, the spring may provide a force that would rotate the lighting module 1100 towards the first rotational position. Thus, a user would only have to pull on the push bracket 1200 to position the lighting module 1100 at a desired rotational position. Alternatively, the spring may instead provide force to rotate the lighting module towards the second rotational position where the user would have to push on the push bracket to position the lighting module 1100. In another example, the lighting module 1100 may sufficiently heavy to cause discomfort when a user adjusts the rotational position. In these cases, the spring may provide a force oriented such that the amount of force a user has to apply to rotate the lighting module 1100 is reduced. For instance, the spring may provide a force that opposes the gravitational force arising from the mass of the lighting module 1100 in order to reduce the force needed to raise/lift the lighting module 1100 when rotating towards a preferred rotational position. Various types of springs may be used including, but not limited to torsion springs, coil springs, a thin beam under tensile or compressive stress, or any other springs known to one of ordinary skill in the art.

As described above, the adjustable mount 1300 includes a base structure 1320 that supports various components in the adjustable lighting apparatus 1000 including, but not limited to the lighting module 1100, the shield 1360, and the retainer 1340. FIGS. 20A-20H show several views of an exemplary base structure 1320, according to an implementation. The base structure 1320 may have a sidewall 1326 that defines an interior cavity 1322, a first opening 1328 that is aligned proximate to and, in some instances, abuts the lighting module 1100, and a second opening 1330 through which light from the light source 1160 passes through. In some implementations, the light that passes through the second opening 1330 is coupled directly out of the adjustable lighting apparatus 1000. In some implementations, the light that passes through the second opening 1330 enters the through hole opening 1504 of the rotation ring 1500. The sidewall 1326 may define a cross-sectional shape that includes, but is not limited to a circle, an ellipse, a square, a rectangle, a polygon, or any combination of the foregoing. Additionally, the cross-section of the base structure 1320 may vary in shape and/or dimension along at least one axis. The interior cavity 1322 may be dimensioned and shaped to contain therein at least a portion of one or more components in the adjustable lighting apparatus 1000 including, but not limited to the lighting module 1100, the shield 1360, the trim 1700, and the rotation ring 1500 for most of the rotational positions.

Figure 20A:
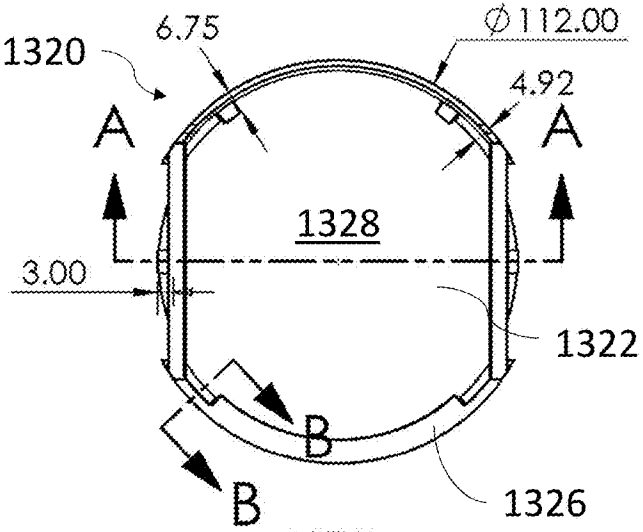
FIG. 20A is a top view of a base structure of an adjustable lighting apparatus, according to an implementation.
Figure 20B:
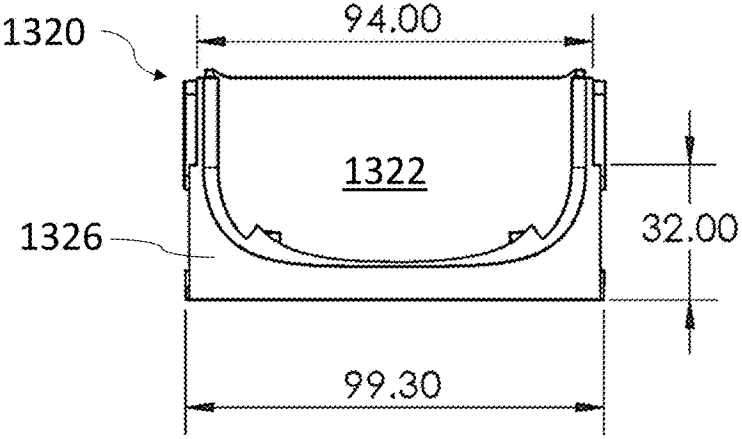
FIG. 20B is a front view of the base structure shown in FIG. 20A.
Figure 20C:
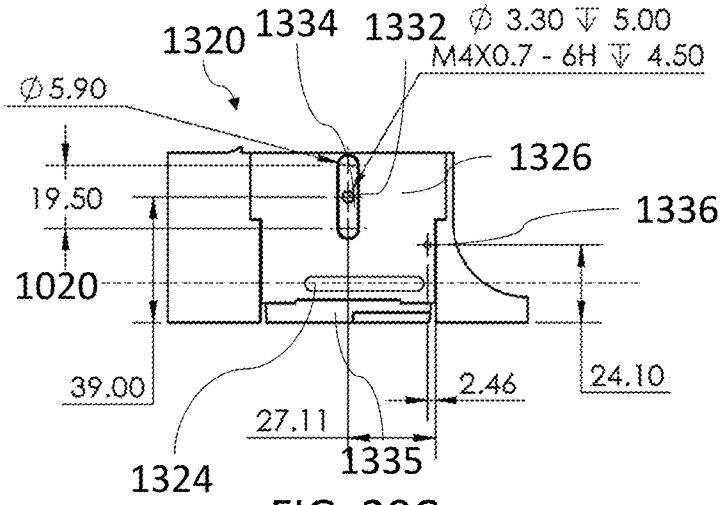
FIG. 20C is a right view of the base structure shown in FIG. 20A.
Figure 20D:
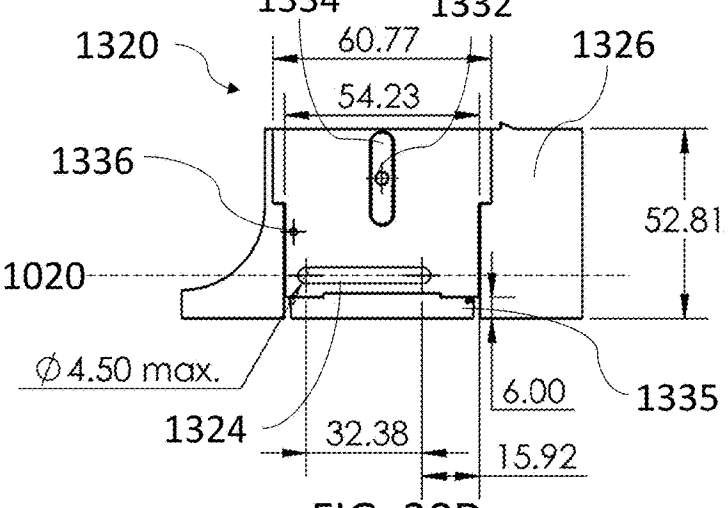
FIG. 20D is a left view of the base structure shown in FIG. 20A.
Figure 20E:
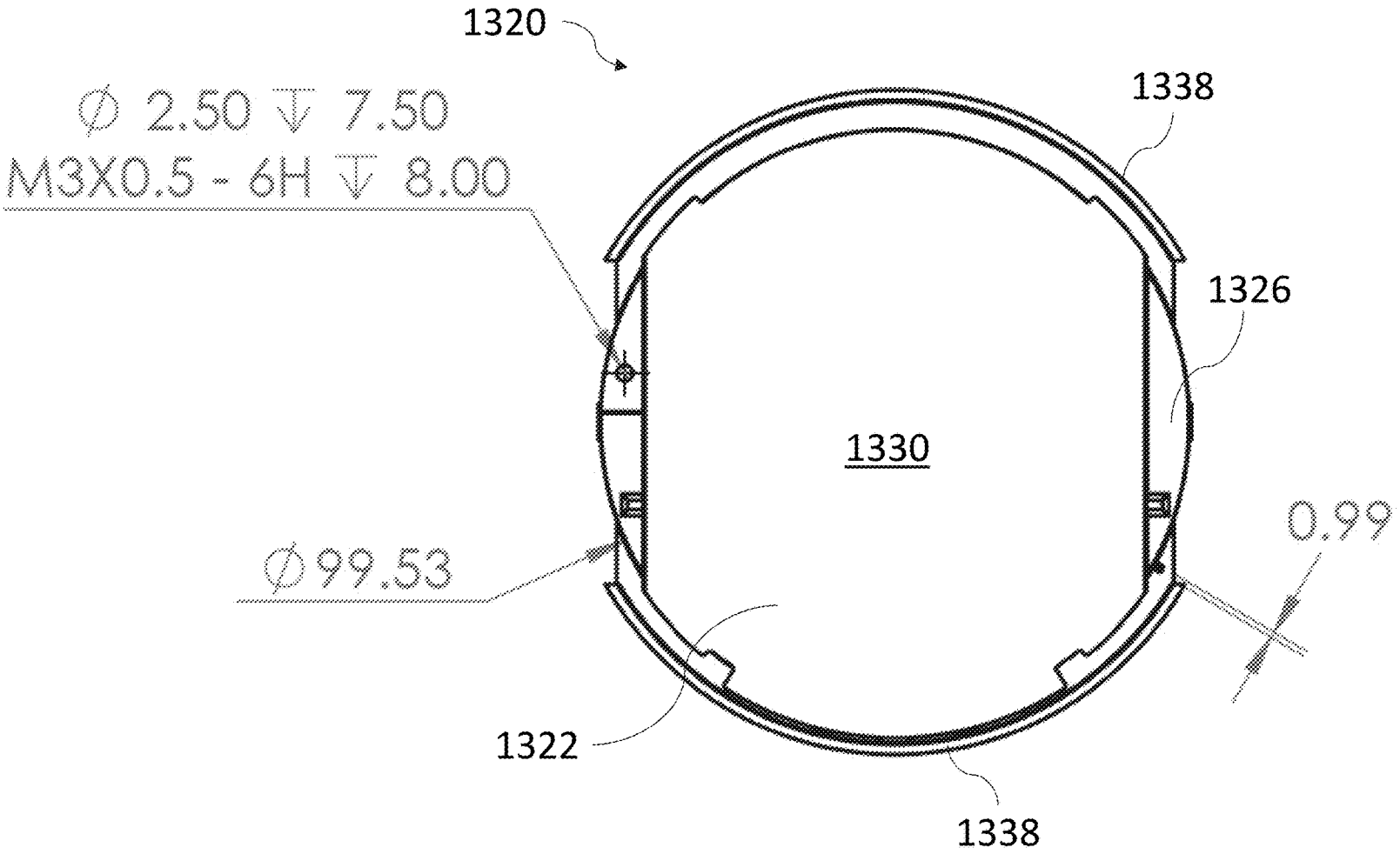
FIG. 20E is a bottom view of the base structure shown in FIG. 20A.
Figure 20F:
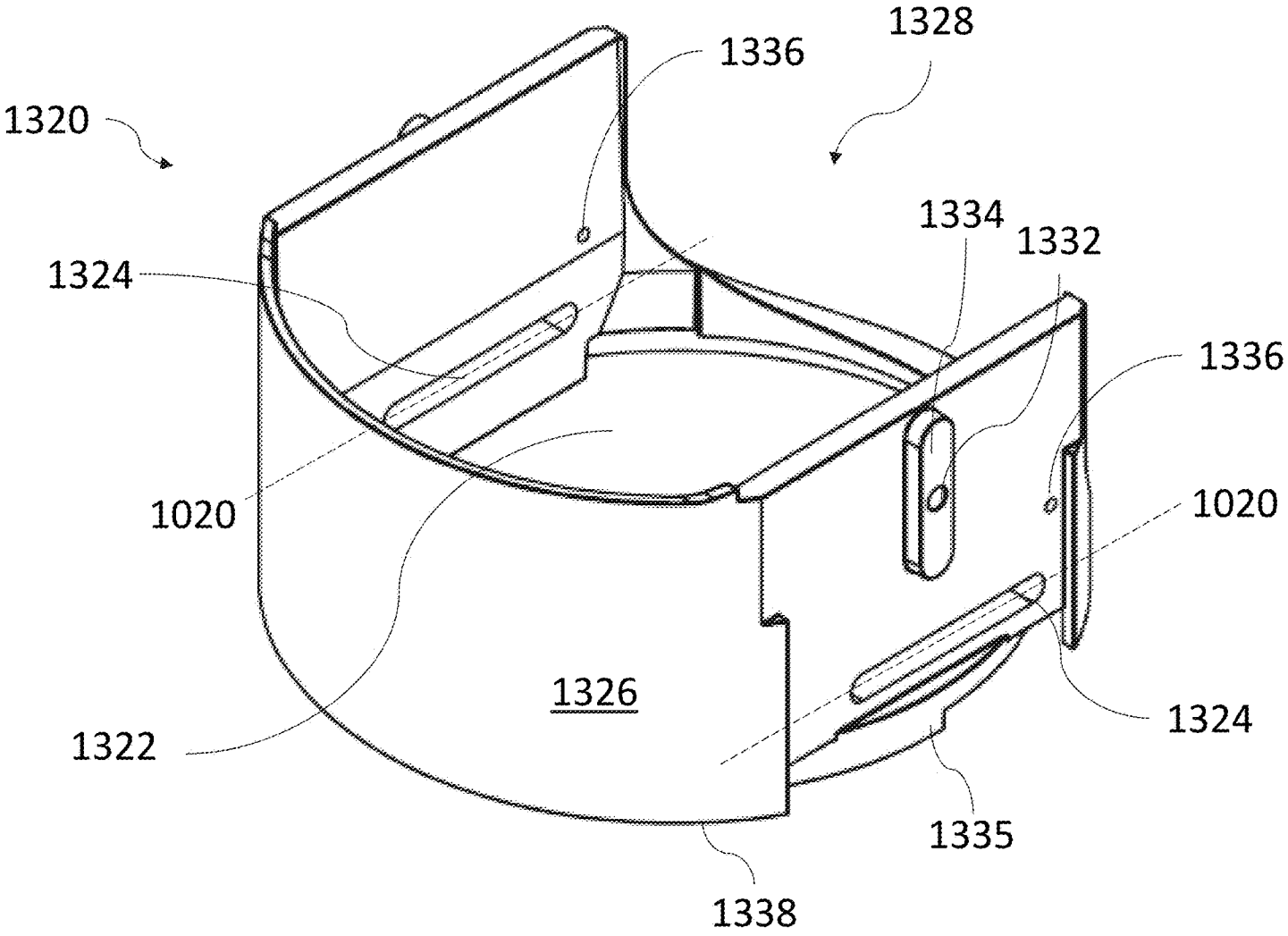
FIG. 20F is a top, rear, right perspective view of the base structure shown in FIG. 20A.
Figure 20H:
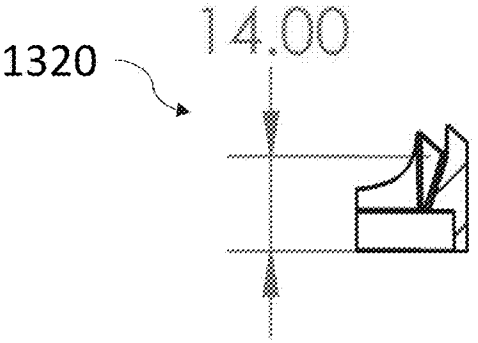
FIG. 20H is a cross-sectional view of the base structure shown in FIG. 20A along the plane B-B.
Figure 20G:
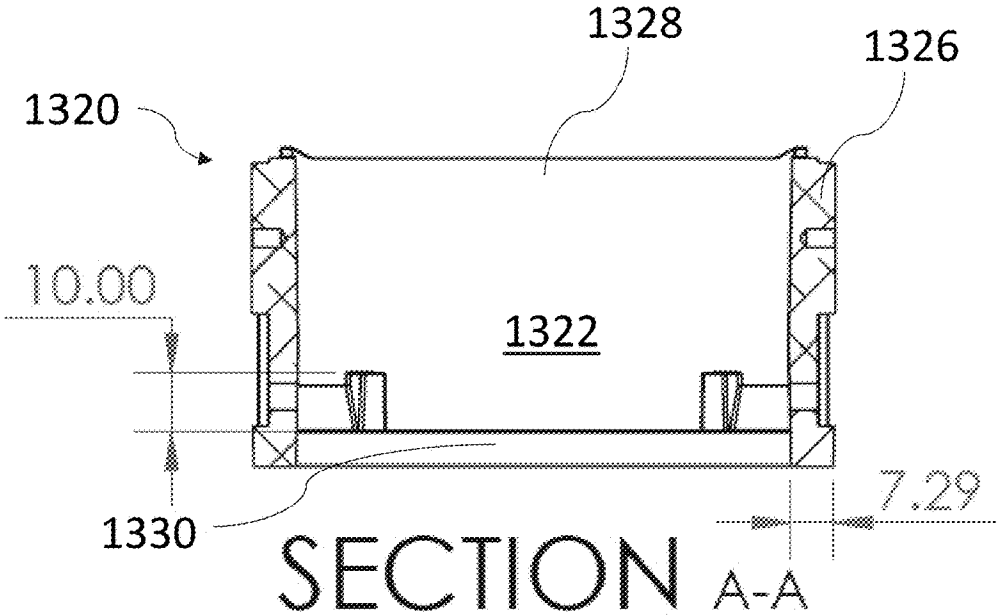
FIG. 20G is a cross-section view of the base structure shown in FIG. 20A along the plane A-A.

In order to accommodate the translational and rotational motion of the lighting module 1100, the first opening 1328 may extend from the top surface of the base structure 1320 to a portion of the sidewall 1326 as shown in FIG. 20F. In this manner, the lighting module 1100 may protrude, at least in part, through the portion of the sidewall 1326 when the lighting module 1100 translates along the first translation axis 1020 and rotating about the first rotation axis 1010. This may allow the first rotation axis 1010 to be located closer towards the second opening 1330 and a shorter radius of rotation (e.g., a shorter pivot arm 1184 on the heat sink arm 1180) without risk of collision with the base structure 1320, which can reduce the overall size of the adjustable lighting apparatus 1000. The second opening 1330 may have an edge 1338 shaped to be a rail or a track that couples to a corresponding track/rail on the rotation ring 1500 such that the adjustable mount 1300 may rotate about a second rotation axis 1070 of the second opening 1330 relative to the rotation ring 1500. In some implementations, the second opening 1330 may instead have coupling features that couple to corresponding coupling features on the rotation ring 1500. Various coupling features may be used including, but not limited to grooves, registration features, twist-n-lock connectors/receptacles, screw holes, or any other mating features known to one of ordinary skill in the art.

The sidewall 1326 of the base structure 1320 may include a slot 1324 that defines the orientation of the first translation axis 1020. In some implementations where multiple heat sink arms 1180 are used, a corresponding number of slots 1324 may be disposed onto the base structure 1320. In some implementations, the slots 1324 may be substantially parallel such that the shield 1360 primarily translates along the first translation axis 1020. In some implementations, the slots 1324 may not be substantially parallel to one another such that the shield rotates while translating along the first translation axis 1020. For example, FIG. 20F shows two slots 1324 disposed on opposing sides of the sidewall 1326 to correspond with the two heat sink arms 1180 on the lighting module 1100. The width of the slot 1324 may be tailored to accommodate a particular pin/rod diameter. The length of the slot 1324 may correspond to the range of induced translational motion of the lighting module 1100 when rotating about the first rotation axis 1010. In some implementations, the lighting module 1100 may be coupled to the base structure 1320 by inserting the pin/rod from one side of the sidewall 1326, through the slot 1324, and into the hole on the pivot arm 1184 of the heat sink arm 1180.

The sidewall 1326 may also include a hole 1336 to rigidly mount a stabilizing pin 1337 that is inserted into the stabilizing slot 1366 of the shield 1360. The stabilizing pin 1337 and the stabilizing slot 1366 provide additional mechanical constraints in order to substantially reduce unwanted rotation along the first rotation axis 1010 while the shield 1360 translates along the first translation axis 1020.

The sidewall 1326 may also include one or more coupling features to couple the retainer 1340 to the sidewall 1326 of the base structure 1320. Various coupling features may be used including, but not limited to screw holes, snap fit connectors, spring clips, or any other coupling features known to one of ordinary skill in the art. For example, FIG. 20D shows the sidewall 1326 has a screw hole 1332 disposed proximate to the slot 1324. In this manner, the retainer 1340, which may have the motion rail 1342, may be disposed above the slot 1324 such that the motion track 1182 and the pivot arm 1184 are coupled to both the slot 1324 and the motion rail 1342 of the retainer 1340. Additional registration features may be incorporated onto the sidewall 1326 for alignment and mechanical support. As shown in FIG. 20D, the sidewall 1326 includes a protruding structure 1334 that mates to a corresponding recessed structure 1348 on the retainer 1340. In some implementations, the sidewall 1326 may have a recess 1335 on the second opening 1330 at least proximate to where the retainer is coupled to the base structure 1320. The recess 1335 allows a portion of the retainer 1340 to couple to the rotation ring 1500, thus securely attaching the rotation ring 1500 to the base structure 1320.

The base structure 1320 may be formed from various materials including, but not limited to, aluminum, carbon steel, stainless steel, copper, polymers, ceramics, or any alloys or composites of the foregoing. The base structure 1320 may also be painted/coated to improve various aspects of the base structure 1320 such as corrosion resistance, durability, thermal emissivity, or aesthetic quality.

The retainer 1340 may provide additional mechanical constraint on the rotational motion of the lighting module 1100 with respect to the adjustable mount 1300. The retainer 1340 may also be used to couple the rotation ring 1500 to the base structure 1320. FIGS. 21A-21H show several views of an exemplary retainer 1340, according to an implementation. As described above, the retainer 1340 couples to the sidewall 1326 of the base structure 1320. The retainer 1340 may thus be shaped and/or dimensioned, in part, to conform to the shape and/or dimensions of the base structure 1320.

The retainer 1340 may include a motion rail 1342, which couples to the motion track 1182 on the heat sink arm 1180. As described above, the motion rail 1342 may have a curved profile with a center of curvature substantially similar to the motion track 1182. The motion rail 1342 may thus be used to mechanically guide the lighting module 1100 as the lighting module 1100 rotates about the first rotation axis 1010. In some implementations, the curved profile may also induce translation of the lighting module 1100 along the first translation axis 1020 as previously described. The motion rail 1342 may also include a mechanical stop 1344 that contacts a corresponding mechanical stop on the motion track 1182 to limit the rotational motion of the lighting module 1100 (e.g., the second rotational position).

The retainer 1340 may also include coupling features to couple the retainer 1340 to the sidewall 1326 of the base structure 1320. Various coupling features may be used including, but not limited to screw holes, snap fit connectors, spring clips, or any other coupling features known to one of ordinary skill in the art. For example, FIG. 21A shows the retainer 1340 having a hole 1346 for a screw fastener that couples to the hole 1332 on the sidewall 1326. As described above, FIG. 21B shows the retainer 1340 may include a recessed structure 1348 that mates to a protruding structure 1334 on the sidewall 1326 of the base structure 1320. The retainer 1340 may also include a recessed slot 1348 to accommodate the pin/rod 1011 inserted into the slot 1324 on the base structure 1320.

Figure 21B:
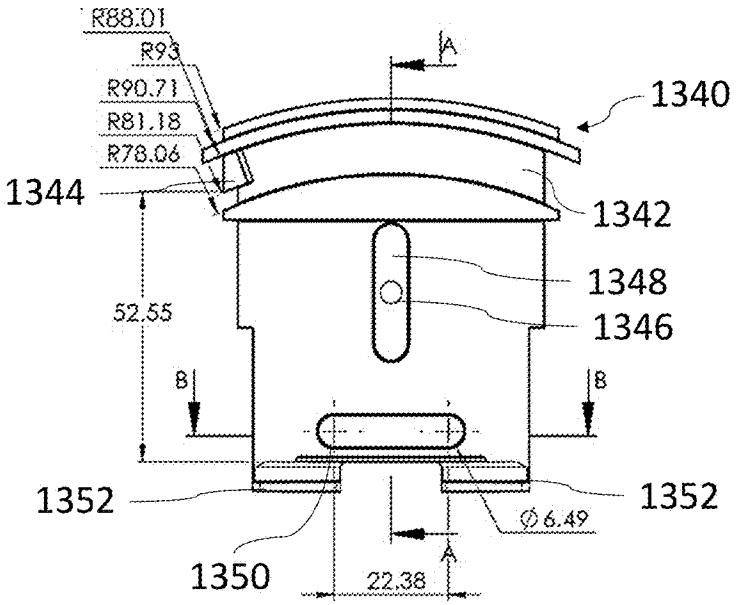
FIG. 21B is a rear view of the retainer shown in FIG. 21A.
Figure 21D:
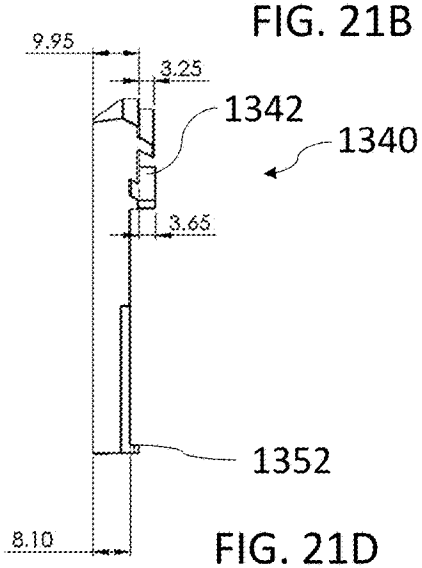
FIG. 21D is a left view of the retainer shown in FIG. 21A.
Figure 21A:
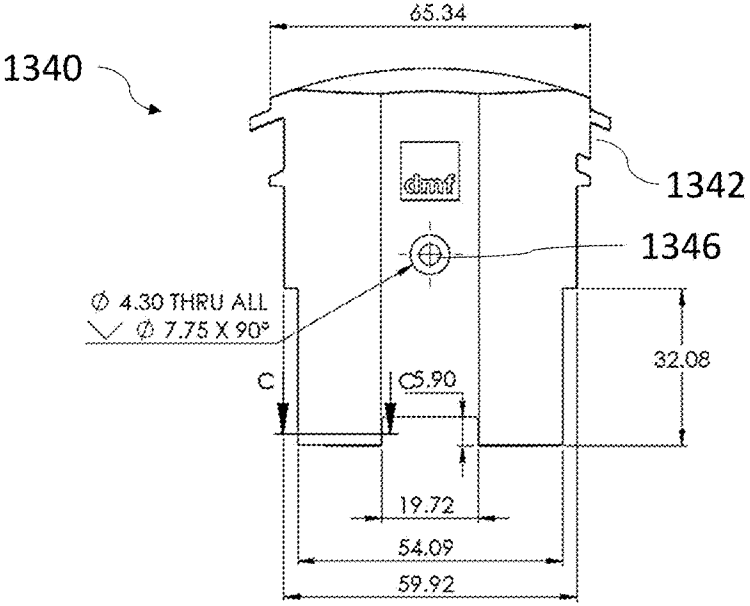
FIG. 21A is front view of a retainer of an adjustable lighting apparatus, according to an implementation.
Figure 21C:
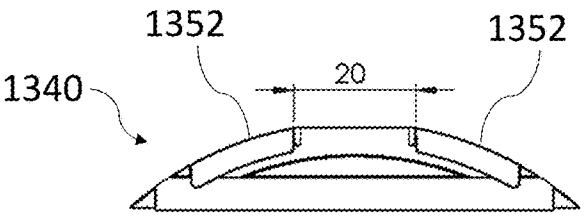
FIG. 21C is a bottom view of the retainer shown in FIG. 21A.
Figure 21E:
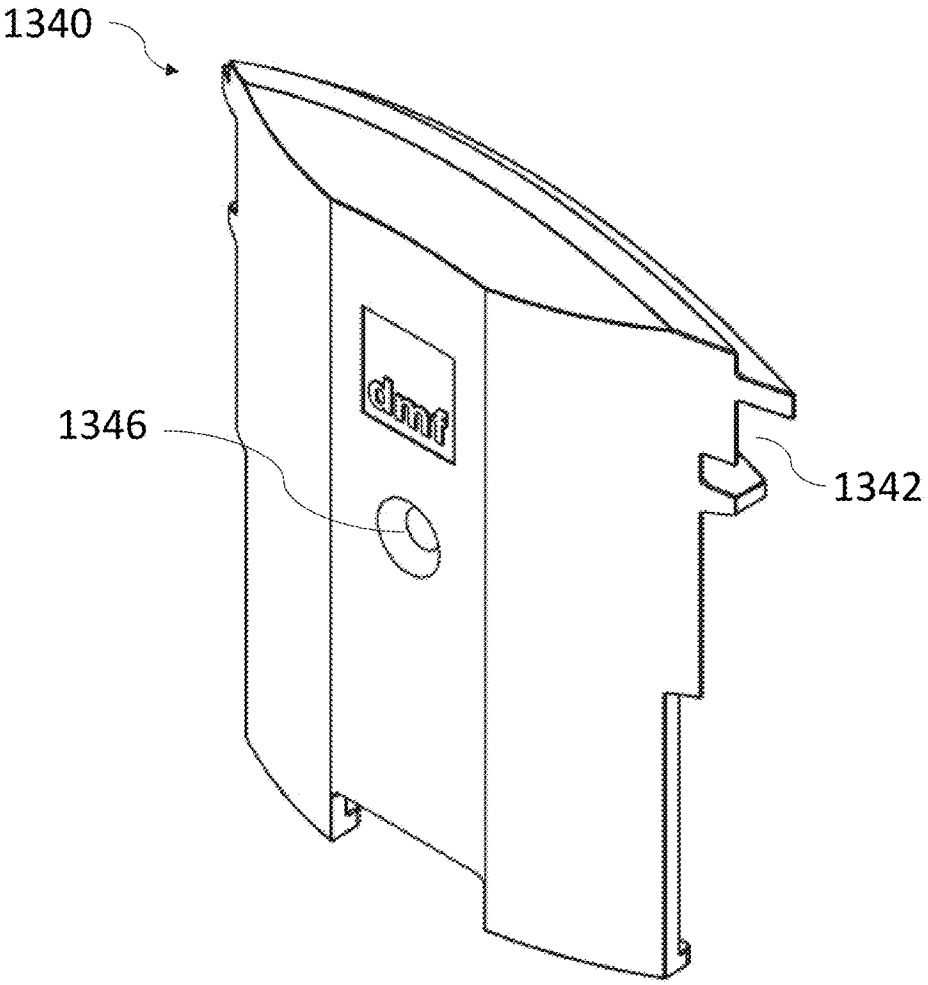
FIG. 21E is a top, front, left perspective view of the retainer shown in FIG. 21A.
Figure 21G:
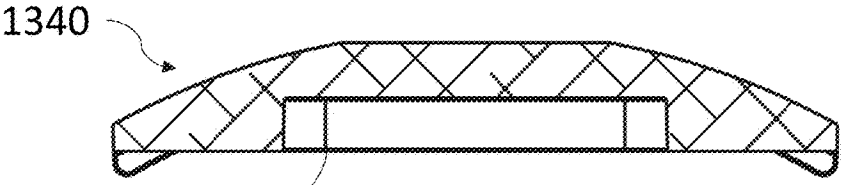
FIG. 21G is a cross-sectional view of the retainer shown in FIG. 21B along the plane B-B.
Figure 21H:
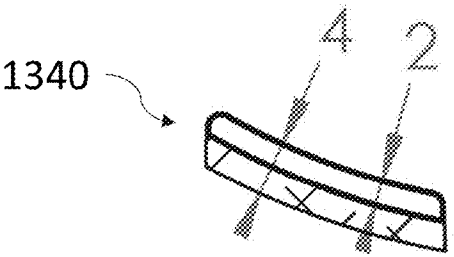
FIG. 21H is a cross-sectional view of the retainer shown in FIG. 21A along the plane C-C.
Figure 21F:
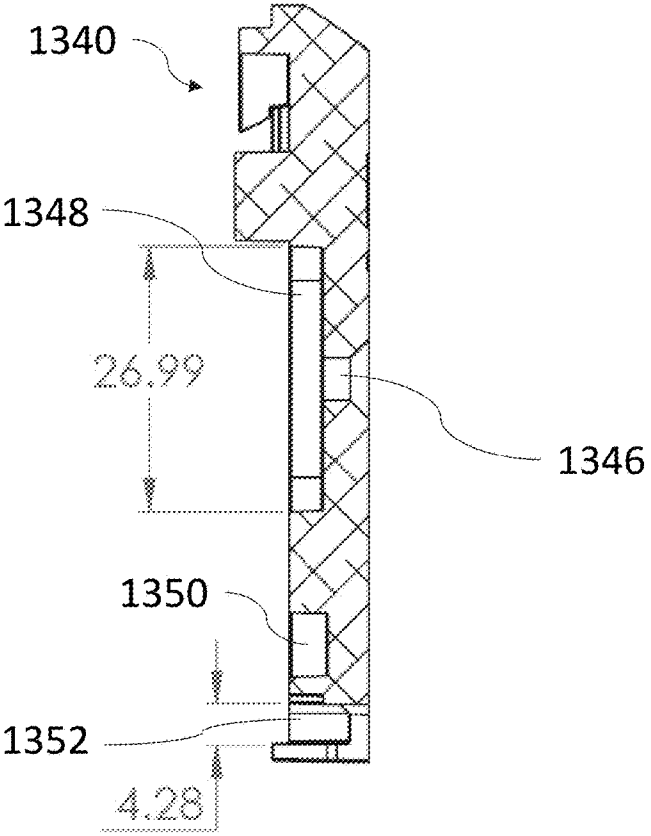
FIG. 21F is a cross-sectional view of the retainer shown in FIG. 21B along the plane A-A.

The retainer 1340 may also have a rail/track feature 1352 that corresponds to the rail/track feature 1338 on the second opening 1330 of the base structure 1320 as shown in FIG. 21B. In some implementations the rotation ring 1500 may be coupled to the rail/track feature 1338 on the second opening 1330 of the base structure 1320 first and then the retainer 1340 may be coupled to the base structure 1320 such that the rail/track feature 1352 secures the rotation ring 1500 to the base structure 1320. Once the rotation ring 1500 is secured to the base structure 1320 via the retainer 1340, the adjustable mount 1300 may then rotate about the a second rotation axis 1070 with respect to the rotation ring 1500. In some implementations, the retainer 1340 may incorporate a coupling feature to couple the rotation ring 1500 to the base structure 1320. Various coupling features may be used including, but not limited to grooves, registration features, twist-n-lock connectors/receptacles, screw holes, or any other mating features known to one of ordinary skill in the art.

In some implementations, multiple retainers 1340 may be coupled to the base structure 1320 corresponding to the number of heat sink arms 1180 on the lighting module 1100. For example, FIG. 11A shows the adjustable lighting apparatus 1000 includes two retainers 1340 corresponding to the two heat sink arms 1180 on the lighting module 1100. The multiple retainers 1340 may have a shape/dimensions that are mirror symmetric with respect to one another.

The retainer 1340 may be formed from various materials, preferably materials having a low coefficient of friction, including, but not limited to aluminum, polyoxymethylene (e.g., Delrin), polytetrafluoroethene (e.g., Teflon), graphite, composite materials, or any other low friction materials known to one of ordinary skill in the art. In some implementations, the retainer 1340 may be formed from a material with a low coefficient of friction while the heat sink arm 1180 is formed from another material, such as aluminum. Depending on the material used, a portion of the retainer 1340 (e.g., the motion rail 1342) may be polished to further reduce the coefficient of friction. Additionally, a lubricant may be disposed onto the retainer 1340 to further reduce friction. For example, a thin layer of lubricant may be coated onto the motion rail 1342.

FIGS. 22A-22E show an exemplary shield 1360, according to an implementation. As described above, the shield 1360 may be shaped and/or dimensioned to have a cavity 1362 that substantially covers the first opening 1328 of the base structure 1320 for at least one rotational position. For example, the shield 1360 may have a cross-sectional shape substantially similar, at least in part, to the cross-section of the interior cavity 1362 of the base structure 1320. Additionally, the shield 1360 may be curved to conform, at least in part, to the shape of the cavity 1362 in the heat sink 1140. In some implementations, a portion of the shield 1360 may extend into the cavity 1362 to substantially surround the light source 1160. As described above, the shield 1360 may include a rotation slot 1364 that extends along the portion of the shield 1360 proximate to the lighting module 1100. The rotation slot 1364 may have a width substantially similar to the diameter of the central region 1146 on the heat sink 1140 and an arc length that physically constrains the range of rotational motion of the lighting module 1100.

The shield 1360 may include an opening 1370 located opposite to the rotation slot 1364 to allow light from the light source 1160 to couple out of the adjustable lighting apparatus 1000. The edge of the opening 1370 may be shaped/dimensioned, in part, to provide clearance for the trim 1700, which may be inserted into the cavity 1322 of the base structure 1320. In some implementations, a portion of the edge of the opening 1372 may be shaped such that when the lighting module 1100 is rotated to its largest rotation angle, the resultant translation of the shield 1360 along the first translation axis 1020 causes the edge of the opening 1372 to be aligned proximate to a first edge of the trim 1700 such that the shield 1360 in combination with the trim 1700 substantially covers the first opening 1328 of the base structure 1320.

Figure 22A:
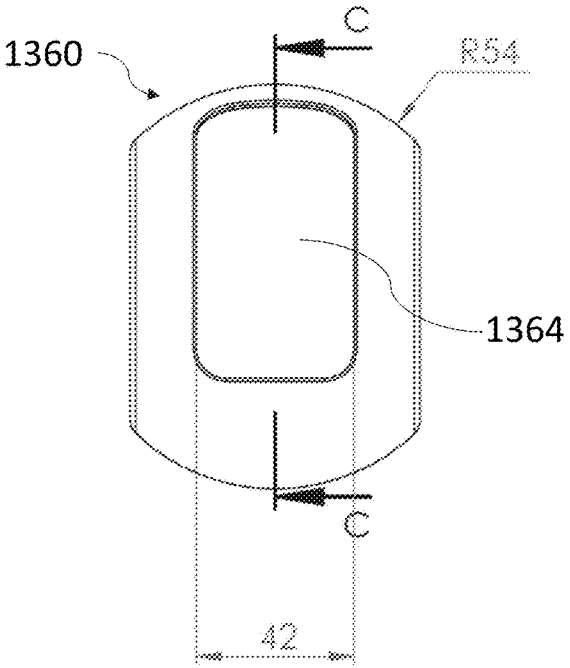
FIG. 22A is a top view of a shield of an adjustable lighting apparatus, according to an implementation.
Figure 22B:
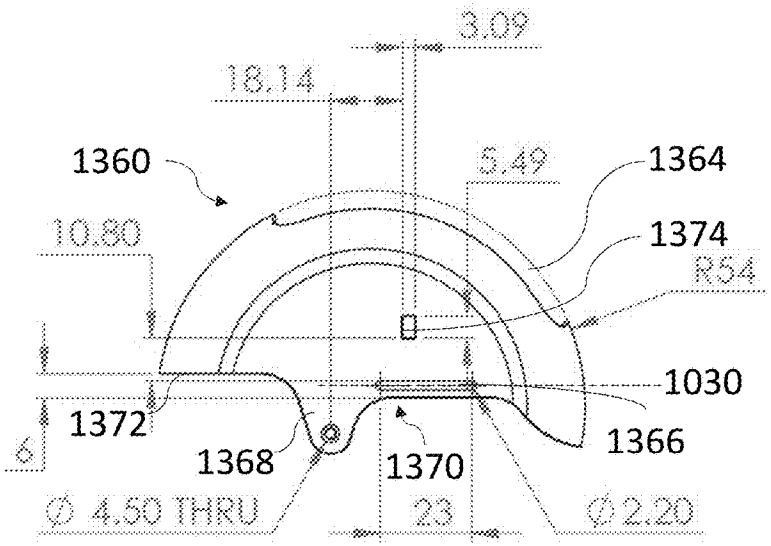
FIG. 22B is a left view of the shield shown in FIG. 22A.
Figure 22D:
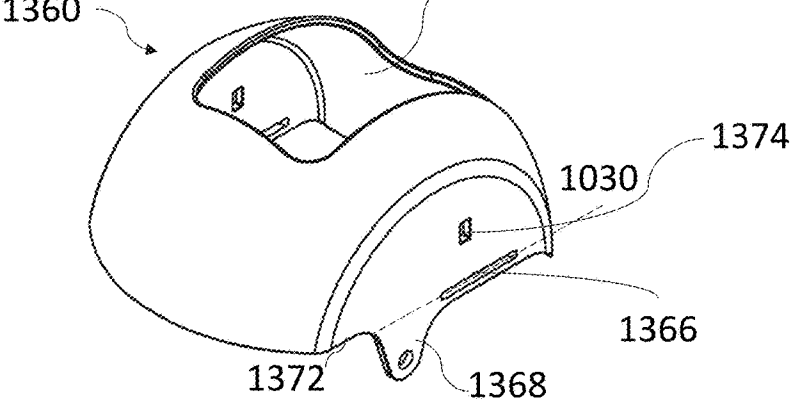
FIG. 22D is a top, front, left perspective view of the shield shown in FIG. 22A.
Figure 22C:
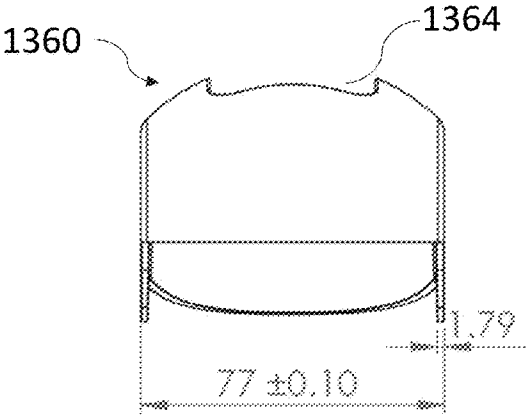
FIG. 22C is a front view of the shield shown in FIG. 22A.
Figure 22E:
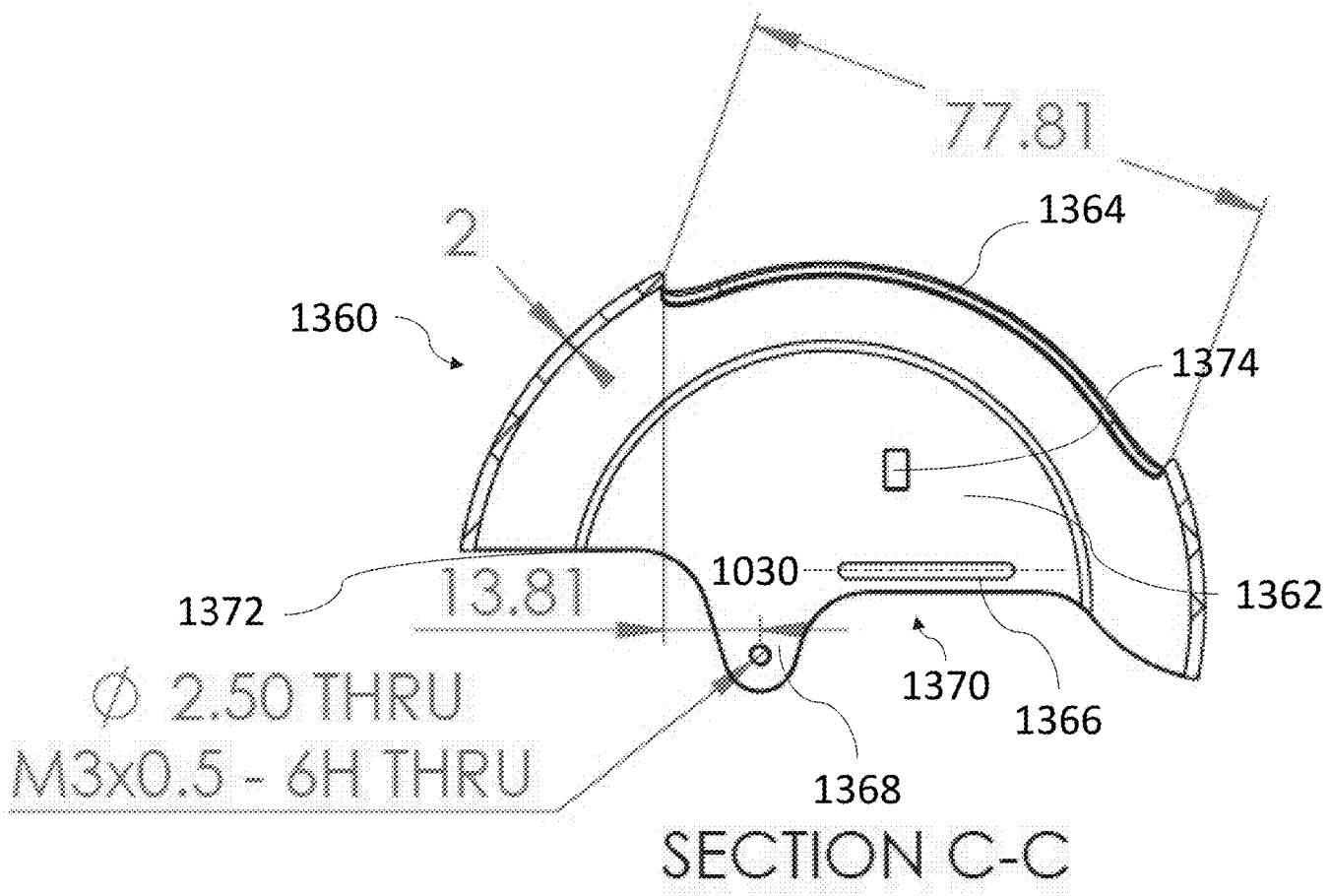
FIG. 22E is a cross-sectional view of the shield shown in FIG. 22A along the plane C-C.

The shield 1360 may be coupled to the base structure 1320 and the lighting module 1100 via a tab 1368 disposed along the periphery of the opening 1370 of the shield 1360. The tab 1368 may be an extension of the shield 1360 with a hole that receives the pin/rod 1011 coaxial with the first rotation axis 1010. In some implementations, the locking nut 1220 may be coupled to the pin/rod 1011 from within the cavity 1362 of the shield 1360. Additionally, the shield 1360 may include a stabilizing slot 1366, which may be disposed proximate to the tab 1368. As described above, the stabilizing slot 1366 receives the stabilizing pin/rod 1337 rigidly coupled to the base structure 1320 to reduce unwanted rotational motion of the shield 1360 when translating along the first translation axis 1020. The stabilizing slot 1366 may define a second translation axis 1030 substantially parallel to the first translation axis 1020 in order to constrain the shield 1360 to move primarily along the first translation axis 1020. In some implementations, the stabilizing pin/rod 1337 may instead be rigidly coupled to the shield 1360 and inserted into the slot 1366 along with the pin/rod coaxial with the first rotation axis 1010 thereby creating two mechanical constraints in the slot 1366, which may also reduce unwanted rotational motion of the shield 1360 when translating along the first translation axis. The shield 1360 may also include coupling features to couple the secondary shield 1380 to the shield 1360. Various coupling features may be used including, but not limited to snap fit receptacles, screw holes, adhesives, or any other coupling feature known to one of ordinary skill in the art. For example, FIG. 22E shows a snap fit receptacle 1374 that receives a corresponding snap-fit connector 1382 on the secondary shield 1380.

In some implementations, the shield 1360 may include multiple tabs 1368 and stabilizing slots 1366 corresponding to the number of heat sink arms 1180 on the lighting module 1100, thus providing additional stability to the shield 1360 when translating along the first translation axis 1020. Multiple coupling features may also be disposed on the shield 1360 to more stably support the secondary shield 1380.

The shield 1360 may be formed from various materials including, but not limited to aluminum, carbon steel, stainless steel, copper, polymers, ceramics, or any alloys or composites of the foregoing. Additionally, the shield 1360 may be painted or coated to have a particular color, which may meet particular aesthetic preferences or to reduce the visibility openings that are covered by other components in the adjustable lighting apparatus 1000. In some implementations, the reflective properties of the shield 1360 may also be diffuse, specular, or a combination of the foregoing, which may also affect the aesthetic appearance of the adjustable lighting apparatus 1000 and/or the amount of light coupled out of the adjustable lighting apparatus 1000.

Figure 23B:
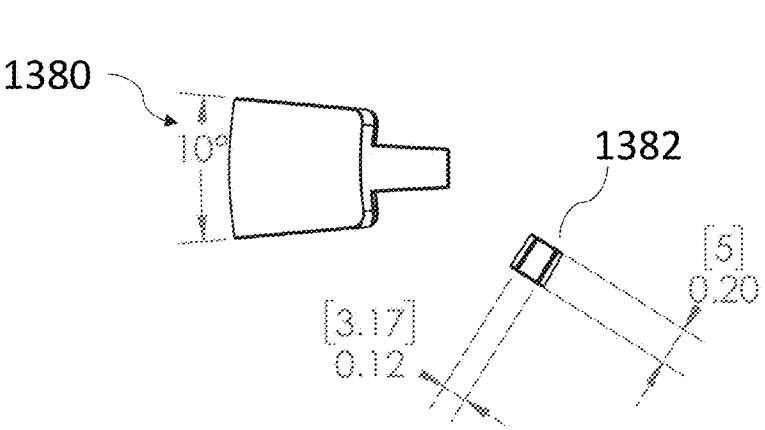
FIG. 23B is a left view of the secondary shield shown in FIG. 23A.
Figure 23A:
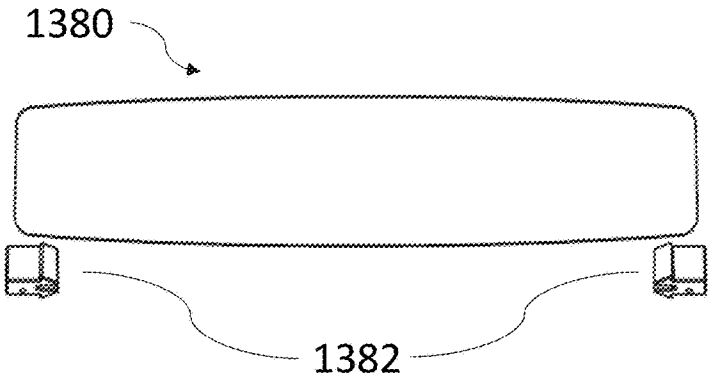
FIG. 23A is a front view of a secondary shield of an adjustable lighting apparatus, according to an implementation.
Figure 23D:
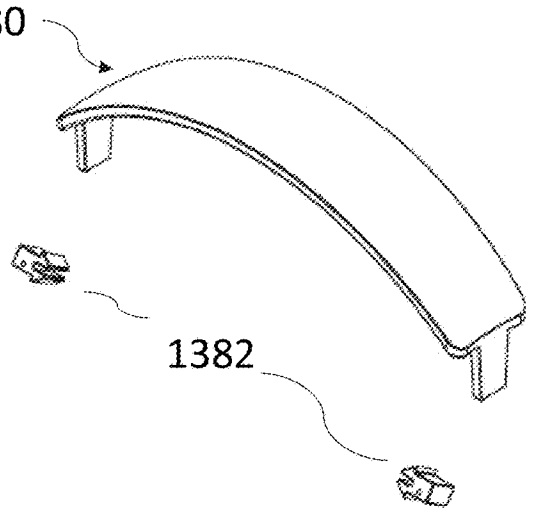
FIG. 23D is a front, left perspective view of the secondary shield shown in FIG. 23A.
Figure 23C:
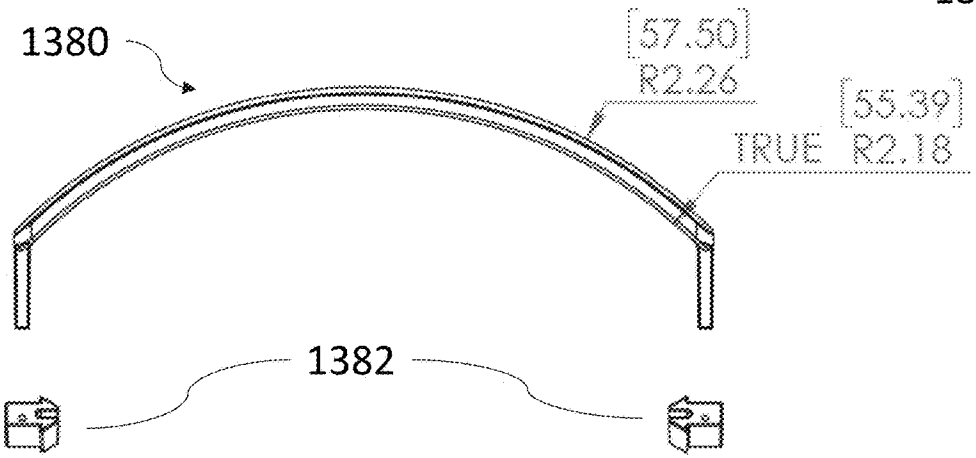
FIG. 23C is a top view of the secondary shield shown in FIG. 23A.
Figure 24B:
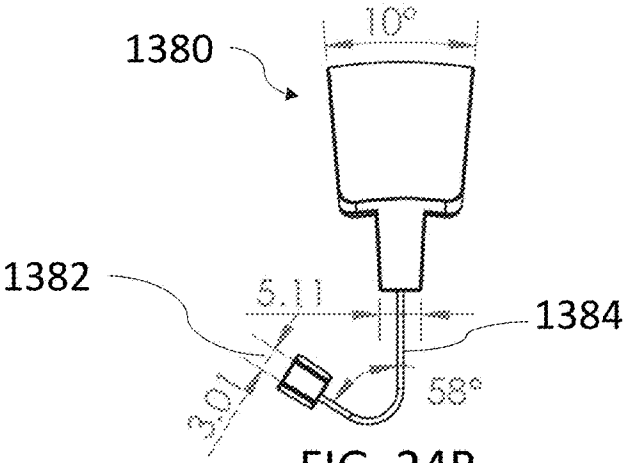
FIG. 24B is a left view of the secondary shield shown in FIG. 24A.
Figure 24D:
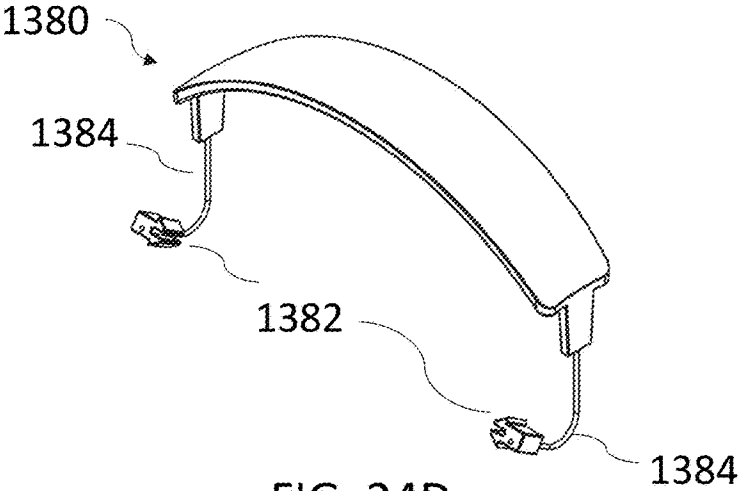
FIG. 24D is a front, left perspective view of the secondary shield shown in FIG. 24A.
Figure 24A:
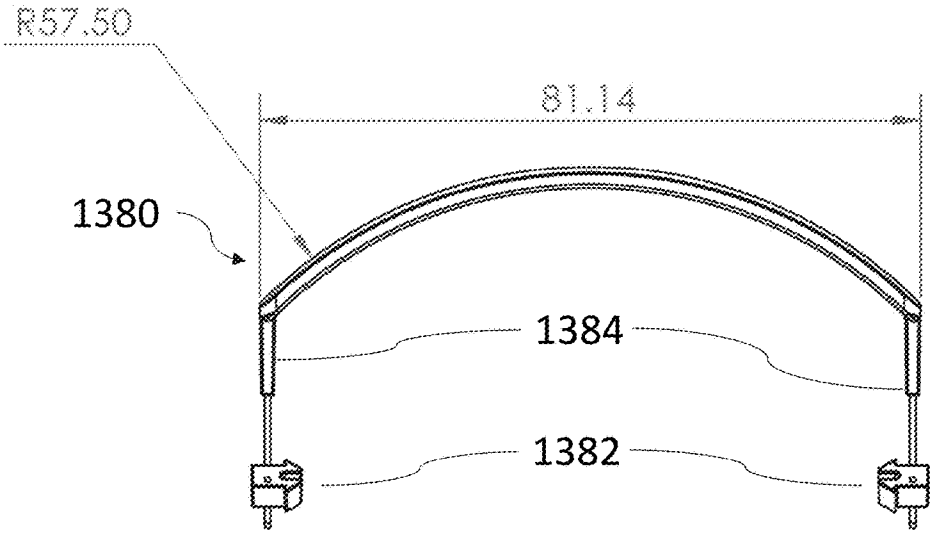
FIG. 24A is a front view of a secondary shield of an adjustable lighting apparatus, according to an implementation.
Figure 24C:
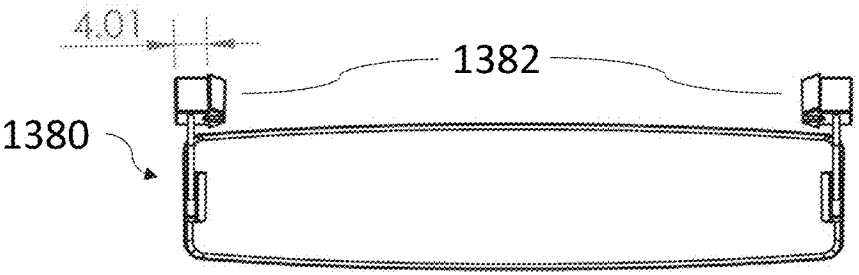
FIG. 24C is a top view of the secondary shield shown in FIG. 24A.
Figure 25A:
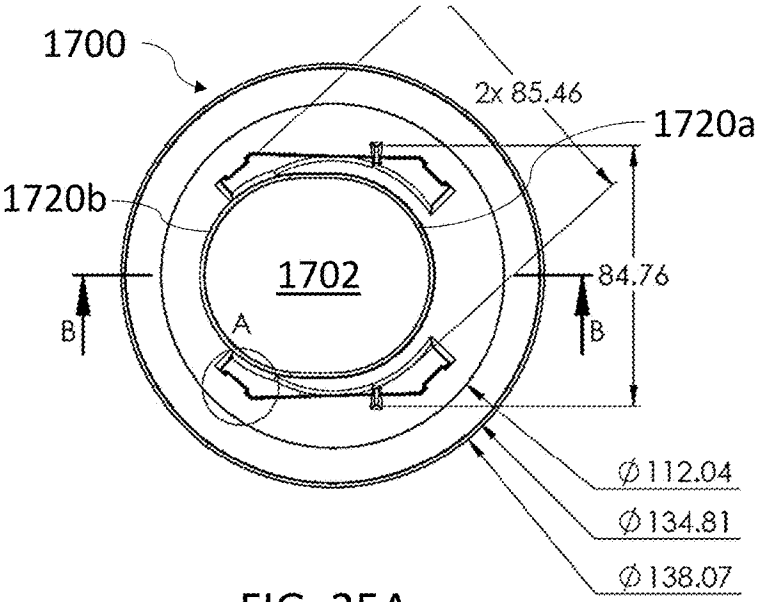
FIG. 25A is a top view of a trim of an adjustable lighting apparatus, according to an implementation.
Figure 25B:
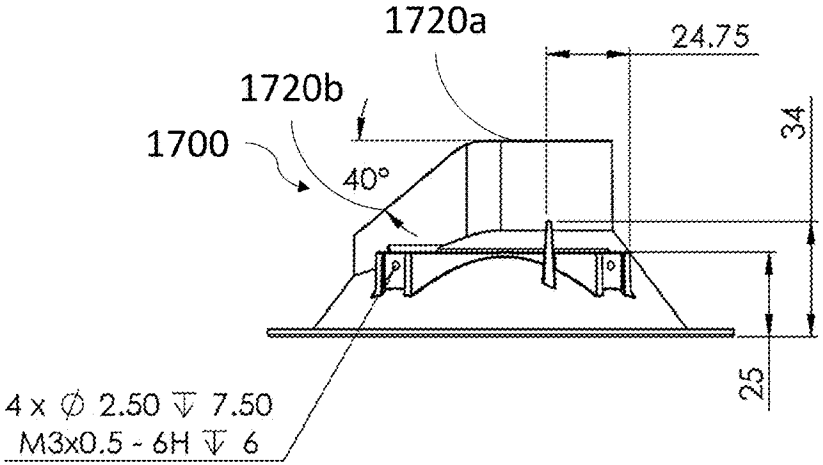
FIG. 25B is a front side view of the trim shown in FIG. 25A.
Figure 25C:
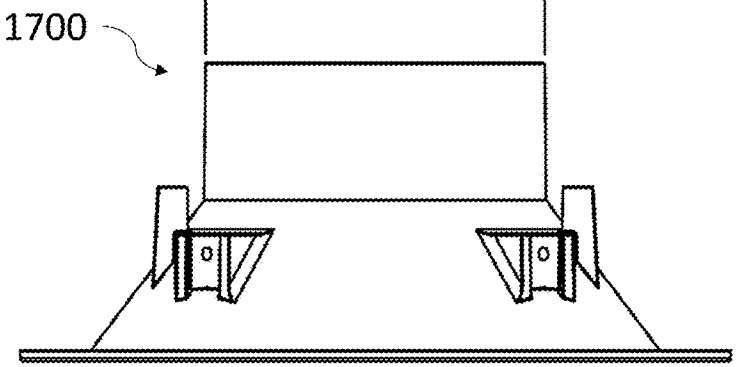
FIG. 25C is a right view of the trim shown in FIG. 25A.
Figure 25D:
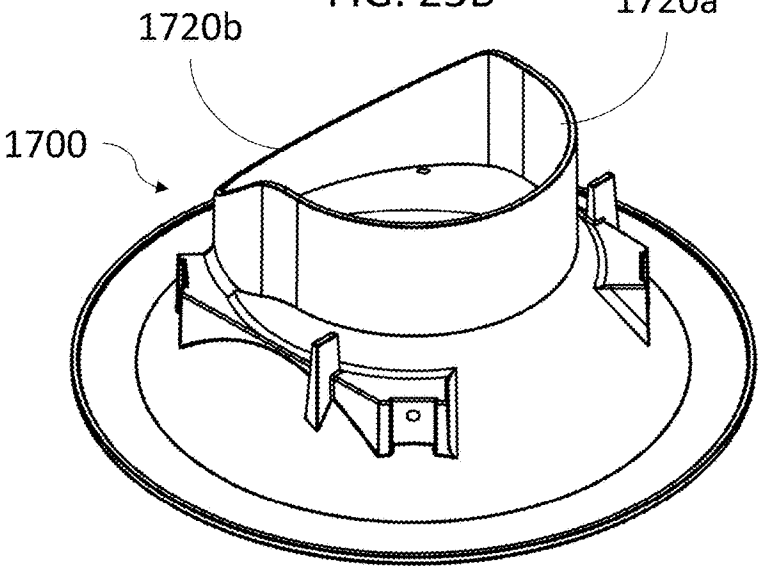
FIG. 25D is a top, front, right perspective view of the trim shown in FIG. 25A.
Figure 25E:
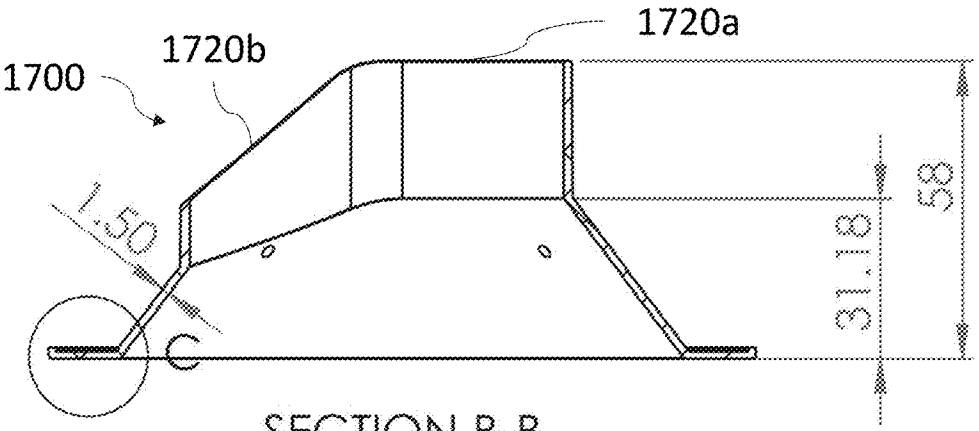
FIG. 25E is a cross-sectional view of the trim shown in FIG. 25A along the plane B-B.
Figure 25G:
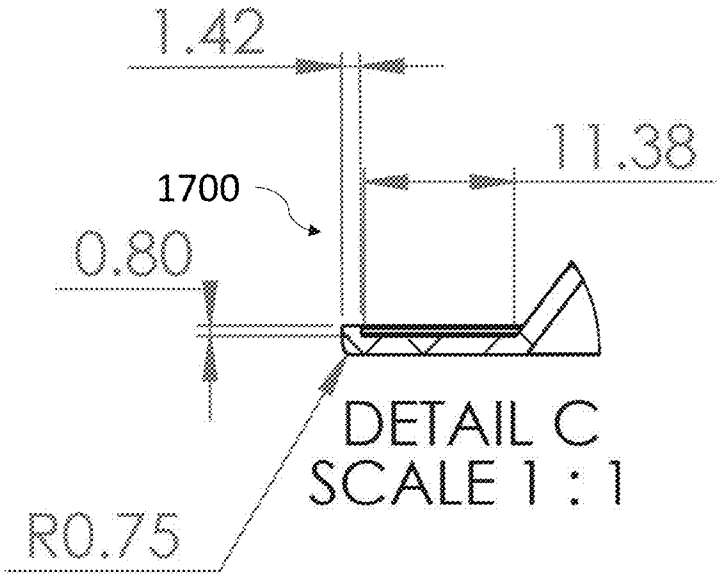
FIG. 25G is a magnified view of the trim shown in FIG. 25E in inset C.
Figure 25F:
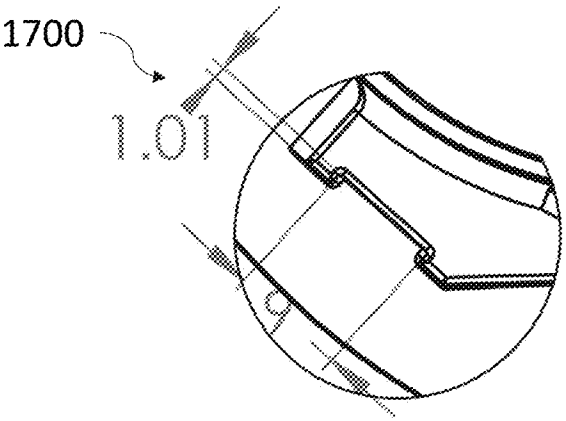
FIG. 25F is a magnified view of the trim shown in FIG. 25A in inset A.

The secondary shield 1380 may be used in combination with the heat sink 1140 to cover the rotation slot 1364 on the shield 1360 at certain rotational positions, thus preventing users from seeing through the rotation slot 1364 into the ceiling or wall space where the adjustable lighting apparatus 1000 is installed. For example, FIG. 10C showed that when the lighting module 1100 is in the first rotational position, the secondary shield 1380 covers a portion of the rotation slot 1364 corresponding to where the lighting module 1100 would be located in the second rotational position. FIGS. 23A-23D show several views of an exemplary secondary shield 1380, according to an implementation. The secondary shield 1380 may have a curved body that substantially conforms to the curvature of the shield 1360. The secondary shield 1380 may be coupled to the shield 1360 using various coupling mechanisms including, but not limited to snap fit connectors, screw holes, adhesives, or any other coupling feature known to one of ordinary skill in the art. As shown in FIG. 23A, the exemplary secondary shield 1380 includes snap-fit connectors 1382 to couple the secondary shield 1380 to the shield 1360.

In some implementations, the secondary shield 1380 may be coupled to the shield 1360 such that when the lighting module 1100 rotates to the portion of the rotation slot 1364 covered by the secondary shield 1380, the lighting module 1100 can move the secondary shield 1380 out of the way. FIGS. 24A-24D show one example where the secondary shield 1380 is coupled to the snap-fit connectors by a flexible member 1384. The flexible member 1384 provides sufficient compliancy such that when the lighting module 1100 contacts the secondary shield 1380, the flexible member 1384 bends, thus allowing the secondary shield 1380 to move. Otherwise, the flexible member 1384 is able to support the secondary shield 1380 above the rotation slot 1364. It should be appreciated other mechanisms may be used to enable relative motion between the secondary shield 1380 and the shield 1360. Note that the manner in which the snap-fit connectors are coupled to the body of the secondary shield 1380 are left undefined in FIGS. 23A-23D to emphasize the generality of the mechanism. In another example, the secondary shield 1380 may be mounted to the shield 1360 along a track/rail structure that allows the secondary shield 1380 to move. The secondary shield 1380 may be coupled to a spring that provides a restoring force such that the secondary shield 1380 is maintained above the rotation slot 1364 at a particular rotational position unless the lighting module 1100 is rotated to said rotational position.

The secondary shield 1380 may be formed from various materials including, but not limited to aluminum, carbon steel, stainless steel, copper, polymers, ceramics, or any alloys or composites of the foregoing. In some implementations, the secondary shield 1380 may be formed from the same material as the shield 1360. Additionally, the secondary shield 1380 may be painted or coated to have a particular color, which may meet particular aesthetic preferences. In some implementations, the reflective properties of the secondary shield 1380 may also be diffuse, specular, or a combination of the foregoing, which may also affect the aesthetic appearance of the adjustable lighting apparatus 1000 and/or the amount of light coupled out of the adjustable lighting apparatus 1000.

The trim 1700 may be used to cover a hole in a ceiling or wall in which the adjustable lighting apparatus 1000 is placed. The style of the trim 1700 may vary depending, in part, on the desired aesthetic appearance. In some implementations, the trim 1700 may have a flange. In some implementations, the trim 1700 may have different shaped openings including, but not limited to a beveled opening or a pinhole opening. The trim 1700 may also be shaped and/or dimensioned to reduce shading losses when the lighting module 1100 is positioned at various rotational positions.

In particular, the trim 1700 may have a first opening 1702 that extends towards the lighting module 1100 in the cavity 1322 of the base structure 1320. The first opening 1702 may be shaped to accommodate the rotational motion of the lighting module 1100. For example, FIGS. 25A-25G show several views of an exemplary trim 1700, according to an implementation, with a first opening 1702 that has a first edge 1720*a* and a second edge 1720*b*. The first edge 1720*a* may be coplanar with a first plane with a normal vector that is substantially parallel to the lighting module axis 1060 at the first rotational position. In some implementations, the first edge 1720*a* may be aligned proximate to the edge of the opening 1370 on the shield 1360 when the lighting module 1100 is rotated to it largest rotation angle. The second edge 1720*b* may be coplanar with a second plane with a normal vector substantially parallel to the lighting module axis 1060 at the second rotational position. Said in another way, the first opening 1702 may extend from the top of the trim 1700 to a portion along the side of the trim 1700 such that light from the light source 1160 can emit out of the adjustable lighting apparatus 1000 through the trim 1700. It should be appreciated that in other implementations, the first opening 1702 may have a different shape to accommodate the rotational motion of the lighting module 1100.

Figure 26B:
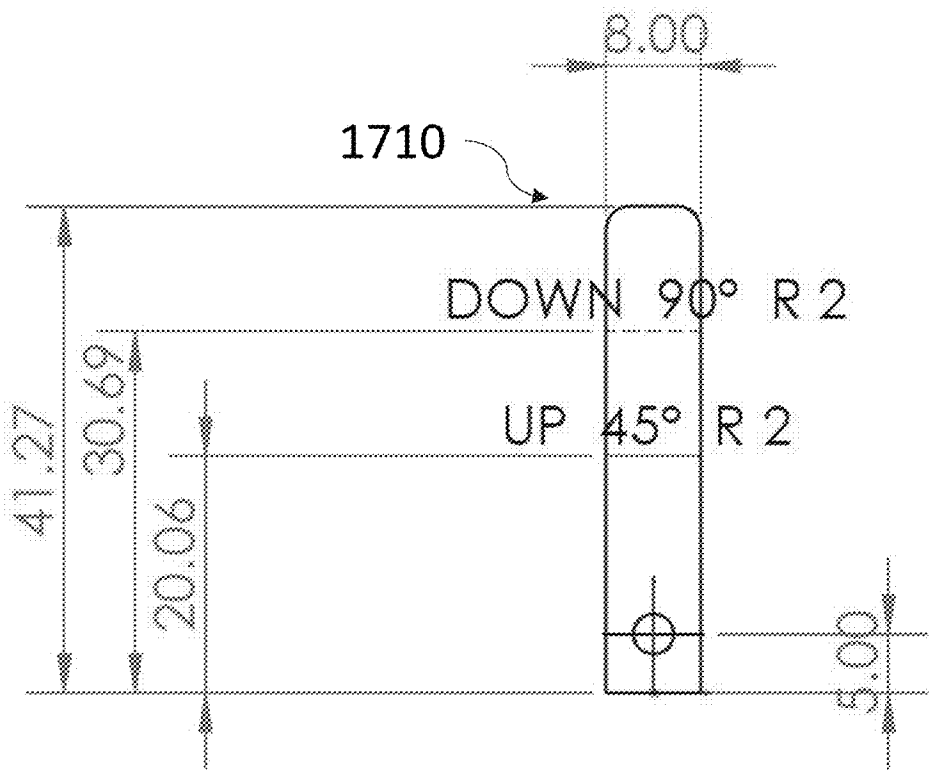
FIG. 26B is a front view of the spring clip shown in FIG. 26A.
Figure 26A:
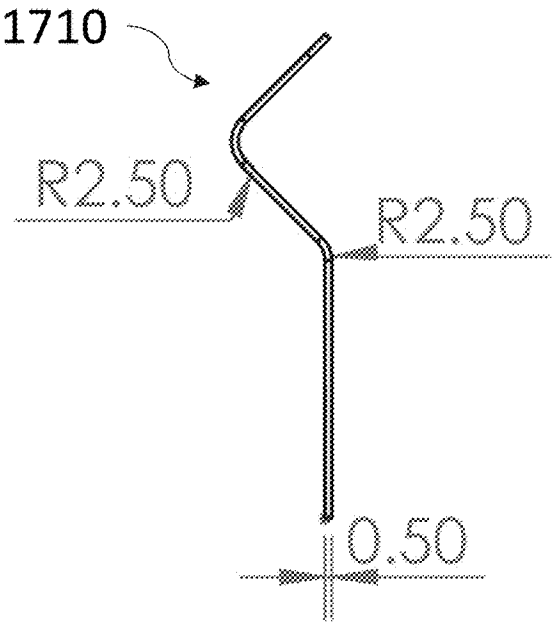
FIG. 26A is a side view of a spring clip of an adjustable lighting apparatus, according to an implementation.
Figure 27B:
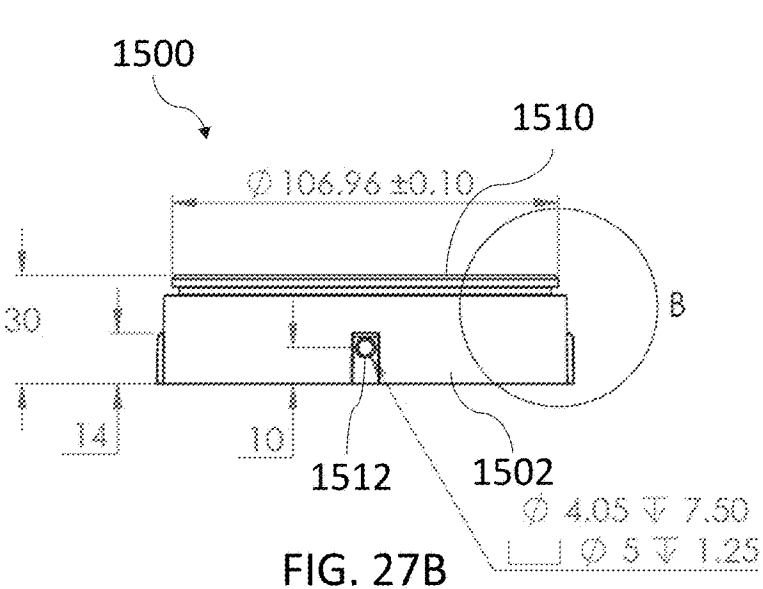
FIG. 27B is a right view of the rotation ring shown in FIG. 27A.
Figure 27D:
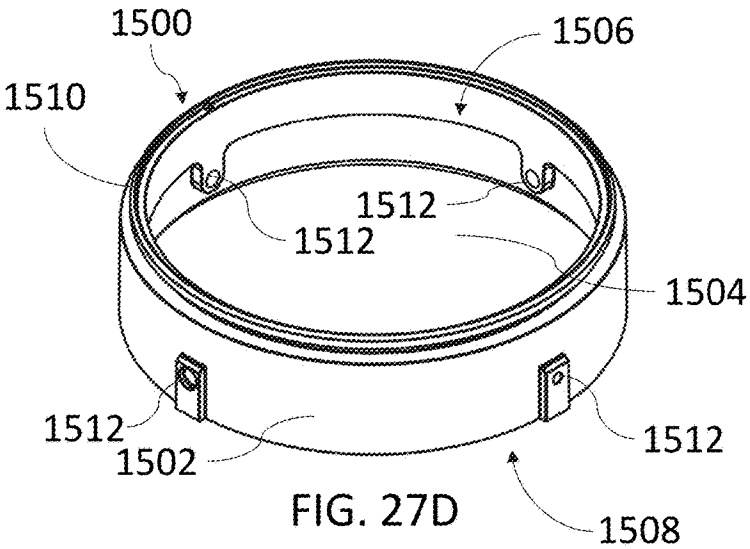
FIG. 27A is a top view of a rotation ring of an adjustable lighting apparatus, according to an implementation.
FIG. 27C is a front view of the rotation ring shown in FIG. 27A.
Figure 27A:
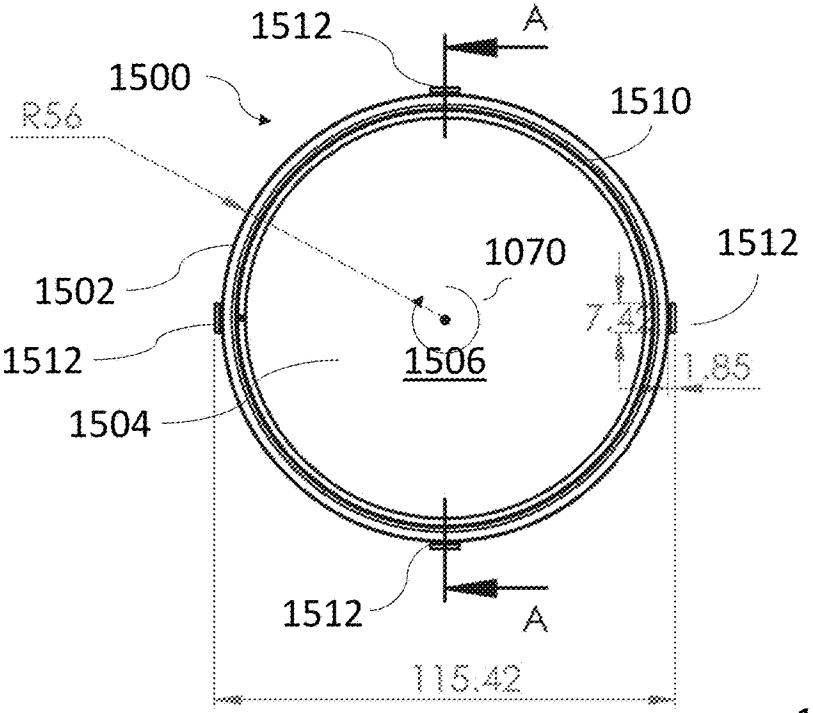
Figure 27C:
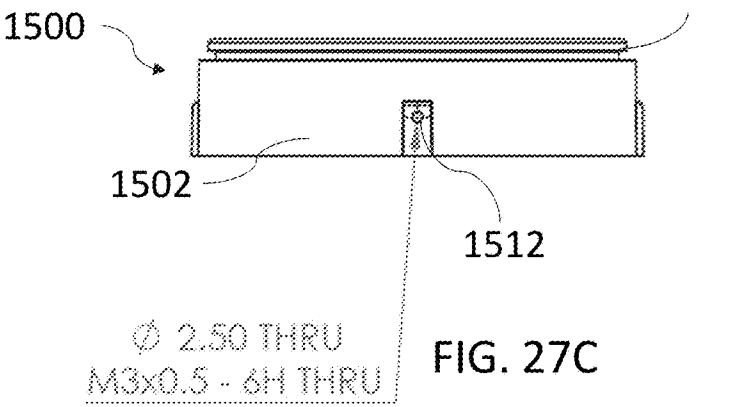
Figure 27F:
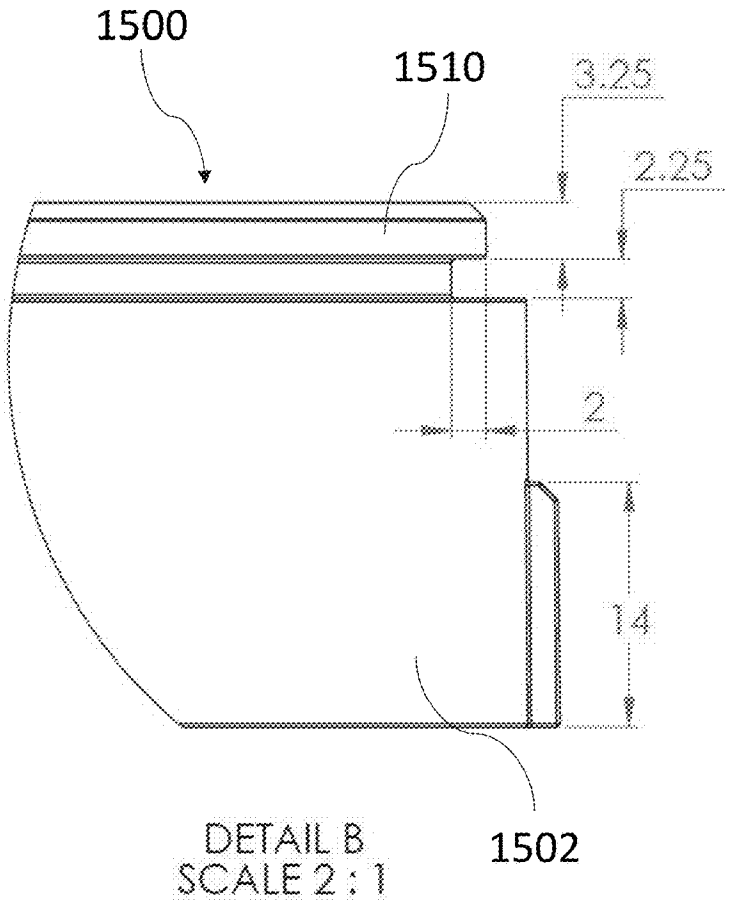
Figure 27E:
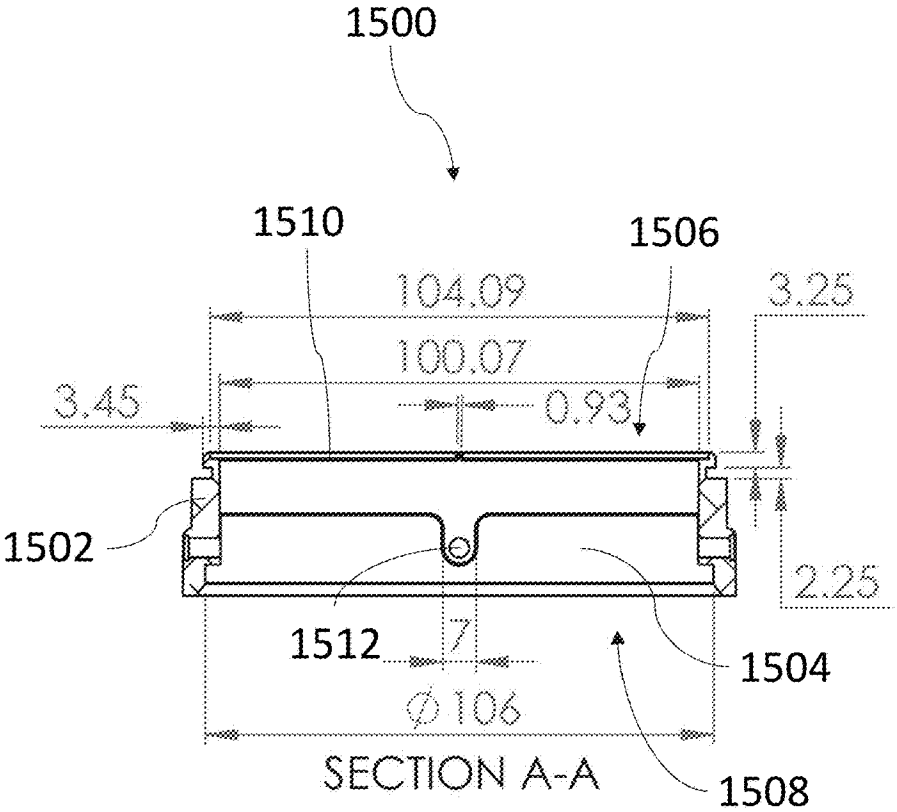

The trim 1700 may be coupled to the base structure 1320 using various coupling mechanisms including, but not limited to, spring clips, screw fasteners, bolt fasteners, clamps, adhesives or any other coupling mechanism known to one of ordinary skill in the art. FIG. 10C shows one example where the trim 1700 is inserted into the cavity 1322 of the base structure 1320 and secured to the sidewall 1326 of the base structure 1320 using multiple spring clips 1710. FIGS. 26A and 26B show several views of an exemplary spring clip 1710.

The trim 1700 may be formed from various materials including, but not limited to aluminum, carbon steel, stainless steel, copper, polymers, ceramics, or any alloys or composites of the foregoing. The trim 1700 may be painted or coated to have a particular color, which may meet particular aesthetic preferences.

The rotation ring 1500 may be used to attach the adjustable mount 1300 (with the lighting module 1100 attached) to the frame 1600. FIGS. 27A-27F show several views of an exemplary rotation ring 1500, according to an implementation. The rotation ring 1500 may have a sidewall 1502 that defines a through hole opening 1504 that includes a first opening 1506 and a second opening 1508. The first opening 1506 may couple to the second opening 1330 of the base structure 1320. In some implementations, light from the light source 1160 may pass through the through hole opening 1504 and transmit out of the second opening 1508. In some implementations, the sidewall 1502 may substantially surround the trim 1700. The sidewall 1502 may define a cross-sectional shape that includes, but is not limited to a circle, an ellipse, a square, a rectangle, a polygon, or any combination of the foregoing. Additionally, the cross-section of the rotation ring 1500 may vary in shape and/or dimension along at least one axis. In some implementations, the cross-sectional shape of the rotation ring 1500 may be substantially similar to the cross-sectional shape of the base structure 1320.

The first opening 1506 of the rotation ring 1500 may have an edge 1510 with a rail/track feature that mates to a corresponding rail/track feature on the second opening 1338 of the base structure 1320 and the retainer 1340 such that the adjustable mount 1300 can rotate about the second rotation axis 1070 relative to the rotation ring 1500, which is fixed to the frame 1600. In some implementations, the first opening 1506 may instead have coupling features to couple the rotation ring 1500 to the base structure 1320 including, but not limited to, screw holes, twist-n-lock connectors, or registration features.

The rotation ring 1500 may also include one or more receptacles 1512 disposed along the exterior of the sidewall 1502. The one or more receptacles 1512 may couple to connectors that provide a press fit connection between the rotation ring 1500 and the frame 1600. Various types of connectors may be used including, but not limited to, a protruding tab, a ball plunger, or a spring clip. In one example, the rotation ring 1500 includes multiple ball plungers 1520 coupled to corresponding receptacles 1512 as shown in FIG. 10C. The through hole opening in the frame 1600 may be designed such that the rotation ring 1500 is inserted from either side of the through hole opening.

Figure 28A:
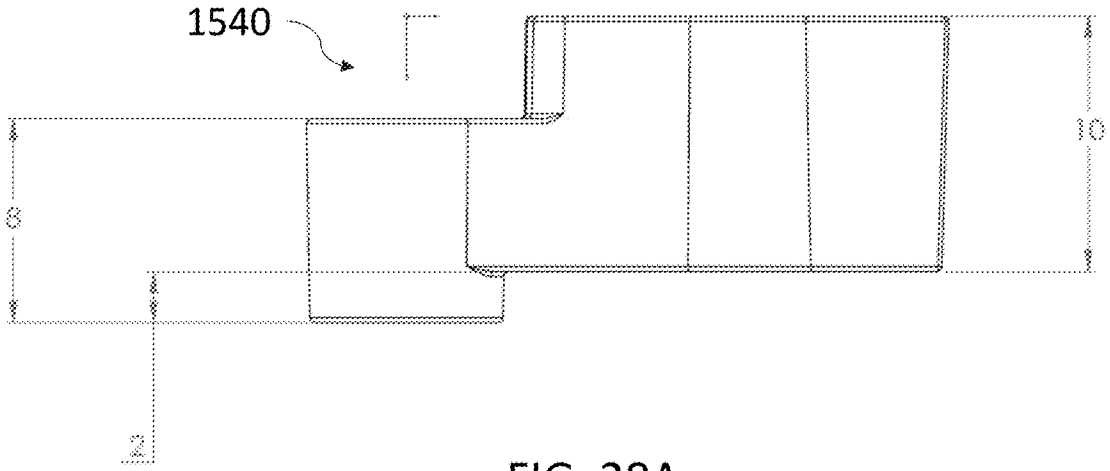
Figure 28C:
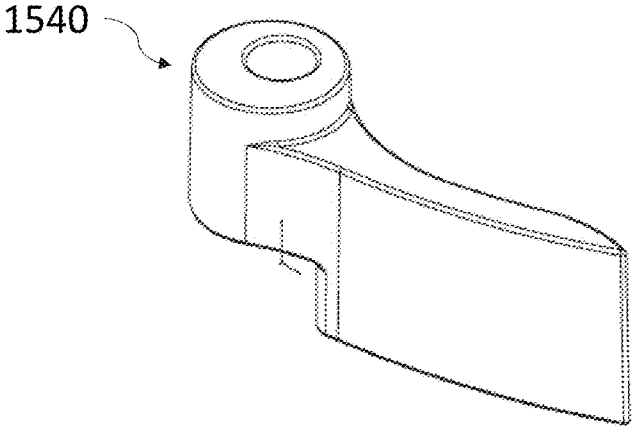
Figure 28B:
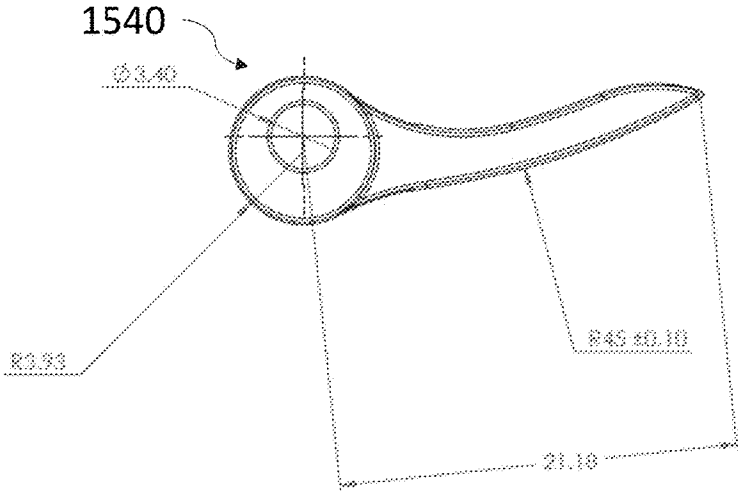

For example, the frame 1600 may first be mounted to a support structure in a ceiling or a wall such that the through hole opening of the frame 1600 is aligned to an opening in said ceiling or wall. Then, the adjustable mount 1300, with the lighting module 1100 and the rotation ring 1500 attached, may be inserted into the through hole opening in the frame 1600 from within the room. Once the rotation ring 1500 is secured to the frame 1600, the adjustable mount 1300 may be rotated about the second rotation axis 1070 to a desired orientation. Once the adjustable mount 1300 is set to a desired rotational orientation about the second rotation axis 1070, a rotational lock 1540 may be used to restrict rotational motion of the adjustable mount 1300 relative to the rotation ring 1500. FIGS. 28A-28C show several views of an exemplary rotation lock 1540 that may be rotated to lock or unlock the adjustable mount 1300 to the rotation ring 1500. This may then be followed by rotational adjustment of the lighting module 1100 about the first rotation axis 1010 as described above. A safety mechanism may be incorporated into the adjustable lighting apparatus 1000 that prevents the adjustable mount 1300 and the lighting module 1100 from falling through the through hole opening of the frame 1600. For example, a safety pin 1530 may be used to fasten the rotation ring 1500 to the frame 1600 to substantially reduce the possibility of the rotation ring 1500 from sliding relative to the frame 1600. As shown in FIG. 11A, the safety pin 1530 may be fastened to one of the receptacles 1510 on the rotation ring 1500. In another example, a safety cable may be used to couple the adjustable mount 1300 and the lighting module 1100 to the frame 1600. In the event the rotation ring 1500 is no longer secured to the frame 1600, the safety cable may prevent the adjustable mount 1300 and the lighting module 1100 from falling out of the frame 1600 and/or allows the adjustable mount 1300/lighting module 110 to hang from the frame 1600.

The rotation ring 1500 may be formed from various materials including, but not limited to, aluminum, carbon steel, stainless steel, copper, polymers, ceramics, or any alloys or composites of the foregoing. The rotation ring 1500 may also be painted/coated to improve various aspects of the rotation ring 1500 such as corrosion resistance, durability, thermal emissivity, or aesthetic quality.

A Second Exemplary Design for an Adjustable Lighting Apparatus

FIGS. 29A-46D show another exemplary adjustable lighting apparatus 1000, according to an implementation. The adjustable lighting apparatus 1000 includes a lighting module 1100 and an adjustable mount 1300. The lighting module 1100 rotates about a first rotation axis 1010 and translates along a first translation axis 1020 relative to the adjustable mount 1300. For this design, the secondary shield 1380 is coupled to the shield 1360 using one or more slots 1324. Once again, the secondary shield 1380 may be used to cover a portion of the rotation slot 1364 of the shield 1360. The one or more slots 1324 allow the secondary shield 1380 to slidably move relative to the shield 1360 via contact by the lighting module 1100 when the lighting module 1100 is rotated to the second rotational position. In order for the secondary shield 1380 to move back to cover the portion of the rotation slot 1364, one or more springs may be disposed between the shield 1360 and the secondary shield 1380 to provide a restoring force necessary to move the secondary shield 1380 back over the portion of the rotation slot 1364.

The adjustment mechanism in the adjustable lighting apparatus 1000 shown in FIGS. 30A-30B may also be based on an adjustable slider mechanism. In FIG. 30B, the base structure 1320 is hidden for clarity. Specifically, a slider plate 1204 may be coupled to the base structure 1320. The slider plate 1204 defines a track 1205 along which a push spring 1208 may be slidably moved relative to the slider plate 1204. The push spring 1208 may be coupled to the lighting module 1100 so as to move with the lighting module 1100 as the lighting module 1100 rotates about the first rotation axis 1010 and translates along the first translation axis 1020. The push spring 1208 includes a hole 1209 into which a quarter turn knob 1220 is inserted. The quarter turn knob 1220 may be used to secure the push spring 1208 to the slider plate 1204 using a fastening mechanism. In one exemplary case, a user may rotate the quarter turn knob 1220 so as to loosen the mechanical constraint imposed on the slider plate 1204 and the push spring 1208. Once released, the user may rotate the lighting module 1100 by pushing/pulling the quarter turn knob 1220, which imparts a force that causes the push spring 1208 with the lighting module 1100 attached thereto to move along the track 1205 of the slider plate 1204. Once the desired rotational position is reached, the user may tighten the quarter turn knob 1220 to mechanically constrain the slider plate 1204 and the push spring 1208.

The adjustable lighting apparatus 1000 may also include a shield 1360 that translates with the lighting module 1100 along the first translation axis 1020. The shield 1360 may be used to cover an opening in the base structure 1320, as previously described. The exemplary shield 1360 shown in FIGS. 29E-29F does not include a stabilizing slot. Rather, a stabilizing pin 1337 may be inserted into a hole 1336 on the tab 1368 of the shield 1360 such that a pin 1011 coaxial with the first rotation axis 1010 and the stabilizing pin 1337 are guided along the slot 1324 on the base structure 1320. By providing two points of mechanical constraint in the slot 1324, unwanted rotation of the shield 1360 relative to the lighting module 1100 is substantially reduced.

In some implementations, the trim 1700 may also couple to the adjustable mount 1300 using one or more trim attachment plates 1712. The trim attachment plates 1712 may be magnetically couple to corresponding magnets disposed in the adjustable mount 1300. The trim attachment plates 1712 may be coupled to the main body of the trim 1700 using various coupling mechanisms including, but not limited to, screw fasteners, bolt fasteners, or adhesive. In this manner, the trim 1700 may be coupled to the adjustable mount 1300 without using additional fasteners or other coupling mechanisms.

FIGS. 29A-29H show various side views and cross-sectional side views of the adjustable lighting apparatus 1000 in both the first rotational position and the second rotational position. FIGS. 29I-29L show various perspective views of the adjustable lighting apparatus 1000 in both the first rotational position and the second rotational position. FIGS. 30A-30B show a detailed view of the adjustment mechanism used in this particular implementation of the adjustable lighting apparatus 1000 where a sliding adjustment mechanism is used.

FIGS. 31A and 31B show an exploded view of the adjustable lighting apparatus 1000 and a corresponding table of the various component used in the adjustable lighting apparatus 1000.

FIGS. 32A-32G show various views of an exemplary heat sink 1140 in the lighting module 1100, according to an implementation. As before, the heat sink 1140 may be used to dissipate heat from the light source 1160 as well as support other components in the lighting module 1100, such as a driver 1120, or multiple heat sink arms 1180.

FIGS. 33A-33G show various views of an exemplary optic holder 1162, according to an implementation. The optic holder 1162 may be a part of the light source 1160 and is used to support both one or more light emitting elements and an optic. As before, the lighting module 1100 may accommodate various light sources 1160 with different optics.

FIGS. 34A-34D show various views of an exemplary heat sink arm 1180, according to an implementation. The heat sink arm 1180 again includes a motion track 1182 and a pivot arm 1184 to facilitate rotation of the lighting module 1100 about the first rotation axis 1010. The heat sink arm 1180 may also include a mechanical stop 1186 to restrict the rotational motion of the lighting module 1100 by contacting a corresponding mechanical stop 1344 on the retainer 1340.

FIGS. 35A-35E show various views of the slider plate 1204, according to an implementation. As shown, the slider plate 1204 may define a track 1205 that guides the push spring 1208 when the lighting module 1100 is adjusted. In some implementations, the slider plate 1204 may be curved in order to conform to the cavity 1322 of the base structure 1320 and the curvature of the shield 1360. In some implementations, the slider plate 1204 may be coupled to the sidewall 1326 of the base structure 1320 using one or more coupling mechanisms, including, but not limited to screw fasteners, bolt fasteners, clips, clamps, or adhesives.

FIGS. 36A-36C show various views of an exemplary push spring 1208, according to an implementation. As described above, the push spring 1208 may be coupled to the lighting module 1100 and slidably movable along the track 1205 of the slider plate 1204. The push spring 1208 may be curved to conform to the curvature of the shield 1360. In some implementations, the curvature of the push spring 1208 may also provide a force to assist with adjustment of the lighting module 1100. For example, when a pushing/pulling motion on the push spring 1208 occurs along one axis, a reactionary force may develop in the push spring 1208 along another axis, which may be oriented to increase the torque applied to the lighting module 1100 to rotate about the first rotation axis 1010. The push spring 1208 may include a hole 1209 for attachment to the quarter turn knob 1220.

FIGS. 37A-37D show various views of an exemplary quarter turn knob 1220, according to an implementation. As shown, the quarter turn knob 1220 may include features that assist a user to grip the quarter turn knob 1220 when tightening or loosening the adjustment mechanism.

FIGS. 38A-38G show various views of an exemplary base structure 1320, according to an implementation. As described above, the base structure 1320 may include a cavity 1322, a first opening 1328 that contacts, at least in part, the lighting module 1100, and a second opening that light from the light source 1160 can pass through. To accommodate the rotational motion of the lighting module 1100, first opening 1328 of the base structure 1320 may extend from the top of the base structure 1320 to the sidewall 1326. The base structure 1320 may also include multiple coupling features for coupling to the slider plate 1204. The base structure 1320 may also have one or more slots 1324 that define the first translation axis 1020.

FIGS. 39A-39H show various views of an exemplary retainer 1340, according to an implementation. The retainer 1340 may again be used to mechanically constrain the rotational motion of the lighting module 1100 such that translational motion along the first translation axis 1020 also occurs. The retainer 1340 may also be used to couple the adjustable mount 1300 to a rotation ring 1500, used to rotatably adjust the adjustable mount 1300 (with the lighting module 1100) about a second rotation axis 1070, which is orthogonal to the first rotation axis 1010. In some implementations where the rotation ring 1500 is substantially circular in cross-section, the second rotation axis 1070 may correspond to the center axis of the circle.

FIGS. 40A-40E show various views of an exemplary shield 1360, according to an implementation. The shield 1360 may be used to cover the first opening 1328 of the base structure 1320 as before. Again, the shield 1360 may also include a rotation slot 1364 that surrounds the base of the light source 1160. The shield 1360 may again translate along the first translation axis 1020 with the lighting module 1100 as the lighting module 1100 rotates about the first rotation axis 1010.

FIGS. 41A-41D show various views of a secondary shield 1380, according to an implementation. Here, the secondary shield 1380 includes rigid inserts 1382 designed to be inserted into slots 1374 on the shield 1360 in order to allow the secondary shield 1380 to be movable relative to the shield 1360, as described above.

FIGS. 42A-42E show several views of an exemplary trim 1700, according to an implementation. The trim 1700 may include a first opening 1702 that is shaped to accommodate the rotational motion of the lighting module 1100 such that shading losses may be reduce once the trim 1700 is inserted, at least in part, into the cavity 1322 of the base structure 1320.

FIGS. 43A-43C show several views of an exemplary trim attachment plate 1712, according to an implementation. The trim attachment plate 1712 may be formed from a magnetic material to couple to corresponding magnets disposed in the base structure 1320.

FIGS. 44A-44E show several views of an exemplary rotation ring, according to an implementation. The rotation ring 1500 may be used, in part, to provide a second rotational degree of freedom where the adjustable mount 1300 (with the lighting module 1100 coupled thereto) rotates about the second rotation axis 1070 relative to the rotation ring 1500. The rotation ring 1500 may also be used to facilitate attachment of the adjustable mount 1300 to a frame 1600 mounted in the ceiling or wall of a building.

FIGS. 45A-45C show several views of an exemplary rotation lock 1540, according to an implementation. The rotation lock 1540 may be disposed in the cavity 1322 of the base structure 1320 or the through hole opening 1504 of the rotation ring 1500. The rotation lock 1540 may be used to lock the rotational motion of the adjustable mount 1300 relative to the rotation ring 1500 by applying a clamping force that restricts rotational motion. The rotation lock 1540 may be released by rotating said rotation lock 1540, which releases said clamping force. As before, the rotation ring 1500 may have a through hole opening 1504.

FIGS. 46A-46D show several views of a portion of an exemplary frame 1600, according to an implementation. The frame 1600 may have a through hole opening 1604 into which the rotation ring 1500 (coupled to the adjustable mount 1300) may be inserted, forming a press fit connection.

A Third Exemplary Design for an Adjustable Lighting Apparatus

FIGS. 47A and 47B show an exploded view of another adjustable lighting apparatus 1000 and a table of the various components in the adjustable lighting apparatus 1000, according to an implementation. The adjustable lighting apparatus 1000 once again includes a lighting module 1100 that rotates about a first rotation axis 1010 relative to an adjustable mount 1300. The lighting module 1100 translates along a first translation axis 1020 while rotating about the first rotation axis 1010 in order to reduce shading losses at larger orientation angles.

In some implementations, the adjustment mechanism used to rotatably adjust the lighting module 1100 may be based on an adjustable slider mechanism, as described above. In some implementations however, a quick release lever 1220 and a quick release pin 1222 may be used to secure and adjust the lighting module 1100 at a particular rotational position. Compared to the quarter turn knob 1220 described previously, the combination of the quick release lever 1220 and the quick release pin 1222 doesn't rely on a fastening mechanism to secure the slider plate 1204 and the push spring 1208. Rather, the shape of the quick release lever 1220 is such that a compressive force is applied onto the push spring 1208 and the slider plate 1204 when the quick release lever 1220 is rotate to a locking position. When the quick release lever 1220 is rotated to an unlocked position, the compressive force is reduced such that a user may push/pull the quick release lever 1220 to adjust the rotational position of the lighting module 1100. In one example, the quick release pin 1222 is inserted through the hole 1209 on the push spring 1208 and the track 1205 on the slider plate 1204 and coupled to the quick release lever 1220 on the opposing side.

The adjustable lighting apparatus 1000 may also include a trim 1700 to cover a hole in a ceiling or a wall. In some implementations, the trim 1700 may or may not include a flange. In some implementations, the opening in the trim 1700 may have various shapes including, but not limited to a beveled opening or a pinhole opening. The trim 1700 may be designed such that the coupling mechanism to the adjustable mount 1300 is substantially similar such that different types of trims 1700 may be installed and/or replaced by a user. It should be appreciated that different shaped trims 1700 (i.e., circular, ellipsoidal, square, rectangular, polygonal, etc.) may be used. It should also be appreciated that the dimensions of the trim 1700 may also be used depending on the size of the adjustable mount 1300 and/or the hole in the ceiling or wall.

In some implementations, a stabilizing pin 1337 may be used to mechanically constrain the motion of the shield 1360 such that the shield 1360 primarily translates along the first translation axis 1020 while the lighting module 1100 rotates about the first rotation axis 1010. In some implementations, the stabilizing pin 1337 may be a threaded pin that rigidly couples to the shield 1360. For example, the threaded portion of the stabilizing pin 1337 may be inserted through a hole 1336 on the shield 1360 and secured by a nut.

FIGS. 48A-48G show several views of an exemplary heat sink 1140, according to an implementation. The heat sink 1140 is again used to dissipate heat from a light source 1160 and for mounting various components in the lighting module 1100 including a driver 1120 and multiple heat sink arms 1180.

FIGS. 49A-49G show several views of an exemplary optic holder 1162, according to an implementation. The optic holder 1162 is used to support a light emitting element and at least one optic in the light source 1160. In some implementations, the optic holder 1162 may holder various optics designed, for example, to focus light with various angular distributions and spatial intensity distributions. In some implementations, different optic holders 1162 may be used to accommodate different optics.

FIGS. 50A-50D show several views of an exemplary heat sink arm 1180, according to an implementation. The heat sink arm 1180 includes a motion track 1182 and a pivot arm 1184.

FIGS. 51A-51E show several views of an exemplary slider plate 1204, according to an implementation. The slider plate 1204 includes a track 1205 along which the push spring 1208 may slide relative to the slider plate 1204. In some implementations, the slider plate 1204 may be shaped so as to conform to a sidewall 1326 of the base structure 1320 and the curvature of the shield 1360.

FIGS. 52A-52C show several views of an exemplary push spring 1208, according to an implementation. The push spring 1208 is coupled to the lighting module 1100. In some implementations, the push spring 1208 may be shaped and dimensioned so as to be flexible such that when the push spring 1208 slides along the track 1205 of the slider plate 1204, the push spring 1208 may deform. The deformation may generate a force used to assist a user in rotatably adjusting the lighting module 1100.

FIGS. 53A-53D show several views of an exemplary quick release lever 1220, according to an implementation. The quick release lever 1220 may rotate about a hole, which couples to the quick release pin 1222 via a corresponding pin. The hole on the quick release lever 1220 may be located such that an edge of the quick release lever 1220 and the hole vary as the quick release lever 1220 rotates. This variation may cause a force that secures the push spring 1208 to the slider plate at certain rotational positions of the quick release lever 1220. In this manner, a user can flip the quick release lever 1220 to quickly lock/unlock the adjustment mechanism.

FIGS. 54A-54C show several views of an exemplary quick release pin 1222, according to an implementation. The quick release pin 1222 may be inserted through the hole 1209 on the push spring 1208 and the track 1205 on the slider plate 1204.

FIGS. 55A-55G show several views of an exemplary base structure 1320, according to an implementation. The base structure 1320 includes a sidewall 1326 that defines a cavity 1322, a first opening 1328 that contacts, at least in part, the lighting module 1100, and a second opening 1330 that light from the light source 1160 propagates through. The base structure 1320 may also include one or more slots 1324 that define the orientation of the first translation axis 1020.

FIGS. 56A-56H show several views of an exemplary retainer 1340, according to an implementation. The retainer 1340 may be used to provide additional mechanical constraint with a motion rail 1342 that couples to the motion track 1182 of the heat sink arm 1180. As before, the motion rail 1342 and the motion track 1182 may be shaped to cause the lighting module 1100 to translate along the first translation axis 1020 while the lighting module 1100 rotates about the first rotation axis 1010.

FIGS. 57A-57E show several views of an exemplary shield 1360, according to an implementation. The shield 1360 is shaped to cover the first opening 1328 of the base structure at certain rotational positions of the lighting module 1100. The shield 1360 also includes a rotational slot 1364 through which the light source 1160 is coupled to the heat sink 1140. The shield 1360 may also include coupling features 1374 for the secondary shield 1380 to slide along. In some implementations, the shield 1360 may also include a hole 1369 for a stabilizing pin 1337 used to mechanically limit the shield 1360 to translational motion.

FIGS. 58A-58C show several views of a stabilizing pin 1337, according to an implementation. The stabilizing pin 1337, as described above, is inserted into the hole 1369 on the shield 1360 and the slot 1324 on the base structure 1320. The stabilizing pin 1337 includes a threaded portion that receives a corresponding nut to rigidly couple said stabilizing pin 1337 to the shield 1360.

FIGS. 59A-59D show several views of a secondary shield 1380, according to an implementation. As described above, the secondary shield 1380 may cover a portion of the rotation slot 1364 so as to visually block the rotation slot 1364, thereby preventing users from seeing through the rotation slot 1364 and into the ceiling or wall.

FIGS. 60A-60D show several views of an exemplary trim 1700, according to an implementation. The trim 1700 represents an exemplary beveled, flangeless trim.

FIGS. 61A-61E show several views of an exemplary trim 1700, according to an implementation. The trim 1700 represents an exemplary pinhole trim.

FIGS. 62A-62G show several views of an exemplary trim 1700, according to an implementation. The trim 1700 represents an exemplary beveled trim with a flange.

FIGS. 63A-63E show several views of an exemplary trim 1700, according to an implementation. The trim 1700 represents another exemplary pinhole trim.

FIGS. 64A-64E show several views of an exemplary rotation ring 1500, according to an implementation. The rotation ring 1500 may include a rail/track feature on the edge 1510 of the first opening 1506 that allows the adjustable mount 1300 to rotate about a second rotation axis 1070 relative to the rotation ring 1500.

FIGS. 65A-65C show several views of an exemplary rotation lock 1540, according to an implementation. The rotation lock 1540 may be coupled to either the rotation ring 1500, the base structure 1320, or both the rotation ring 1500 and the base structure 1320. As described above, the rotation lock 1540 is used to lock the adjustable mount 1300 to the rotation ring 1500 once a desired rotational position about the second rotation axis 1070 is set.

Another Exemplary Design of a Lighting Module

FIGS. 66A-66E show an exemplary lighting module 1100, according to an implementation. The lighting module 1100 may include a light source 1160 to emit light, a heat sink 1140 to dissipate heat from the light source 1160, and a driver 1120 to supply power to the light source 1160. Here, the light source 1160 may be disposed primarily within the first cavity 1504 of the heat sink 1140. The driver 1120 may be attached to the heat sink 1140 on a side of the heat sink 1140 opposite to the light source 1160. The heat sink 1140 may also include a coupling feature disposed on an opening of heat sink 1140. In some implementations, the coupling feature may be a twist-n-lock connector. Additionally, the heat sink 1140 may include holes that allow the heat sink to be coupled to other components such as a trim 1700 or a shield 1360.

FIGS. 67A-67B show several views of an exemplary heat sink 1140, according to an implementation.

FIGS. 68A-68C show several views of an exemplary adjustable lighting apparatus 1000 that incorporates the lighting module 1100 shown in FIGS. 66A-66E. In some implementations, the trim 1700 may be coupled to the lighting module 1100 and designed to rotate with the lighting module 1100 about the first rotation axis 1010. In some implementations, the lighting module 1100 may not translate along a first translation axis 1020 as shading losses are already reduced if the trim 1700 rotates with the lighting module 1100. However, in some implementations, the frame 1600 may be shaped to accommodate translational motion along a first translation axis 1020 in order to reduce or, in some instances, avoid collision of the adjustable mount 1300 and the trim 1700 with the frame 1600. In particular, FIG. 68B and FIG. 68C show the adjustable lighting apparatus 1000 without the base structure 1320 or the retainer 1340 to show how the lighting module 1100 and the trim 1700 rotate about the first rotation axis 1010.

CONCLUSION

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

While various inventive implementations have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive implementations described herein. More generally, those skilled in the art will readily appreciate that all parameters and configurations described herein are meant to be exemplary inventive features and that other equivalents to the specific inventive implementations described herein may be realized. It is, therefore, to be understood that the foregoing implementations are presented by way of example and that, within the scope of the appended claims and equivalents thereto, inventive implementations may be practiced otherwise than as specifically described and claimed. Inventive implementations of the present disclosure are directed to each individual feature, system, article, and/or method described herein. In addition, any combination of two or more such features, systems, articles, and/or methods, if such features, systems, articles, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, implementations may be constructed in which acts are performed in an order different than illustrated, which may include performing some acts simultaneously, even though shown as sequential acts in illustrative implementations.

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one implementation, to A only (optionally including elements other than B); in another implementation, to B only (optionally including elements other than A); in yet another implementation, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An adjustable lighting apparatus, comprising:

an adjustable mount, comprising:

a base structure having a sidewall defining a cavity with a first opening and a second opening; and a motion rail, coupled to the base structure, having a convex portion defining a curved profile; and a lighting module rotatably coupled to the base structure, the lighting module comprising:

a heat sink;

a light source, coupled to the heat sink and at least partially disposed within the cavity of the base structure through the first opening, to emit light through the second opening; and a motion track, rigidly coupled to the heat sink and slidably coupled to the motion rail, having a concave portion that directly contacts the convex portion of the motion rail such that the lighting module moves along the curved profile of the motion rail relative to the adjustable mount when the lighting module is rotated with respect to the adjustable mount.

2. The adjustable lighting apparatus of claim 1, wherein:

the adjustable mount further comprises:

a shield, coupled to the base structure, to cover at least a portion of the first opening of the base structure, the shield being only translationally movable with respect to the base structure; and the lighting module translates together with the shield when the lighting module rotates with respect to the adjustable mount.

3. The adjustable lighting apparatus of claim 2, wherein:

the shield includes a third opening;

the lighting module includes a light source that passes through a first portion of the third opening; and the adjustable mount further comprises:

a secondary shield, directly coupled to the shield, to cover a second portion of the third opening different from the first portion.

4. The adjustable lighting apparatus of claim 3, wherein:

the light source passes through the first portion of the third opening when the lighting module is at a first rotational position; and the light source physically contacts and displaces at least a portion of the secondary shield by bending a compliant portion of the secondary shield when the lighting module is rotated from the first rotational position to a second rotational position such that the light source passes through the second portion of the third opening when the lighting module is at the second rotational position.

5. The adjustable lighting apparatus of claim 1, further comprising:

a push bracket, disposed within the cavity of the base structure and coupled to the lighting module, to adjust a rotational position of the lighting module in a tool-less manner.

6. The adjustable lighting apparatus of claim 1, wherein the motion rail and the motion track each have mechanical stops that limit the rotation of the lighting module with respect to the base structure.

7. The adjustable lighting apparatus of claim 1, wherein the curved profile causes the lighting module to translate with respect to the adjustable mount.

8. The adjustable lighting apparatus of claim 1, wherein:

the curved profile includes a center of curvature; and the motion track is coupled to a pivot arm that is rotatably coupled to the base structure via a pin joint, the pin joint being offset from the center of curvature.

9. The adjustable lighting apparatus of claim 1, wherein:

the sidewall of the base structure includes a first edge defining a top portion of the first opening and a second edge defining a side portion of the first opening;

the lighting module at least partially passes through the top portion of the first opening when the lighting module is at a first rotational position; and the lighting module at least partially passes through the side portion of the first opening when the lighting module is at a second rotational position.

10. The adjustable lighting apparatus of claim 1, further comprising:

a frame defining an opening; and a rotation ring rotatably coupled to the base structure of the adjustable mount and securely coupled to the frame such that the adjustable mount and the lighting module are rotatable together with respect to the rotation ring and the frame.

11. The adjustable lighting apparatus of claim 1, wherein the lighting module further comprises:

a first electrical connector, coupled to the heat sink and electrically coupled to the light source; and a driver assembly, comprising:

a housing, coupled to the heat sink via a twist and lock connection mechanism, defining a second cavity;

a second electrical connector coupled to the housing and electrically coupled to the first electrical connector;

a third electrical connector, coupled to the housing, to receive electrical power; and a driver, disposed in the second cavity and electrically coupled to the second and third electrical connectors, to receive the electrical power from the third electrical connector and to supply the electrical power to the light source via the second electrical connector.

12. The adjustable lighting apparatus of claim 11, wherein the second electrical connector slidably engages the first electrical connector when the driver assembly is coupled to the heat sink via the twist and lock mechanism so as to electrically couple the driver to the light source in a tool-less manner.

13. The adjustable lighting apparatus of claim 11, wherein the heat sink includes a central support that physically contacts the housing of the driver assembly.

14. The adjustable lighting apparatus of claim 1, further comprising:

a push spring, securely coupled to the lighting module and slidably coupled to the base structure, to change a rotational position of the lighting module when the push spring is pulled or pushed, the push spring being a curved beam.

15. The adjustable lighting apparatus of claim 1, wherein the lighting module further comprises:

a driver assembly disposed outside the cavity of base structure and above the heat sink, the driver assembly comprising:

a housing defining a second cavity; and a driver, disposed within the second cavity, to supply the electrical power to the light source.

16. An adjustable lighting apparatus, comprising:

an adjustable mount, comprising:

a base structure having a sidewall defining a cavity with a first opening and a second opening;

a lighting module rotatably coupled to the base structure, the lighting module comprising:

a heat sink;

a light source, coupled to the heat sink and at least partially disposed within the cavity of the base structure through the first opening, to emit light through the second opening; and a push spring, securely coupled to the lighting module and slidably coupled to the base structure, to change a rotational position of the lighting module, the push spring being a deformable curved beam such that, when the push spring is one of pulled or pushed along a first axis, a force is applied to the lighting module along a second axis different from the first axis that changes the rotational position of the lighting module.

17. The adjustable lighting apparatus of claim 16, wherein:

the adjustable mount further comprises:

a motion rail, coupled to the base structure, having a curved profile; and the lighting module further comprises:

a motion track rigidly coupled to the heat sink and slidably coupled to the motion rail such that the lighting module moves along the curved profile of the motion rail relative to the adjustable mount when the lighting module is rotated with respect to the adjustable mount.

18. The adjustable lighting apparatus of claim 16, wherein physical contact between a concave portion of the lighting module and a convex portion of the adjustable mount constrains the lighting module to move along only a curved path.

19. An adjustable lighting apparatus, comprising:

an adjustable mount, comprising:

a base structure having a sidewall defining a cavity with a first opening and a second opening; and a lighting module rotatably coupled to the base structure, the lighting module comprising:

a heat sink;

a light source, coupled to the heat sink and at least partially disposed within the cavity of the base structure through the first opening, to emit light through the second opening, wherein:

a concave portion of the lighting module maintains physical contact with a convex portion of the adjustable mount when a rotational position of the lighting module is changed; and the physical contact between the concave portion and the convex portion mechanically constrains the lighting module to move along only a curved path.

20. The adjustable lighting apparatus of claim 19, wherein:

the lighting module further comprises a motion track having the concave portion; and the adjustable mount further comprises a motion rail having the convex portion.

21. The adjustable lighting apparatus of claim 19, further comprising:

one of a push spring or a push bracket, securely coupled to the lighting module, to change the rotational position of the lighting module in response to an applied force.

* * * * *